US011910891B2

(12) United States Patent
Mullet et al.

(10) Patent No.: US 11,910,891 B2
(45) Date of Patent: Feb. 27, 2024

(54) UMBRELLA SYSTEM

(71) Applicant: Current Products Corp., Pensacola, FL (US)

(72) Inventors: Willis Jay Mullet, Gulf Breeze, FL (US); Richard Scott Hand, Pace, FL (US); John Foreman, Pace, FL (US); Jonathan Derrick Dry, Pensacola, FL (US); Jon Smidt, Valparaiso, FL (US); Curtis Scott, Milton, FL (US); Sean Scalf, Cantonment, FL (US)

(73) Assignee: Current Products Corp., Pensacola, FL (US)

( * ) Notice: Subject to any disclaimer, the term of this patent is extended or adjusted under 35 U.S.C. 154(b) by 180 days.

(21) Appl. No.: 17/366,177

(22) Filed: Jul. 2, 2021

(65) Prior Publication Data

US 2021/0361042 A1 Nov. 25, 2021

Related U.S. Application Data

(63) Continuation-in-part of application No. 16/516,939, filed on Jul. 19, 2019, now Pat. No. 11,076,663,
(Continued)

(51) Int. Cl.
*A45B 25/16* (2006.01)
*A45B 25/14* (2006.01)
(Continued)

(52) U.S. Cl.
CPC ..... *A45B 25/165* (2013.01); *A45B 3/00* (2013.01); *A45B 25/006* (2013.01); *A45B 25/14* (2013.01);
(Continued)

(58) Field of Classification Search
None
See application file for complete search history.

(56) References Cited

U.S. PATENT DOCUMENTS 1,070,894 A 8/1913 Hopkins
1,838,004 A 11/1931 Spiro
(Continued)

FOREIGN PATENT DOCUMENTS

CN 109288219 A * 2/2019 ..... A45B 25/143
EP 2737819 A1 * 6/2014 ..... A45B 24/143

OTHER PUBLICATIONS 9 page PDF of machine translation of EP 2737819-A1 to Czak. (Year: 2014).*

(Continued)

*Primary Examiner* — Robert Canfield
(74) *Attorney, Agent, or Firm* — BrownWinick Law Firm; Christopher A. Proskey

(57) ABSTRACT

An umbrella system includes a support pole connected to a rotating tube positioned around a center tube that extends between the support pole and a center support that is connected to an umbrella frame. The rotating tube has one or more helical grooves therein that are engaged by teeth of a hub which is connected to the umbrella frame. As the rotating tube is rotated, the hub is driven along the length of the rotating tube thereby opening and closing the umbrella frame. In one arrangement system includes a motor housing assembly including a plurality of batteries and a motor that includes a driven gear that meshes with a stationary gear which causes rotation of the rotating tube.

23 Claims, 117 Drawing Sheets

Related U.S. Application Data which is a continuation-in-part of application No. 16/028,908, filed on Jul. 6, 2018, now Pat. No. 10,357,087, which is a continuation of application No. 15/286,701, filed on Oct. 6, 2016, now Pat. No. 10,039,353.

(60) Provisional application No. 63/052,778, filed on Jul. 16, 2020, provisional application No. 62/239,595, filed on Oct. 9, 2015.

(51) Int. Cl.
*A45B 3/00* (2006.01)
*A45B 25/00* (2006.01)
*A45B 23/00* (2006.01)

(52) U.S. Cl.
CPC .... *A45B 25/143* (2013.01); *A45B 2023/0012* (2013.01); *A45B 2200/1018* (2013.01); *A45B 2200/1027* (2013.01); *A45B 2200/1063* (2013.01)

(56) References Cited

U.S. PATENT DOCUMENTS 2,224,882 A 12/1940 Peck
2,800,323 A 7/1957 West
3,129,715 A 4/1964 Militano et al.
3,311,119 A 3/1967 Morton
3,495,353 A 2/1970 Forsberg
3,532,951 A 10/1970 Hovance
3,870,062 A 3/1975 Medlin
4,353,659 A 10/1982 Comte
4,424,824 A 1/1984 Becher
4,614,057 A 9/1986 Sorber
4,807,655 A 2/1989 Robertson
5,141,010 A 8/1992 Muller
5,213,122 A 5/1993 Clyde
5,386,842 A 2/1995 Becher
5,441,068 A 8/1995 Rasch et al.
5,758,677 A 6/1998 Wang
6,129,101 A 10/2000 Dubinsky
6,374,840 B1 4/2002 Ma
6,388,412 B1 5/2002 Reed
6,415,805 B1 7/2002 Kuo
6,446,650 B1 9/2002 Ma
6,543,464 B1 4/2003 Grady
7,549,430 B1 6/2009 Gravlee
7,562,666 B2 7/2009 Chan
7,607,447 B1 10/2009 Han
7,665,477 B1 2/2010 Hathaway
7,780,139 B2 8/2010 Markert
7,909,049 B2 3/2011 Chaun-Chin
7,926,496 B2 4/2011 Young
8,061,374 B2 11/2011 Li
8,087,420 B1 1/2012 Lukacsy
8,413,671 B2 4/2013 Li
8,459,281 B2 6/2013 Chen
8,534,304 B1 9/2013 Tung
8,757,184 B1 * 6/2014 Chen ..... A45B 19/04 135/25.1
8,857,453 B2 10/2014 Souma
9,181,724 B2 11/2015 Kim
9,259,064 B1 2/2016 Chen et al.
9,839,267 B1 12/2017 Gharahegian
9,949,540 B2 4/2018 Gharabegian
9,951,541 B1 4/2018 Sevada
10,039,353 B2 * 8/2018 Mullet ..... A45B 3/00
10,455,395 B2 10/2019 Gharabegian
10,492,581 B2 12/2019 Lv
10,653,218 B1 5/2020 Volin
11,076,663 B2 * 8/2021 Mullet ..... A45B 25/006
11,098,861 B1 * 8/2021 Wang ..... A45B 23/00
11,129,454 B1 * 9/2021 Campbell ..... A45B 3/04
2003/0000559 A1 * 1/2003 Wu ..... F21V 33/006 362/102
2004/0040591 A1 3/2004 Ma
2004/0055627 A1 3/2004 P. Moga
2004/0165392 A1 * 8/2004 Tung ..... A45B 3/04 362/352
2004/0184261 A1 * 9/2004 Lin ..... A45B 3/04 362/102
2005/0005530 A1 * 1/2005 Li ..... A45B 3/04 52/74
2005/0072451 A1 4/2005 Vivian
2006/0151019 A1 7/2006 Lo
2006/0272686 A1 * 12/2006 Tung ..... A45B 3/04 135/16
2007/0056617 A1 * 3/2007 Li ..... F21V 33/006 135/91
2007/0089768 A1 4/2007 Glasser
2007/0211450 A1 * 9/2007 You ..... A45B 3/04 362/245
2008/0105287 A1 * 5/2008 Huali ..... A45B 3/04 135/16
2009/0223545 A1 9/2009 Beyer
2010/0012164 A1 1/2010 Stoelinga
2010/0192999 A1 * 8/2010 Li ..... A45B 25/00 135/96
2013/0306118 A1 * 11/2013 Souma ..... A45B 25/143 135/16
2014/0028242 A1 * 1/2014 Akin ..... H02J 7/35 320/101
2014/0096802 A1 * 4/2014 Volin ..... A45B 25/143 135/16
2014/0366922 A1 * 12/2014 King ..... A45B 25/165 135/96
2015/0216274 A1 * 8/2015 Akin ..... H02J 7/0013 29/434
2015/0362171 A1 * 12/2015 Li ..... F21V 33/006 362/102
2016/0029752 A1 2/2016 Chen
2017/0055653 A1 * 3/2017 Pan ..... A45B 25/00
2017/0099918 A1 4/2017 Ko
2017/0318922 A1 11/2017 Gharabegian
2017/0323356 A1 11/2017 Gharabegian
2019/0032359 A1 * 1/2019 Jiang ..... A45B 25/14
2019/0242151 A1 8/2019 Gharabegian
2019/0269209 A1 * 9/2019 Akin ..... H01L 31/042
2019/0292805 A1 9/2019 Gharabegian
2019/0316377 A1 * 10/2019 Chuan ..... F21V 23/0485
2019/0335865 A1 11/2019 Mullet
2020/0060398 A1 2/2020 Shuai
2020/0066266 A1 2/2020 Gharabegian
2021/0361042 A1 11/2021 Mullet
2022/0015513 A1 * 1/2022 Mullet ..... A45B 23/00
2022/0386749 A1 * 12/2022 Luo ..... H02S 20/30
2023/0172327 A1 * 6/2023 Wood ..... A45B 25/143 135/22
2023/0189947 A1 * 6/2023 Luo ..... H04R 1/02 381/386

OTHER PUBLICATIONS 5 page PDF of machine translation of CN 109288219-A to Jiang. (Year: 2019).*

* cited by examiner

UMBRELLA SYSTEM

CROSS REFERENCE TO RELATED APPLICATIONS

This application is a Continuation-In-Part ("CIP") of U.S. application Ser. No. 16/516,939 filed Jul. 19, 2019 and titled UMBRELLA SYSTEM, which was a CIP of U.S. application Ser. No. 16/028,908 filed on Jul. 6, 2018 and titled UMBRELLA SYSTEM, which is a continuation of U.S. Utility application Ser. No. 15/286,701 filed on Oct. 6, 2016, which claims the benefit of U.S. Provisional Application No. 62/239,595 filed Oct. 9, 2015, the entirety of each are hereby fully incorporated by reference herein.

This application also claims priority to U.S. Provisional Patent Application No. 63/052,778 filed Jul. 16, 2020, and titled "UMBRELLA SYSTEM", which is hereby fully incorporated by reference herein.

FIELD OF THE DISCLOSURE

This invention relates to umbrellas. More specifically, and without limitation, this invention relates to a new manual and motorized umbrella system.

OVERVIEW

Umbrellas are known in the art. While other forms of umbrellas exist, there are essentially two broad categories of umbrellas, handheld umbrellas and patio umbrellas. Handheld umbrellas are generally light and of small stature such that they can be held by a user in the rain or sunshine. Handheld umbrellas serve to deflect the rain or sun away from the user. Patio umbrellas are on the other hand generally larger in stature and remain in a generally fixed position such as on a patio, or other outdoor seating space, and serve to deflect rain and sun away from the area under the patio umbrella. Patio umbrellas also provide an improved aesthetic appearance to the outdoor seating area and help to define a seating space.

For the purposes of this disclosure, use of the term umbrella herein will generally refer to patio-type umbrellas, however, the disclosure herein is not so limited and the teachings herein are applicable to any umbrella design or type.

Conventional patio umbrellas have an elongated support pole that connects at a lower end to a base and includes an umbrella section at an upper end. The umbrella section includes material connected to an umbrella frame that converts between a retracted position, where the umbrella frame and material are collapsed and in a lowered position against or near the support pole, and a deployed position wherein the umbrella frame and material extend away from the support pole.

There are a plurality of ways in which conventional patio umbrellas convert between a retracted position to a deployed position. One of the simplest mechanisms is a manual-type system that includes connecting the lower portion of the umbrella frame to a lower hub that slides over the support pole. In this example arrangement, the support pole includes one or more openings therein that receive a locking pin therein. To deploy the umbrella, a user simply grasps the lower hub and slides it upward until the lower hub passes an opening and the user inserts a locking pin therein, which prevents the lower hub from sliding down the support pole thereby holding the umbrella in a deployed position. While this simple system is effective in some applications, it has its drawbacks.

One drawback is that manually deploying the umbrella is time consuming and inconvenient for a user. Another drawback is that deploying the umbrella using this system requires a great amount of force which may be more than many users can apply especially the young, the old, and persons of smaller stature. In addition, many persons of shorter stature are unable to reach the lower hub or move it all the way up to the desired deployed position. Another drawback is that when the umbrella is placed in the center of a table, it can be tremendously difficult to deploy the umbrella because the width of the table. Another drawback is that the larger the umbrella is the more difficult it is to deploy the umbrella because of increased weight and/or resistance. Another drawback of this arrangement is that it can be quite a difficult balancing act to force the umbrella upward while inserting the locking pin into the locking opening, which is a process that requires a tremendous amount of dexterity. Another drawback of this arrangement is that it can be quite difficult to remove the locking pin after use to lower the umbrella. Another drawback of this arrangement is that the pin can be lost. Another drawback is that the user must force the lower hub upward against the resistance of the umbrella material, which can be exceedingly difficult. Another drawback of this system is that it can be difficult to get the umbrella material taught due to the spacing of the locking holes in combination with the inability of the user to overcome the resistance in the fabric. These are only some of the many disadvantages of this system.

Another system for raising and lowering the umbrella is a crank-type system. These crank type systems include a rotating handle connected to a gear system near the mid-section of support pole, often positioned just above, or just below, a tabletop. This handle and gear system is connected to a mechanism, such as a cable, which moves the umbrella frame between a deployed position and a retracted position when rotated. The crank-type system improves many of the deficiencies of the manual-type system such as eliminating the need to reach all the way up the support pole to deploy or retract the umbrella. Another improvement is that by using the gear system, some of the forces required to raise or lower the umbrella can be reduced or overcome. The mechanical advantage provided by the crank-type system allows a user to more-easily tighten the umbrella material. In addition, because there are no set discrete positions like there are with the manual locking pin system described above, the user can move the crank to essentially any position and thereby select the appropriate amount of tension in the umbrella material.

Despite these advantages, the crank-type system still suffers from many of the same disadvantages as the manual-type system. One drawback of the crank-type system is that operating the crank can be quite inconvenient and difficult for a user. In addition, when the umbrella is used in association with a table, the crank can be difficult to reach. Another disadvantage to this system is that the crank mechanism itself can be in the way of users especially when the crank is positioned above a table. Another problem with this arrangement is that it still suffers from the disadvantage that the larger the umbrella the greater the amount of force that is required to raise and lower the umbrella. Another disadvantage is that the large gear system and crank handle are aesthetically unappealing in many applications. Yet another disadvantage is that many operators are not strong enough or have enough dexterity to operate the crank handle. Another disadvantage, like the manual-type system, is that the umbrella must be lowered by the force of the user. Another disadvantage of this system is that the process of cranking the umbrella up and down can be quite awkward. These are only some of the many disadvantages of this system.

One common problem associated with the use of patio umbrellas is that users often forget to lower the umbrella after use. This is often because after use it is unappealing for the user to put in the manual labor required to lower the umbrella. Leaving the umbrella in a deployed position when not in use or when unattended often creates a dangerous condition that can damage property and the umbrella. If the umbrella is left deployed during high winds, the winds can lift up the umbrella and damage the umbrella or other property. As such, it is desirable to have an umbrella that can be lowered without the manual force of the operator.

Therefore, for the reasons stated above, and for other reasons stated below which will become apparent to those skilled in the art upon reading and understanding the specification, there is a need in the art for an improved umbrella system.

Thus, it is a primary object of the disclosure to provide an umbrella system that improves upon the state of the art.

Another object of the disclosure is to provide an umbrella system that is easier to deploy.

Yet another object of the disclosure is to provide an umbrella system that is easier to retract.

Another object of the disclosure is to provide an umbrella system that automatically opens.

Yet another object of the disclosure is to provide an umbrella system that automatically closes.

Another object of the disclosure is to provide an umbrella system that is powered by batteries.

Yet another object of the disclosure is to provide an umbrella system that does not need to be plugged into a conventional power source to be operable.

Another object of the disclosure is to provide an umbrella system that is aesthetically pleasing.

Yet another object of the disclosure is to provide an umbrella system that improves safety.

Another object of the disclosure is to provide an umbrella system that can be remotely opened.

Yet another object of the disclosure is to provide an umbrella system that can be remotely closed.

Another object of the disclosure is to provide an umbrella system that can be manually opened or closed with ease.

Yet another object of the disclosure is to provide an umbrella system that can be opened or closed by motorization.

Another object of the disclosure is to provide an umbrella system that improves the ergonomics of opening or closing an umbrella.

Yet another object of the disclosure is to provide an umbrella system that can be used with large umbrellas.

Another object of the disclosure is to provide an umbrella system that is relatively inexpensive to manufacture.

Yet another object of the disclosure is to provide an umbrella system that has a minimum number of parts.

Another object of the disclosure is to provide counterbalance assembly that counterbalances the weight of the umbrella.

Yet another object of the disclosure is to provide a counterbalance assembly having a torque profile that matches a torque profile of the umbrella.

Another object of the disclosure is to provide a locking assembly for locking an umbrella in any position.

Yet another object of the disclosure is to provide a locking assembly for locking an umbrella that is easy to use.

Another object of the disclosure is to provide a locking assembly for locking an umbrella that is intuitive.

Yet another object of the disclosure is to provide an umbrella system that has an intuitive design.

Another object of the disclosure is to provide an umbrella system that has a long useful life.

Yet another object of the disclosure is to provide an umbrella system that is rugged.

Another object of the disclosure is to provide an umbrella system that is durable.

Yet another object of the disclosure is to provide an umbrella system that utilizes standard and/or batteries.

Another object of the disclosure is to provide an umbrella system that is safe to use.

These and other objects, features, or advantages of the disclosure will become apparent from the specification and claims.

SUMMARY

In one or more arrangements, an umbrella system includes a support pole connected to a rotating tube positioned around a center tube that extends between the support pole and a upper hub that is connected to an umbrella frame. The rotating tube has one or more helical grooves therein that are engaged by a lower hub which is connected to the umbrella frame. As the rotating tube is rotated, the lower hub is driven along the length of the rotating tube, thereby opening and closing the umbrella frame. In one or more arrangements, system includes a motor housing assembly including a plurality of batteries and a motor that includes a driven gear that meshes with a stationary gear which causes rotation of the rotating tube.

In one or more arrangements, the system also includes a counterbalance assembly positioned in a upper hub of the umbrella frame. The counterbalance assembly includes at least one cord having a first end connected to the counterbalance assembly and a second end connected to the lower hub.

The counterbalance assembly is configured to tension the cords to provide a counterbalance force to the operation of the umbrella frame. In one or more arrangements, the counterbalance assembly includes at least one spring positioned within the rotating tube that tensions the cord and provides the counterbalance force. In one or more arrangements, the counterbalance assembly includes a spool connected to the spring. The cord is spooled around the spool. In one or more arrangements, the spool has a tapered exterior surface. In one or more arrangements, downward movement of the lower hub causes the spool to rotate in a first direction and the spring to tension. Upward movement of the lower hub causes the spool to rotate in a second direction and the spring to untension.

In one or more arrangements, the spring of the counterbalance assembly is a constant force spring. In one or more arrangements, the spring of the counterbalance assembly is a variable force spring. In one or more arrangements, the counterbalance assembly includes a combination of constant force and variable force springs.

In one or more arrangements, the system includes a rotational lock assembly configured to prevent rotation of the rotating tube when locked and permit rotation of the rotating tube when unlocked. In one or more embodiments, the rotational lock assembly includes a gear member, an inner lock assembly, and an outer collar. In some arrangements, the gear member is operably connected to the bottom end of the first tube. The gear member has a cylindrical shaped exterior surface and a set of teeth extending around the exterior surface. The gear member is positioned within the inner lock assembly. The inner lock assembly is positioned within the outer collar. The inner lock assembly is configured to engage the teeth of the gear member and prevent rotation of the gear member in response to rotation of the outer collar in a first direction. The inner lock assembly is further configured to disengage from the teeth of the gear member and permit rotation of the gear member in response to rotation of the outer collar in a second direction, opposite of the first direction.

In one or more arrangements, the inner lock assembly includes an arm member. The inner lock assembly is configured to extend the arm member to a first position in response to rotation of the outer collar in the first direction. In the first position, the arm member engages with the teeth of the gear member and prevents rotation of the gear member. The inner lock assembly is configured to retract the arm member to a second position in response to rotation of the outer collar in the second direction. In the second position, the arm member is disengaged from the teeth of the gear member and rotation of the gear member uninhibited by the arm member.

In one or more arrangements, the inner lock assembly includes an inner collar. The inner collar has a cylindrical shape. The inner collar has an interior surface and an exterior surface. The inner collar includes an opening. The inner collar includes a fulcrum surface adjacent to the opening on the outer surface. The gear member is positioned within the inner collar. The inner lock assembly includes a locking member. The locking member has a pivot positioned at the fulcrum surface. The locking member includes the arm member, the arm member extending from the pivot of the locking member. The inner collar and rocker arm are positioned within the outer collar. The locking member is member is configured to extend the arm member through the opening to engage the teeth of the gear member in response to the outer collar being rotated in the first direction. The locking member is member is configured to retract the arm member to disengage from teeth of the gear member in response to the outer collar being rotated in the second direction.

In one or more arrangements, the rotational lock assembly includes a bearing. The bearing is positioned at a lower end of the rotating tube. The bearing is configured to facilitate rotation of the rotating tube.

In one or more arrangements an umbrella system is presented having the first tube extending a length from a top end to a bottom end and an umbrella frame positioned adjacent a top end of the first tube. The umbrella frame is configured to move between an open position and a closed position. A motor is operably connected to the umbrella system and configured to move the umbrella frame between the open position and the closed position. A power source is configured to power the motor. In one or more arrangements the system includes a first lighting assembly positioned on the first tube and is movable along the first tube between an upper position and a lower position. The first lighting assembly includes a first battery and one or more lighting elements powered by the first battery. The first lighting assembly is configured to electrically connect the first battery to the power source and thereby facilitate charging of the first battery when the first lighting assembly is moved to the lower position.

In one or more arrangements, the first lighting assembly is moved to the lower position, the first lighting assembly is configured to form an electrical connection between the first battery and the power source at various rotational positions relative to the first tube. In one or more arrangements the first lighting assembly is configured to be rotated around the first tube. In one or more arrangements, the first lighting assembly is configured to form an electrical connection between the first battery and the power source at any orientation around the first tube when the first lighting assembly is moved to the lower position.

In one or more arrangements, a first set of electrical contacts are positioned on the first lighting assembly and electrically connected to the first battery, a second set of electrical contacts are connected to the power source, and the first set of electrical contacts are configured to contact the second set of electrical contacts when the first lighting assembly is moved to the lower position. In one or more arrangements, one set of the first set of electrical contacts and second set of electrical contacts are spring loaded pin type contacts and the other set of the first set of electrical contacts and second set of electrical contacts are concentric ring type contacts.

In one or more arrangements, the system includes a second lighting assembly. The second lighting assembly is positioned on the first tube above the first lighting assembly and is movable along the tube. The second lighting assembly includes a second battery and one or more lighting elements powered by the second battery. The first lighting assembly includes a set of electrical contacts configured to electrically connect the second lighting assembly to the first lighting assembly when the second lighting assembly is moved to a position in contact with the first lighting assembly.

In one or more arrangements, the motor is configured to move the umbrella frame between the open and closed positions by rotating the first tube relative to a second tube. In one or more arrangements, the motor and power source are positioned in a motor housing assembly having an upper member, connected to a bottom end of the first tube, and a lower member, connected to a top end of the second tube. The motor is configured to rotate the upper member relative to the lower member when operated to thereby open and close the umbrella frame. In one or more arrangements, wherein the power source is positioned in the lower member and connected to a set of electrical contacts positioned on the upper member by a brushless electrical contact configured to electrically connect the set of electrical contacts to the power source without inhibiting rotation of the upper member relative to the lower member. In one or more arrangements, the brushless electrical contact is a coiled wire configured to electrically connect the set of electrical contacts to the power source without inhibiting rotation of the upper member relative to the lower member.

In one or more arrangements, the system includes a solar panel positioned adjacent a top end of the first tube. The solar panel is configured to charge a battery of the power source. a control circuit operably connected to the motor.

In one or more arrangements, the system includes a control circuit configured to control operation of the motor. In one or more arrangements, the control circuit is configured to conserve power below threshold power level so as to reserve enough power to facilitate closing of the umbrella frame. In one or more arrangements, the control circuit is configured to conserve power by disabling one or more accessory devices powered by the battery of the power source in response to the power level of the battery falling to the threshold power level.

In one or more arrangements, wherein the control circuit includes a memory having a set of trigger conditions are stored thereon. In response to the one trigger condition of the set of trigger conditions being satisfied, the control circuit is configured to perform an action specified by the trigger condition. In one or more arrangements, the control circuit is configured to provide a user interface for a user to customize the set of trigger conditions.

DETAILED DESCRIPTION

Figure 1:
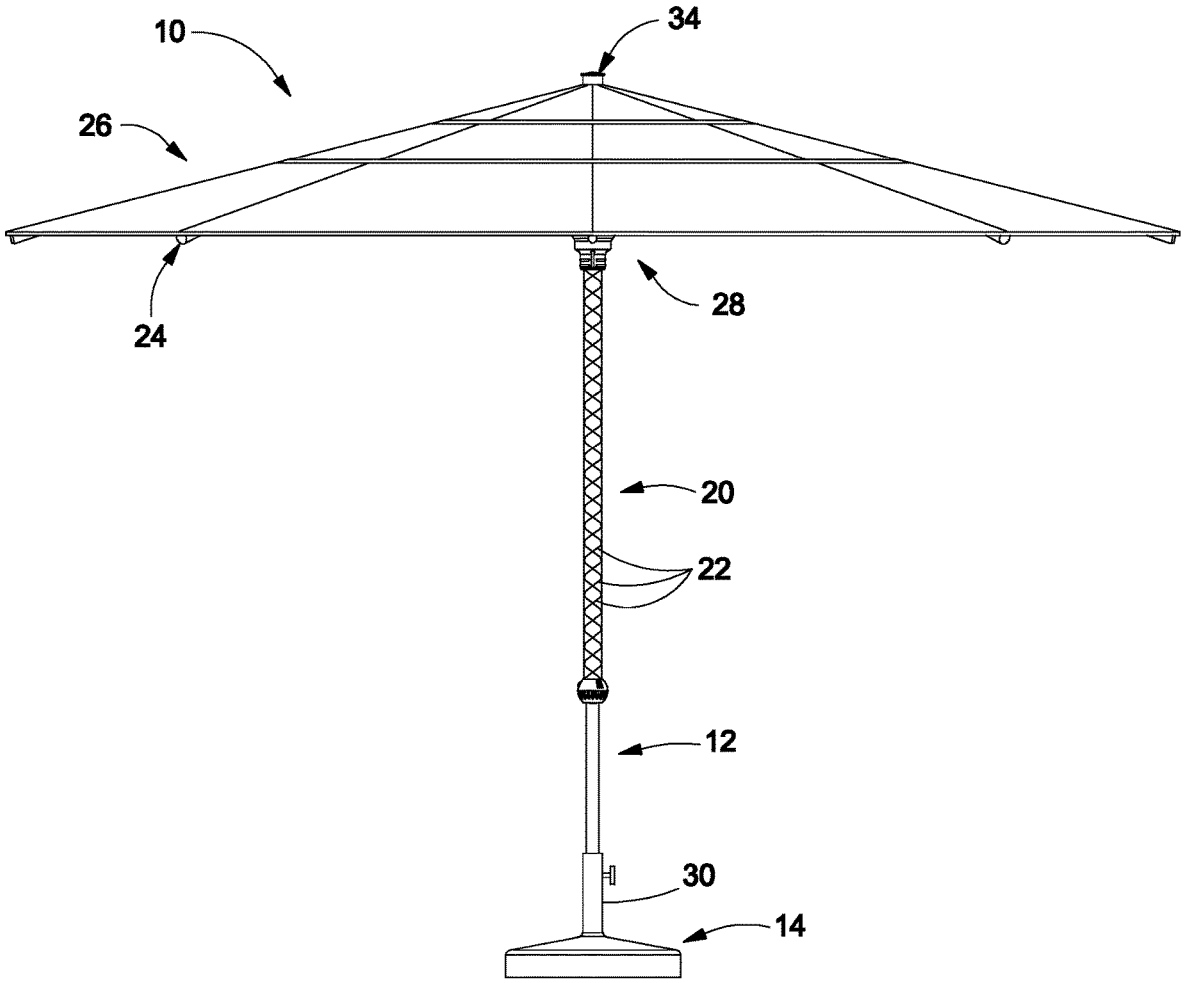
FIG. 1 is an elevation view of a manual umbrella system in accord, in accordance with one or more embodiments; the view showing a support pole, a base, a rotating tube having four helical grooves therein including two clockwise rotating helical grooves positioned on opposing sides of the rotating tube and two counterclockwise rotating helical grooves positioned on opposing sides of the rotating tube with the clockwise and counterclockwise helical grooves periodically intersecting one another across the entire length of the rotating tube, a lower hub, an umbrella frame, umbrella material and a upper hub connecting the umbrella frame to a center tube, the view showing the umbrella in an open position.
Figure 2:
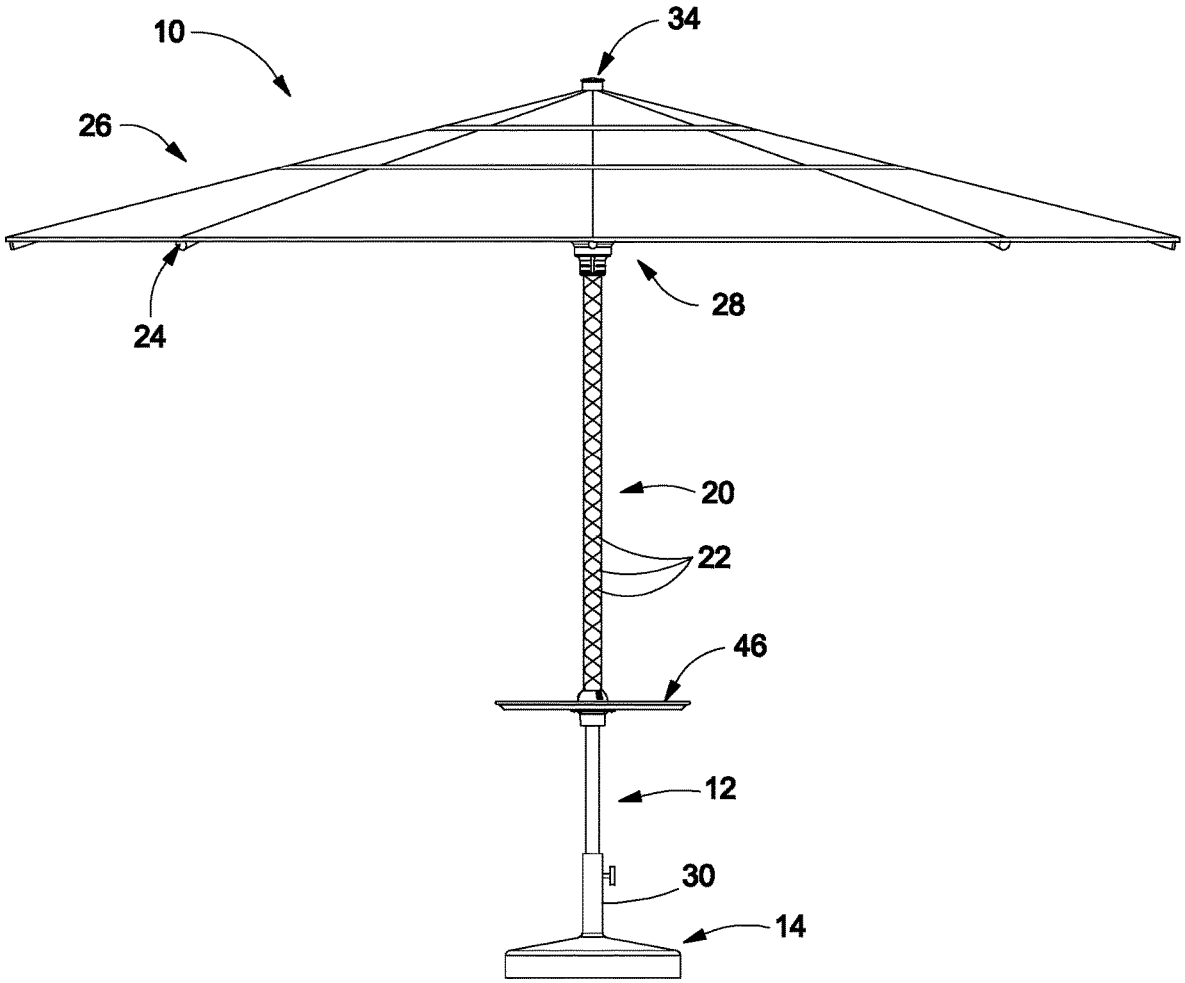
FIG. 2 is an elevation view of the manual umbrella system of claim 1, in accordance with one or more embodiments; the view also showing the addition of a table.
Figure 3:
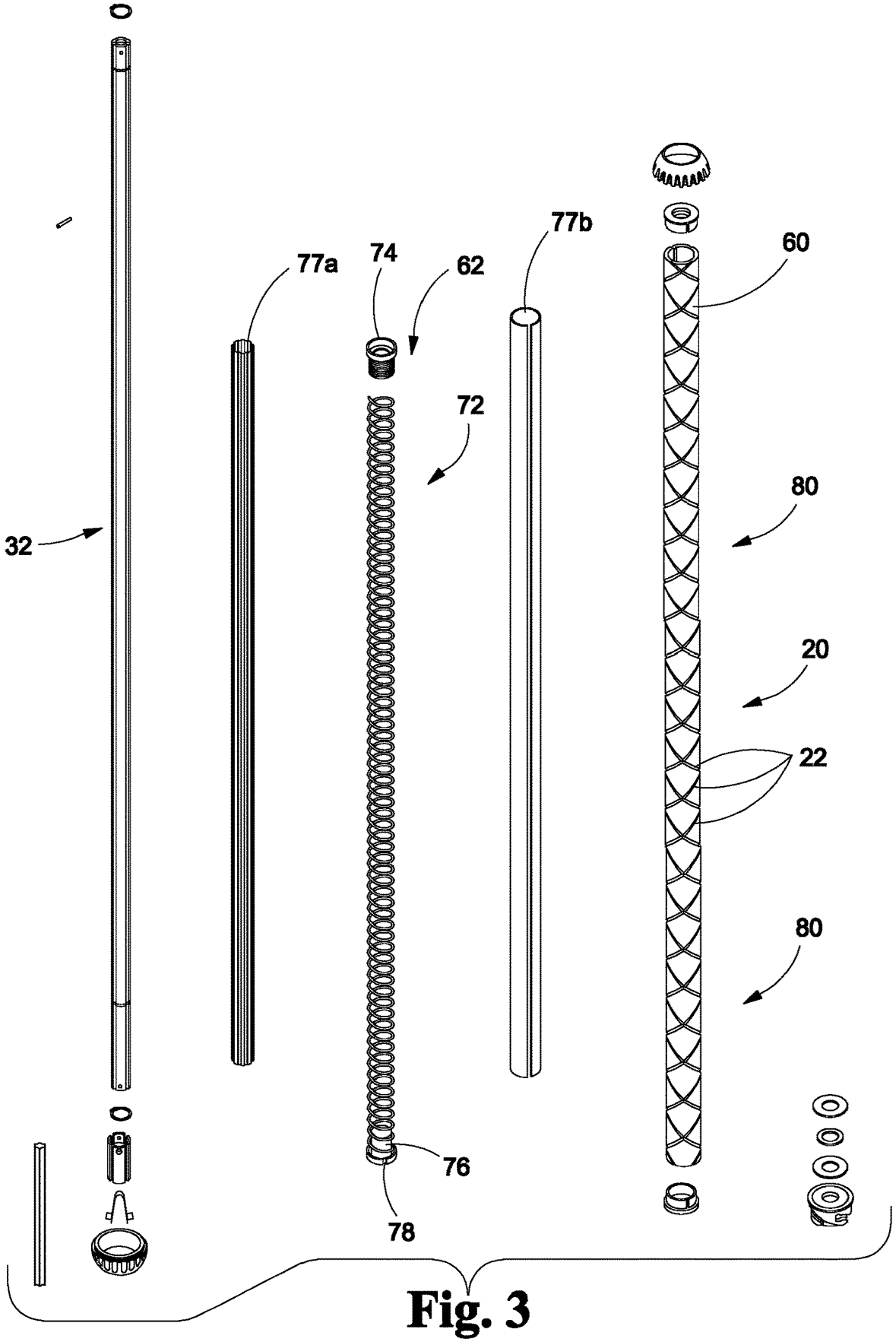
FIG. 3 is a perspective exploded view of the rotating tube assembly shown in FIGS. 1 and 2, in accordance with one or more embodiments; the view showing the rotating tube, the center tube, the counterbalance assembly, the inner sleeve and the outer sleeve.
Figure 4:
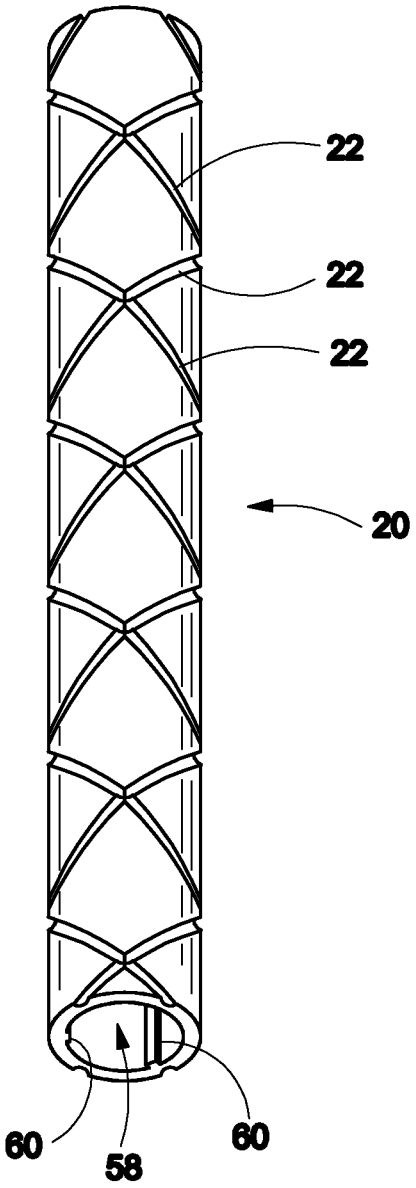
FIG. 4 is a perspective view of a portion of the center tube, in accordance with one or more embodiments; the view showing the rotating tube having four helical grooves in its exterior surface including two clockwise rotating helical grooves positioned on opposing sides of the rotating tube and two counterclockwise rotating helical grooves positioned on opposing sides of the rotating tube with the clockwise and counterclockwise helical grooves periodically intersecting one another across the length of the rotating tube, the view also showing the hollow interior having features therein, which in this example are protrusions or rails within the hollow interior.
Figure 5:
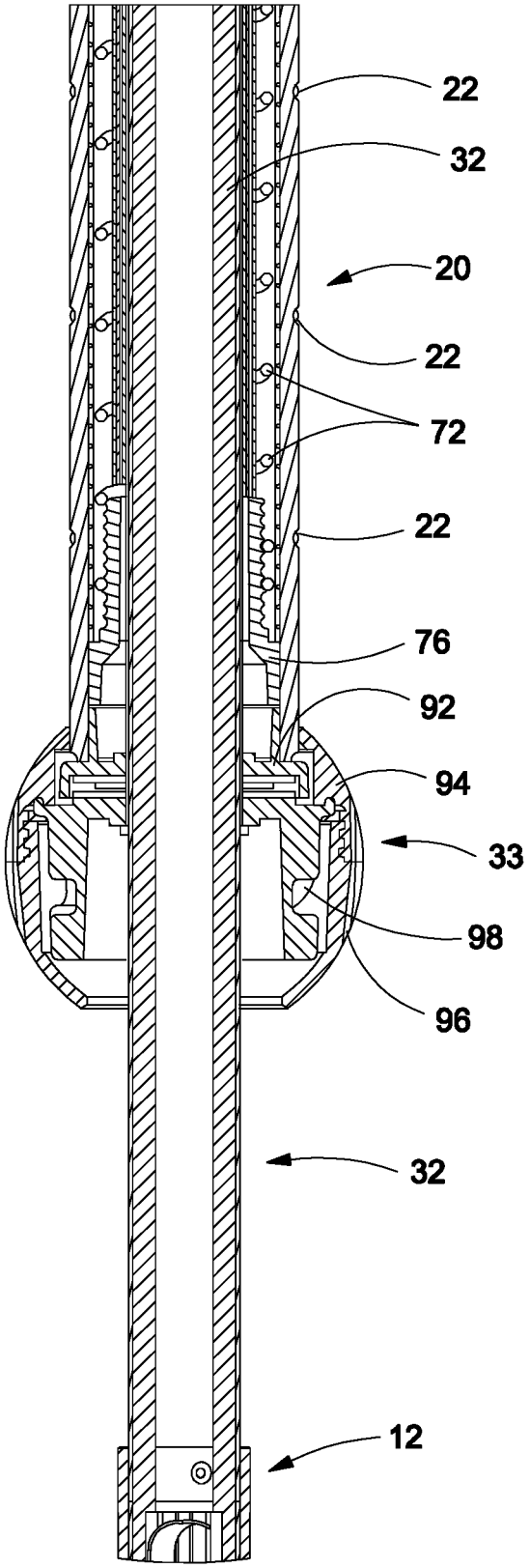
FIG. 5 is a side cut-away elevation view of the lower end of the rotating tube, the center tube and the support pole, in accordance with one or more embodiments; the view showing the counterbalance assembly having a spring and an inner sleeve and an outer sleeve positioned within the rotating tube and around the center tube.
Figure 6:
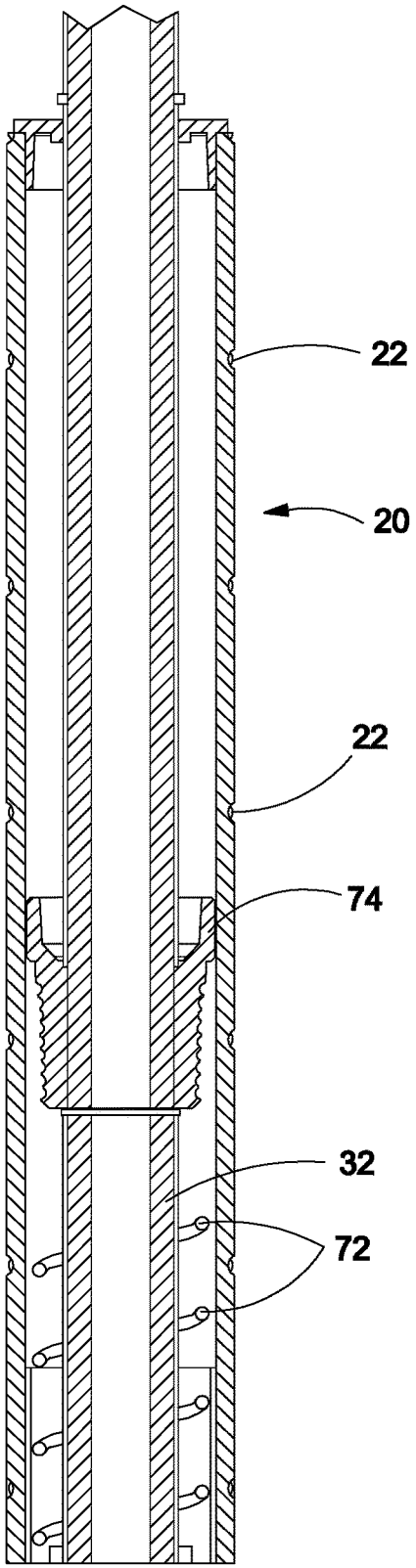
FIG. 6 is a side cut-away elevation view of the upper end of the rotating tube, the center tube and the support pole, in accordance with one or more embodiments; the view showing the counterbalance assembly having a spring and an inner sleeve and an outer sleeve positioned within the rotating tube and around the center tube.
Figure 7:
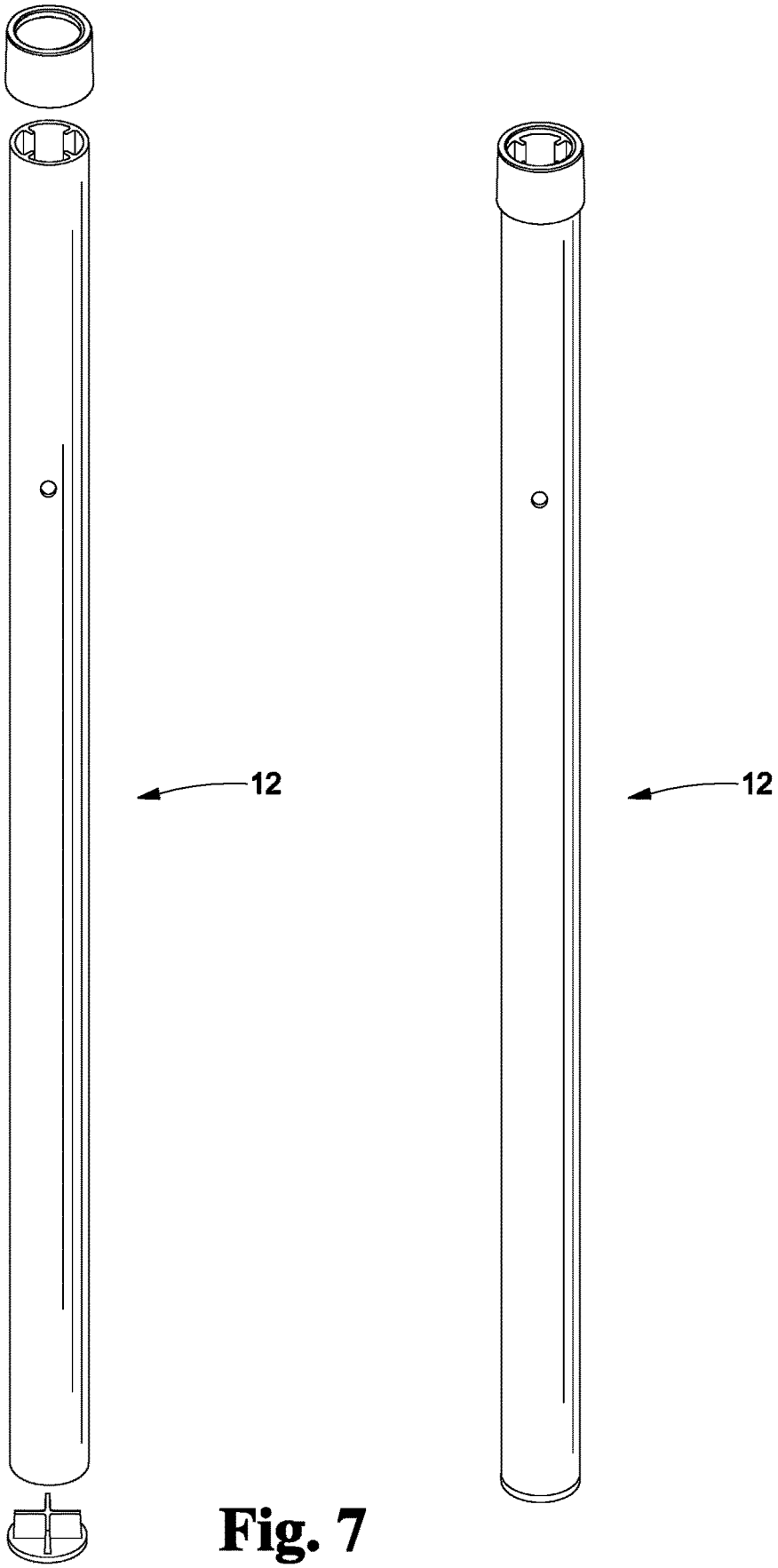
FIG. 7 is a perspective view of the support pole in an assembled state and an exploded state in accordance with one or more embodiments.
Figure 8:
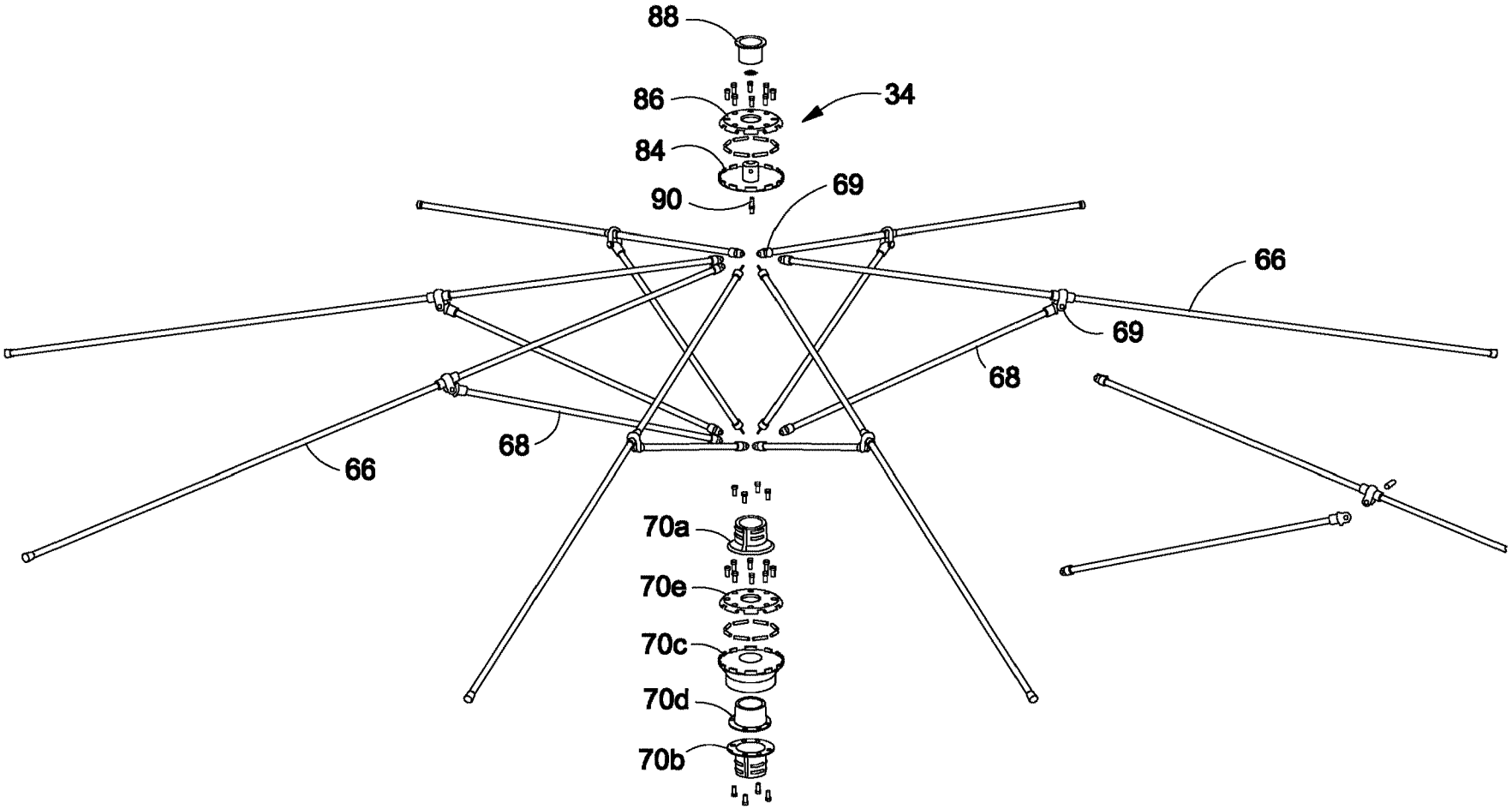
FIG. 8 is an exploded perspective view of the umbrella frame, in accordance with one or more embodiments; the view showing the upper hub and lower hub in an exploded arrangement, the view also showing the upper supports and the lower supports and how they connect to one another and to the upper support and the lower support, the view showing the umbrella frame in an open position.
Figure 9:
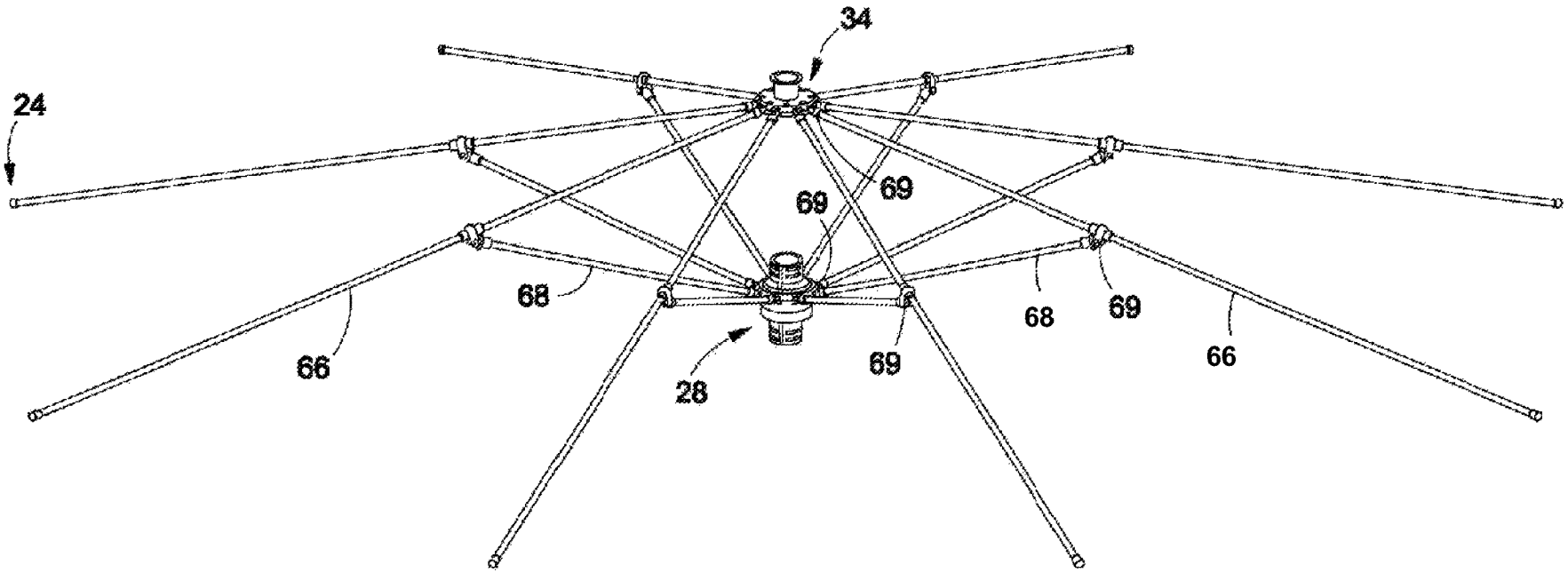
FIG. 9 is a perspective view of the umbrella frame of FIG. 8, in accordance with one or more embodiments; the view showing the upper support and the lower hub and the umbrella frame in an assembled state.
Figure 10:
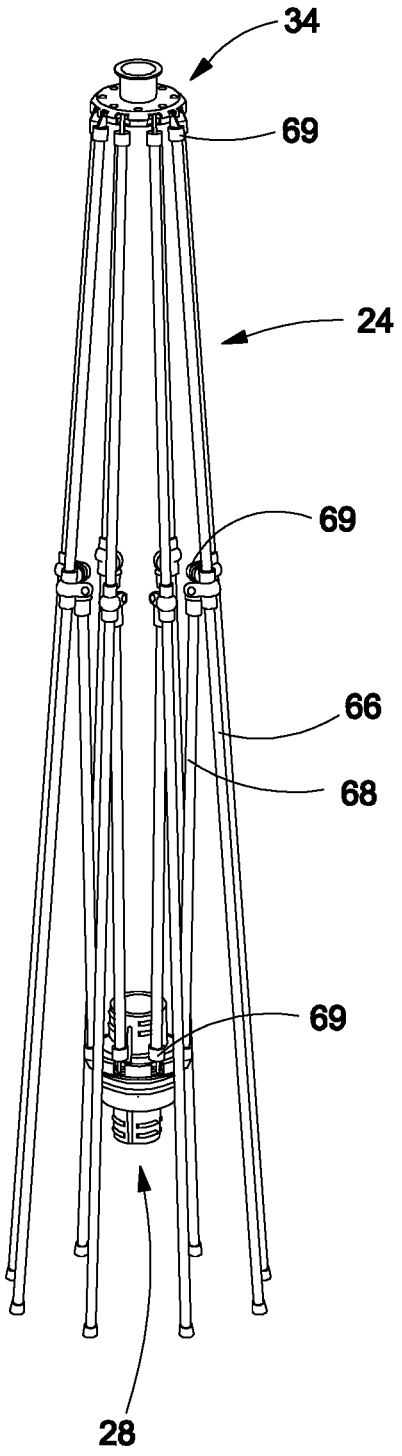
FIG. 10 is a perspective view of the umbrella frame of FIGS. 8 and 9, in accordance with one or more embodiments; the view showing the umbrella frame in a closed position.
Figure 11:
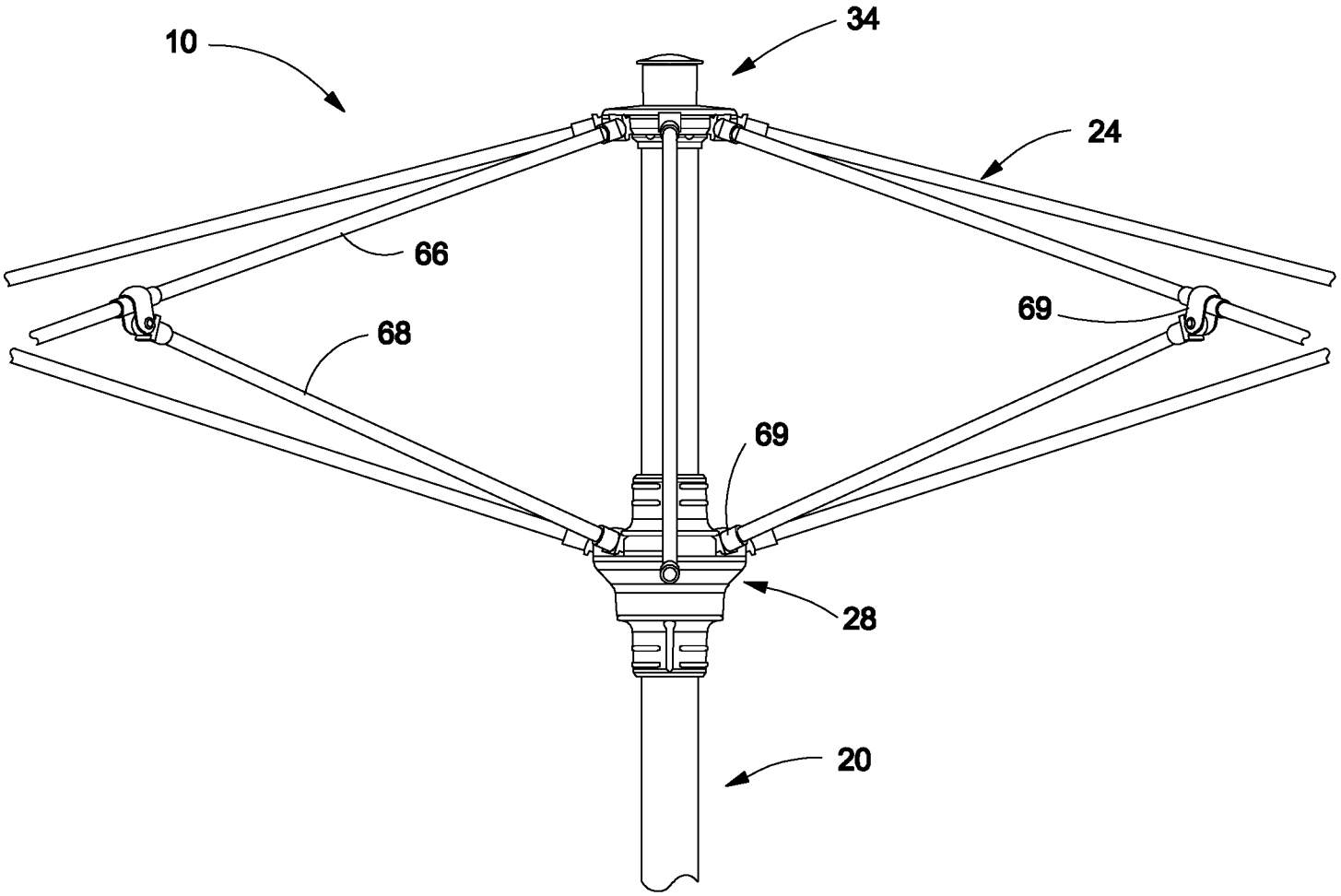
FIG. 11 is a close up elevation view of the umbrella frame, in accordance with one or more embodiments; the view showing the umbrella frame, the upper hub and the lower hub in an assembled state, the view showing the umbrella frame in an open position.
Figure 12:
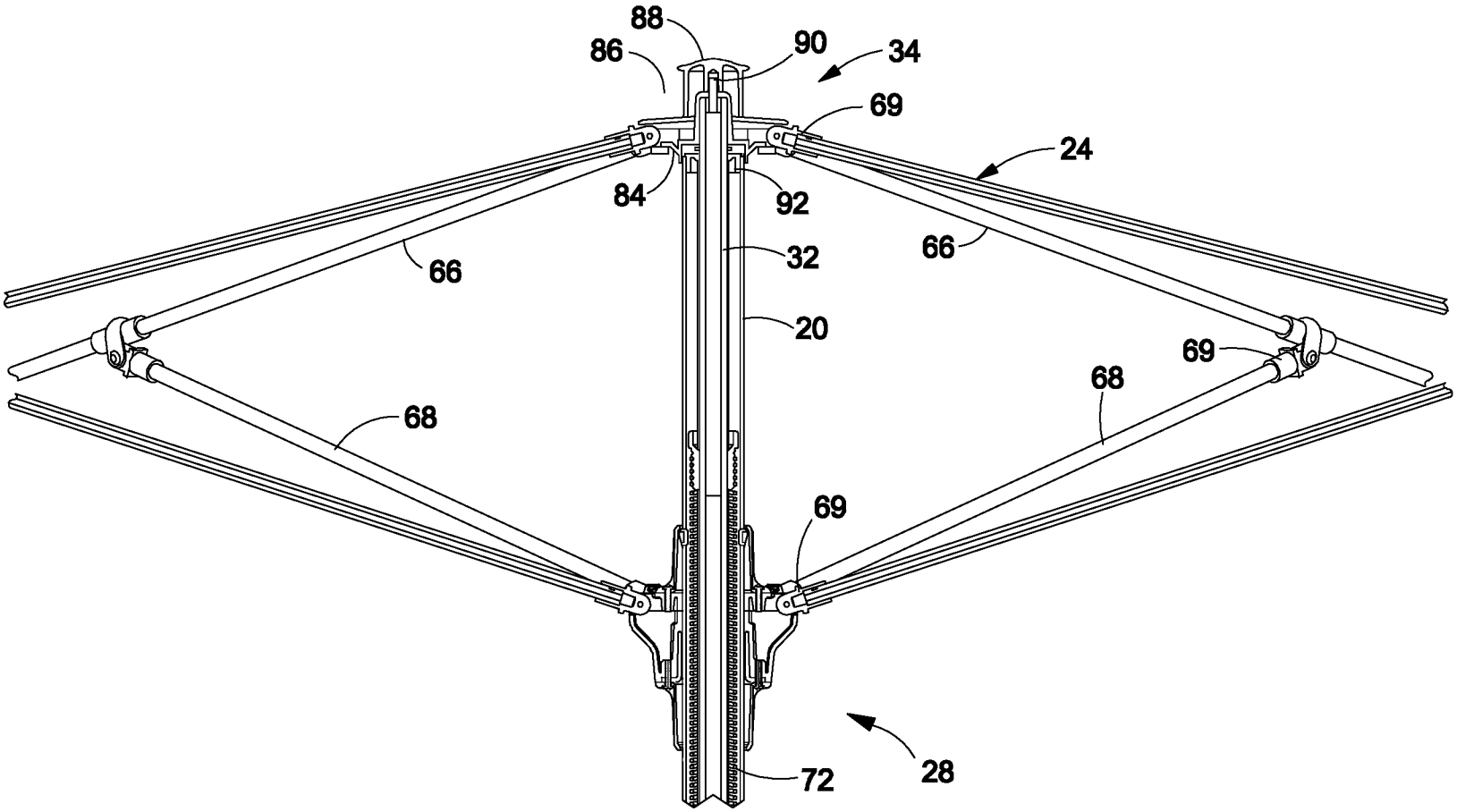
FIG. 12 is a side cut-away elevation view of the umbrella frame of FIG. 11, in accordance with one or more embodiments; the view the showing center tube and the counterbalance assembly positioned within the rotating tube, the view showing the umbrella frame in an open position.

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation to encompass all such modifications and similar arrangements and procedures. For instance, although aspects and features may be illustrated in and/or described with reference to certain figures and/or embodiments, it will be appreciated that features from one figure and/or embodiment may be combined with features of another figure and/or embodiment even though the combination is not explicitly shown and/or explicitly described as a combination. In the depicted embodiments, like reference numbers refer to like elements throughout the various drawings.

Any advantages and/or improvements discussed herein may not be provided by various disclosed embodiments, and/or implementations thereof. The contemplated embodiments are not so limited and should not be interpreted as being restricted to embodiments which provide such advantages and/or improvements. Similarly, it should be understood that various embodiments may not address all or any objects of the disclosure and/or objects of the invention that may be described herein. The contemplated embodiments are not so limited and should not be interpreted as being restricted to embodiments which address such objects of the disclosure and/or invention. Furthermore, although some disclosed embodiments may be described relative to specific materials, embodiments are not limited to the specific materials and/or apparatuses but only to their specific characteristics and capabilities and other materials and apparatuses can be substituted as is well understood by those skilled in the art in view of the present disclosure.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation and/or configuration.

As used herein, "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof, unless expressly indicated otherwise. For example, if an embodiment of a system is described at comprising an article, it is understood the system is not limited to a single instance of the article unless expressly indicated otherwise, even if elsewhere another embodiment of the system is described as comprising a plurality of such articles.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected and/or engaged, respectively, in any manner that facilitates operation, which may include being directly connected, indirectly connected, electronically connected, wirelessly connected and/or connected by any other manner, method and/or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments and/or methods.

Similarly, the structures and operations discussed herein may occur out of the order described and/or noted in the figures. For example, two operations and/or figures shown in succession may in fact be executed concurrently and/or may sometimes be executed in the reverse order, depending upon the functionality/acts involved. Similarly, individual operations within example methods described below may be executed repetitively, individually, and/or sequentially, to provide looping and/or other series of operations aside from single operations described below. It should be presumed that any embodiment and/or method having features and functionality described below, in any workable combination, falls within the scope of example embodiments.

While the figures show the embodiments used in association with a patio umbrella, the embodiments are not so limited, and reference herein to a patio umbrella is not intended to be limiting. In contrast, a patio umbrella is simply used as one of countless examples. It is hereby contemplated that the embodiments may also be used with any form of an umbrella, and for that matter any applicable mechanical device.

System 10:

Umbrella system 10 (system 10) is presented. In one or more arrangements, umbrella system 10 includes a support pole 12, a base 14, a motor housing assembly 16, a table 46, a rotating tube 20, having one or more helical grooves 22 therein and an umbrella frame 24 that supports fabric or material 26 and is connected to a movable lower hub 28.

Support Pole 12 & Base 14:

Support pole 12 is formed of any suitable size, shape, and design and is configured to support and position the other components of the system 10 at the proper height. In the arrangement shown, as one example, support pole 12 is a generally cylindrical pole that extends from a lower end to an upper end. The lower end of support pole 12 is connected to base 14. In one or more arrangements, the lower end of support pole 12 fits within a hollow tube of base stem 30 which is connected to base 14. Base 14 is formed of any suitable size, shape, and design and is generally heavy and rigid and thereby provides stability for the remaining parts of the system 10.

In this example arrangement, the upper end of support pole 12 connects to center tube 32 and provides support thereto. In this example arrangement, support pole 12 and center tube 32 connect to rotating tube 20 by lower bearing assembly 33. In one or more arrangements, as is shown, support pole 12 and rotating tube 20 are hollow and cylindrical in nature. In one or more arrangements, center tube 32 is any elongated device that extends through rotating tube 20 and remains stationary while rotating tube 20 axially rotates there around. As such, the stationary nature of support pole 12 and center tube 32 allows for the transfer of torque or rotation to rotating tube 20 as is further described herein. In this example arrangement, center tube 32 connects at its lower end to support pole 12 and connects at its upper end to upper hub 34 of umbrella frame 24.

Also connected adjacent the intersection of center tube 32 and rotating tube 20 in this example arrangement is a stationary gear 36. In this example arrangement, stationary gear 36 is any form of a gear that remains stationary with respect to support pole 12 and center tube 32. In the arrangement shown, as one example, stationary gear 36 is generally cylindrical in nature and has gear teeth on an inwardly facing surface, however, the alternative arrangement is hereby contemplated where teeth are located on an outward surface of stationary gear 36. This stationary gear 36 matingly receives a driven gear 38 connected to motor 40, which drives around the stationary gear 36 to open and close the umbrella system 10 as is further described herein.

Motor Housing Assembly 16:

Motor housing assembly 16 serves to drive rotating tube 20 in a motorized manner, thereby opening and closing umbrella system 10. Motor housing assembly 16 is formed of any suitable size, shape, and design and serves to open and close the umbrella system 10. In the arrangement shown, as one example, motor housing assembly 16 includes a container 41 that holds and shelters motor 40 as well as power source 42, which in the arrangement shown is a plurality of batteries 44 that are positioned around rotating tube 20 and center tube 32. In this example arrangement, container 41 is connected to rotating tube 20 at its inward end, and therefore container 41, and the other components of motor housing assembly 16 rotate as the rotating tube 20 rotates.

In one or more arrangements, batteries 44 are held within a battery holder 45. Battery holder 45 frictionally hold batteries 44 in place around the exterior surface of rotating tube 20 while also providing electrical connection between the plurality of batteries 44. In this example arrangement, battery holder 45 holds the plurality of batteries 44 which are stacked in a generally vertical arrangement around the exterior surface of rotating tube 20 such that the exterior surfaces of the plurality of batteries 44 form a generally cylindrical exterior periphery when viewed from above or below. This arrangement maximizes battery density while minimizing space used. While batteries 44 are stacked in side-to-side nature they are electrically connected in series to one another by battery holder 45.

Motor 40 is formed of any suitable size, shape, and design. In the arrangement shown, as one example, motor 40 is generally tubular in shape or cylindrical in shape and includes a drive shaft 40A that connects to driven gear 38 and imparts rotation on driven gear 38 when motor 40 is activated. In one or more arrangements, to reduce the rotational output speed of driven gear 38, a gear assembly 40B is connected between an output shaft of motor 40 and driven gear 38. This gear assembly 40B facilitates slower rotation of driven gear 38 than the rotational speed of the output shaft of motor 40.

In this example arrangement, as motor 40 is sized and shaped in a similar manner to batteries 44, and as such motor 40 is held by battery holder 45 in a side-to-side adjacent manner with the plurality of batteries 44. That is, motor 40 is positioned in a vertical alignment, like batteries 44, around the exterior surface of rotating tube 20. In one or more arrangements, motor 40 is oriented such that drive shaft 40A and driven gear 38 extend below the lower surface of motor housing assembly 16 and container 41. This downward extension of driven gear 38 facilitates the engagement of driven gear 38 with stationary gear 36. However, the opposite arrangement is hereby contemplated for use as one alternative wherein the motor 40 remains stationary while gear 36 rotates.

A table 46 is also connected to system 10 at or near the motor housing assembly 16 and just below the lower end of container 41. Table 46 is formed of any suitable size, shape, and design and can either be connected to the stationary center tube 32 such that it is non-rotational in nature, or it is connected to the rotating tube 20 such that the table 46 is rotational in nature.

When table 46 is rotational in nature, and is therefore connected to rotating tube 20, table 46 can be used to raise and lower the umbrella frame 24 by manually rotating the table 46. When table 46 is rotational in nature, and is therefore connected to rotating tube 20, table 46 can also be used to raise and lower the umbrella frame 24 by starting or stopping motor 40 by moving or initiating rotation of table 46 or alternatively stopping rotation of table 46 as is further described herein. When the table 46 is used to open and close the system 10, the increased diameter of table 46 provides a mechanical advantage, thereby making it easier to open and close the system 10.

In one or more arrangements, table 46 extends outward from rotating tube 20 in a generally perpendicular nature such that table 46 provides a generally flat and level upper surface. In one or more arrangements, table 46 has a generally circular or cylindrical shape when viewed from above or below, however, any other shape is hereby contemplated for use. An optional table extension 48 (not shown) is connected to table 46 by any engagement member, manner or method, and serves to extend the size or diameter of table 46 and provide greater tabletop surface area. In one or more arrangements, table extension 48 connects to table 46 by way of clips 50 (not shown). In one or more arrangements, table 46 is connected to rotating tube 20 and therefore is rotational in nature. In contrast, in another arrangement, table extension 48 is connected to center tube 32 and therefore table extension 48 is non-rotational in nature.

In one or more arrangements, a cover 52 is connected to the upper end of container 41 and covers container 41. Cover 52 is formed of any suitable size, shape, and design and serves to hold lighting elements 54, which are any form of a light producing device such as one or more light bulbs, LEDs, or the like. In one or more arrangements, cover 52 is vertically fixed, or fixed to the upper end of container 41, or cover 52 is formed as a unitary part of container 41. In an alternative arrangement, cover 52 is a separate part from container 41 and, in this example arrangement, cover 52 is vertically movable along rotating tube 20 so as to allow the positioning of cover 52 and lighting elements 54 at the appropriate position above table 46. To facilitate this vertical movement, cover 52 is connected to power source 42 by a flexible cord 56 (not shown) that accommodates any positioning of cover 52 along the length of rotating tube 20. In one or more arrangements, cover 52 is generally circular in shape when viewed from above and below so as to mimic the exterior shape of container 41.

In one or more arrangements, cover 52 has a slightly larger diameter than the exterior diameter of container 41 and includes a curved or angled upper surface 52A and a curved or angled lower surface 52B. In one or more arrangements, the lighting elements 54 are positioned at or near the exterior periphery of cover 52 and/or in the lower surface 52B. This configuration allows lighting elements 54 to be positioned beyond the exterior surface of container 41 and further allows lighting elements 54 to shine down upon the tabletop of table 46/48 when lighting elements 54 are present. The curved or angled upper surface 52A facilitates water and debris to roll off of the cover 52 and away from the container 41. This configuration provides both useful light on the tabletop as well as an elegant ambiance.

Rotating Tube 20:

Rotating tube 20 is formed of any suitable size, shape, and design. As motor 40 is activated, motor 40 rotates driven gear 38 which meshes with stationary gear 36, thereby driving motor 40, and the components connected thereto (including rotating tube 20 and motor housing assembly 16) in circular fashion. In one or more arrangements, rotating tube 20 includes one or more helical grooves 22 therein. In one or more arrangements, a single helical groove 22 is used, either clockwise rotating or counterclockwise rotating. In another arrangement a pair of helical grooves 22 are used, either both clockwise rotating or counterclockwise rotating, or one clockwise rotating and one counterclockwise rotating. In yet another arrangement, as is shown, four helical grooves 22 are used, two clockwise rotating and two counterclockwise rotating, wherein the clockwise rotating and counterclockwise rotating helical grooves 22 intersect with one another. Also, in the example arrangement shown, the two clockwise helical grooves 22 are positioned at all times on opposite or opposing sides of the rotating tube 20 from one another and the two counterclockwise helical grooves 22 are positioned at all times on opposite or opposing sides of the rotating tube 20 from one another. While only one of either a clockwise rotating helical groove 22 or a counterclockwise rotating helical groove 22 are needed for operation, having two clockwise rotating and two counterclockwise rotating helical grooves 22 that intersect one another provides an appealing aesthetic appearance. In one or more arrangements, these helical grooves 22 extend from end to end along the entire length of rotating tube 20, whereas in an alternative arrangement, these helical grooves 22 only extend a portion of the length of rotating tube 20. In addition, by placing a pair of helical grooves 22 on opposing sides of the rotating tube 20 and engaging these opposing helical grooves 22 with a tooth 70 of lower hub 28 provides greater stability and smoother operation as compared to only using a single helical groove 22. The use of any number of helical grooves 22 are hereby contemplated for use.

Rotating tube 20 includes a hollow interior 58 that provides space for center tube 32 therein. The interior surface of rotating tube 20 also includes one or more features 60 therein, such as ridges, grooves or other aberrations that are used to connect counterbalance assembly 62 thereto as is further described herein.

In one or more arrangements, in addition to having one or more helical grooves 22 therein, the exterior surface of rotating tube 20 includes one or more lateral grooves 64 (not shown). Lateral grooves 64 extend in a straight fashion along the lateral length of rotating tube 20. In one or more arrangements, these lateral grooves 64 extend from end to end across the entire length of rotating tube 20, whereas in an alternative arrangement, these lateral grooves 64 only extend a portion of the length of rotating tube 20.

Lower Hub 28:

Lower hub 28 is formed of any suitable size, shape, and design and serves to open and close umbrella frame 24 as rotating tube 20 is rotated. In one or more arrangements, lower hub 28 is connected to the non-rotating upper hub 34 by connection to the upper supports 66 of umbrella frame 24 which are connected to lower supports 68 of umbrella frame 24. In one or more arrangements, upper supports 66 connect to lower supports 68 by joints 69. Similarly, in one or more arrangements, lower hub 28 connects to lower supports 68 by joints 69. Similarly, in one or more arrangements, upper hub 34 connects to upper supports 66 by joints 69. Joints 69 are any connecting member that provides connection while also providing the needed articulation for opening and closing of the umbrella frame 24. Upper supports 66 of umbrella frame 24 serve to connect to and support material 26 when umbrella frame 24 is in a fully extended or deployed position. Lower supports 68 of umbrella frame 24 connect between lower hub 28 and upper supports 66 and serve to move the upper supports 66 between the retracted position or closed position and the deployed position or open position as lower hub 28 moves up and down along a length of the rotating tube 20. That is, this connection between lower hub 28, lower supports 68, upper supports 66 and upper hub 34 causes lower hub 28 to be non-rotational while allowing lower hub 28 to travel vertically along the vertical length of rotating tube 20.

In one or more arrangements, lower hub 28 includes one or more teeth 70 positioned on the inward facing surface of lower hub 28. This tooth 70 or these teeth 70 are keyed to be received within one of the helical grooves 22. To facilitate smooth operation, teeth 70 are formed of an elongated nature, or said another way, teeth 70 are generally extended in nature. In one or more arrangements, the length of teeth 70 can range anywhere from ¼ of an inch to well over 2 or 3 inches in length. Again, the elongated nature of teeth 70 provides greater surface area of engagement between teeth 70 and helical grooves 22, thereby providing smooth operation and reducing the possibility that teeth 70 could skip out of helical groove 22.

In one or more arrangements, to aid in smooth operation, lower hub 28 is generally vertically elongated so as to cover a vertical portion of rotating tube 20. In the arrangement shown, as one example, lower hub 28 is formed of an upper collar 70A, a lower collar 70B, a center collar 70C, an interior collar 70D and a connecting collar 70E. Each of the upper collar 70A, lower collar 70B, center collar 70C, interior collar 70D and connecting collar 70E are generally cylindrical in shape or tubular in shape and have a hollow interior that extends around a portion of the rotating tube 20. The lower end of upper collar 70A connects to the upper end of connecting collar 70E, the lower end of connecting collar 70E connects to the upper end of center collar 70C, the upper end of lower collar connects to the lower end of center collar 70C. Interior collar 70D fits generally within center collar 70C and between the upper end of lower collar 70B and the lower end of upper collar 70A. In this example arrangement, interior collar 70D has an elongated or extended interior surface that is sized and shaped to fit around the exterior surface of rotating tube 20 with close and tight tolerances, while still allowing for smooth and easy sliding over the exterior surface of rotating tube 20. Teeth 70 are positioned within this interior surface of interior collar 70D and extend inward and engage grooves 22. In an alternative arrangement, upper collar 70A, lower collar 70B and/or center collar 70C also have an elongated or extended interior surface that include teeth 70 therein, the interior surface being sized and shaped to fit around the exterior surface of rotating tube 20 with close and tight tolerances, while still allowing for smooth and easy sliding over the exterior surface of rotating tube 20.

In one or more arrangements, connecting collar 70E includes a plurality of recesses therein. These recesses receive the lower end of lower supports 68 and connect thereto with joints 69 that facilitate articulation of umbrella frame 24 during opening and closing.

Counterbalance Assembly 62:

Counterbalance assembly 62 is formed of any suitable size, shape, and design and serves to provide a counterbalance force that counteracts the forces involved in raising and lowering, the umbrella frame 24. In the arrangement shown, as one example, counterbalance assembly 62 is positioned within the hollow interior 58 of rotating tube 20 and includes a spring 72 that is connected at a first end to a stationary perch 74 and at a second end to a rotating perch 76. As the rotating tube 20 is vertically aligned the stationary perch 74 can be positioned either above or below the rotating perch 76, with the stationary perch 74 connected to center tube 32 and the rotating perch 76 connected to the rotating tube 20.

In one or more arrangements, as is shown, stationary perch 74 is connected to upper hub 34 adjacent the upper end of center tube 32 within the upper end of rotating tube 20. Stationary perch 74 is connected to center tube 32 by any manner, method or means such as threading, bolting, pinning, riveting, gluing, welding, or any other manner of connection.

In this example arrangement, rotating perch 76 is connected to the interior surface of hollow interior 58. In one or more arrangements, this connection is similarly made by any manner, method or means such as threading, bolting, pinning, riveting, gluing, welding, or any other manner of connection. In the arrangement shown, as one example, as one example, mating engagement of grooves 78 in the exterior surface of rotating perch 76 with the features 60 in the hollow interior 58 of rotating tube 20 is used such that when rotating tube 20 rotates so rotates rotating perch 76.

As rotating perch 76 rotates while stationary perch 74 remains stationary, forces are built up within, or released from, spring 72, thereby providing a counterbalance force to the force of raising the umbrella frame 24. This counterbalance force can substantially reduce the amount of energy needed to raise or lower the umbrella frame 24, which is highly advantageous, especially in a battery powered application as the less force required, the longer the battery life. The spring 72, rotating perch 76 and stationary perch 74 fit around center tube 32.

To provide quieter and smoother operation, in one or more arrangements, an interior sleeve 77A is positioned within the hollow interior of spring 72 and between the spring 72 and the center tube 32 and an exterior sleeve 77B is positioned around the exterior of spring 72 and between the spring 72 and the center tube 32. In one or more arrangements, interior sleeve 77A and exterior sleeve 77B are formed of a plastic material or composite material. This helps to reduce noise and smooth operation, especially when rotating tube 20, center tube 32 and spring 72 are formed of a metallic material as the semi-compressible and self-lubricating properties of the plastic or composite material help to take up and reduce rattling while accommodating smooth operation.

In one or more arrangements, the counterbalance force produced by counterbalance assembly 62 does not perfectly match the forces generated by opening and closing the umbrella frame 24. In this example arrangement, the counterbalance force of the counterbalance assembly 62 is tailored to be neutral at approximately the middle of the opening and closing cycle.

To hold the umbrella frame 24 in a fully open or fully closed position, detents 80 are positioned in the exterior surface of rotating tube 20 at or near where the lower hub 28 is when the umbrella frame 24 is in a fully open and a fully closed position. In one or more arrangements, the upper end of upper collar 70A and the lower end of lower collar 70B include fingers 82 that are configured to frictionally engage and hold detents 80. When fingers 82 are engaged with or over detent 80, the force required to move past the detent 80 is greater than the force of gravity generated by the umbrella frame 24 and/or greater than the counterbalance force generated by the counterbalance assembly 62. As such, when the fingers 82 are engaged with a detent 80, the lower hub 28 remains in place.

Figure 13:
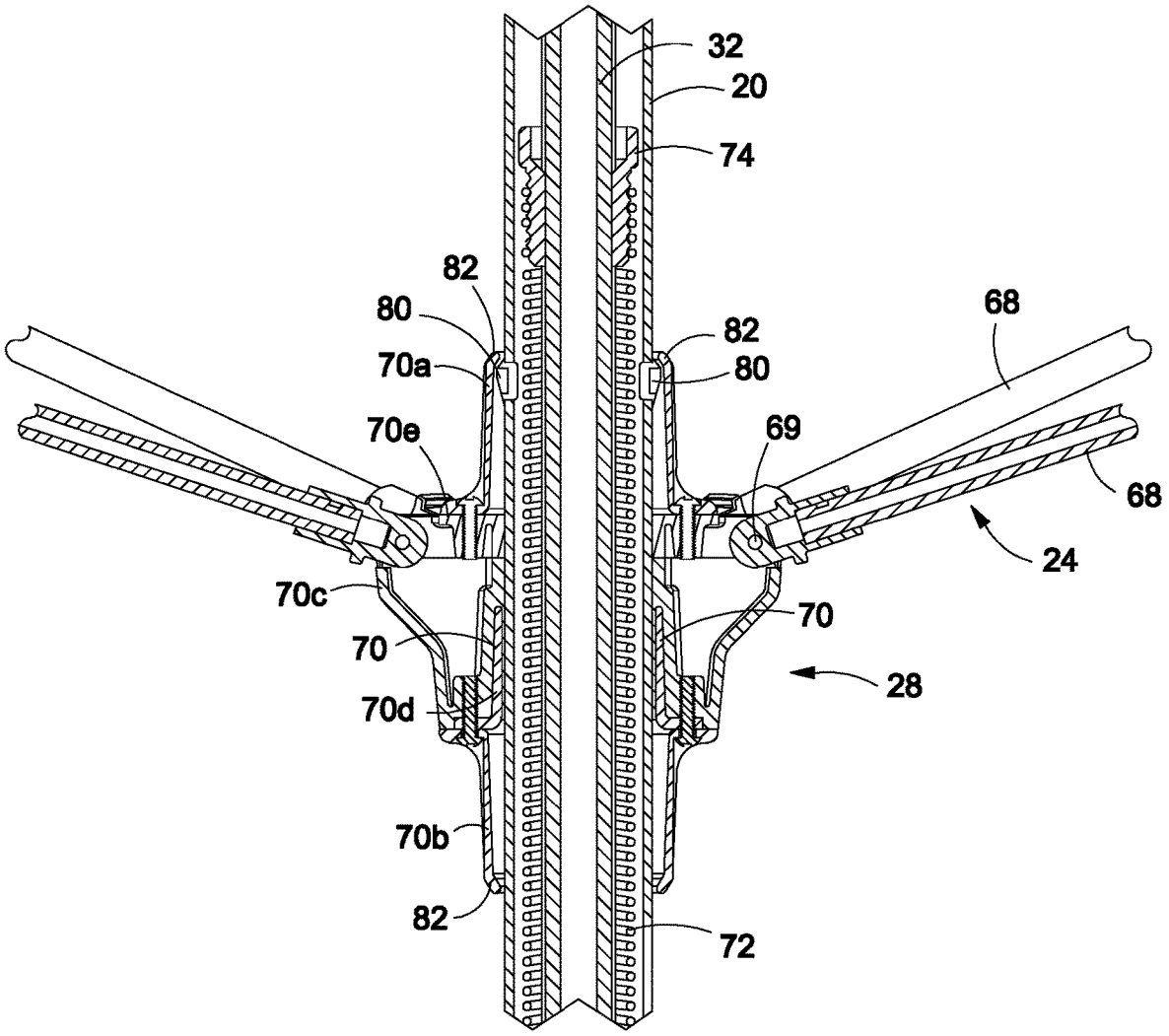
FIG. 13 is a close up side cut-away elevation view of the umbrella frame of FIG. 12, in accordance with one or more embodiments; the view showing the center tube and the counterbalance assembly positioned within the rotating tube, the view showing the umbrella frame in an open position, the view showing the elongated teeth in the lower hub that mesh with the helical grooves in the exterior surface of the rotating tube, the view showing the lower hub engaged with the detents in the exterior surface of the rotating tube which help to hold the umbrella frame in an open position.

Detents 80 can be formed out of any device or feature in the rotating tube 20 that helps hold lower hub 28 in place, thereby overcoming the force of either the counterbalance assembly 62 or the force of the umbrella frame 24. In one or more arrangements, as is shown in FIG. 13 for example, detents 80 include a single feature that protrudes out of the exterior surface of rotating tube 20. In this example arrangement, as the umbrella frame 24 reaches the position of detent 80, the fingers 82 at the end of lower hub 28 stretch and fit around the single feature of the detents 80, thereby holding the umbrella frame 24 in place on the detent. This arrangement is considered a single-position detent.

Figure 14:
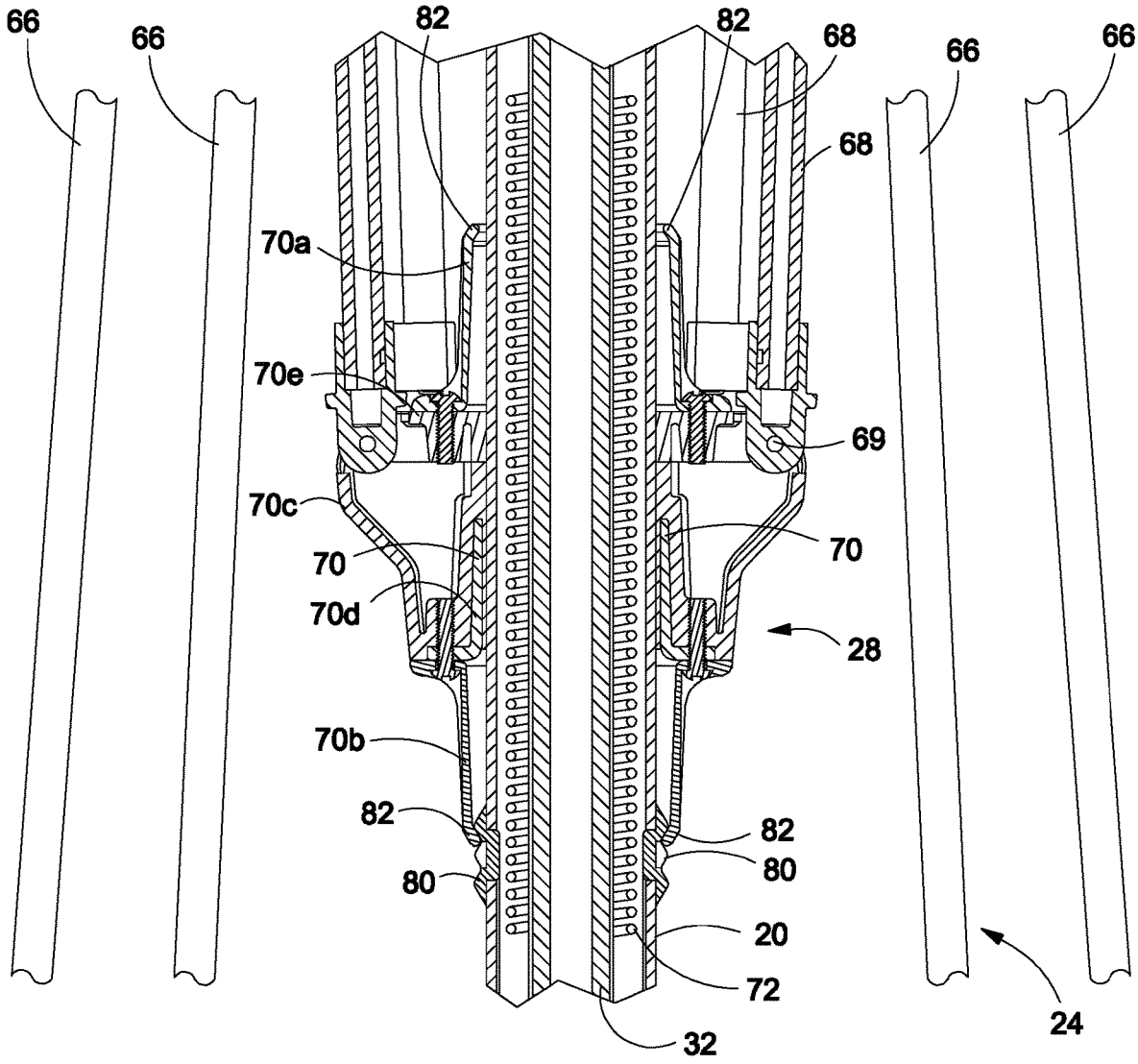
FIG. 14 is a close up side cut-away elevation view of the umbrella frame, in accordance with one or more embodiments; the view showing the center tube and the counterbalance assembly positioned within the rotating tube, the view showing the umbrella frame in a closed position, the view showing the elongated teeth in the lower hub that mesh with the helical grooves in the exterior surface of the rotating tube, the view showing the lower hub engaged with the detents in the exterior surface of the rotating tube which help to hold the umbrella frame in a closed position.
Figure 15:
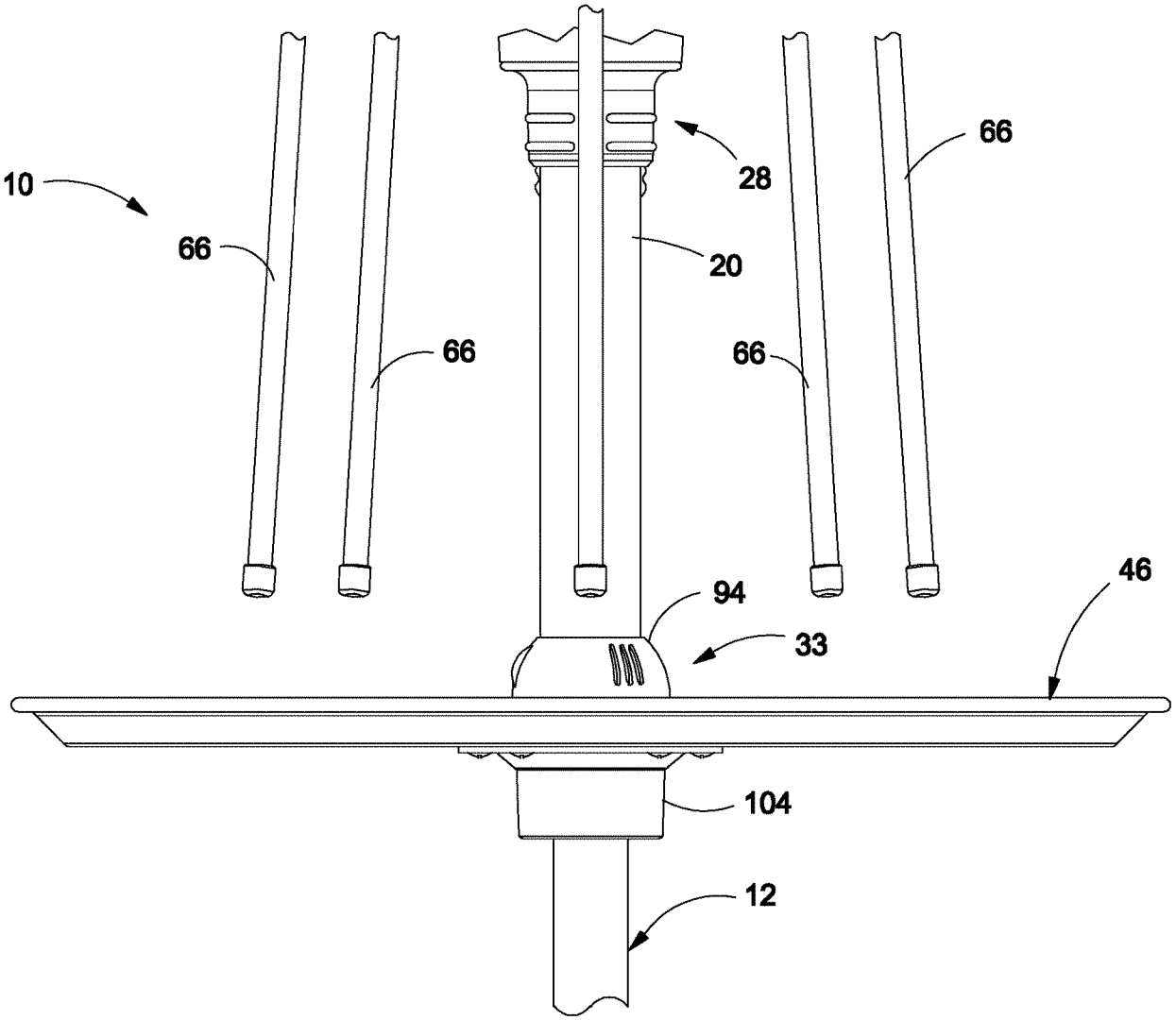
FIG. 15 is a side elevation view of the lower end of the rotating tube, in accordance with one or more embodiments; the view showing the lower bearing assembly, the support pole, a table connected to the system and the view showing the lower hub engaged with detents that help to hold the umbrella frame in a closed position.
Figure 16:
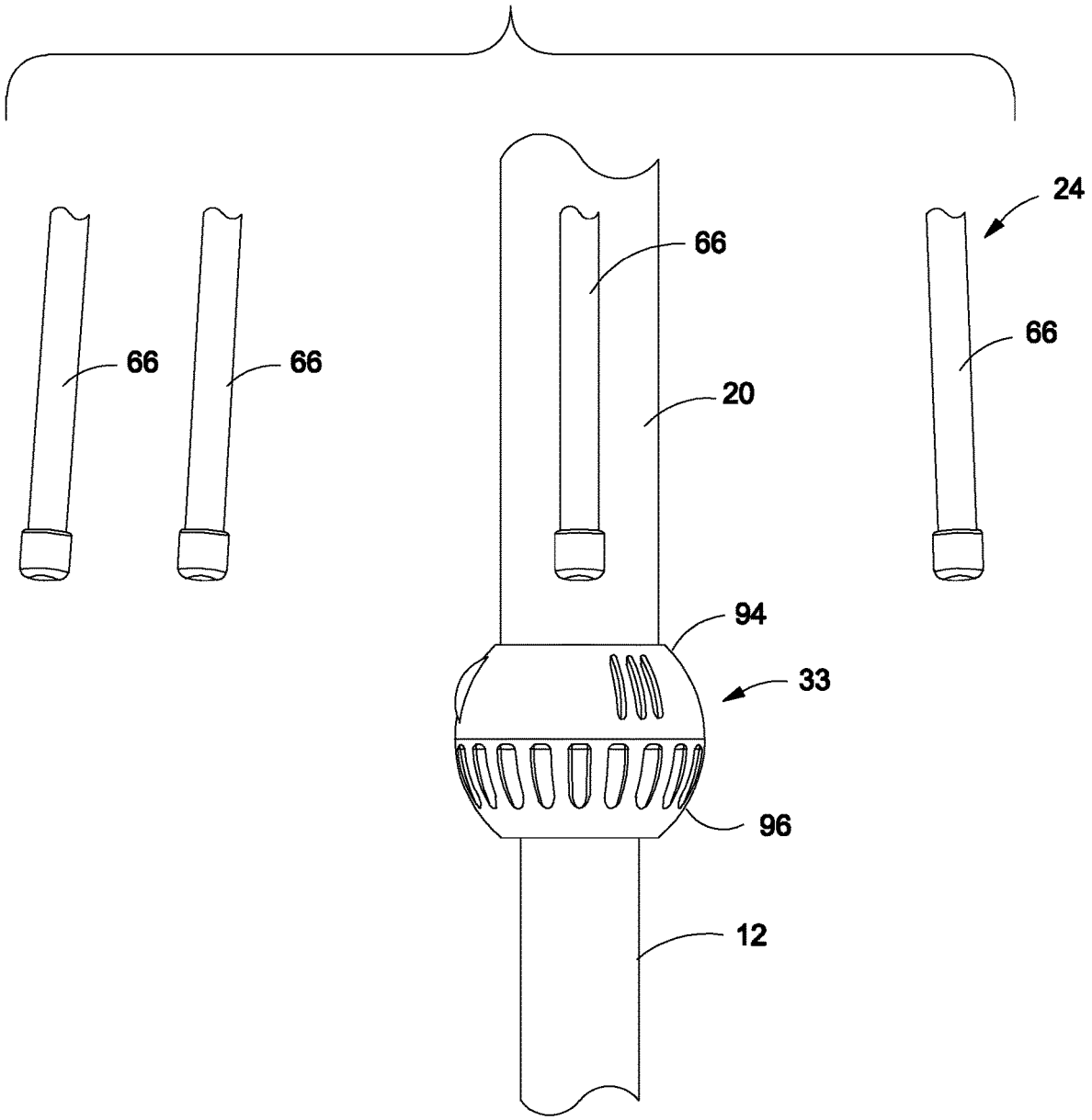
FIG. 16 is a side elevation view of the lower end of the rotating tube, the view showing the lower bearing assembly and the support pole without a table connected to the system, in accordance with one or more embodiments; the view showing the umbrella frame in a closed position.
Figure 17:
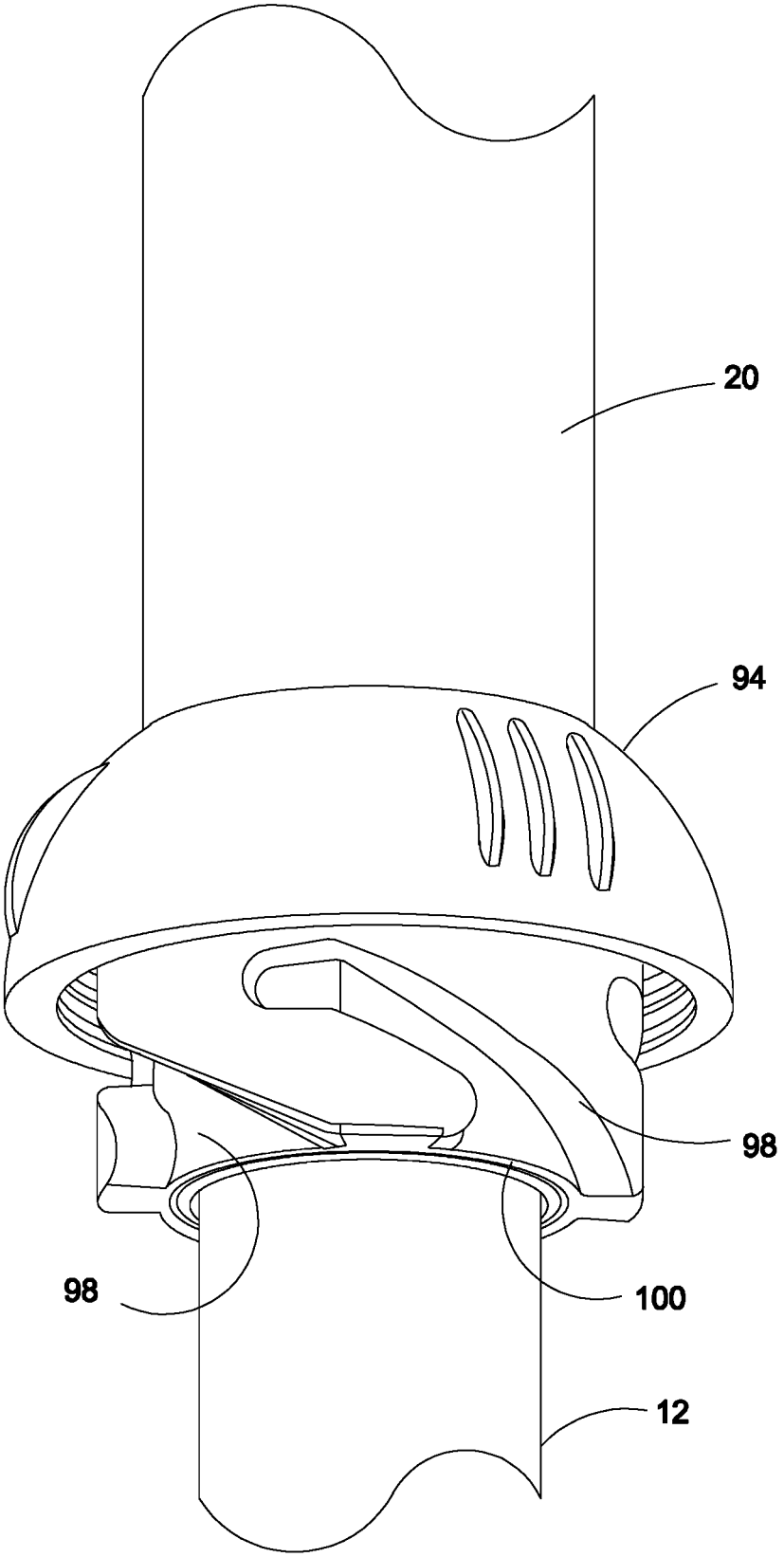
FIG. 17 is a close up side perspective view of the lower end of the rotating tube, the view showing the lower bearing assembly and the support pole without a table connected to the system, in accordance with one or more embodiments; the view showing a connection mechanism in the lower bearing assembly, which is in this case a plurality of grooves, that are configured to facilitate connection of a table to the system.
Figure 18:
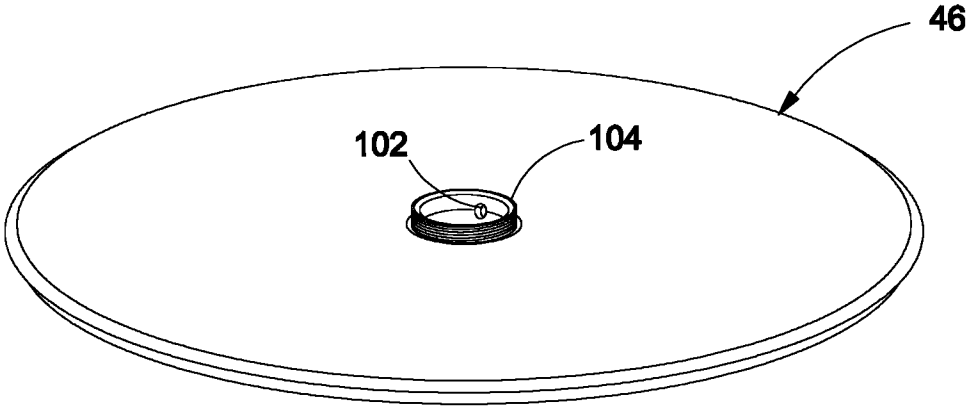
FIG. 18 is a perspective view of a table configured to be attached to the system, in accordance with one or more embodiments.
Figure 19:
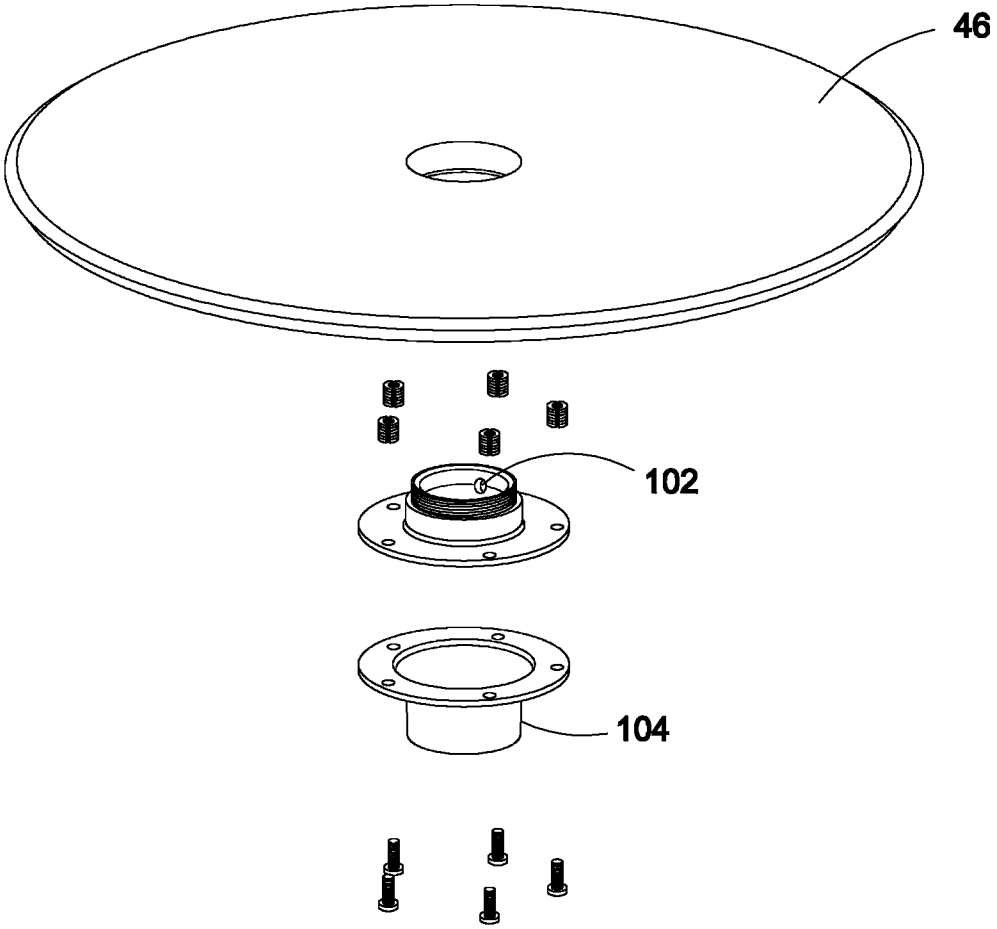
FIG. 19 is an exploded perspective view of the table of FIG. 18, in accordance with one or more embodiments.
Figure 20:
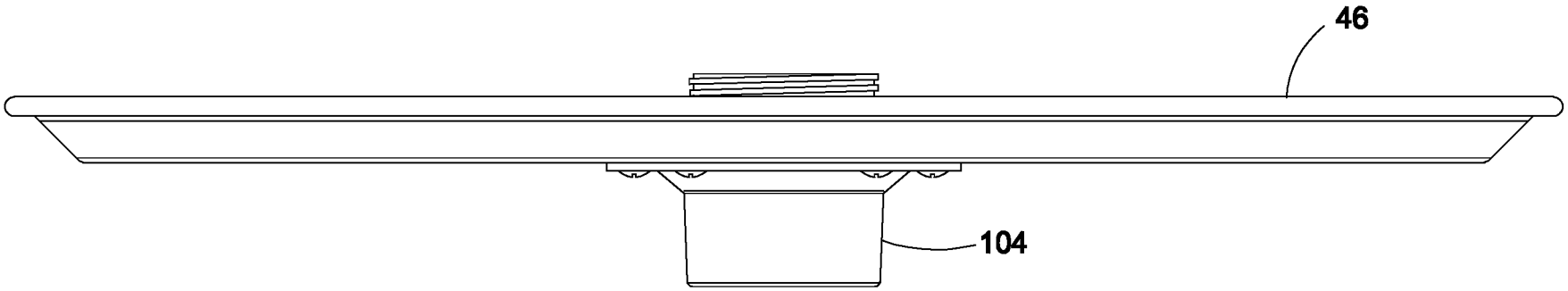
FIG. 20 is a side elevation view of the table of FIGS. 18 and 19, in accordance with one or more embodiments.
Figure 21:
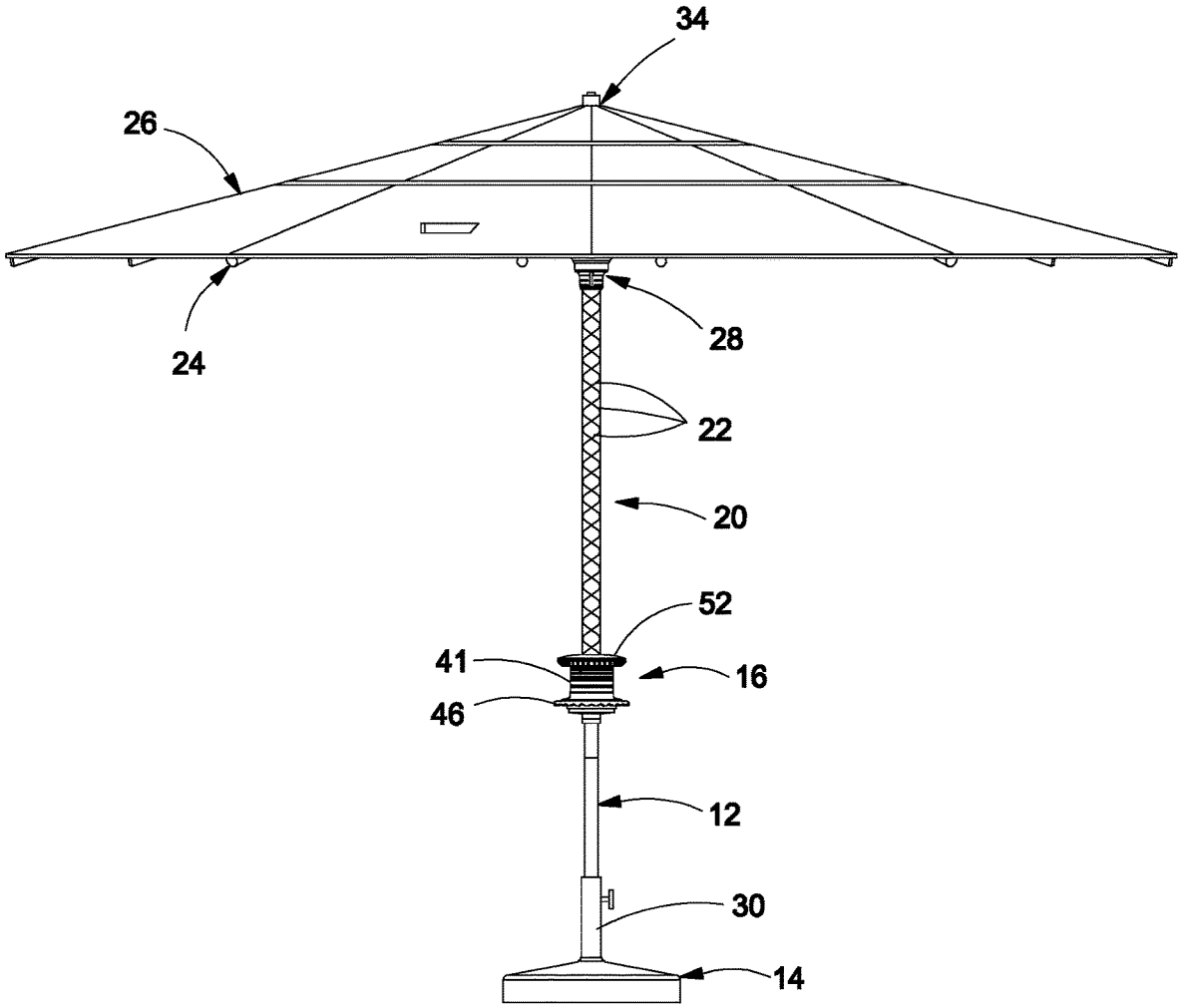
FIG. 21 is a side elevation view of the umbrella system of FIGS. 1-20 with the addition of a motor housing assembly that facilitates motorized opening and closing of the umbrella frame, in accordance with one or more embodiments.
Figure 22:
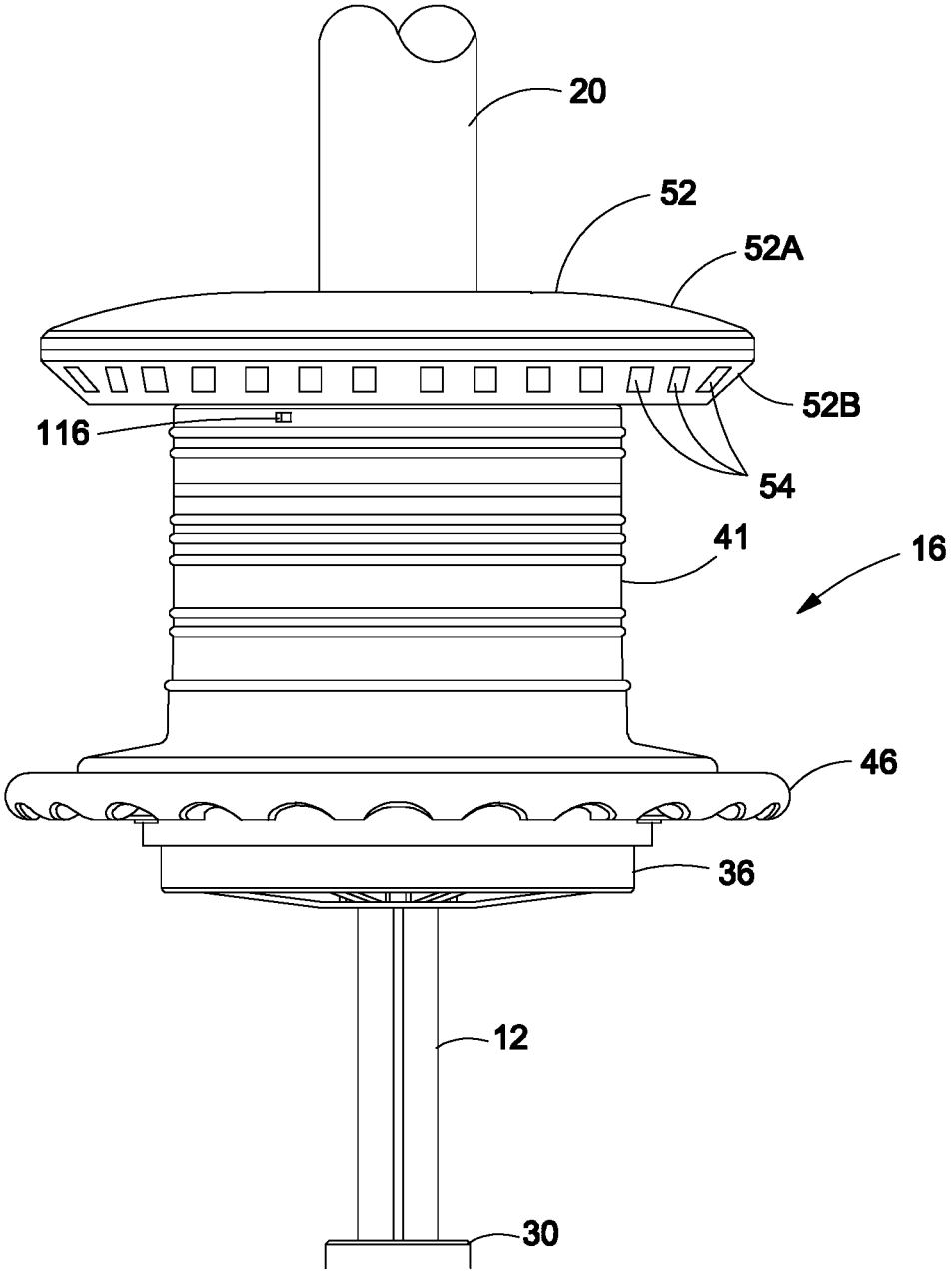
FIG. 22 is a close up side elevation view of the motor housing assembly of FIG. 21, in accordance with one or more embodiments; the view showing the rotating tube, the support pole, the container, the switch, the cover and the stationary gear.
Figure 23:
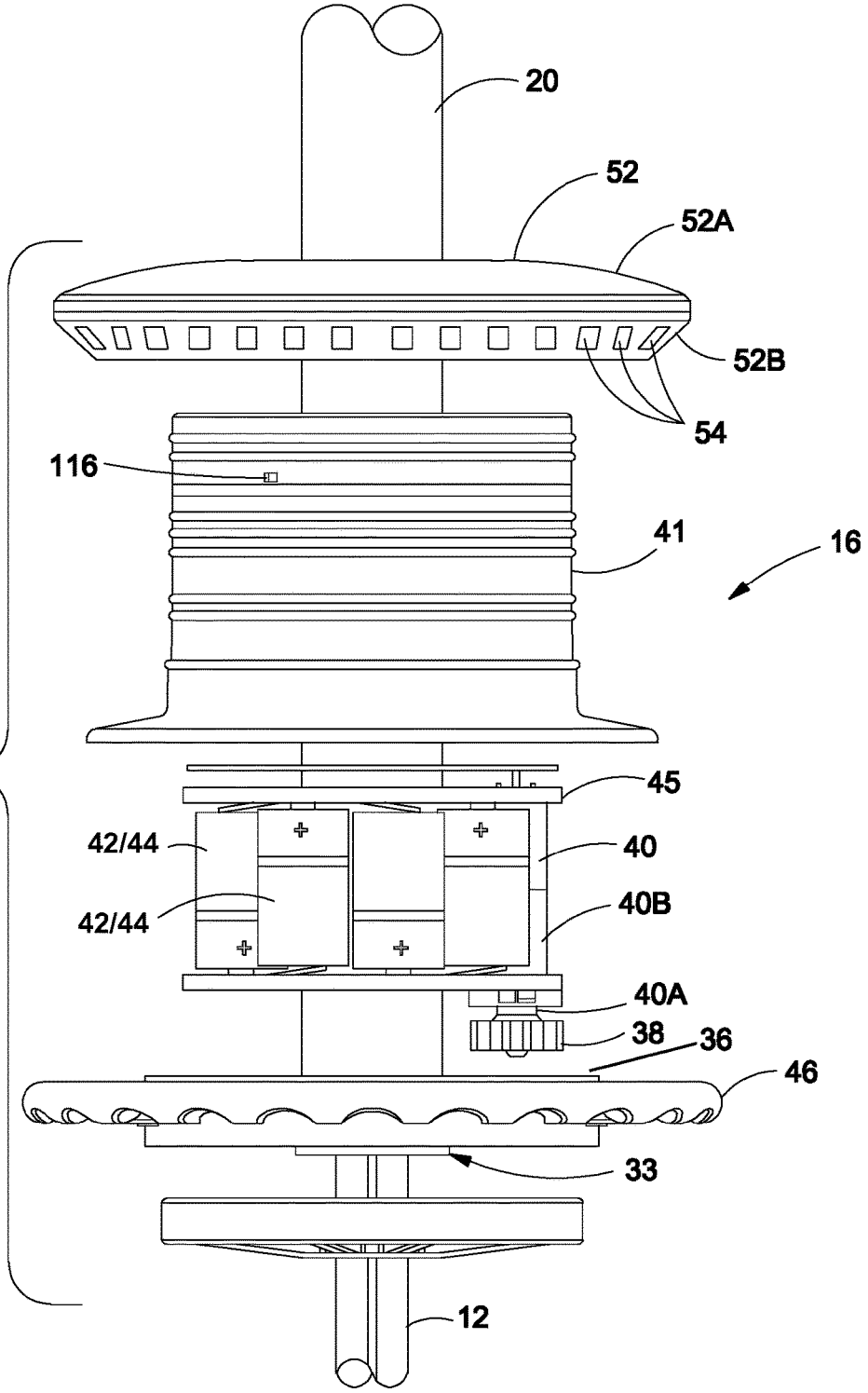
FIG. 23 is a close up exploded elevation view of the motor housing assembly of FIGS. 21 and 22, in accordance with one or more embodiments; the view showing the rotating tube, the cover, the container, the battery holder that holds a plurality of batteries as well as the motor having a gear assembly, drive shaft and driven gear, and the stationary gear.
Figure 24:
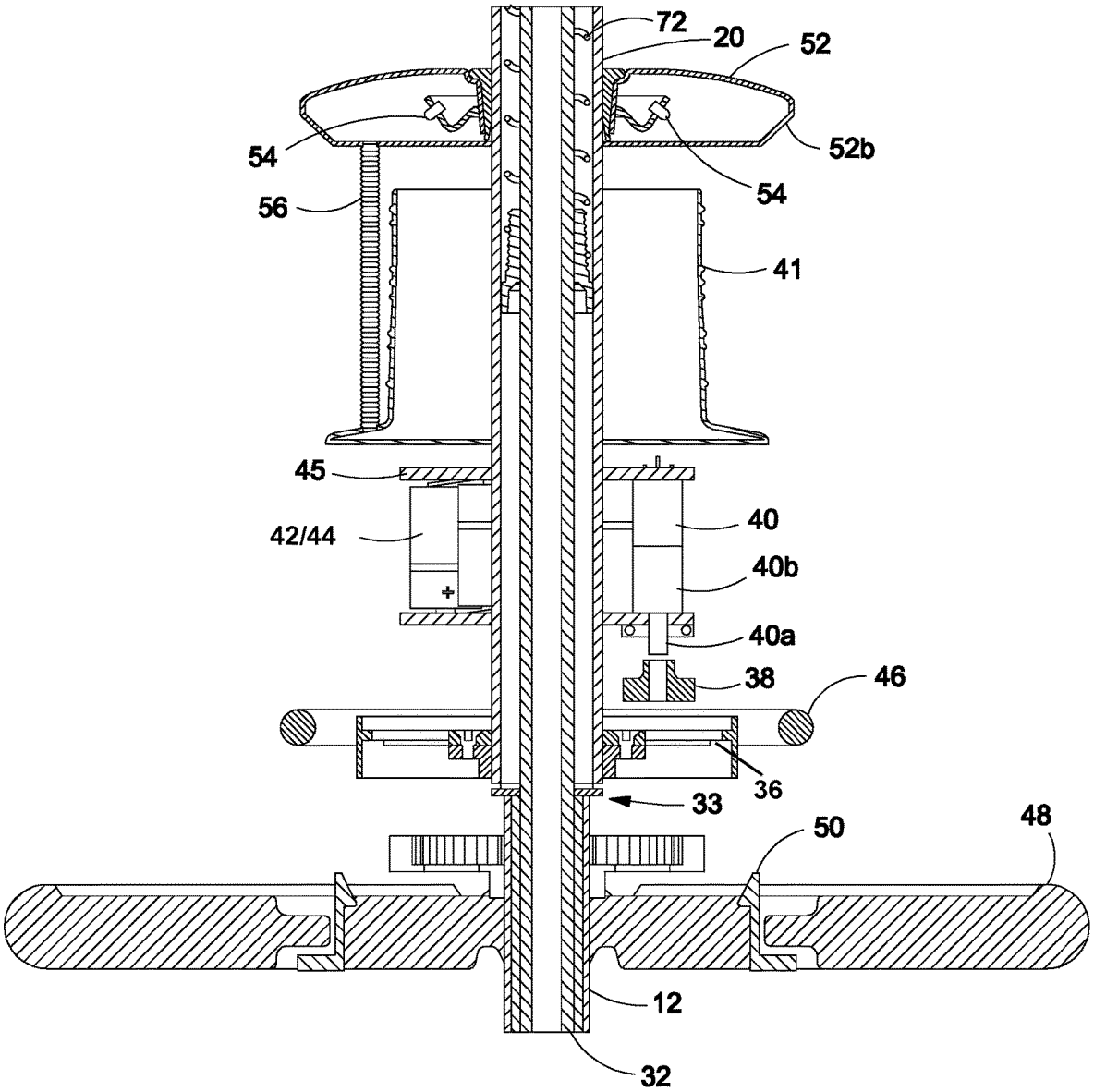
FIG. 24 is a close-up side cut away elevation view of the motor housing assembly of FIGS. 21-23, in accordance with one or more embodiments; the view showing the rotating tube, the cover having lighting elements with the cover in a raised state and connected to the container by a cord, the view showing the container, the battery holder that holds a plurality of batteries as well as the motor having a gear assembly, drive shaft and driven gear; the view showing the table and the stationary gear; the view also showing a table extension connected by clips to the table.
Figure 25:
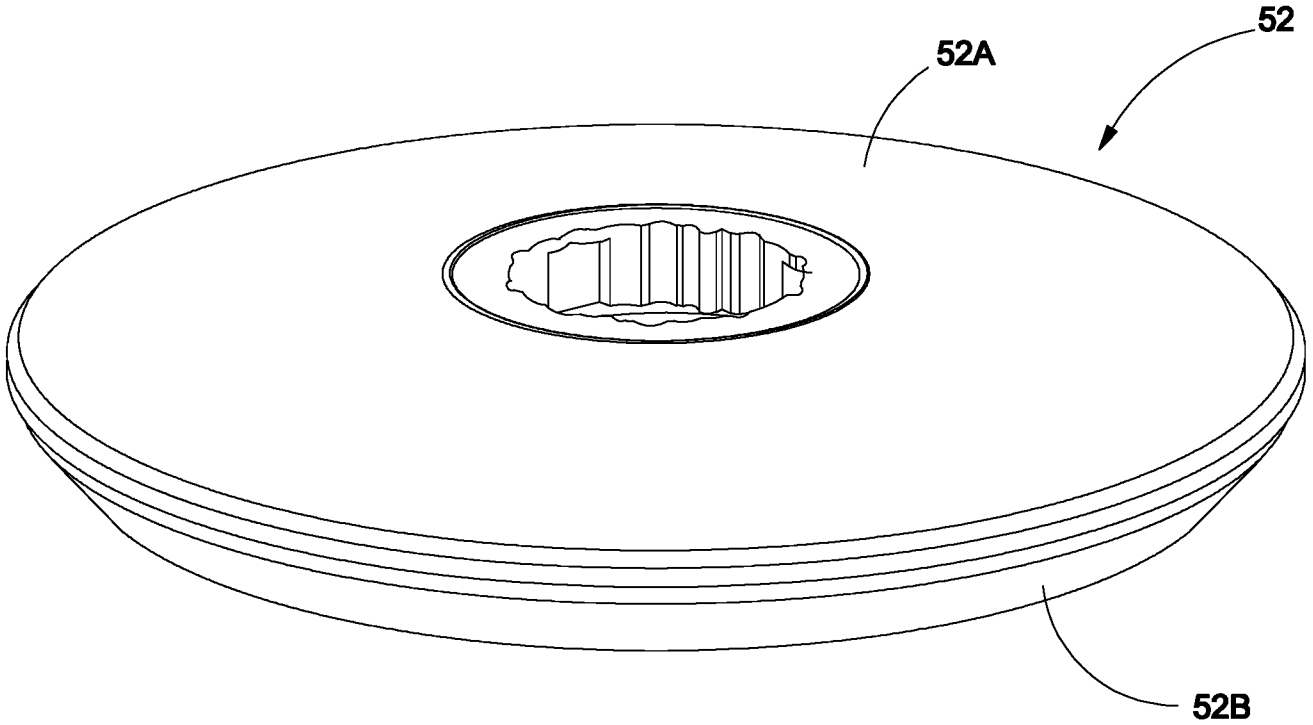
FIG. 25 is a perspective view of the cover of FIGS. 21-24, in accordance with one or more embodiments.
Figure 26:
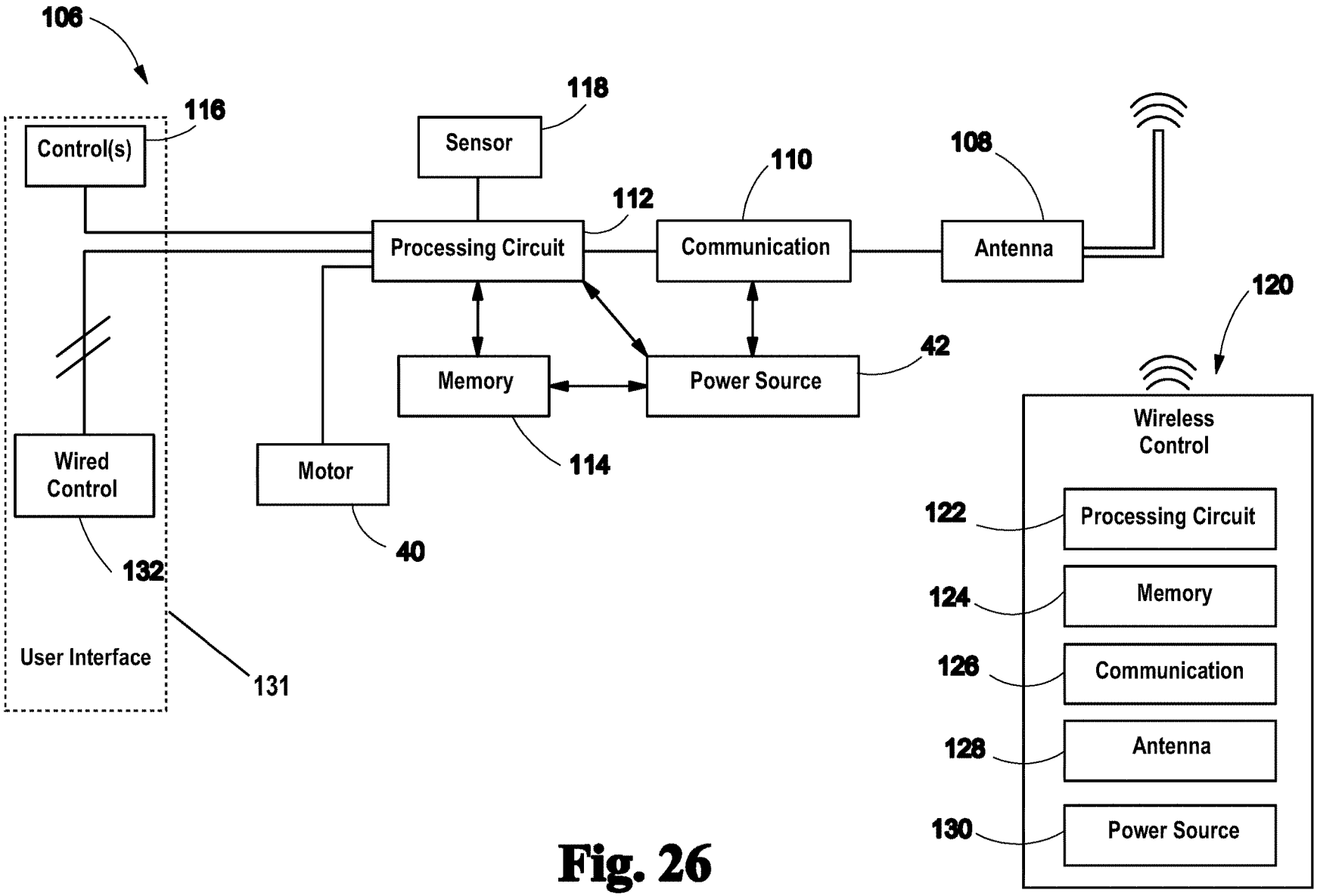
FIG. 26 is a plan view of the electronics of the system for use in an umbrella system, in accordance with one or more embodiments; the view showing the processing circuit, memory, radio, antenna and power source (which can be an on board power source such as a plurality of batteries, or an external power source such as wired connection to external power), in accordance with one or more embodiments; the view also showing a wireless control, such as a conventional remote or a cell phone, tablet or any other control device capable of transmitting wireless control signals.
Figure 27:
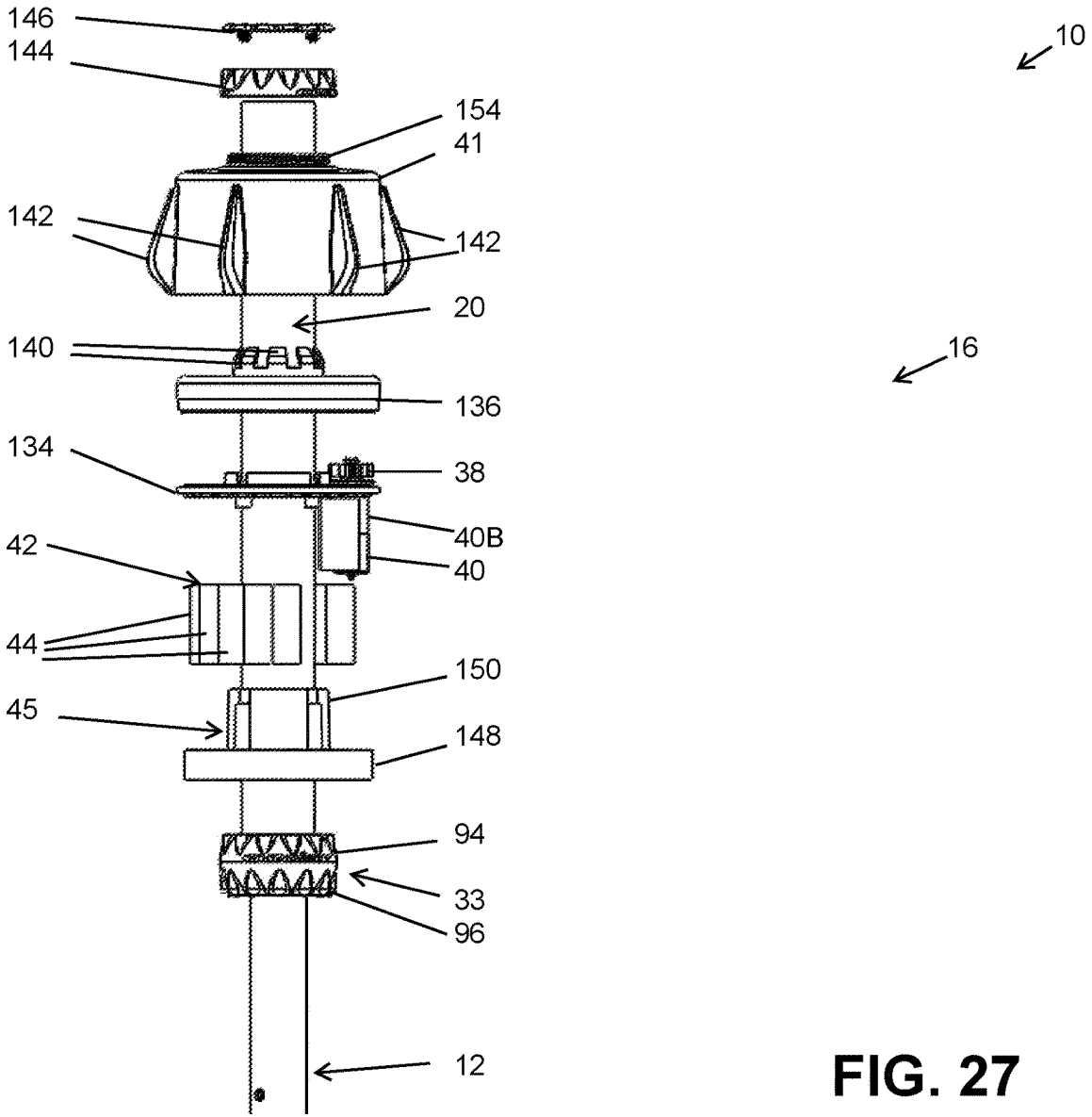
FIG. 27 is an exploded elevation view of an alternative arrangement of a motorized umbrella system, in accordance with one or more embodiments.
Figure 28:
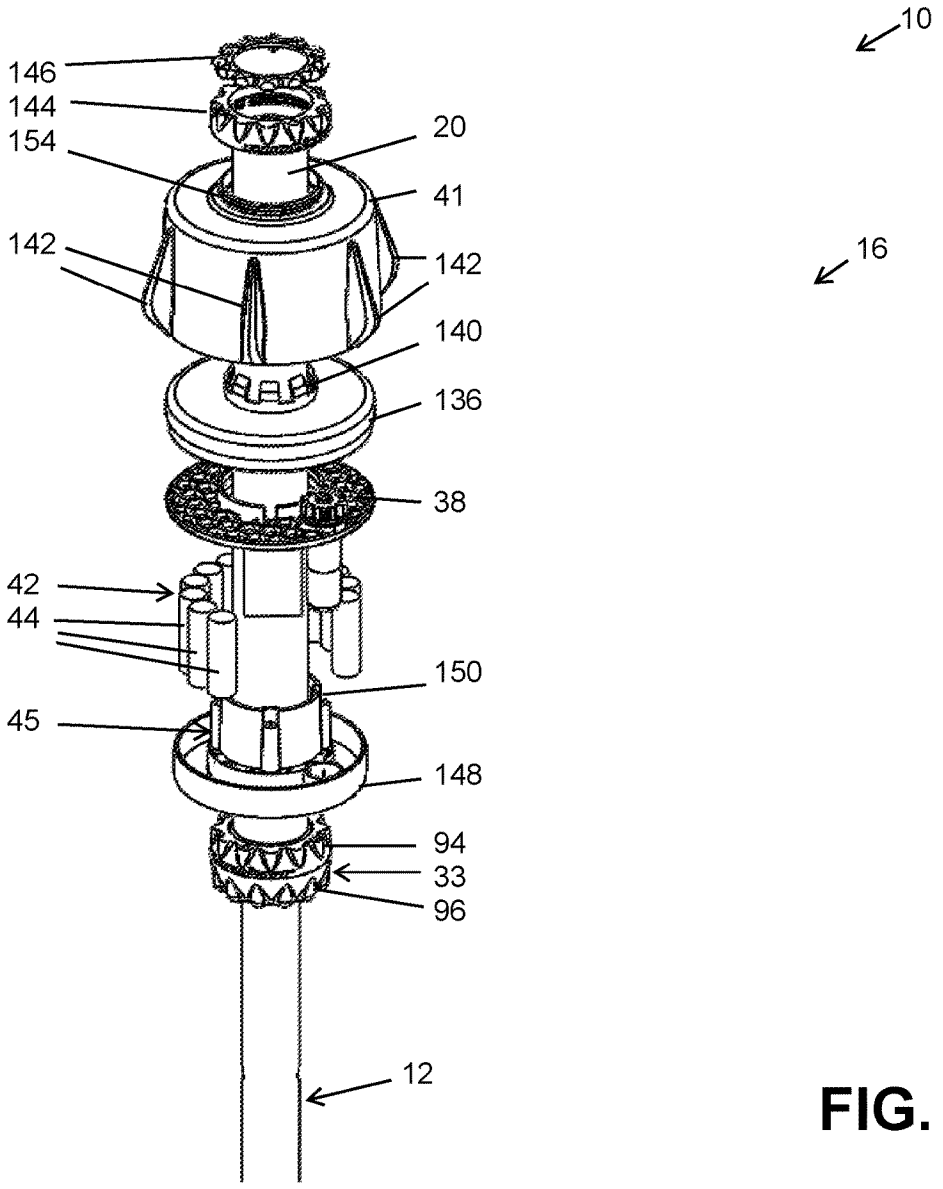
FIG. 28 is an exploded upper perspective view of the alternative arrangement of a motorized umbrella system shown in FIG. 27, in accordance with one or more embodiments.
Figure 29:
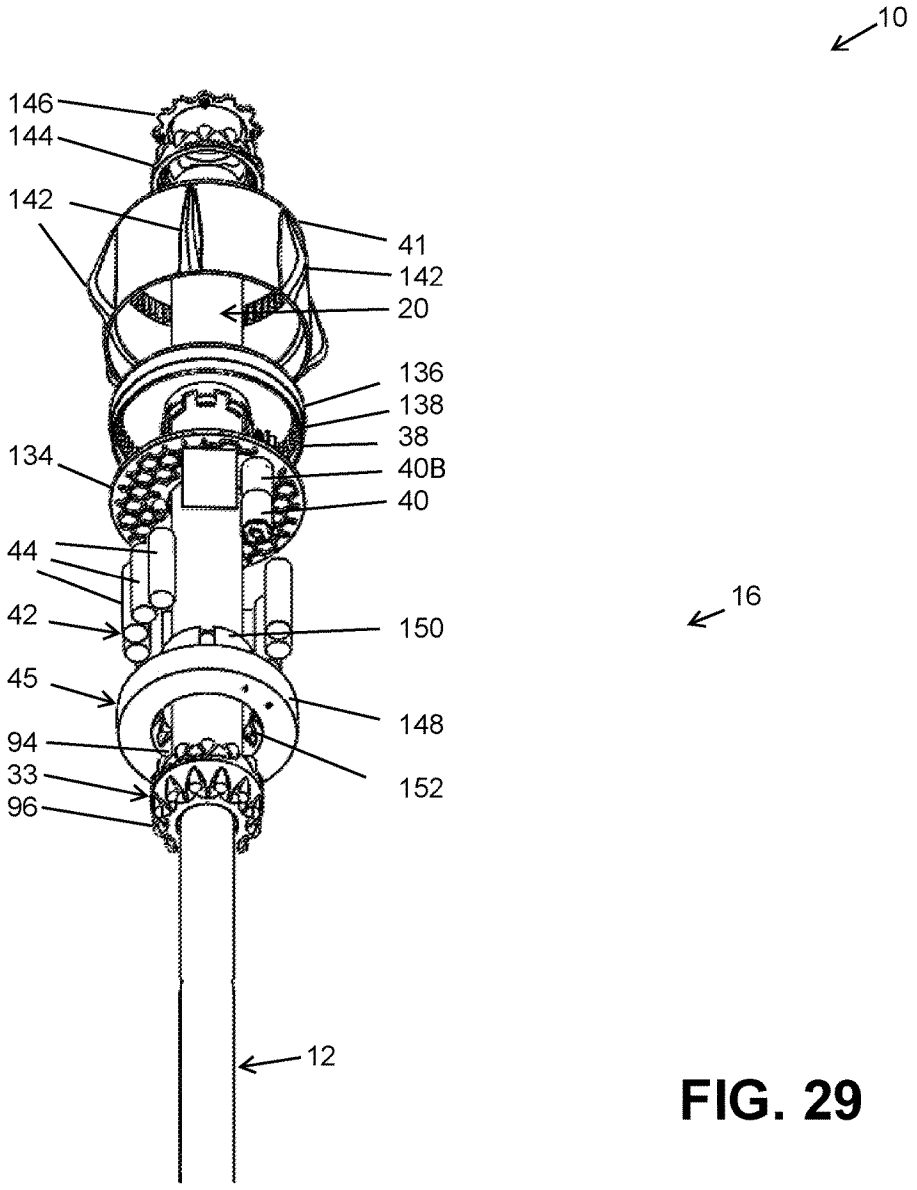
FIG. 29 is another exploded lower perspective view of the alternative arrangement of a motorized umbrella system shown in FIGS. 27 and 28, in accordance with one or more embodiments.
Figure 30:
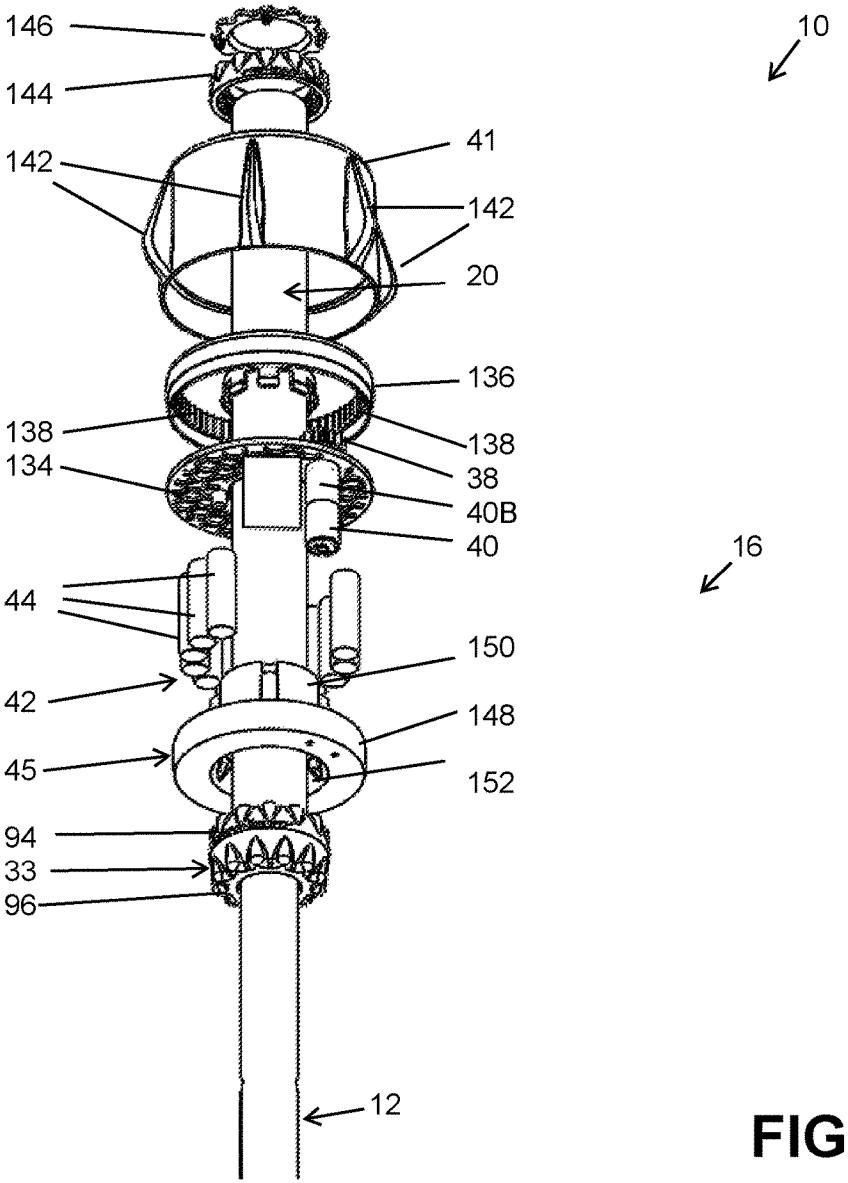
FIG. 30 is another exploded lower perspective view of the alternative arrangement of a motorized umbrella system shown in FIGS. 27-29, in accordance with one or more embodiments.
Figure 31:
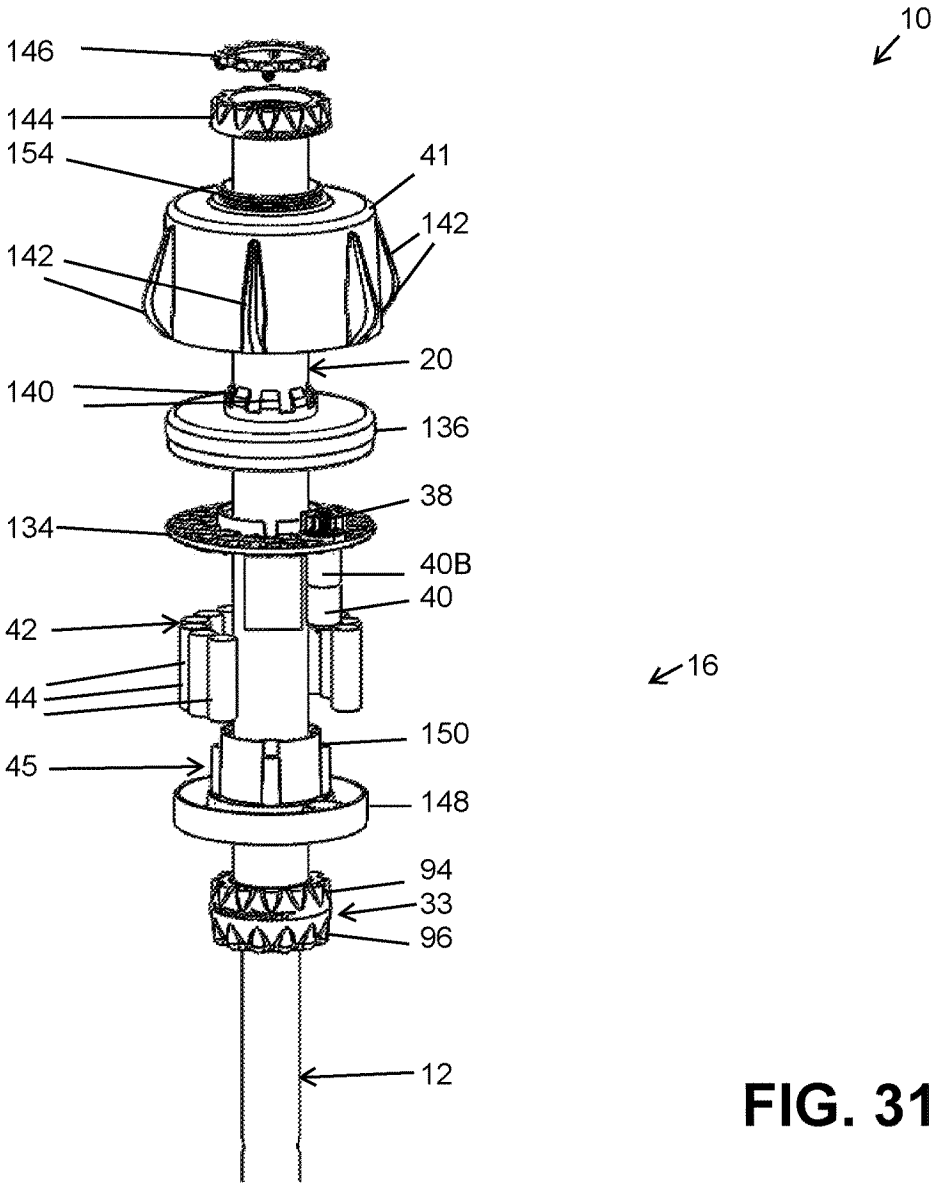
FIG. 31 is another exploded upper perspective view of the alternative arrangement of a motorized umbrella system shown in FIGS. 27-30, in accordance with one or more embodiments.
Figure 32:
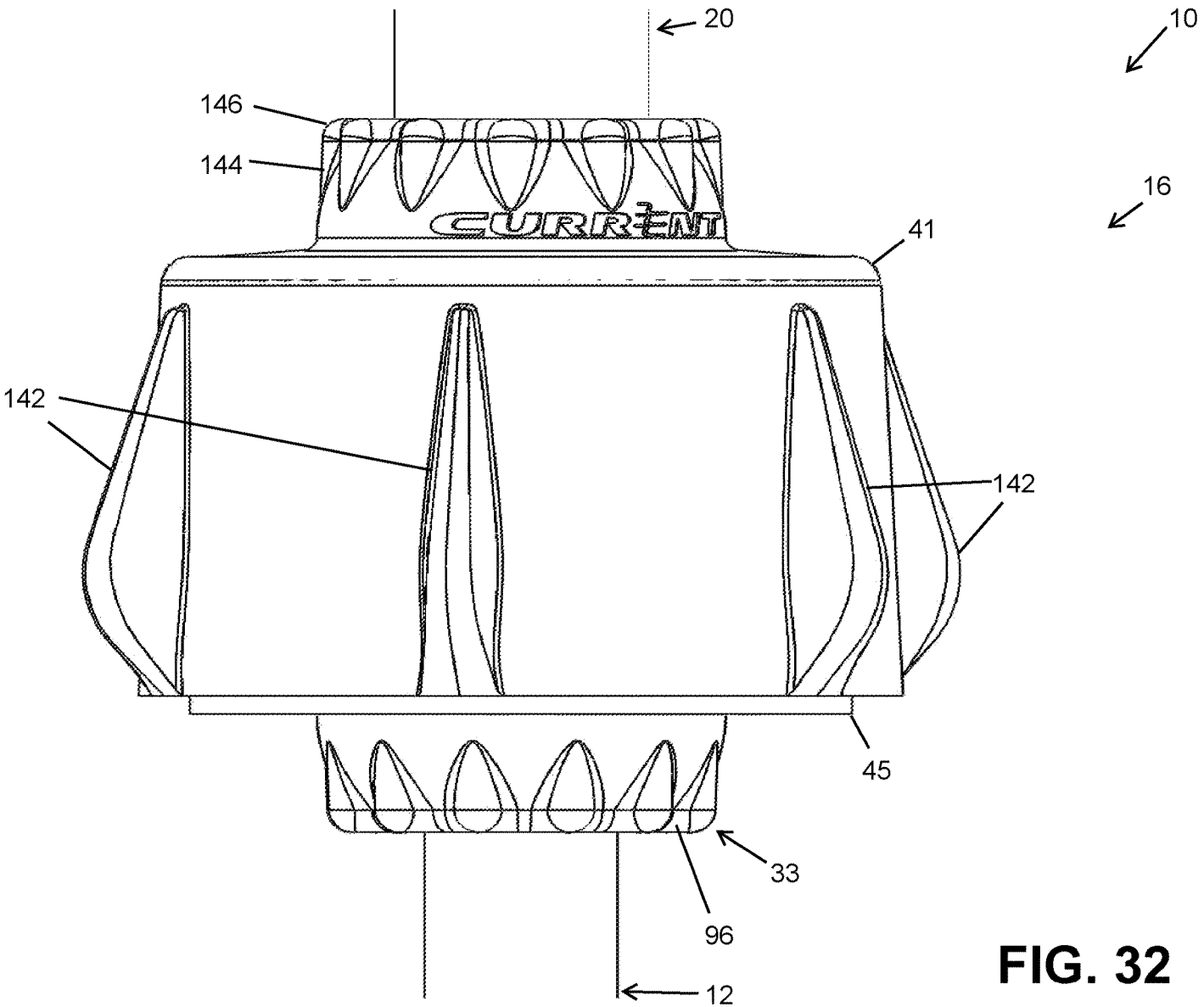
FIG. 32 is an assembled elevation view of the alternative arrangement of a motorized umbrella system shown in FIGS. 27-31, in accordance with one or more embodiments.
Figure 33:
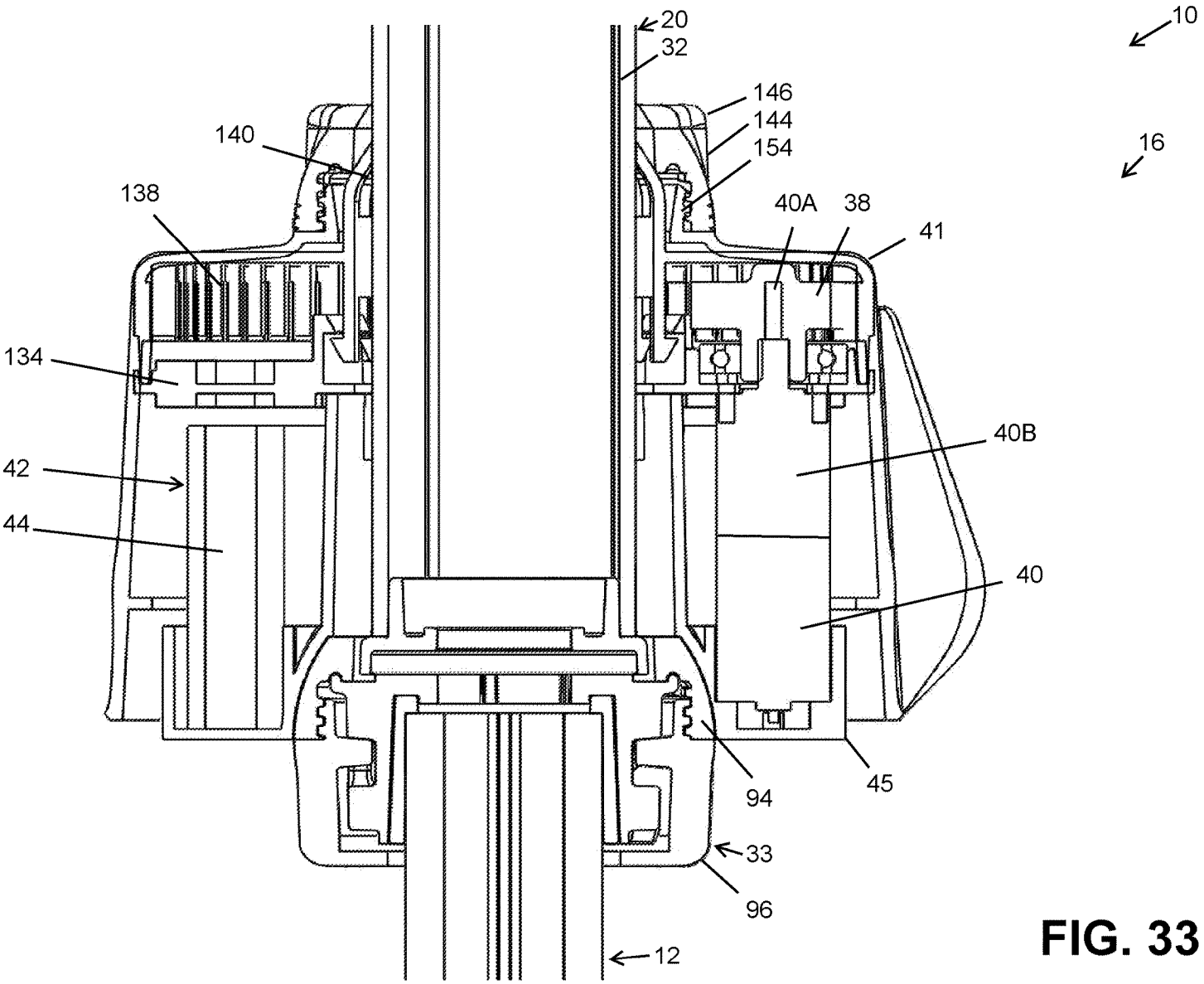
FIG. 33 is an assembled section view of the alternative arrangement of a motorized umbrella system shown in FIGS. 27-32, in accordance with one or more embodiments; the section view taken down the axis of rotation of the rotating tube.
Figure 34:
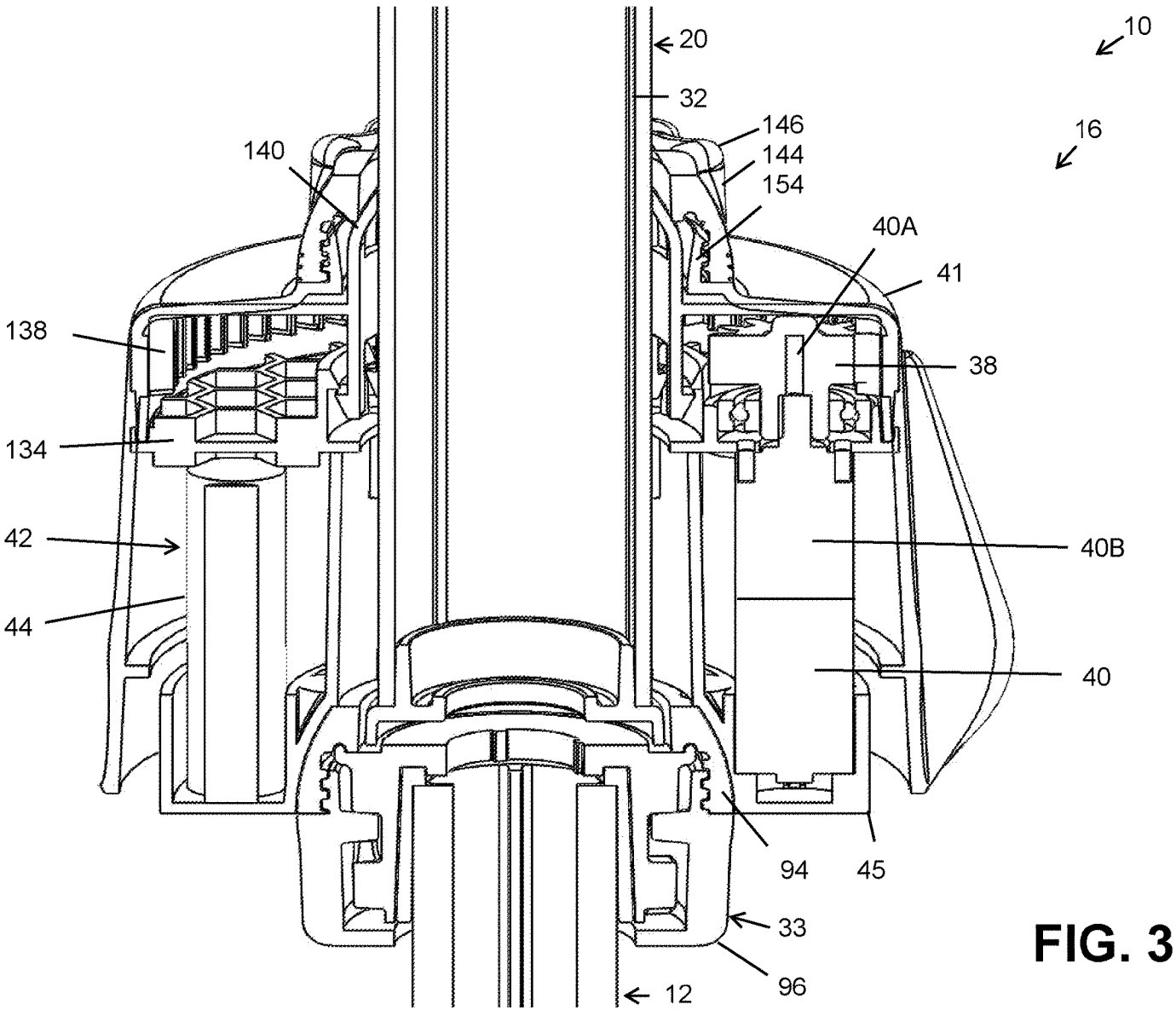
FIG. 34 is an assembled section view of the alternative arrangement of a motorized umbrella system shown in FIGS. 27-33, in accordance with one or more embodiments; the section view taken at an angle to the axis of rotation of the rotating tube.
Figure 35:
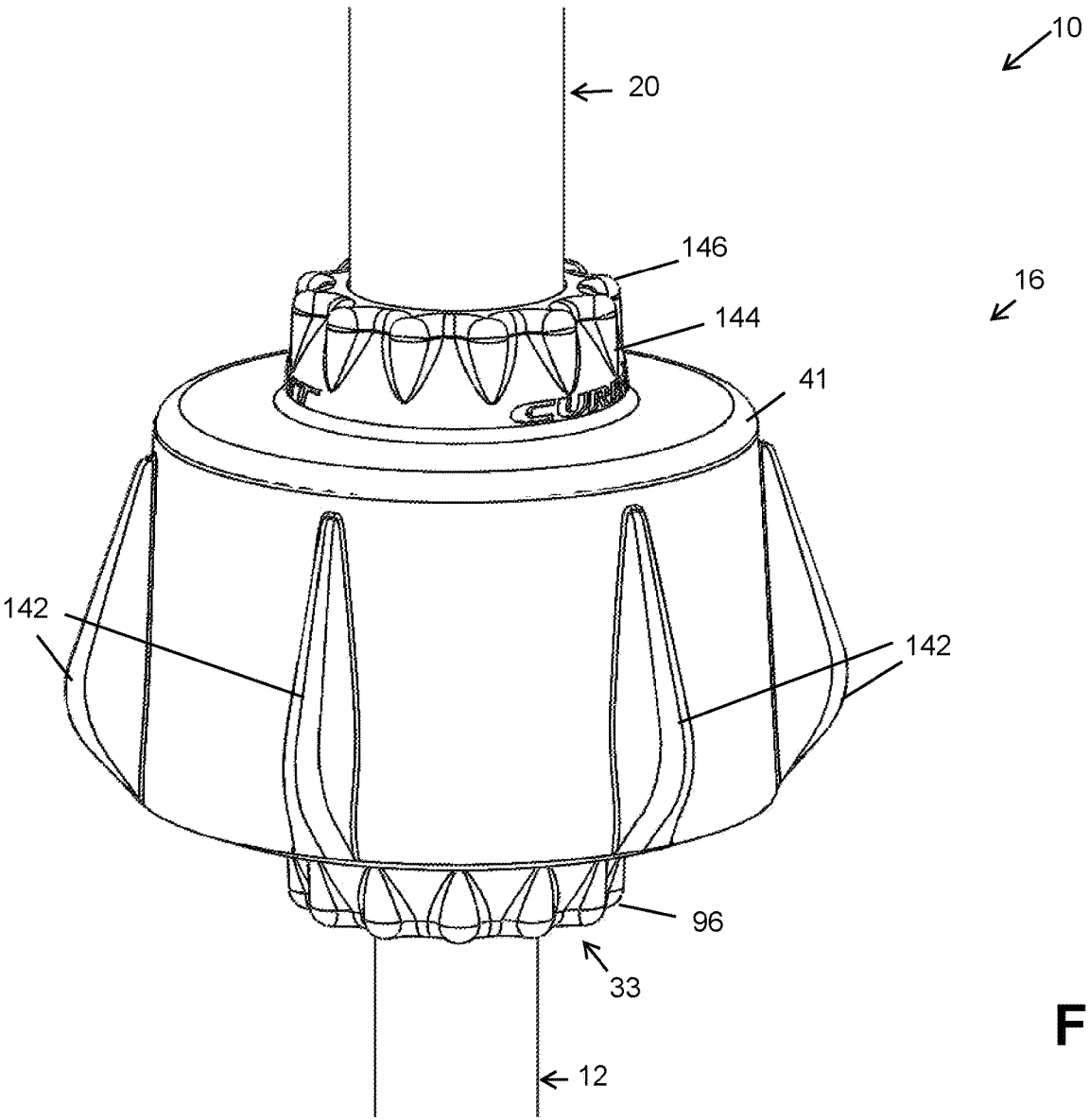
FIG. 35 is an assembled upper perspective view of the alternative arrangement of a motorized umbrella system shown in FIGS. 27-34, in accordance with one or more embodiments.
Figure 36:
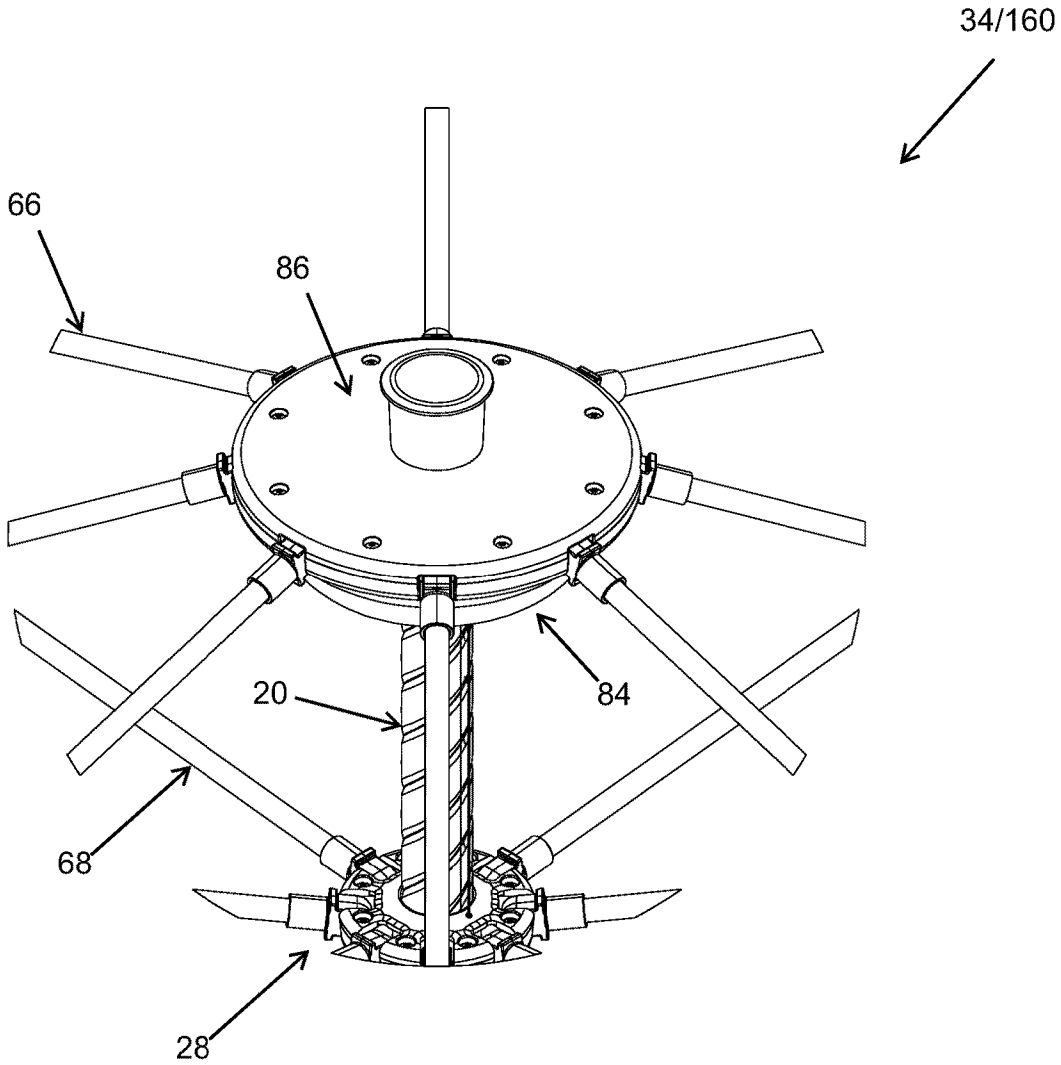
FIG. 36 is an assembled upper perspective view of a central support of an umbrella frame and counterbalance assembly, in accordance with one or more embodiments.
Figure 37:
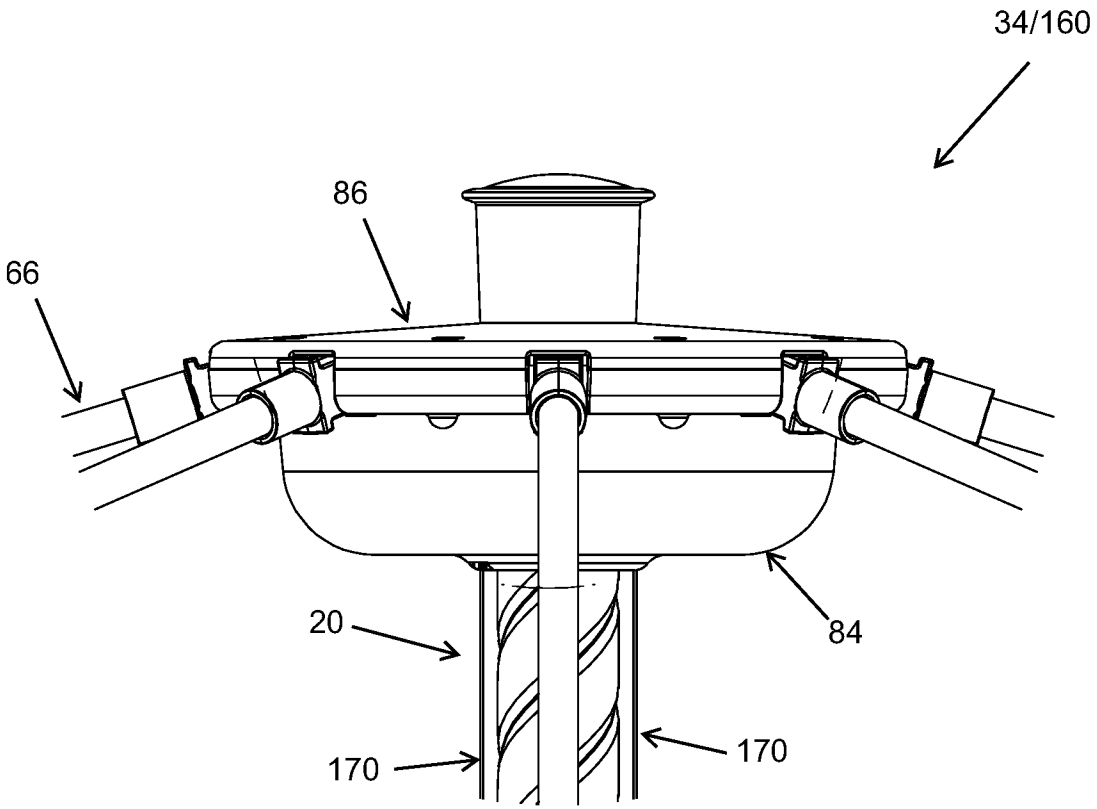
FIG. 37 is a side assembled view of the central support of the umbrella frame and the counterbalance assembly shown in FIG. 36, in accordance with one or more embodiments.
Figure 38:
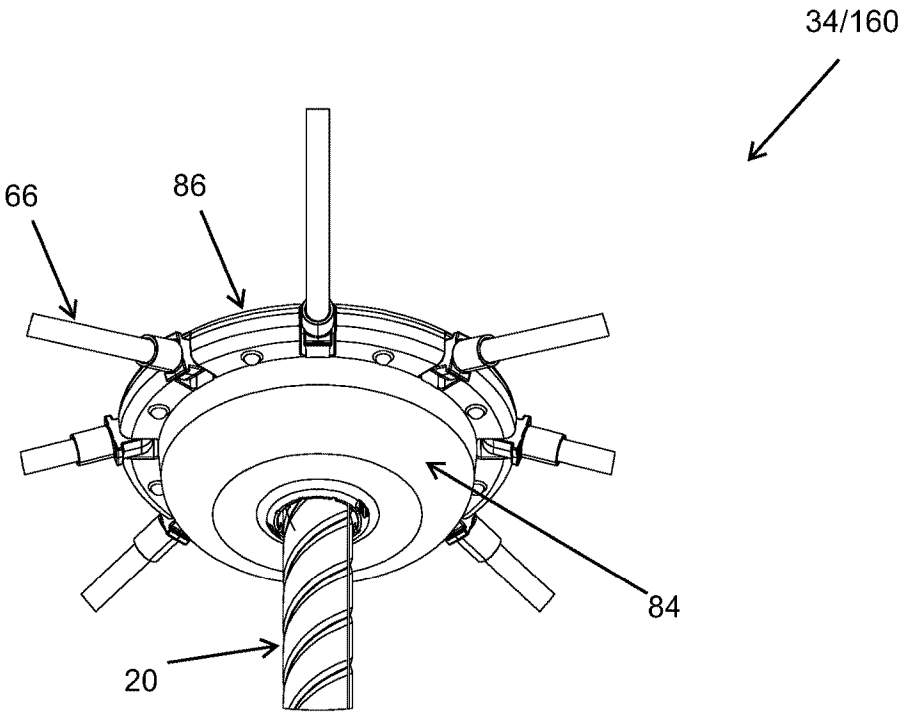
FIG. 38 is a lower assembled perspective view of the central support of the umbrella frame and the counterbalance assembly shown in FIG. 36, in accordance with one or more embodiments.
Figure 39:
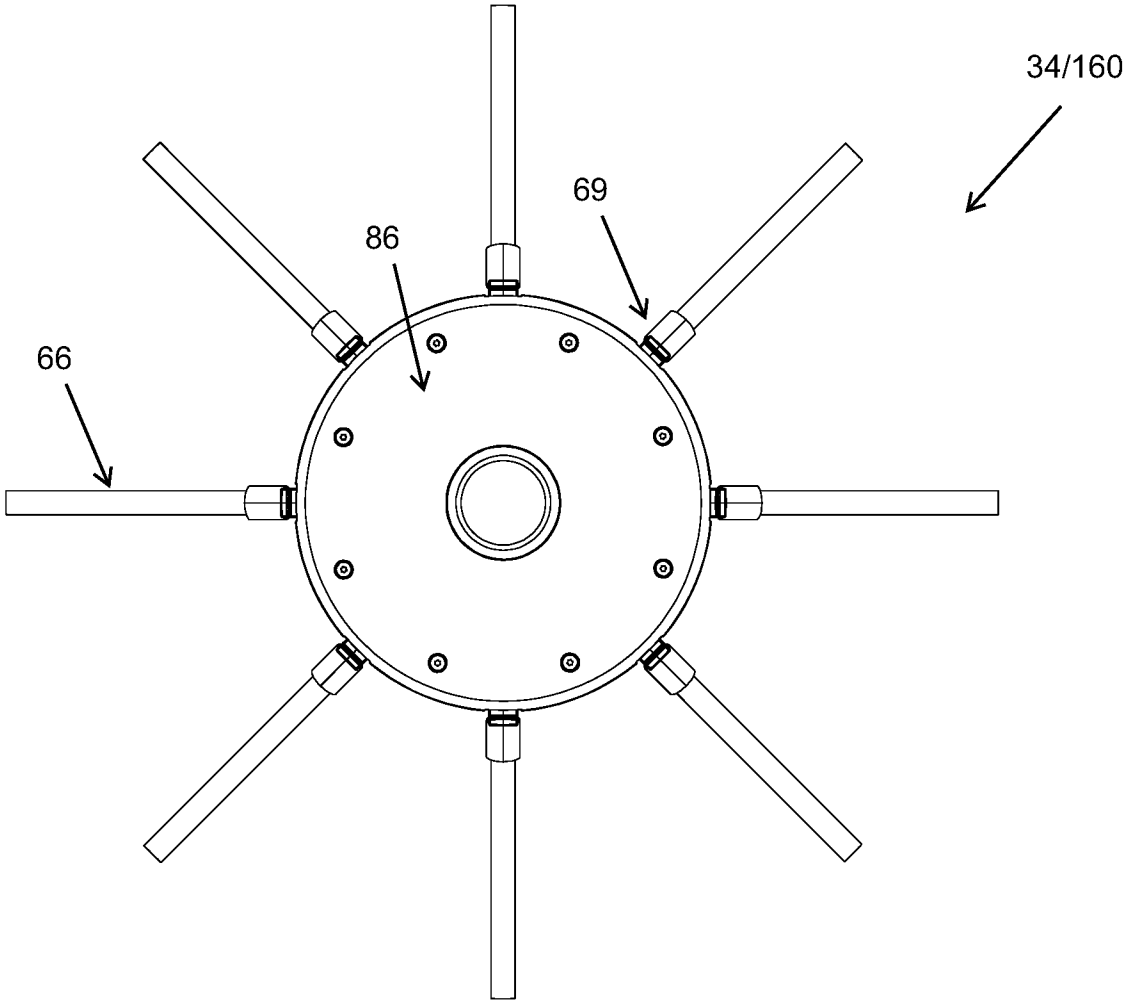
FIG. 39 is a top view of the central support of the umbrella frame and the counterbalance assembly shown in FIG. 36, in accordance with one or more embodiments.
Figure 40:
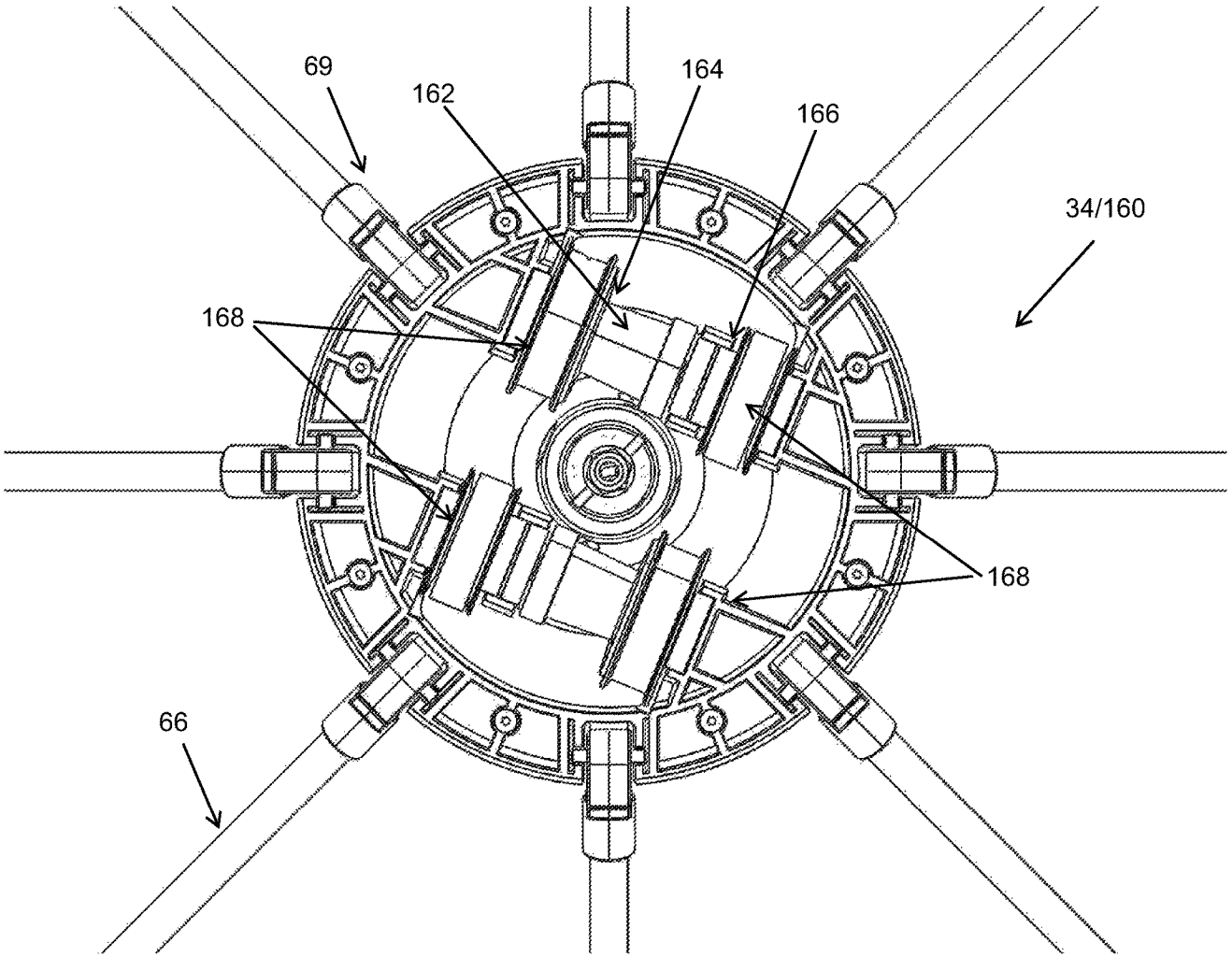
FIG. 40 is a top view of the central support of the umbrella frame and the counterbalance assembly shown in FIG. 36, in accordance with one or more embodiments; the view showing a cover of the central support omitted.
Figure 41:
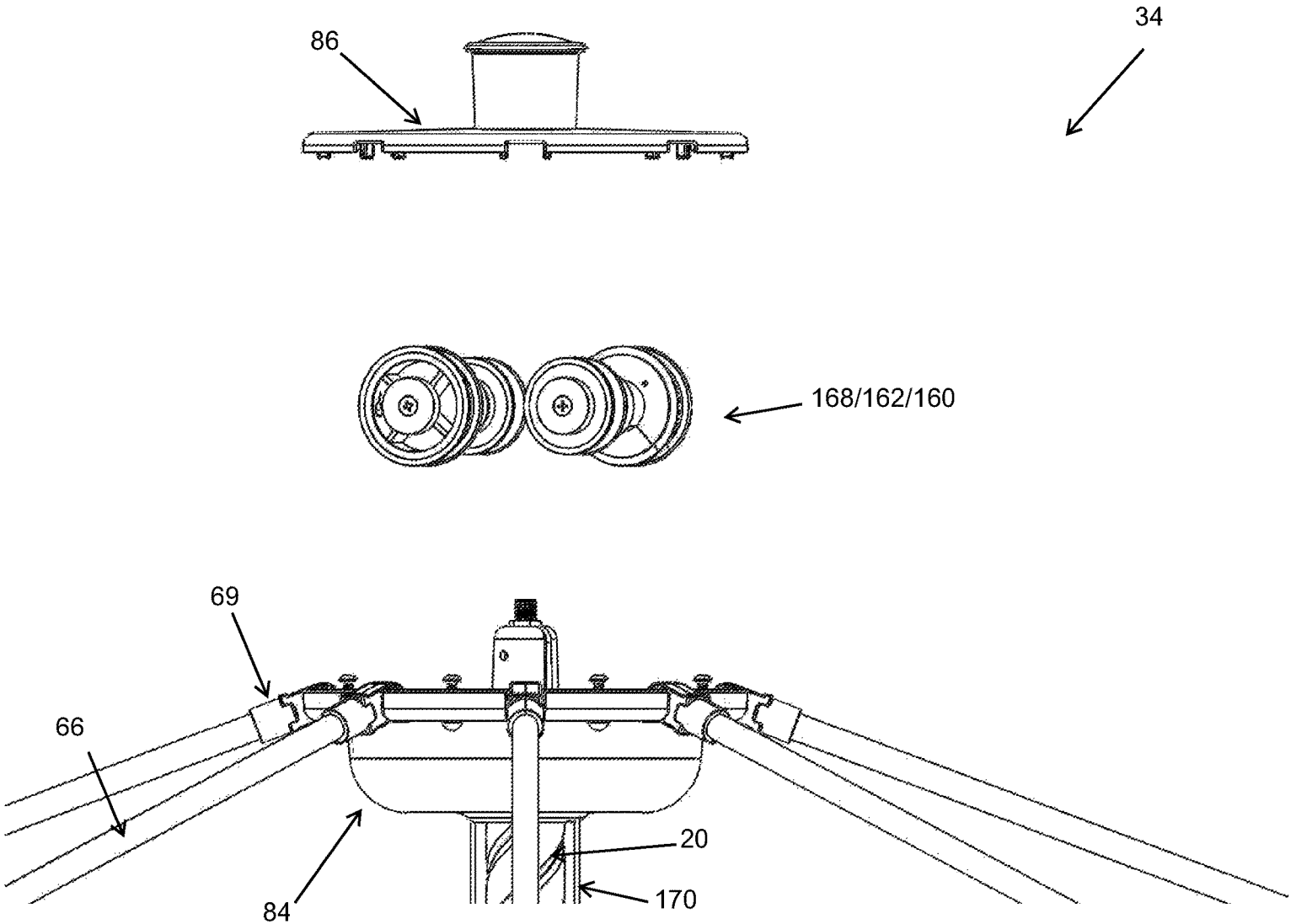
FIG. 41 is a front exploded view of the central support of the umbrella frame and the counterbalance assembly shown in FIG. 36, in accordance with one or more embodiments.
Figure 42:
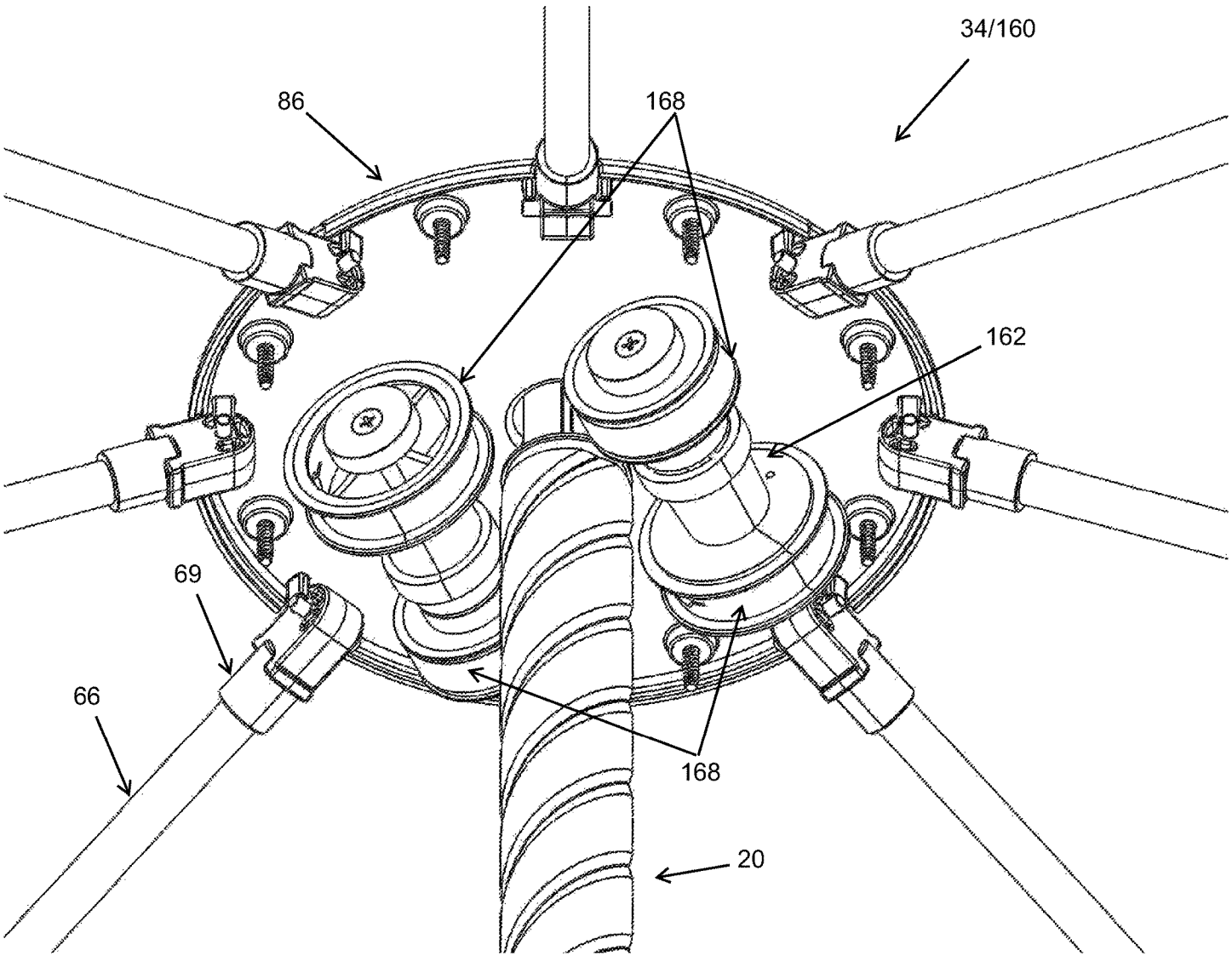
FIG. 42 is a lower perspective view of the central support of the umbrella frame and the counterbalance assembly shown in FIG. 36, in accordance with one or more embodiments; the view showing a collar of the central support omitted.
Figure 43:
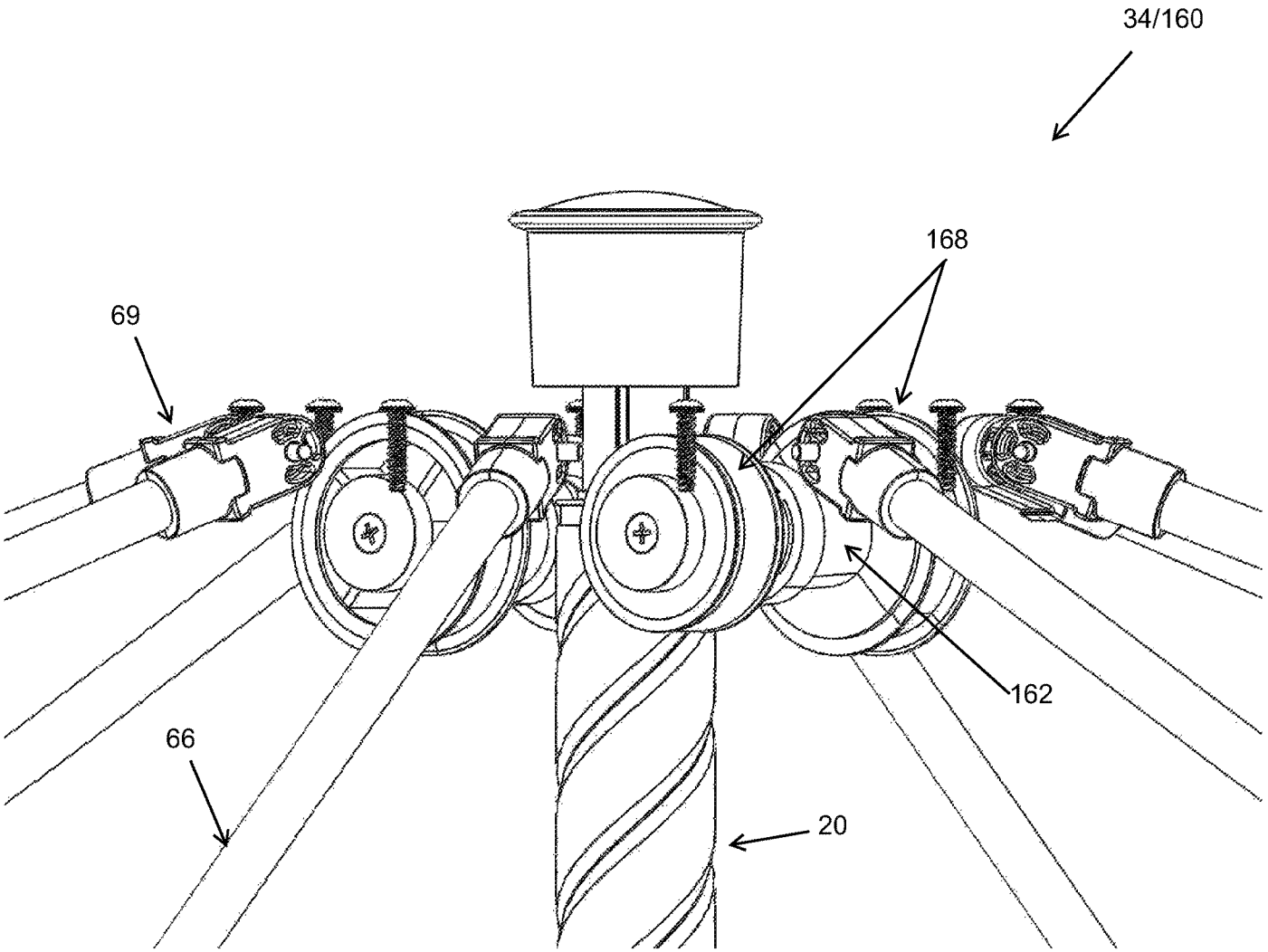
FIG. 43 is a side view of the central support of the umbrella frame and the counterbalance assembly shown in FIG. 36, in accordance with one or more embodiments; the view showing a cover and a collar of the central support omitted.
Figure 44:
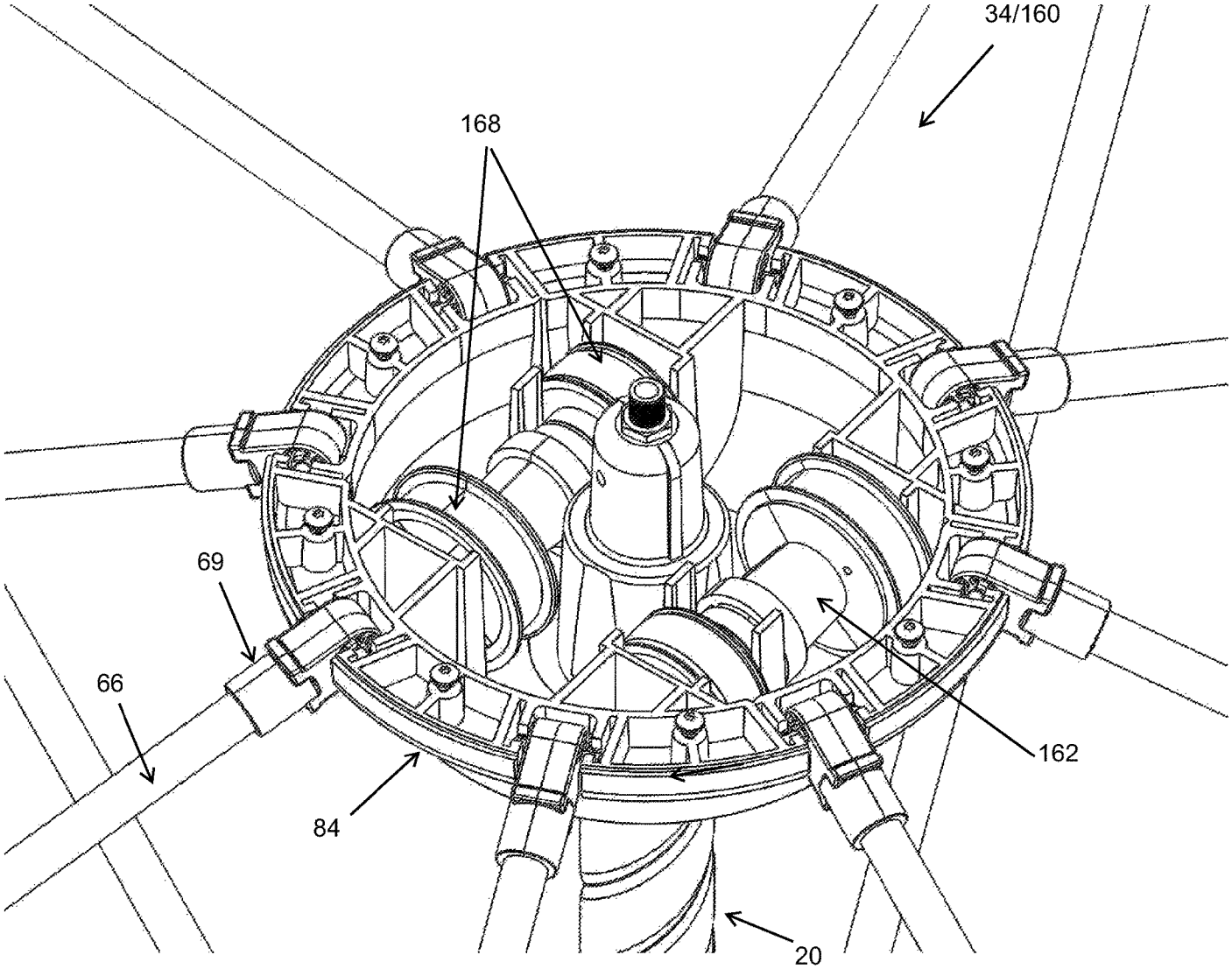
FIG. 44 is an upper perspective view of the central support of the umbrella frame and the counterbalance assembly shown in FIG. 36, in accordance with one or more embodiments; the view showing a cover of the central support omitted.
Figure 45:
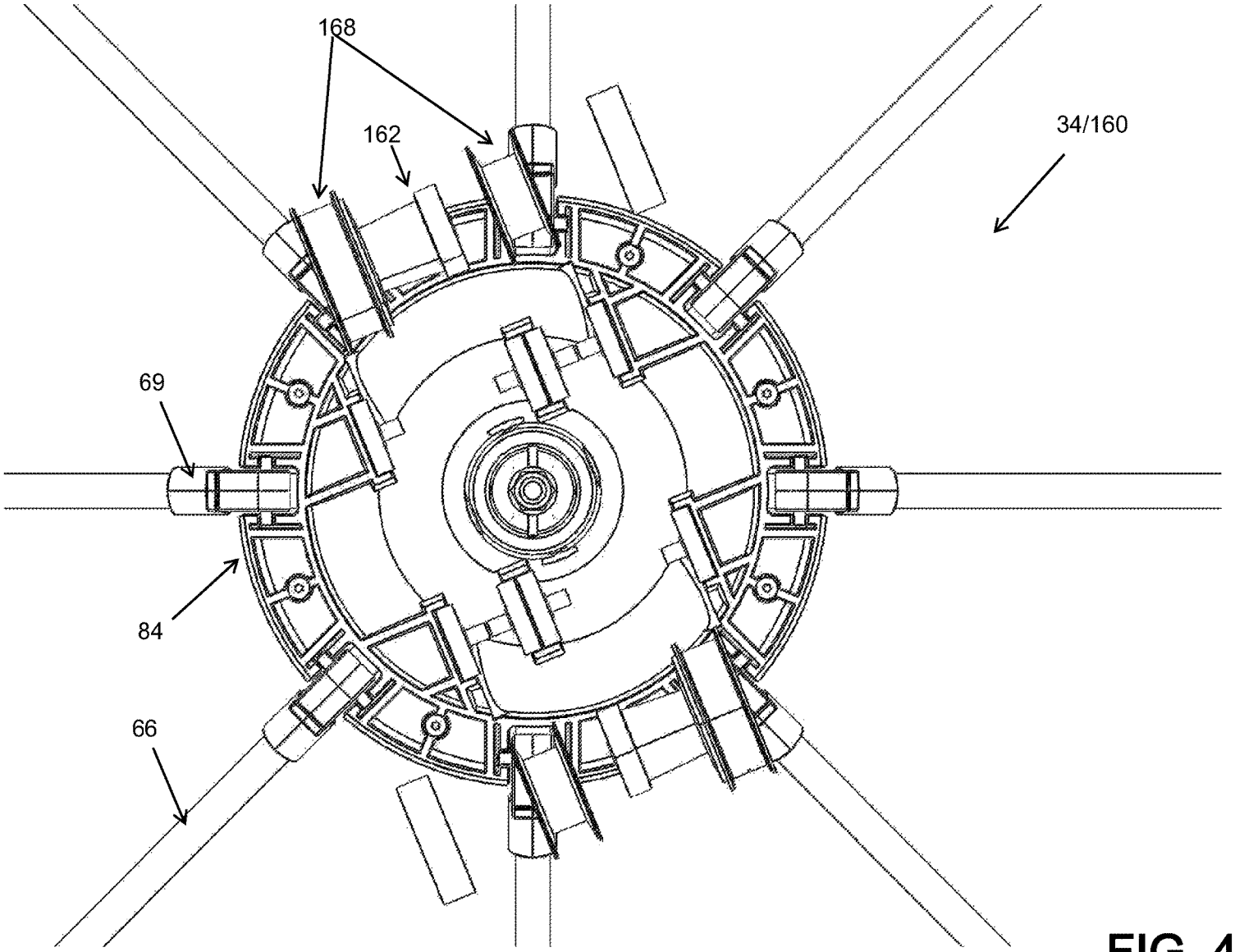
FIG. 45 is a top view of the central support of the umbrella frame and the counterbalance assembly shown in FIG. 36, in accordance with one or more embodiments; the view showing a cover of the central support omitted and showing an exploded view of spools of the counterbalance assembly.
Figure 46:
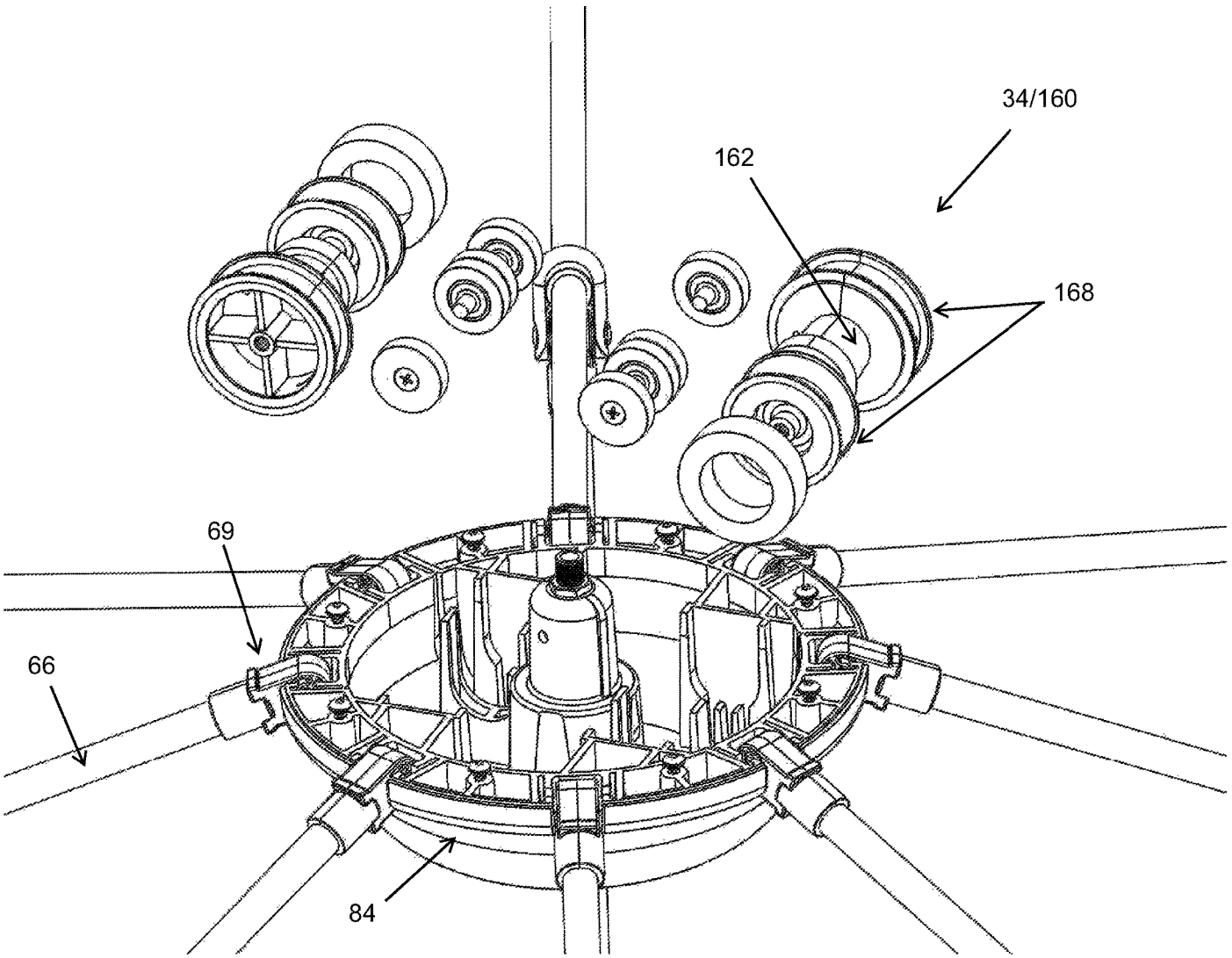
FIG. 46 is an upper exploded perspective view of the central support of the umbrella frame and the counterbalance assembly shown in FIG. 36, in accordance with one or more embodiments; the view showing a cover of the central support omitted.
Figure 47:
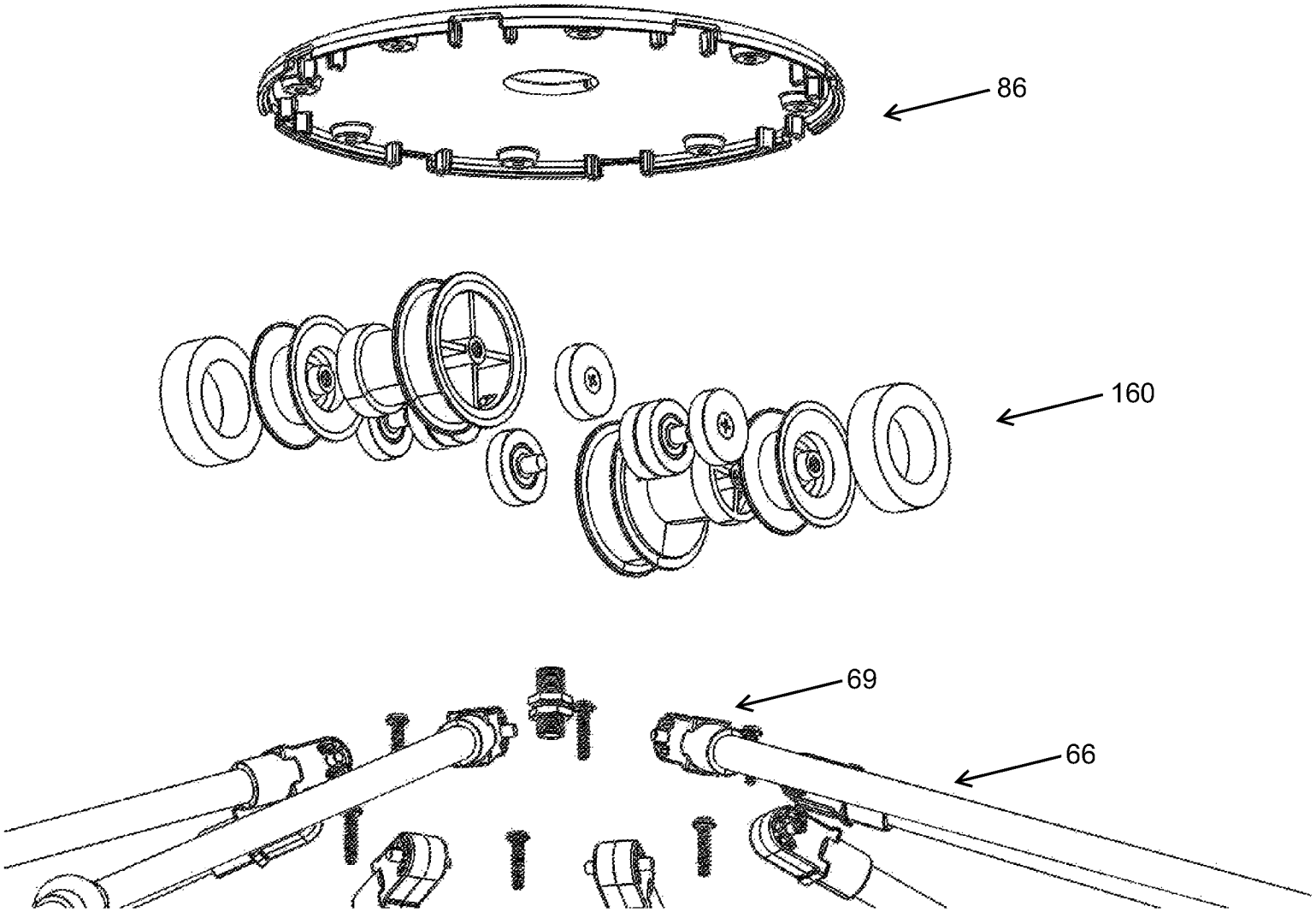
FIG. 47 is a lower exploded perspective view of the central support of the umbrella frame and the counterbalance assembly shown in FIG. 36, in accordance with one or more embodiments; the view showing a collar of the central support omitted.
Figure 48:
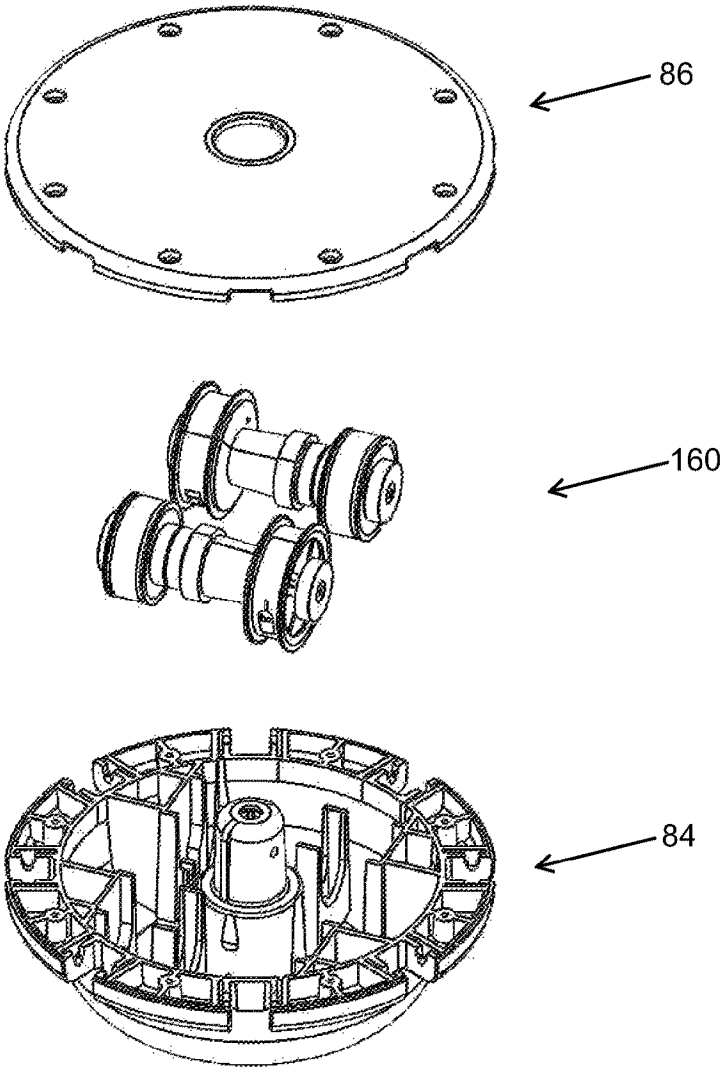
FIG. 48 is an upper exploded perspective view of a central support of an umbrella frame and a counterbalance assembly, in accordance with one or more embodiments.
Figure 49:
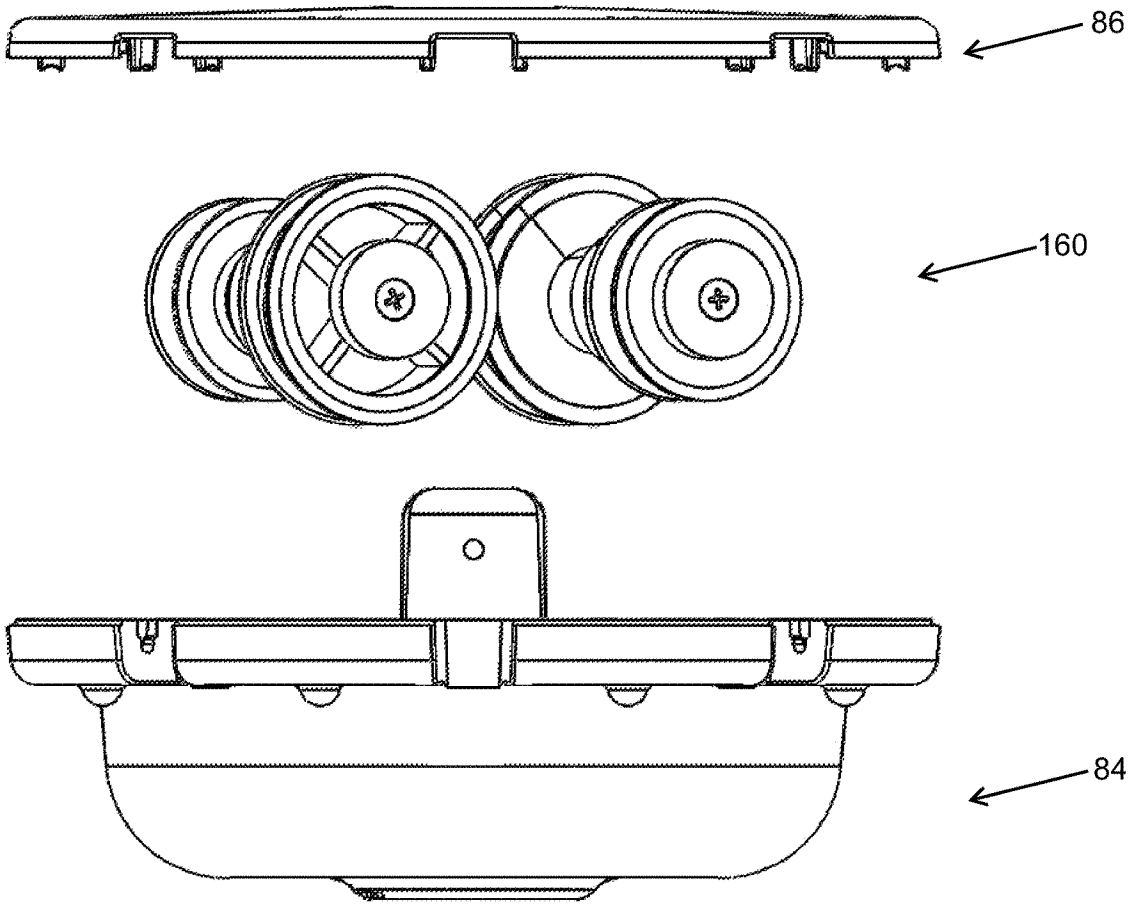
FIG. 49 is a front perspective exploded view of a central support of the central support and the counterbalance assembly shown in FIG. 48, in accordance with one or more embodiments.
Figure 50:
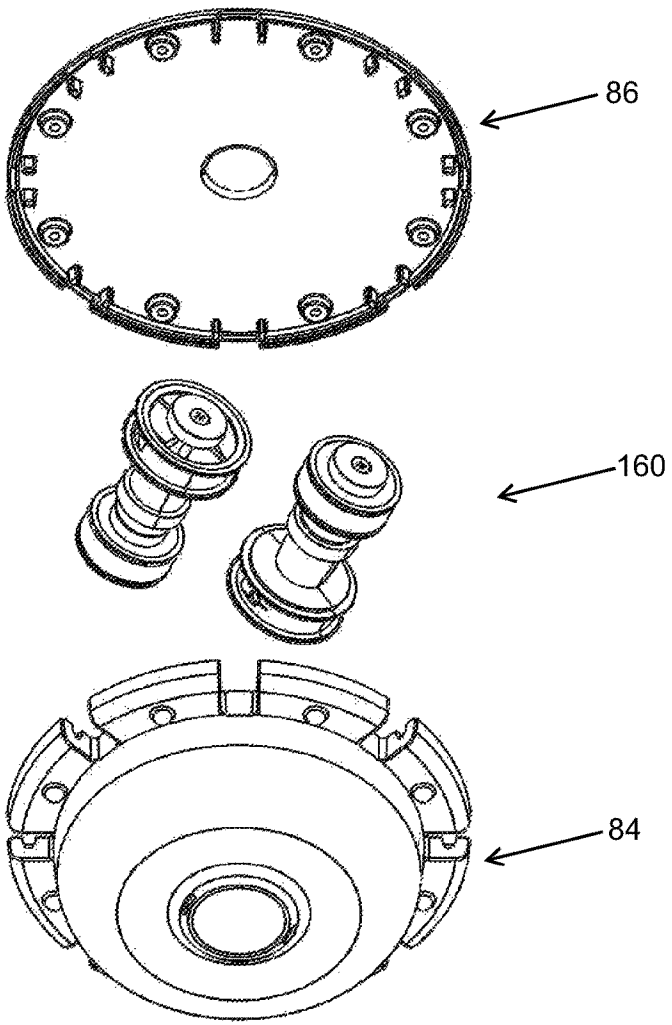
FIG. 50 is a lower perspective exploded view of the central support and the counterbalance assembly shown in FIG. 48, in accordance with one or more embodiments.
Figure 51:
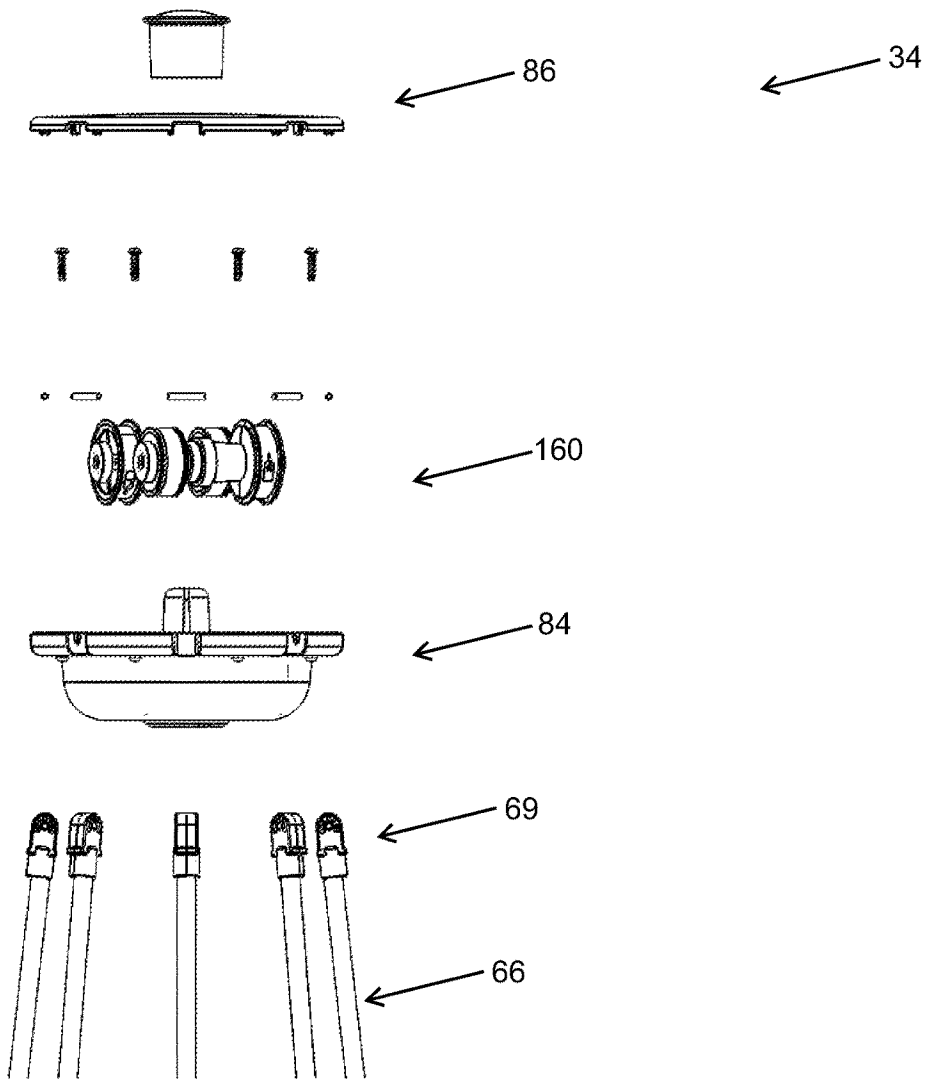
FIG. 51 is a side perspective exploded view of the central support and the counterbalance assembly shown in FIG. 48, in accordance with one or more embodiments.
Figure 52:
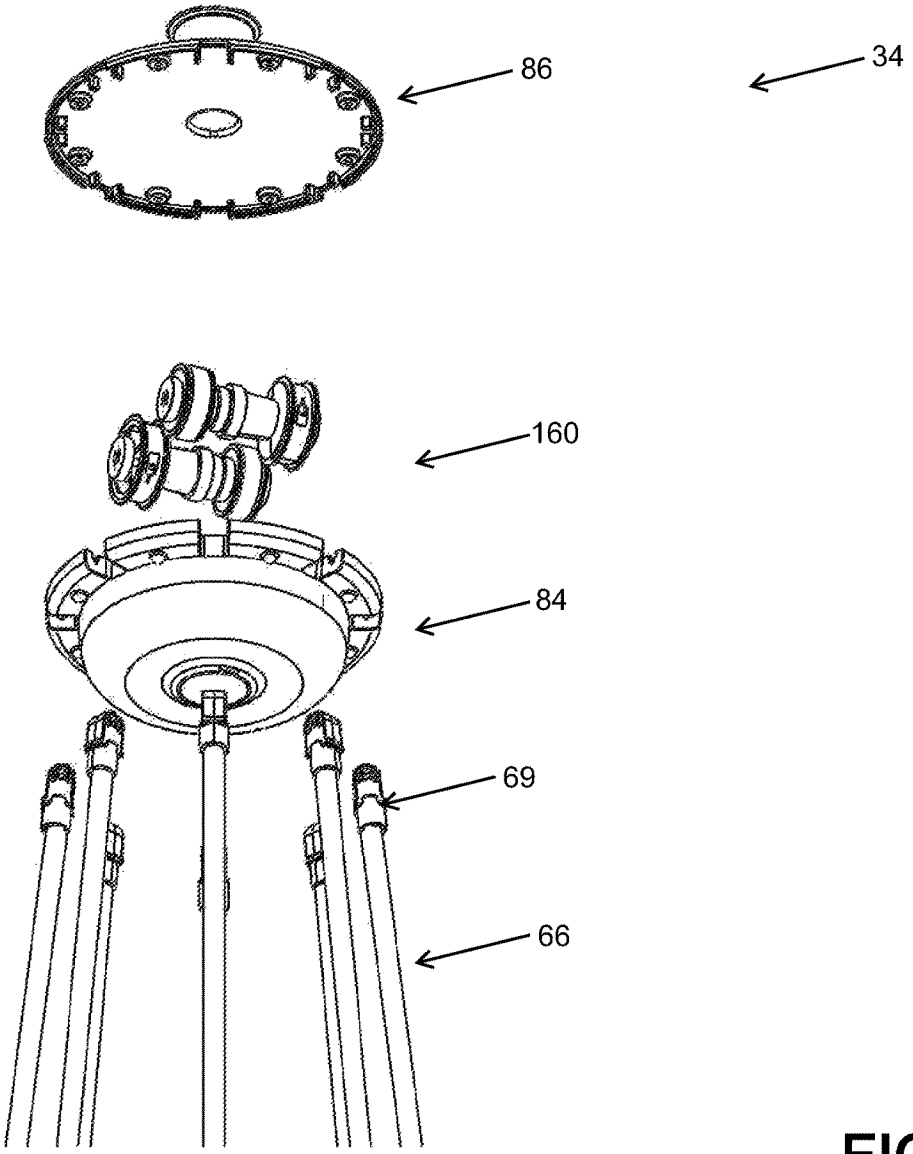
FIG. 52 is a lower perspective exploded view of the central support and the counterbalance assembly shown in FIG. 48, in accordance with one or more embodiments.
Figure 53:
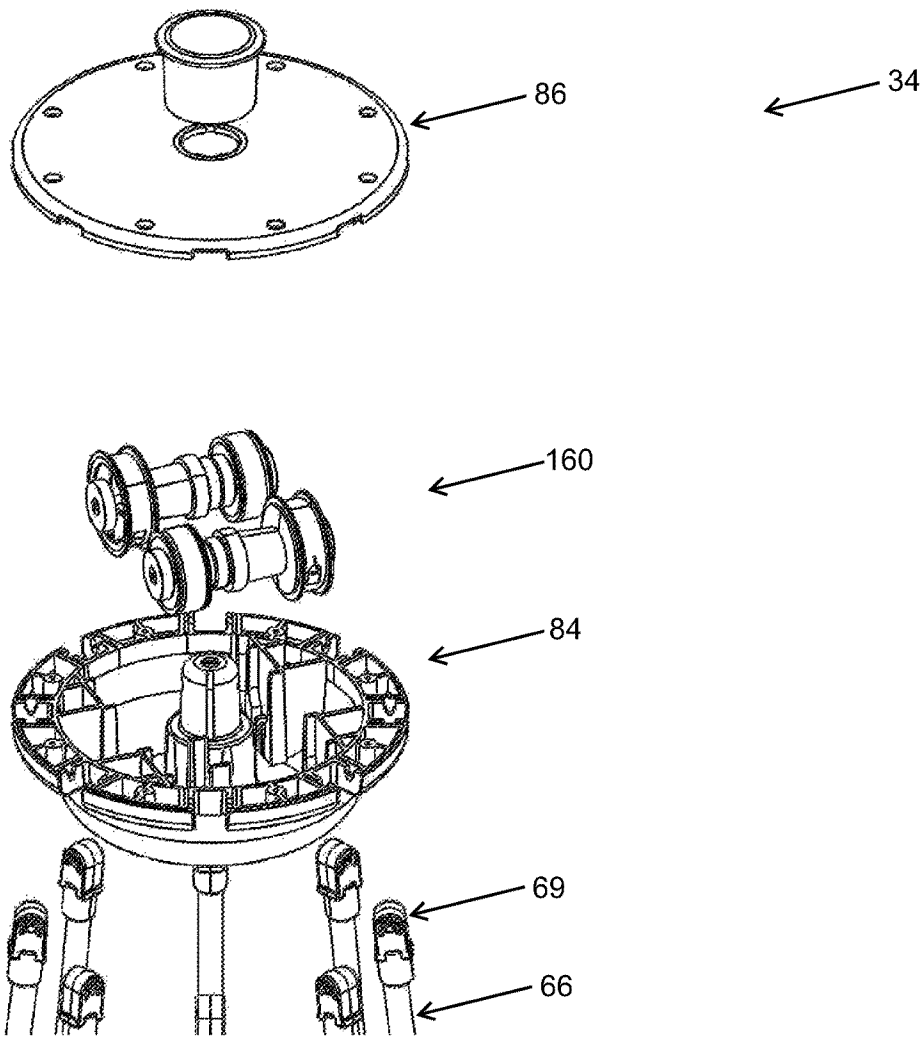
FIG. 53 is an upper perspective exploded view of the central support and the counterbalance assembly shown in FIG. 48, in accordance with one or more embodiments.
Figure 54:
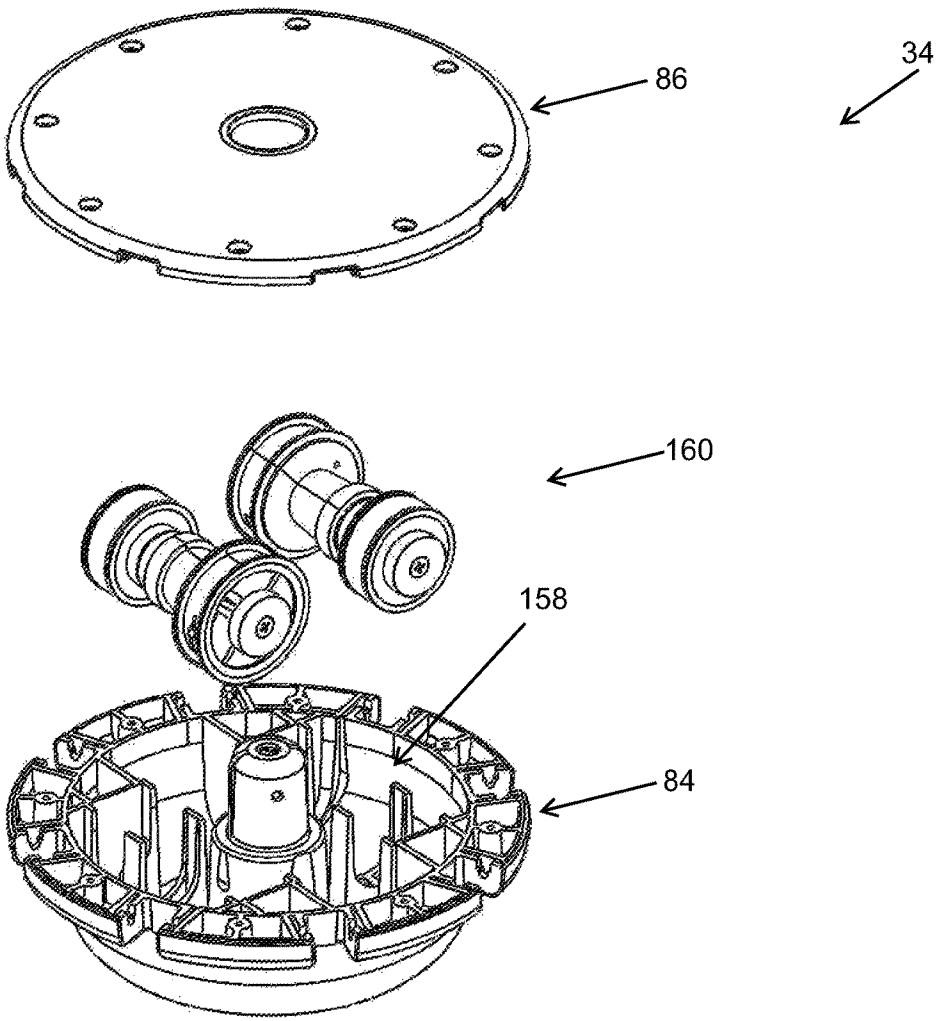
FIG. 54 is an upper perspective exploded view of the central support and the counterbalance assembly shown in FIG. 48, in accordance with one or more embodiments.
Figure 55:
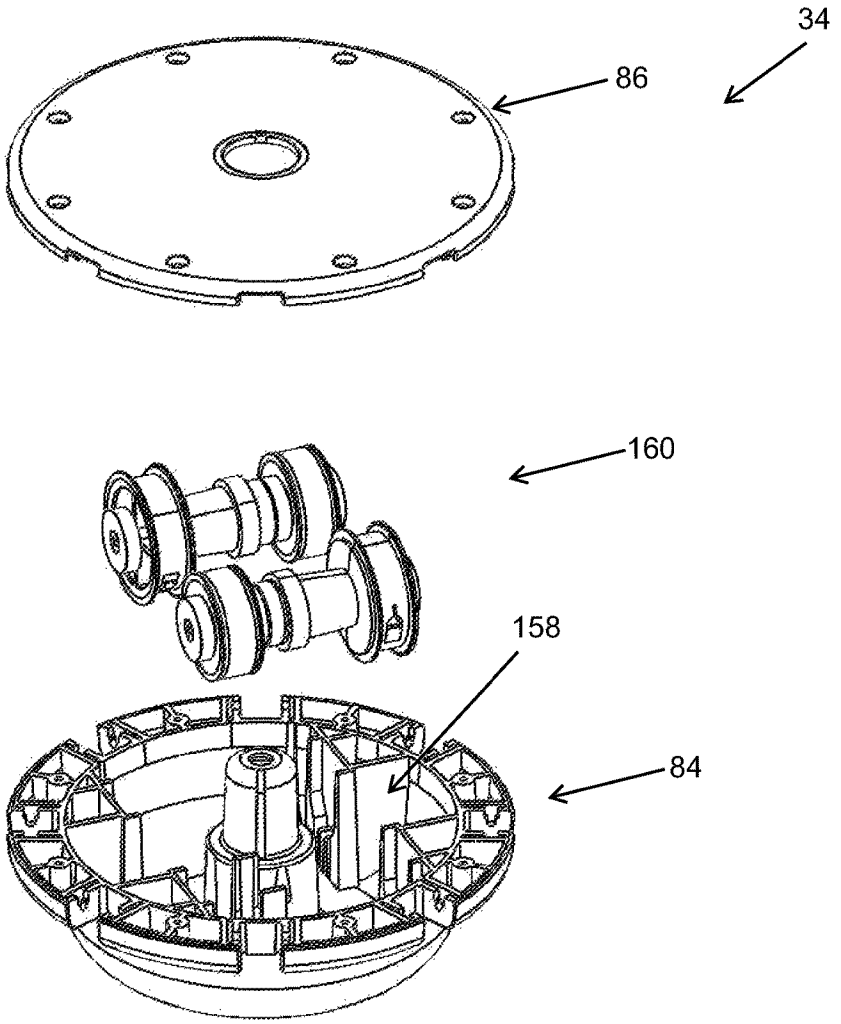
FIG. 55 is an upper perspective exploded view of the central support and the counterbalance assembly shown in FIG. 48, in accordance with one or more embodiments.
Figure 56:
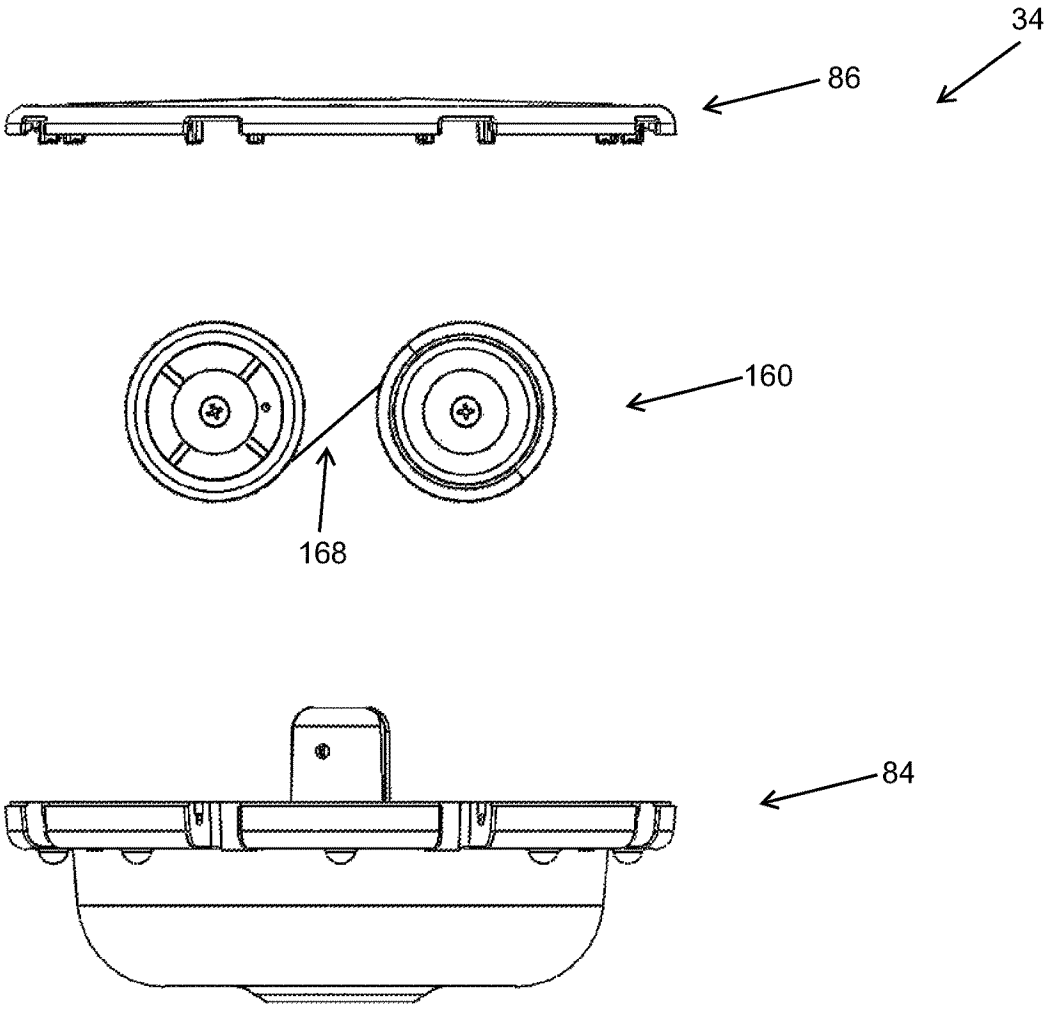
FIG. 56 is a front exploded view of the central support and the counterbalance assembly shown in FIG. 48, in accordance with one or more embodiments.
Figure 57:
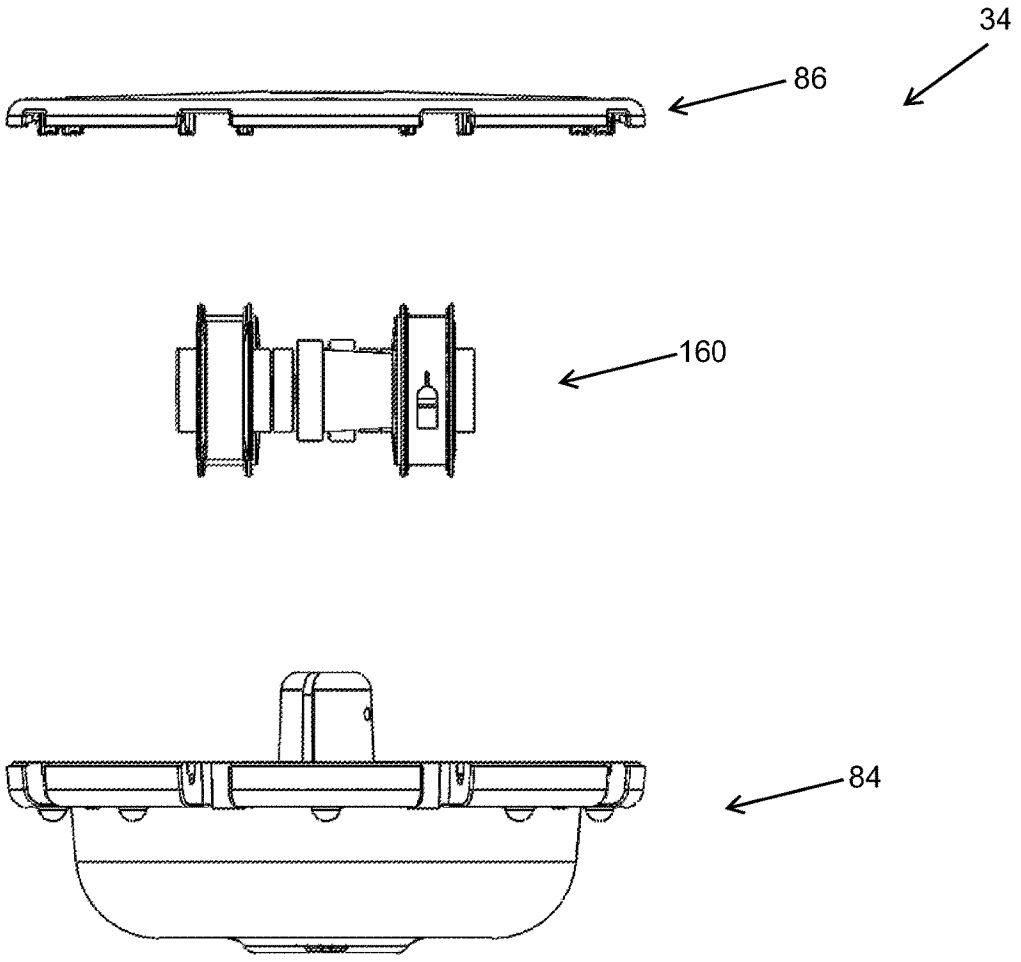
FIG. 57 is a side exploded view of the central support and the counterbalance assembly shown in FIG. 48, in accordance with one or more embodiments.
Figure 58:
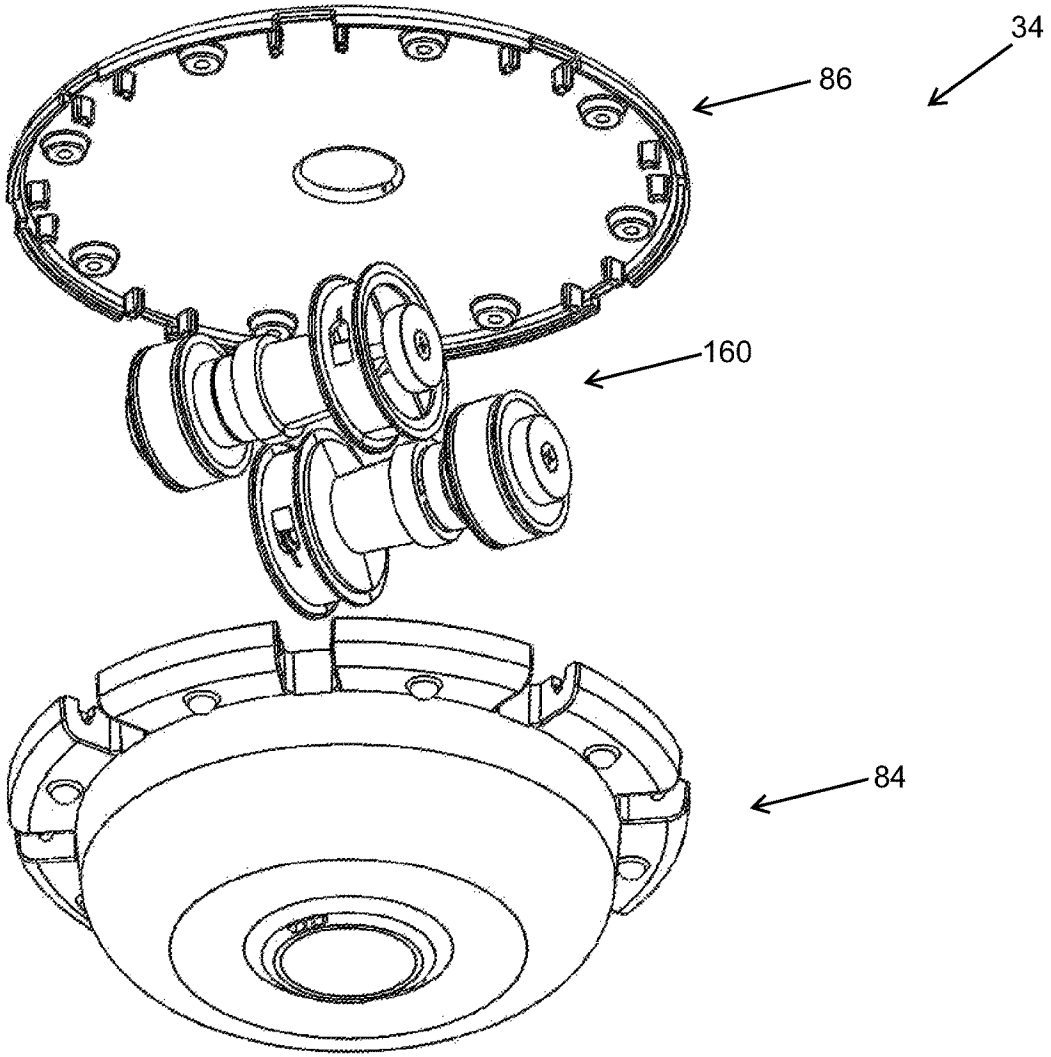
FIG. 58 is a lower perspective exploded view of the central support and the counterbalance assembly shown in FIG. 48, in accordance with one or more embodiments.
Figure 59:
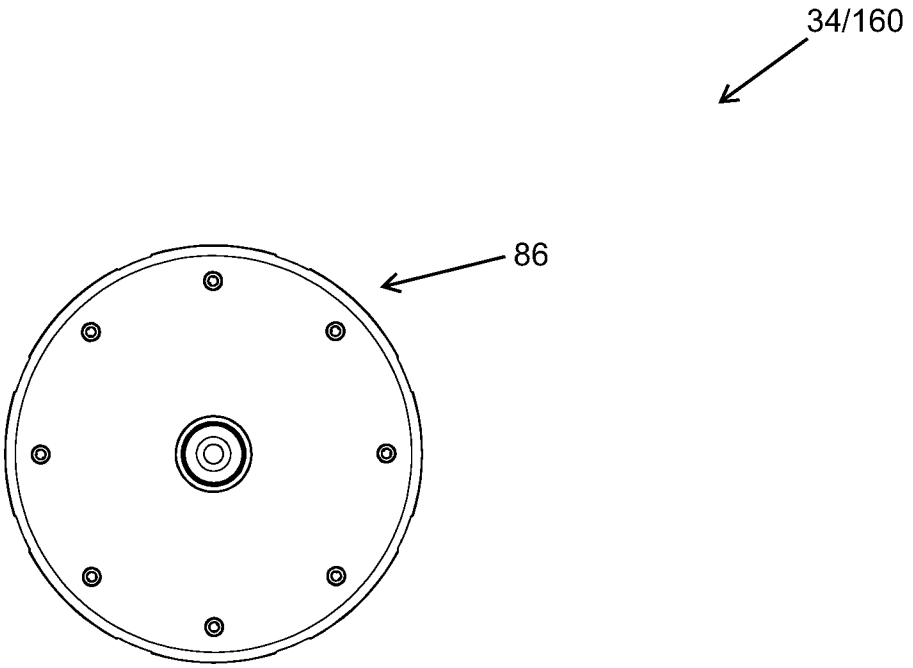
FIG. 59 is a top assembled view of the central support and the counterbalance assembly shown in FIG. 48, in accordance with one or more embodiments.
Figure 60:
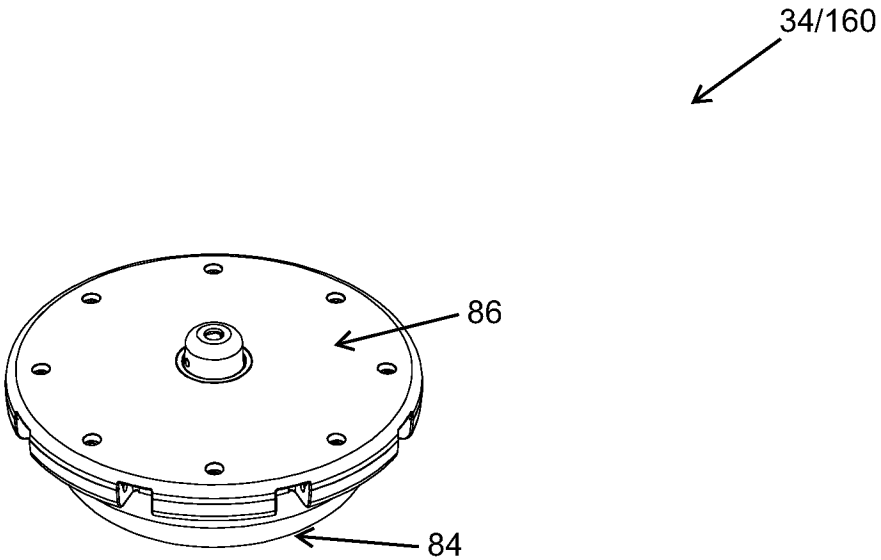
FIG. 60 is an upper perspective assembled view of the central support and the counterbalance assembly shown in FIG. 48, in accordance with one or more embodiments.
Figure 61:
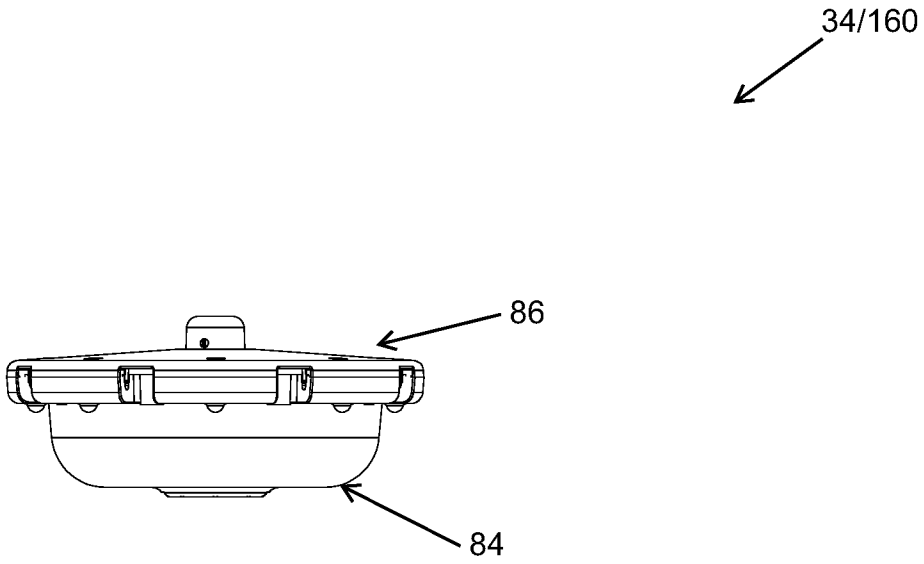
FIG. 61 is a side assembled view of the central support and the counterbalance assembly shown in FIG. 48, in accordance with one or more embodiments
Figure 62:
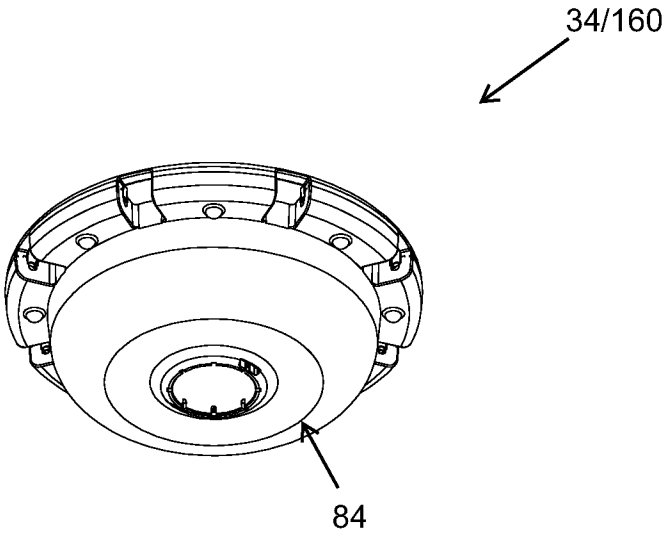
FIG. 62 is a lower perspective assembled view of the central support and the counterbalance assembly shown in FIG. 48, in accordance with one or more embodiments.
Figure 63:
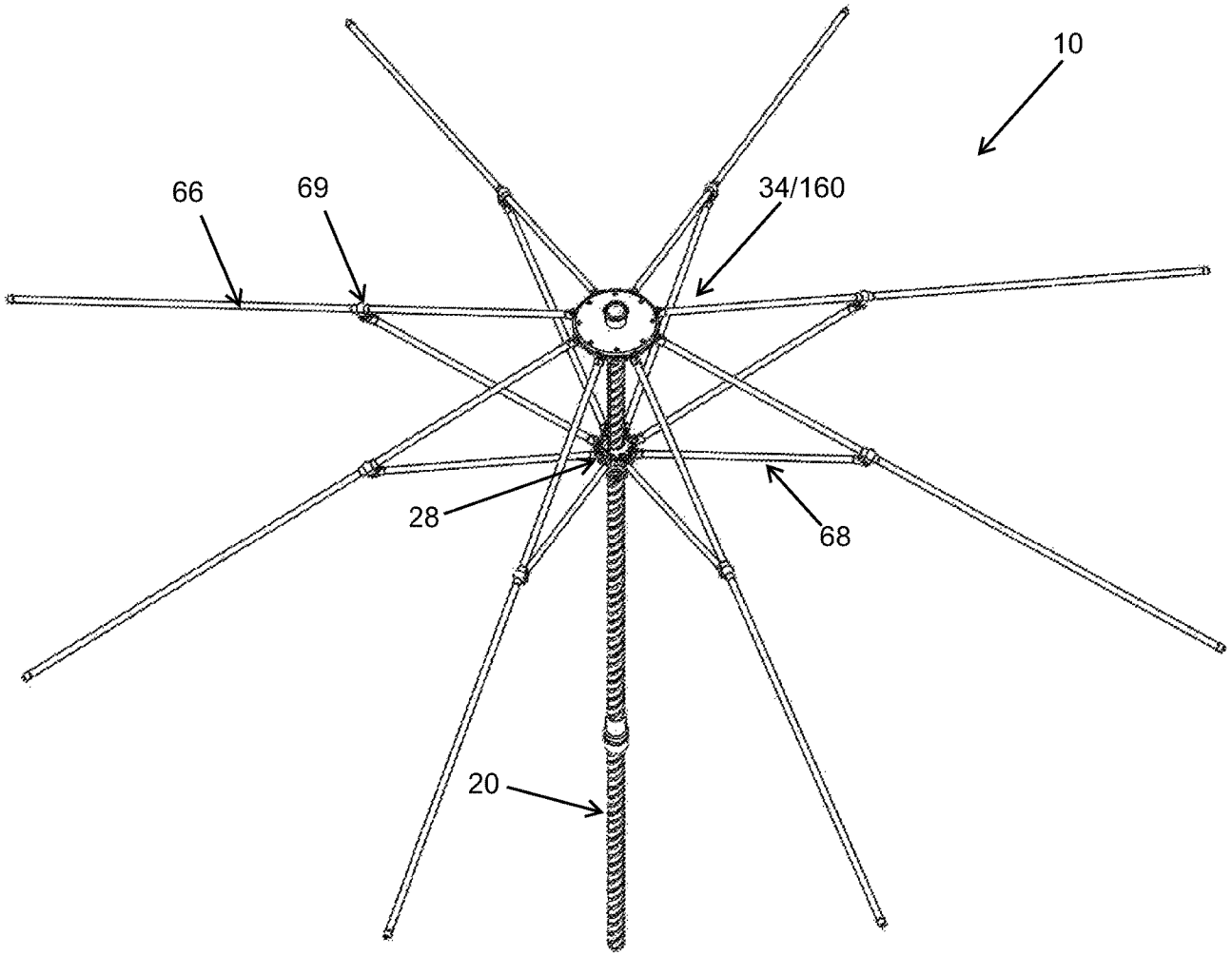
FIG. 63 is an upper perspective view of an umbrella system, in accordance with one or more embodiments.
Figure 64:
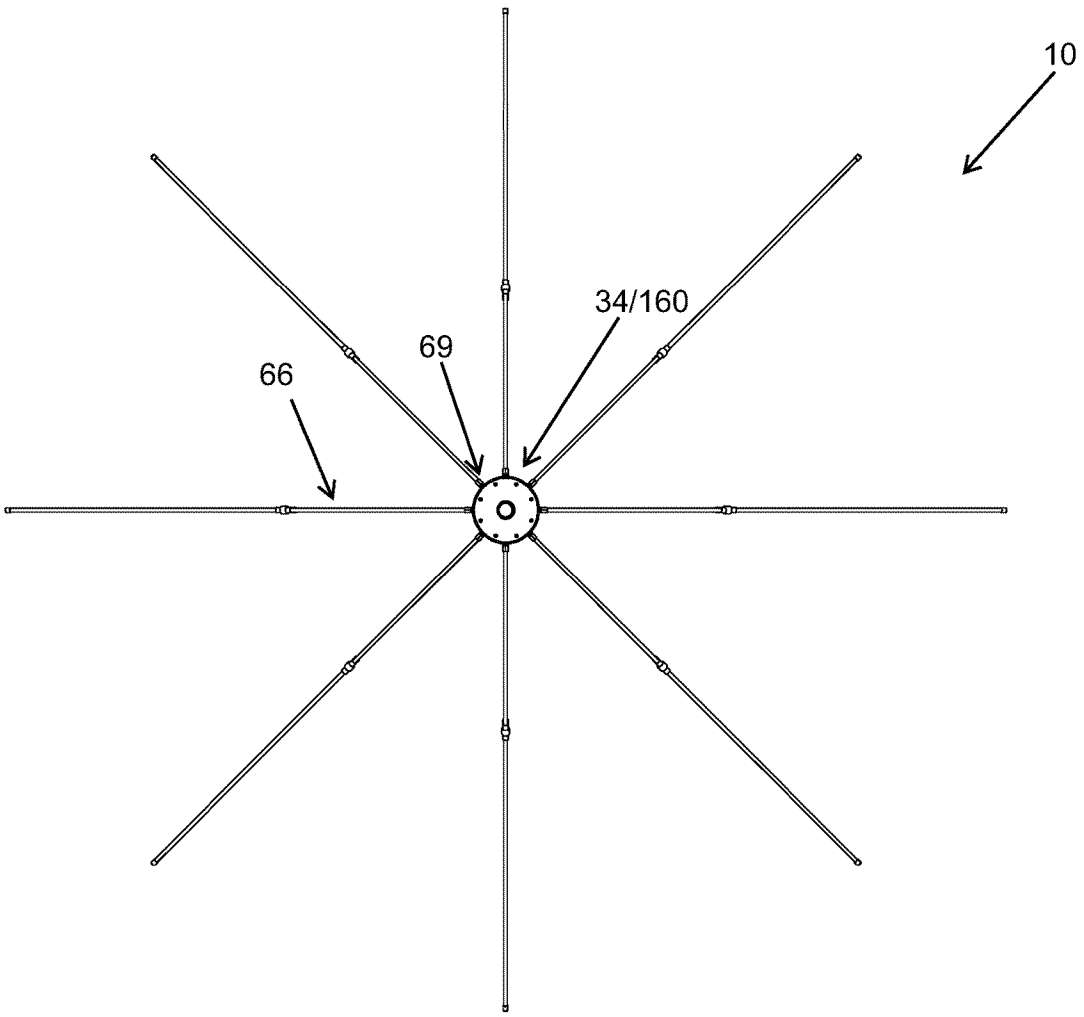
FIG. 64 is a top view of the umbrella system shown in FIG. 64, in accordance with one or more embodiments; the view showing the umbrella system being in a fully opened position.
Figure 65:
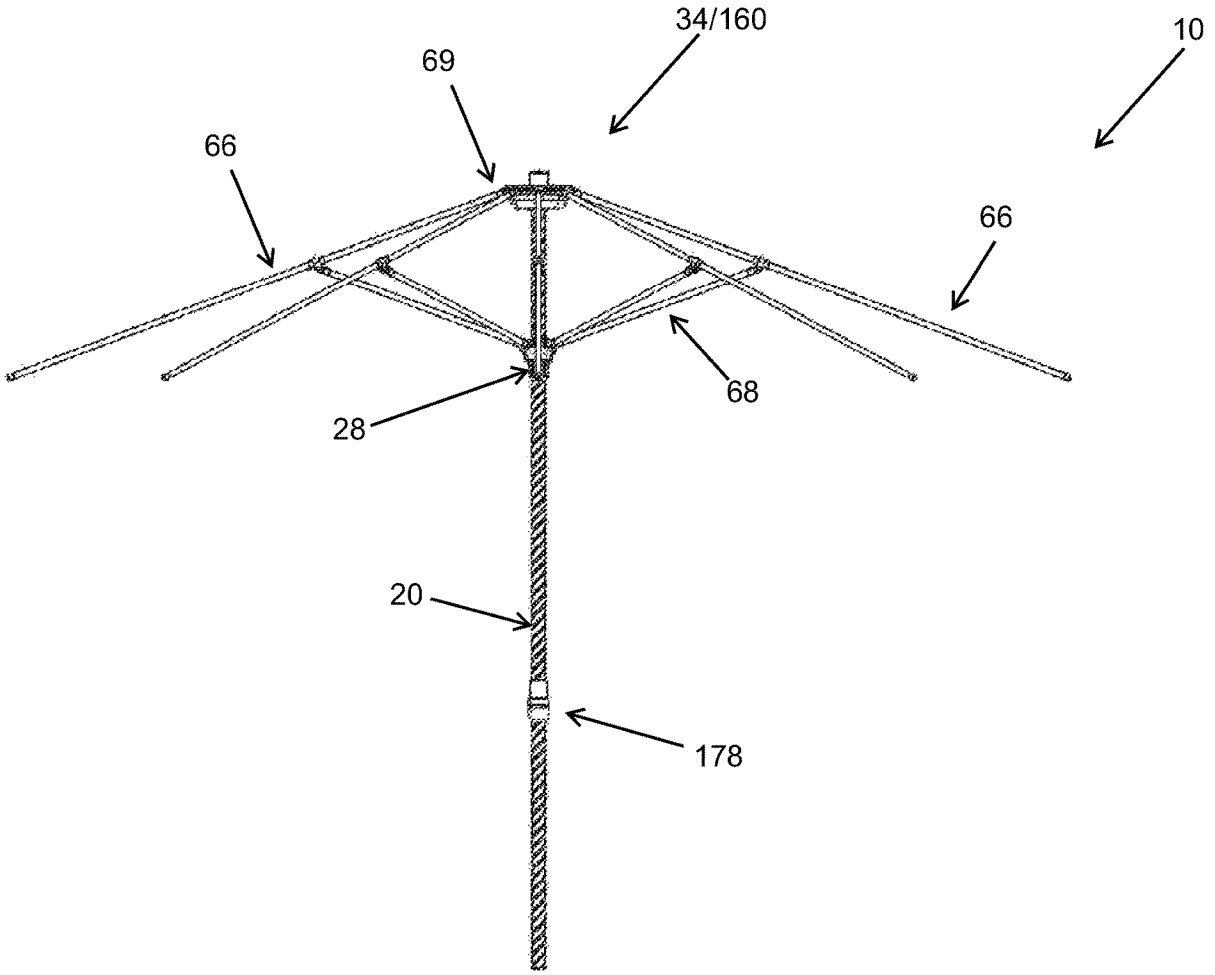
FIG. 65 is a front view of the umbrella system shown in FIG. 64, in accordance with one or more embodiments; the view showing the umbrella system being in a fully opened position.
Figure 66:
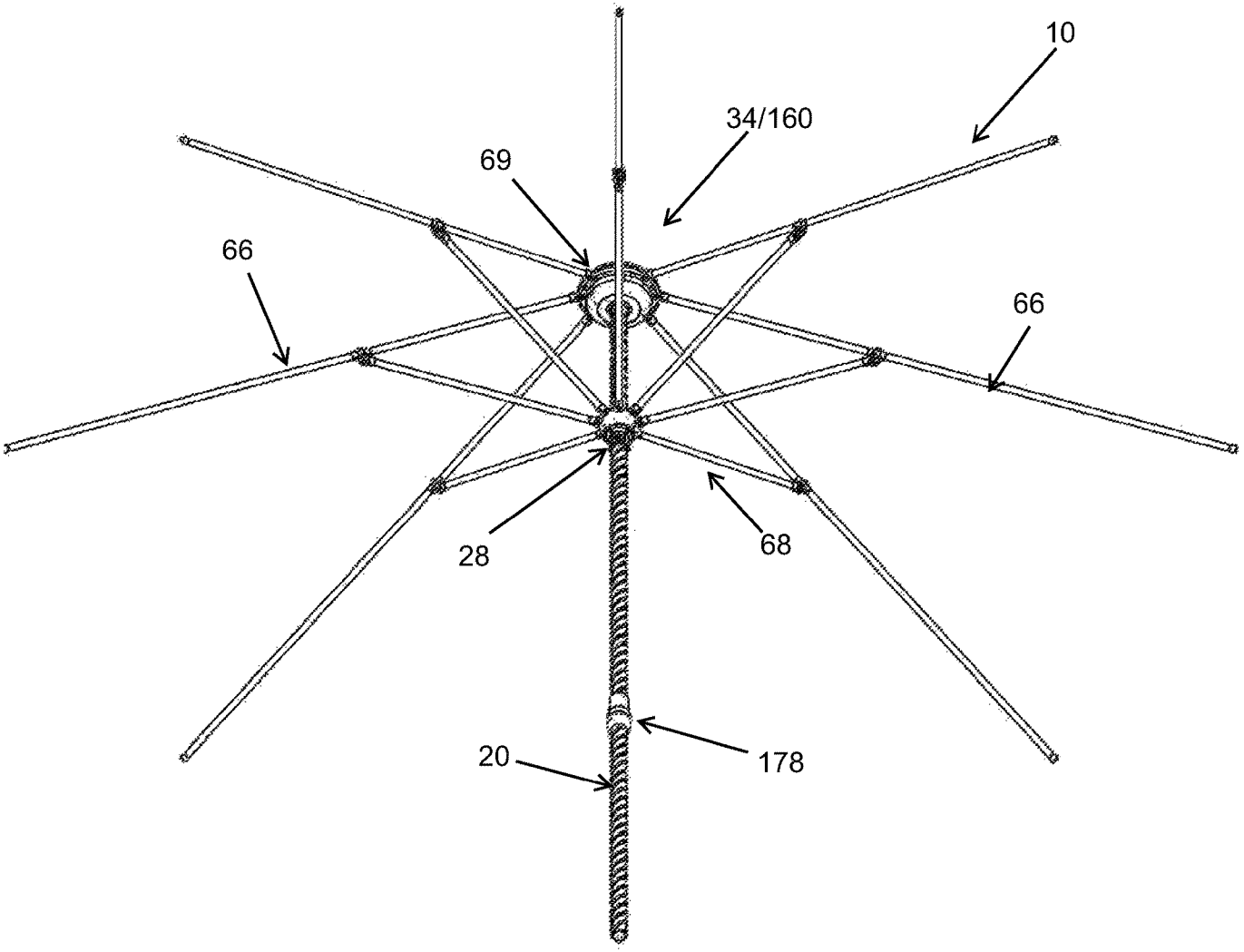
FIG. 66 is a lower perspective view of the umbrella system shown in FIG. 64, in accordance with one or more embodiments; the view showing the umbrella system being in a fully opened position.
Figure 67:
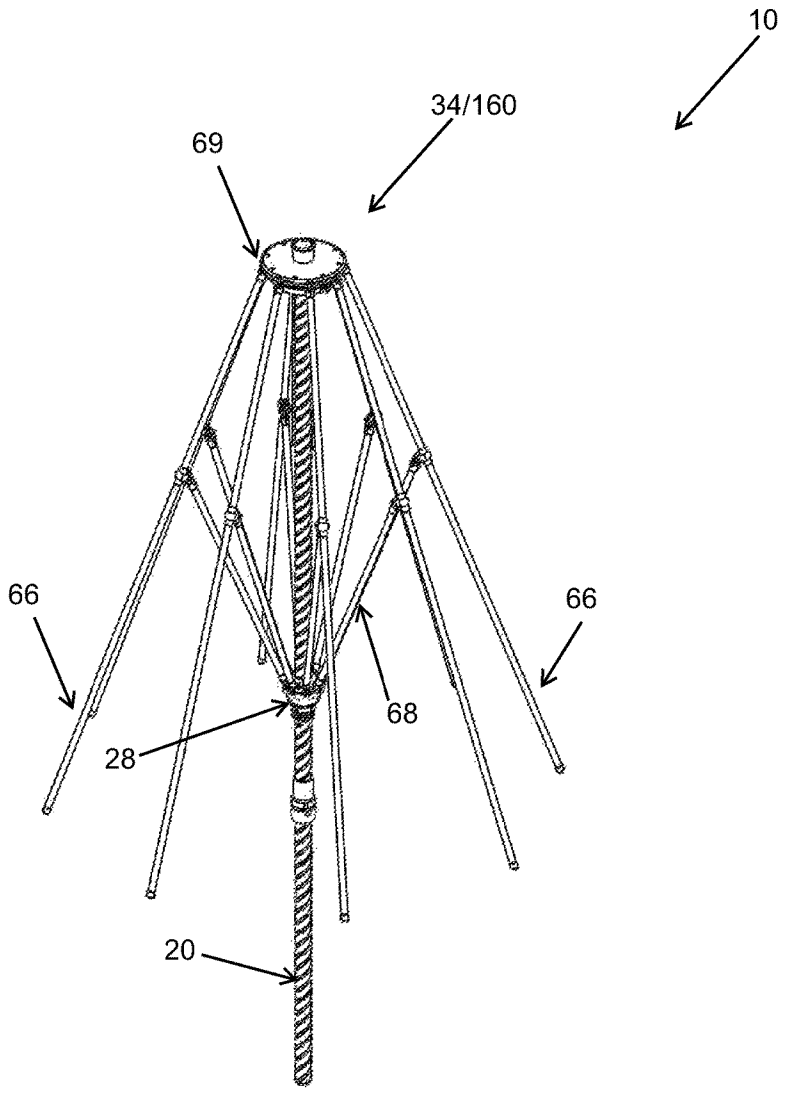
FIG. 67 is an upper perspective view of the umbrella system shown in FIG. 64, in accordance with one or more embodiments; the view showing the umbrella system being in a partially opened position.
Figure 68:
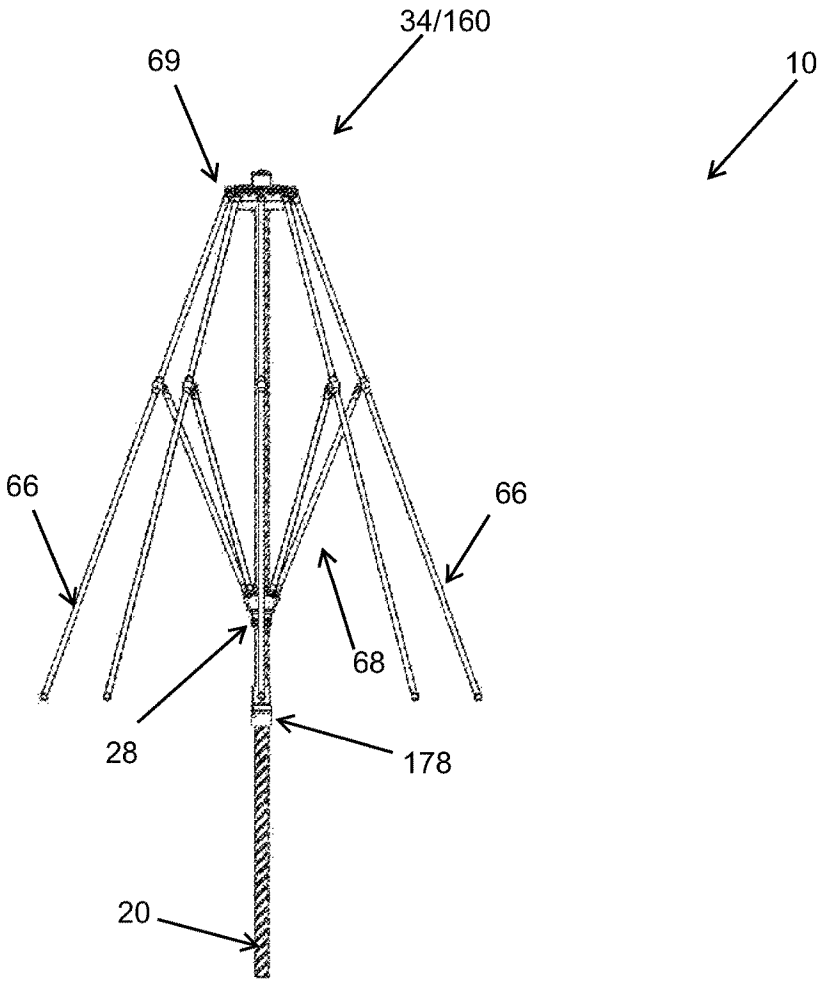
FIG. 68 is a front view of the umbrella system shown in FIG. 64, in accordance with one or more embodiments; the view showing the umbrella system being in a partially opened position.
Figure 69:
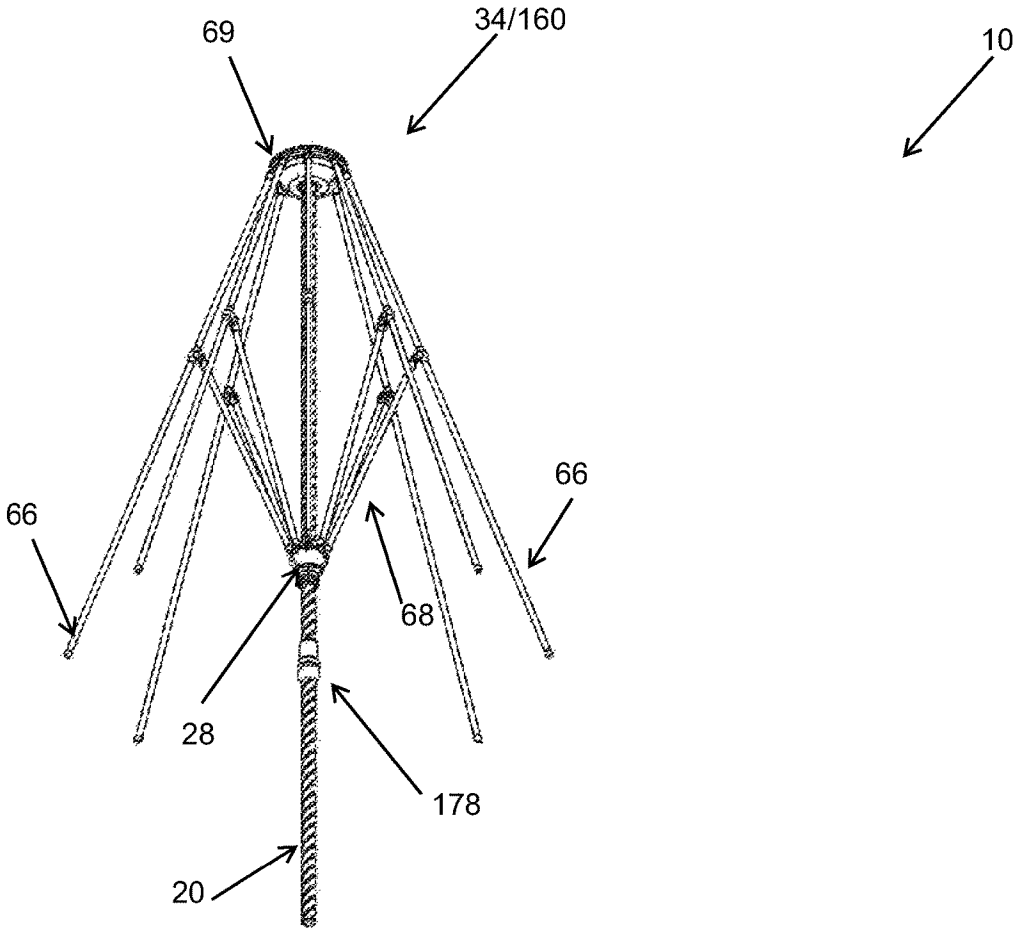
FIG. 69 is a lower perspective view of the umbrella system shown in FIG. 64, in accordance with one or more embodiments; the view showing the umbrella system being in a partially opened position.
Figure 70:
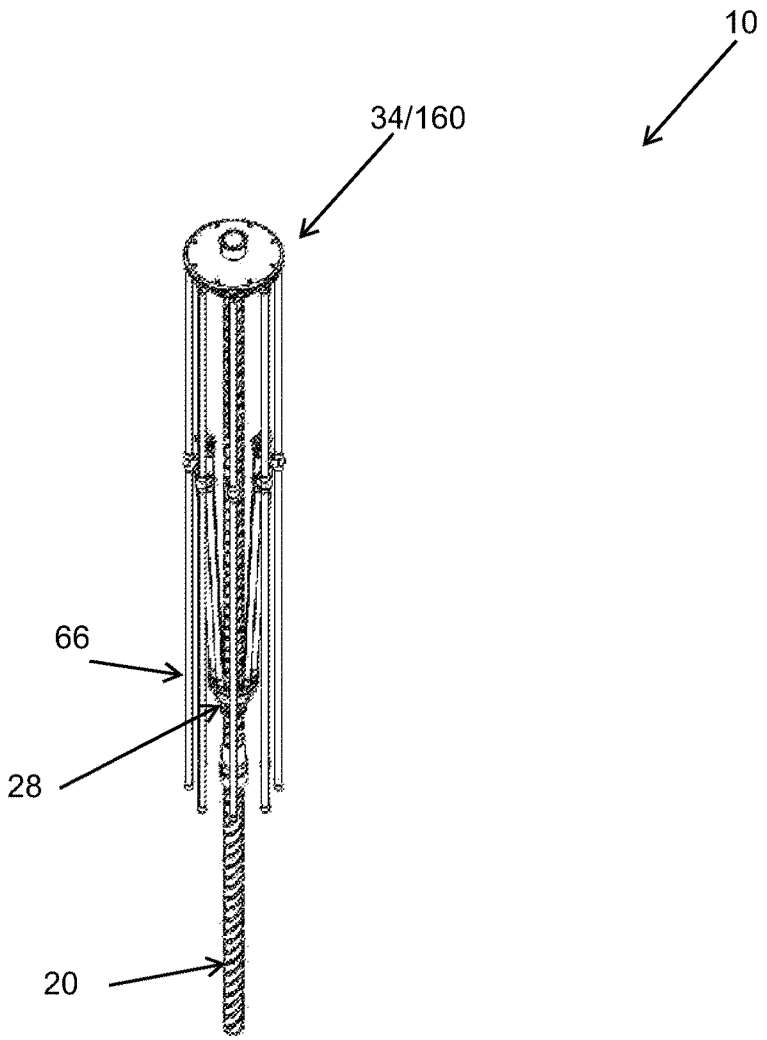
FIG. 70 is an upper perspective view of the umbrella system shown in FIG. 64, in accordance with one or more embodiments; the view showing the umbrella system being in a closed position.
Figure 71:
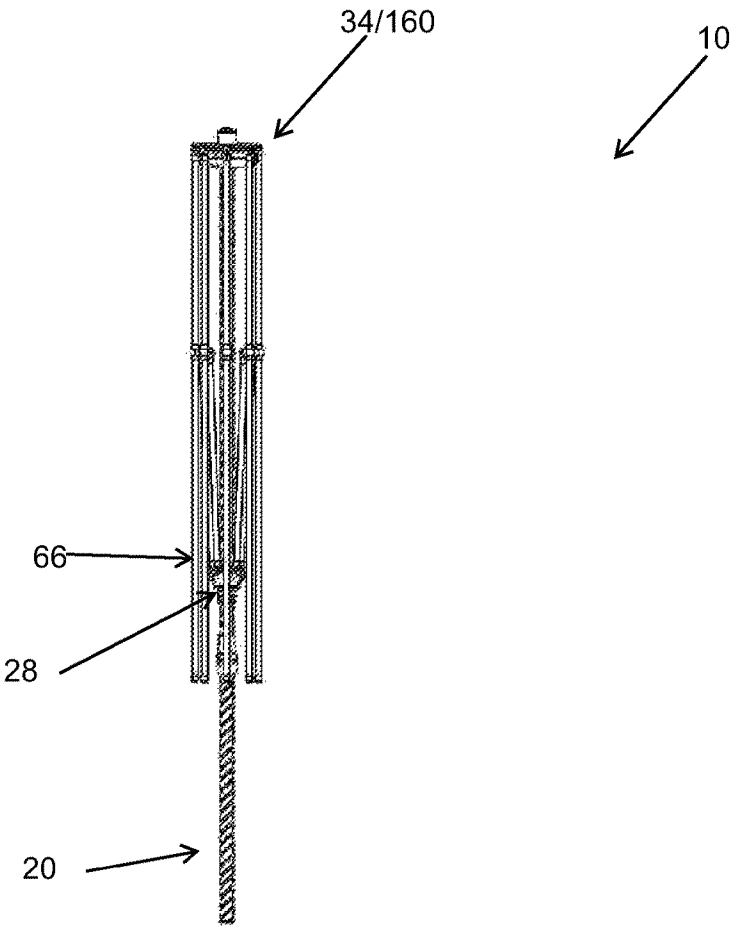
FIG. 71 is a front view of the umbrella system shown in FIG. 64, in accordance with one or more embodiments; the view showing the umbrella system being in a closed position.
Figure 72:
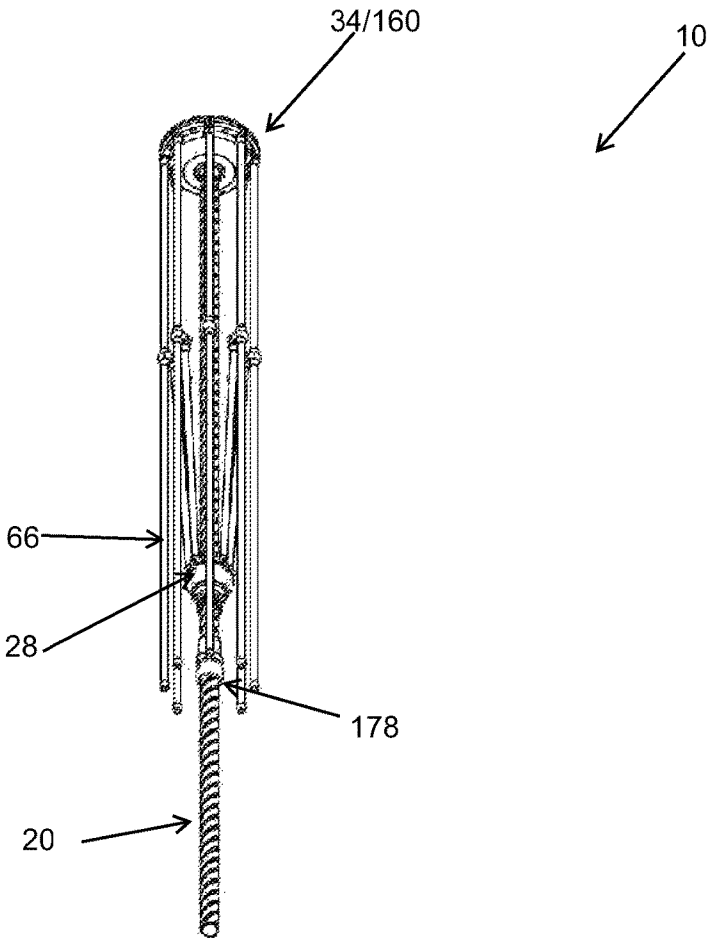
FIG. 72 is a lower perspective view of the umbrella system shown in FIG. 64, in accordance with one or more embodiments; the view showing the umbrella system being in a closed position.
Figure 73:
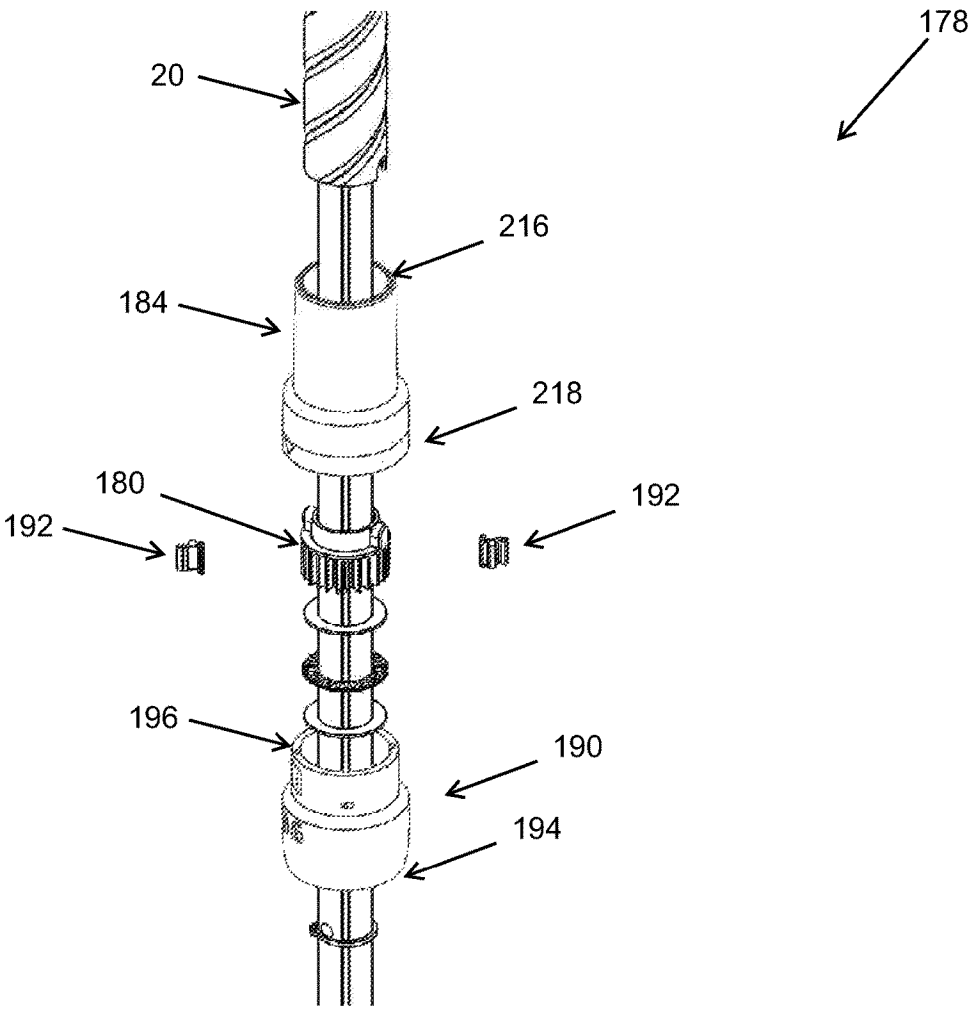
FIG. 73 is an upper perspective exploded view of a rotational lock assembly, in accordance with one or more embodiments.
Figure 74:
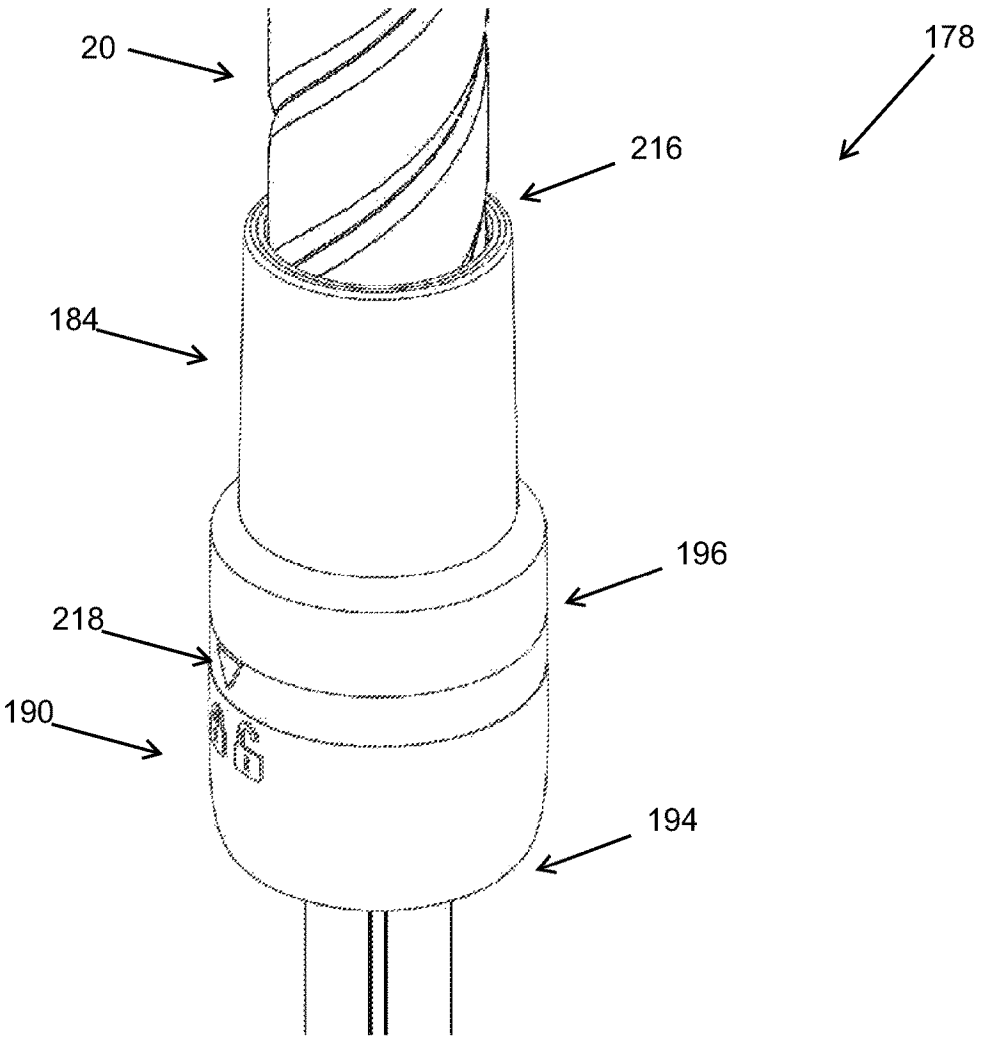
FIG. 74 is an upper perspective assembled view of a rotational lock assembly, in accordance with one or more embodiments.
Figure 75:
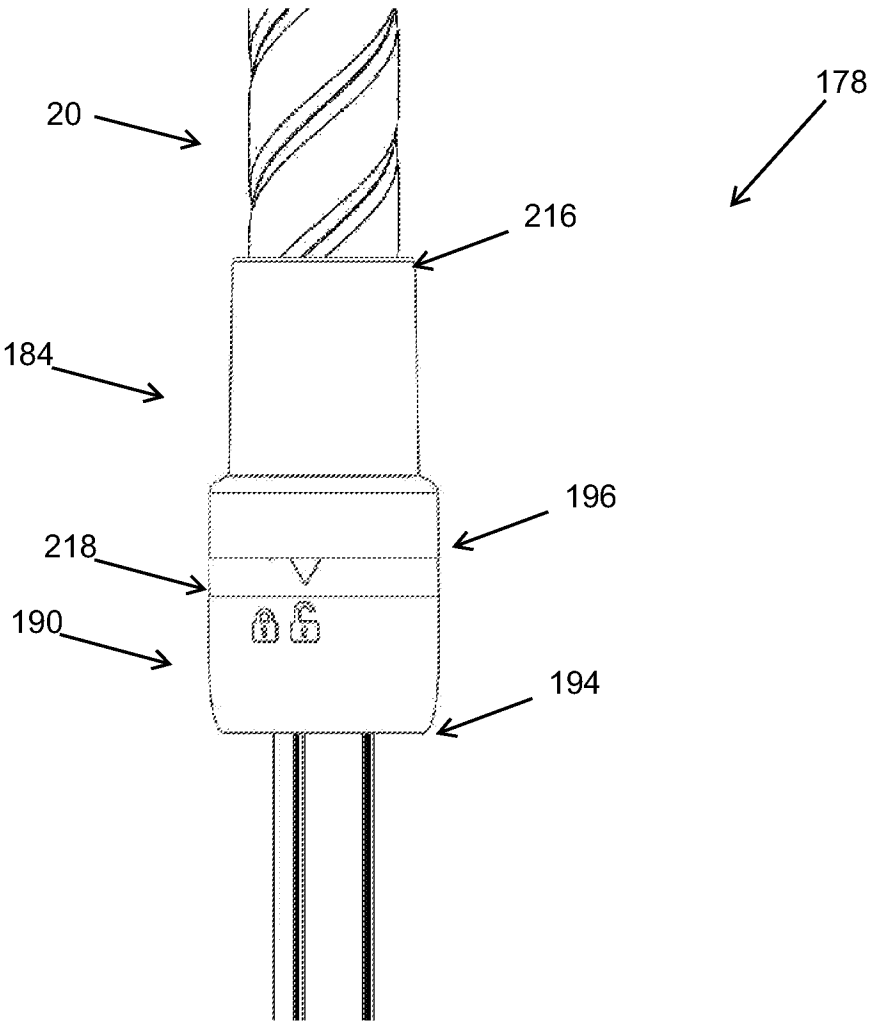
FIG. 75 is a front assembled view of a rotational lock assembly, in accordance with one or more embodiments.
Figure 76:
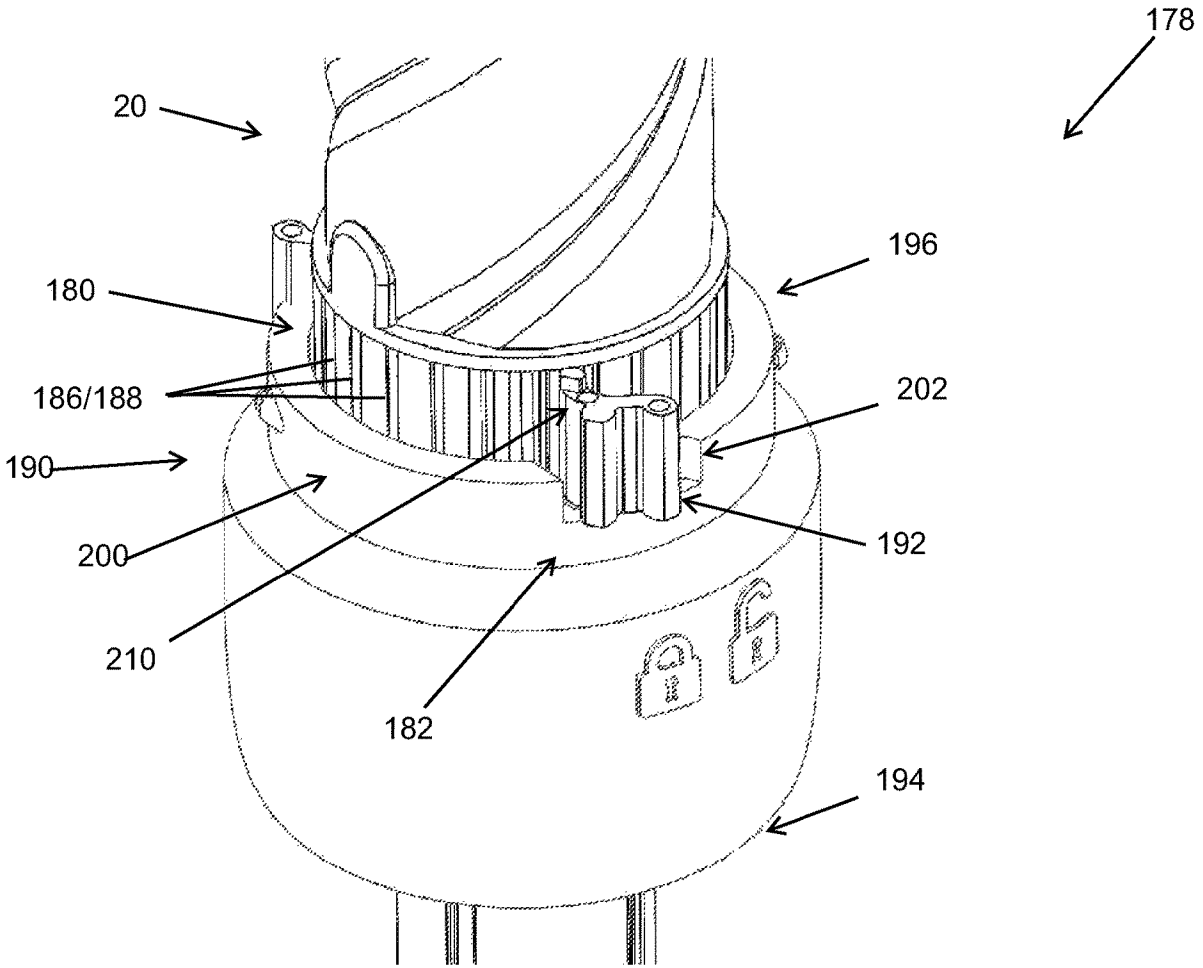
FIG. 76 is an upper perspective view of a rotational lock assembly, in accordance with one or more embodiments; the view showing an upper collar omitted and showing the internal assembly and gear member.
Figure 77:
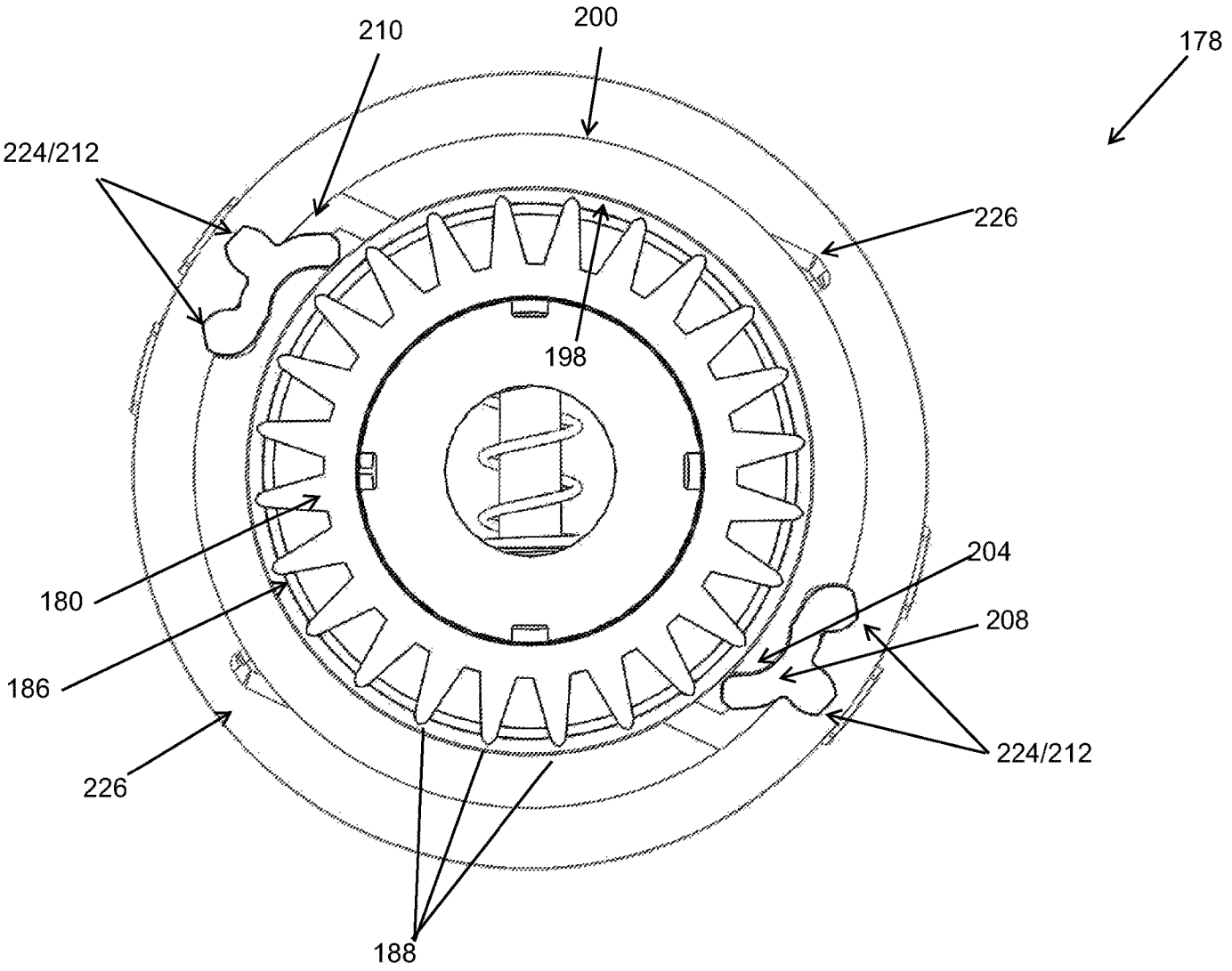
FIG. 77 is a top view of a rotational lock assembly, in accordance with one or more embodiments; the view showing the rotational lock assembly in an unlocked state.
Figure 78:
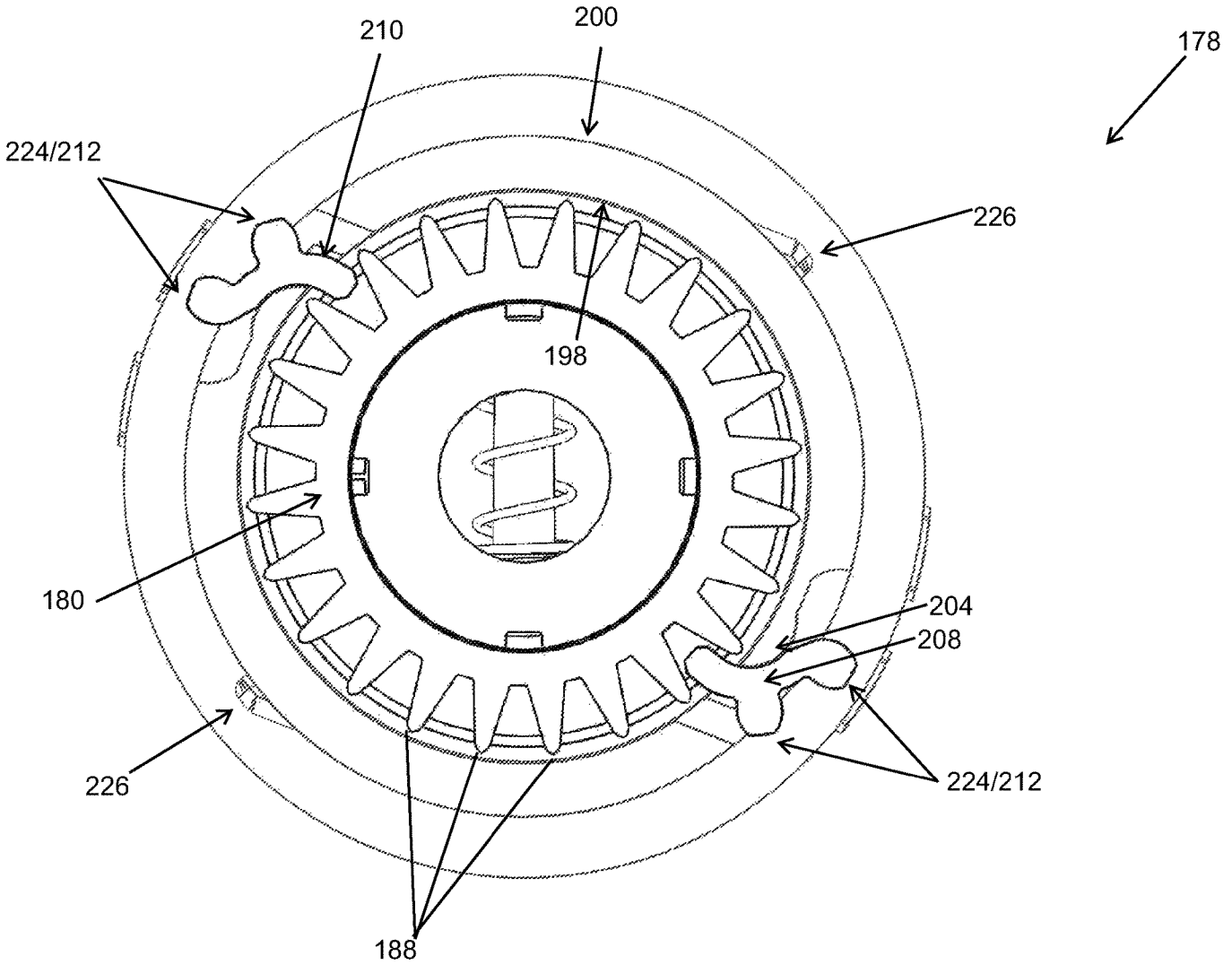
FIG. 78 is a top view of a rotational lock assembly, in accordance with one or more embodiments; the view showing the rotational lock assembly in a locked state.
Figure 79:
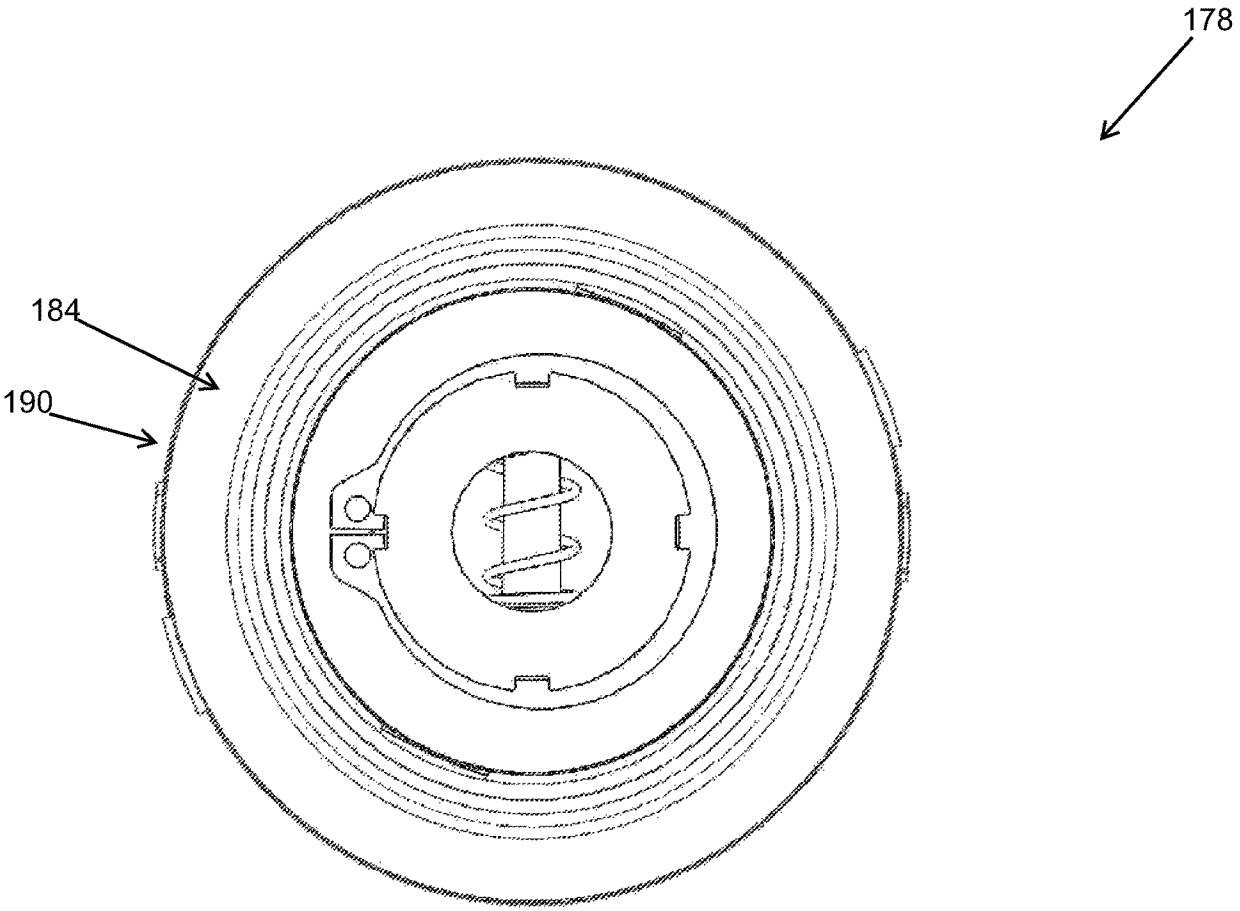
FIG. 79 is a top assembled view of a rotational lock assembly, in accordance with one or more embodiments.
Figure 80:
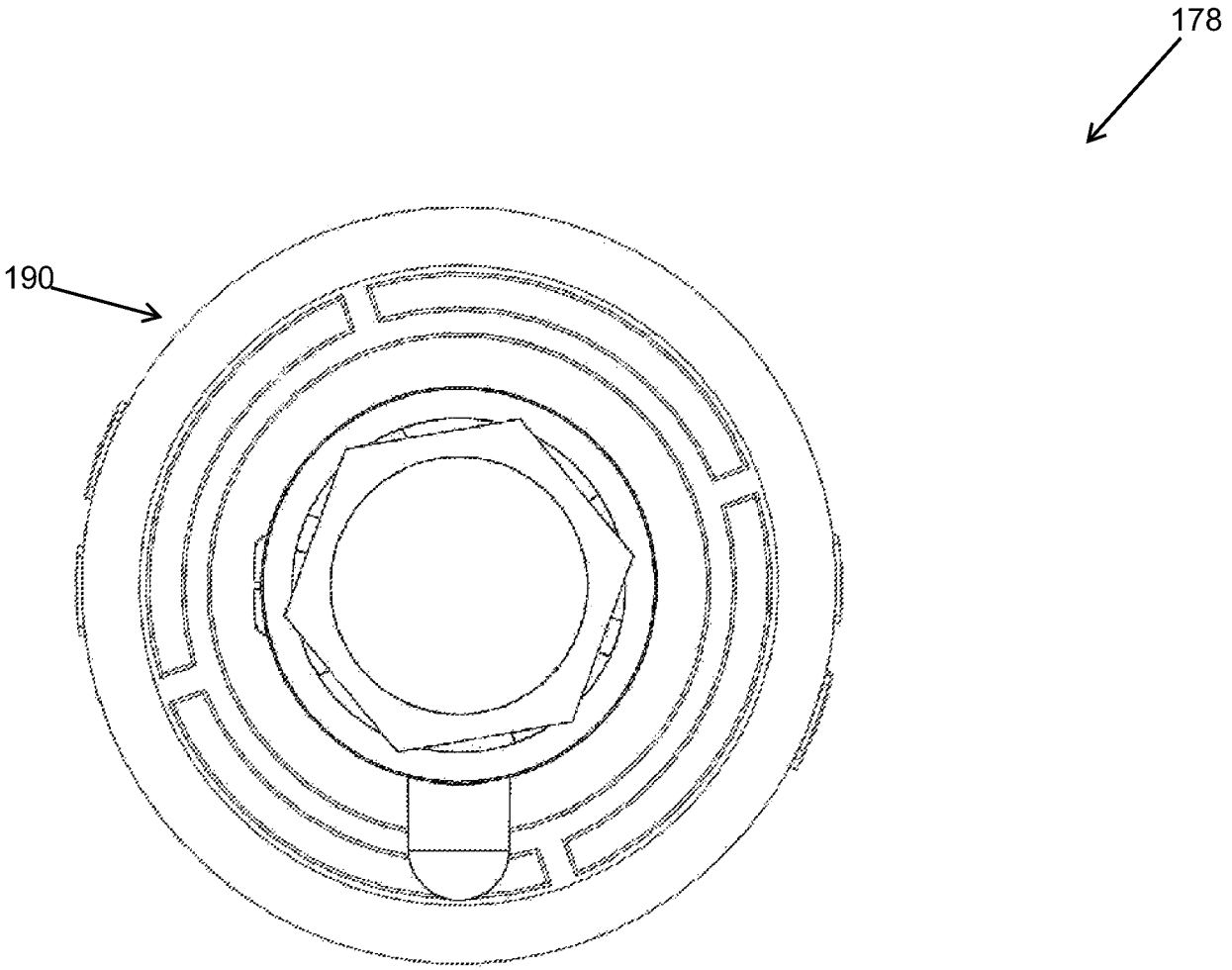
FIG. 80 is a bottom assembled view of a rotational lock assembly, in accordance with one or more embodiments.
Figure 81:
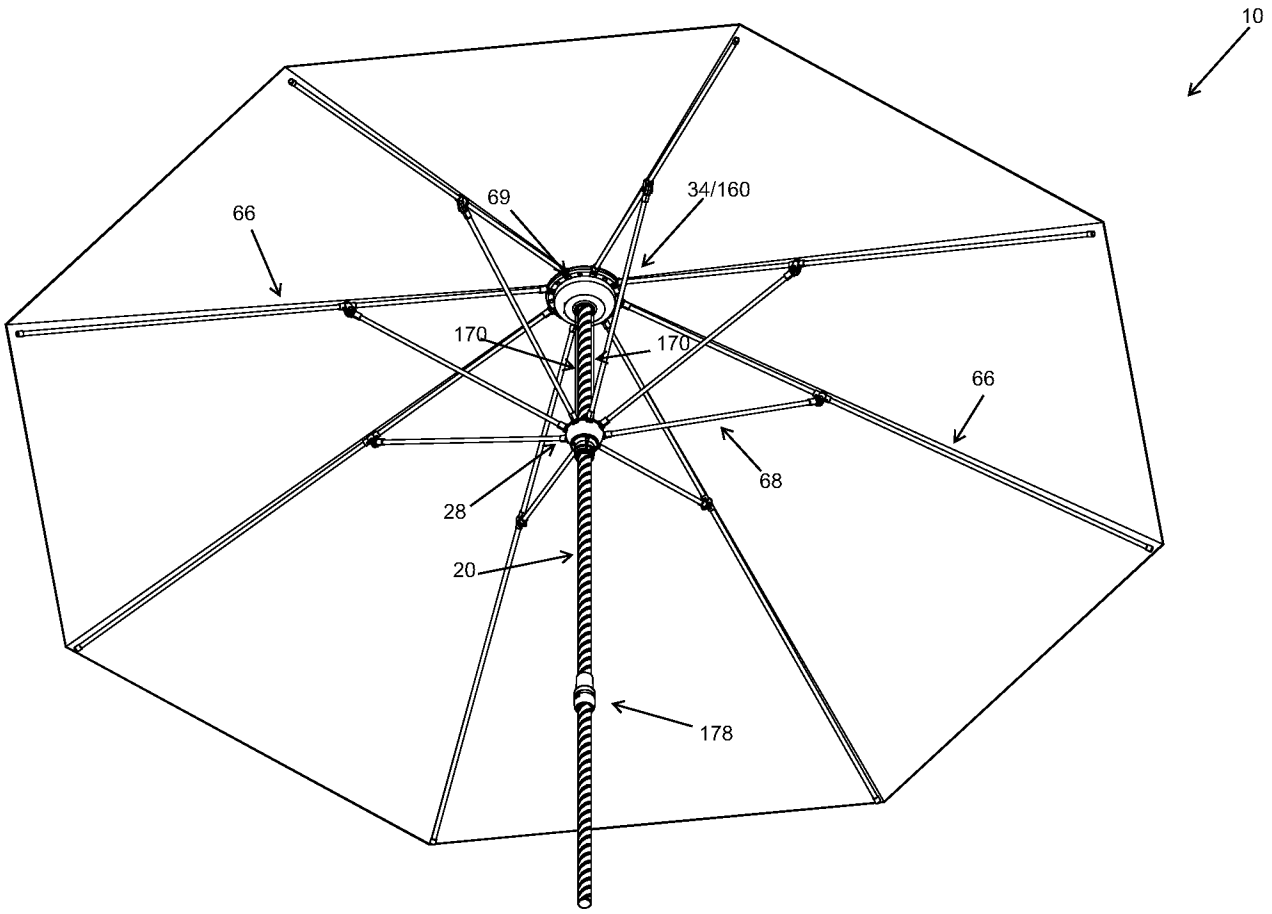
FIG. 81 is a lower perspective view of an umbrella system, in accordance with one or more embodiments; the view showing cords connecting a counterbalance assembly in upper hub to lower hub to apply a counterbalance force to umbrella frame.

In another arrangement, as is shown in FIG. 14, detents 80 are formed of a plurality of protrusions in the exterior surface of rotating tube 20 or a single protrusion that has a plurality of steps or stops therein. In the arrangement shown in FIG. 14 detent 80 includes three positions. That is, there are two recesses in the detent 80 presented which allows for three settings. That is, the fingers 82 can stop in the first recess (the first position), in the second recess (the second position) or past the entire detent (the third position). This arrangement is considered a multi-position detent. This arrangement allows for additional flexibility and control as the umbrella frame 24 can be held in place in a plurality of positions that can accommodate for stretching, give, differences in operation due to environmental conditions, and wear and tear of the umbrella system 10.

Upper Hub 34:

Upper hub 34 is formed of any suitable size, shape, and design and facilitates connection of the upper end of umbrella frame 24 to the upper end of center tube 32. In the arrangement shown, as one example, upper hub 34 includes a connecting collar 84 includes a plurality of recesses therein. These recesses receive the upper end of upper supports 66 and connect thereto with joints 69 that facilitate articulation of umbrella frame 24 during opening and closing. Upper hub 34 includes a cover 86 that covers and protects the area where connecting collar 84 connects to upper supports 66 and prevents water from entering at this point. Upper hub 34 also includes a center cap 88 that covers the upper end of center tube 32 and a pin 90 that connects upper hub 34 to center tube 32, thereby holding upper hub 34 in a non-rotational manner.

An upper bearing 92 is positioned at or near the upper end of rotating tube 20 and rotationally connects rotating tube 20 to non-rotational center tube 32 while facilitating rotation thereon.

Lower Bearing Assembly 33:

Lower bearing assembly 33 is formed of any suitable size, shape, and design. In the arrangement shown, as one example, lower bearing assembly 33 is positioned at the lower end of rotating tube and serves to cover the lower end of rotating tube 20. In this example arrangement, lower bearing assembly 33 includes an upper cover 94 that connects with a lower cover 96. In this example arrangement, when connected together the upper cover 94 and lower cover 96 have a generally spherical shape. In this example arrangement, a lower bearing 92 is positioned at or near the lower end of rotating tube 20 and rotationally connects rotating tube 20 to non-rotational center tube 32 while facilitating rotation thereon. This lower bearing 92 is held within the lower bearing assembly 33 and more specifically within the upper cover 94 and/or lower cover 96. When a table 46 is not used, the combined upper cover 94 and lower cover 96 provide a pleasing aesthetic appearance. In one or more arrangements, lower cover 96 threads onto upper cover 94.

When a table 46 is to be used with the system 10, in one or more arrangements, the lower cover 96 is removed from the upper cover 94 by unthreading the lower cover 96 off of the upper cover 94, thereby exposing locking features 98 in lower collar extension 100. In this position, upper cover 94 is free from lower collar extension 100 and upper cover 94 can be slid vertically along the length of rotating tube 20. Locking features 98 of lower collar extension 100 are any form of a feature or device that facilitates connection of table 46 to lower bearing assembly 33 such as threads, grooves, a bolt or screw, a snap fit feature, or any other manner or method of connecting two components together. In the arrangement shown, as one example, locking features 98 are a plurality of grooves that are sized and shaped to receive a locking feature 102 in table 46 and include a landing area at the top of the grooves that is configured to hold the locking features 102 therein.

More specifically, in one or more arrangements, table 46 includes a center collar 104 that holds a plurality of locking features 102 therein. In this example arrangement, center collar 104 matingly fits over the lower collar extension 100 of lower bearing assembly 33 and the locking features 102 of table 46 matingly engage the locking features 98 of lower bearing assembly 33, thereby connecting table 46 to lower bearing assembly 33 and rotating tube 20. Once the table 46 is fully installed upon the lower collar extension 100 with the locking features 102 of table 46 matingly engage the landing areas of locking features 98 of lower bearing assembly 33, then the upper cover 94 is threaded over the threads in the upper exterior surface of center collar 104 of table 46. In this way, the upper cover 94 locks the table 46 into position on the lower collar extension 100. Any other manner or method of connecting table 46 to either stationary center tube 32 or rotating tube 20 is hereby contemplated for use.

Control Circuit 106:

When umbrella system 10 is motorized, the motor housing assembly 16 includes or is connected to a control circuit 106 that includes or is electrically connected to the electronic components that facilitate operation of the system 10.

Control circuit 106 is formed of any suitable size, shape, and design and is configured to control operation of other components of system 10 to facilitate operation of system 10 in response to input from a user interface 131 (e.g., provided by control(s) 116, wired control 132, wireless control 120, and/or any other device communicatively connected to system and/or in response to signals of sensors 118.

In the arrangement shown, as one example implementation, control circuit 106 includes a processing circuit 228 and memory 114 having software code or instructions that facilitates the computational operation of control circuit 106. Processing circuit 228 may be any computing device that receives and processes information and outputs commands according to software code stored in memory 114.

Memory 114 may be any form of information storage such as flash memory, ram memory, dram memory, a hard drive, or any other form of memory. Processing circuit 228 and memory 114 may be formed of a single combined unit. Alternatively, processing circuit 228 and memory 114 may be formed of separate but electrically connected components. Alternatively, processing circuit 228 and memory 114 may each be formed of multiple separate but communicatively connected components.

Software code is any form of instructions or rules that direct processing circuit 228 how to receive, interpret and respond to information to operate as described herein. Software code or instructions is stored in memory 114 and accessible to processing circuit 228. As an illustrative example, in one or more arrangements, software code or instructions may configure processing circuit 228 of control circuit 106 to control various operations performed by system 10 including but not limited to, for example, turning-on and turning-off motor 40 and controlling the direction of rotation of motor 40 to facilitate opening and closing the umbrella frame 24; operation of upper lighting assembly 230 and lower light right 250; power management and charging of components; and/or other operations described herein.

Communication Circuit 110:

In one or more arrangements, control circuit 106 includes a communication circuit 110. Communication circuit 110 is formed of any suitable size, shape, design, technology, and in any arrangement and is configured to facilitate communication with devices to be controlled, monitored, and/or alerted by control circuit 106. In one or more arrangements, as one example, communication circuit 110 includes a transmitter (for one way communication) or transceiver (for two way communication). In various arrangements, communication circuit 110 may be configured to communicate with various components of system 10 using various wired and/or wireless communication technologies and protocols over various networks and/or mediums including but not limited to, for example, Serial Data Interface 12 (SDI-12), UART, Serial Peripheral Interface, PCI/PCIe, Serial ATA, ARM Advanced Microcontroller Bus Architecture (AMBA), USB, Firewire, RFID, Near Field Communication (NFC), infrared and optical communication, 802.3/Ethernet, 802.11/WIFI, Wi-Max, Bluetooth, Bluetooth low energy, UltraWideband (UWB), 802.15.4/ZigBee, ZWave, GSM/EDGE, UMTS/HSPA+/HSDPA, CDMA, LTE, FM/VHF/UHF networks, and/or any other communication protocol, technology or network.

In one or more arrangements, control circuit 106 includes an antenna 108 connected to a communication circuit 110 to facilitate wireless communication. Antenna 108 is any device that receives and/or transmits wireless control signals.

User Interface 131:

User interface 131 is formed of any suitable size, shape, design, technology, and in any arrangement and is configured to facilitate user control and/or adjustment of various components of system 10. In one or more arrangements, as one example, user interface 131 includes a set of inputs (not shown). Inputs are formed of any suitable size, shape, and design and are configured to facilitate user input of data and/or control commands. In various different arrangements, inputs may include various types of controls including but not limited to, for example, buttons, switches, dials, knobs, a keyboard, a mouse, a touch pad, a touchscreen, a joystick, a roller ball, and/or any other form of user input. Optionally, in one or more arrangements, user interface 131 includes a display (e.g., LEDs 342). Display is formed of any suitable size, shape, design, technology, and in any arrangement and is configured to facilitate display information of settings, sensor readings, time elapsed, and/or other information pertaining to processing of materials by system 10. In one or more arrangements, display may include, for example, LED lights, meters, gauges, screen or monitor of a computing device, tablet, and/or smartphone.

In one or more arrangements, inputs of user interface 131 are implemented by one or more controls 116. Additionally, or alternatively, inputs and/or display of user interface 131 may be implemented on a wired control 132. Additionally or alternatively, in one or more arrangements, the inputs and/or display of user interface 131 may be implemented on a separate device such as wireless control 120 that is communicatively connected control circuit 106.

Wireless control 120 is any device that is capable of transmitting wireless control signals and wirelessly controlling motorized umbrella system 10 and may include a conventional remote control, a handheld device, a home automation system, a cell phone, a laptop, or the like. In one or more arrangements, like control circuit 106, wireless control 120 includes a processing circuit 122, memory 124, a communication circuit 126, an antenna 128 and a power source 130 among other components.

When wireless control 120 transmits a wireless control signal, it is received by antenna 108 of control circuit 106. This signal is transmitted to communication circuit 110 and processed. Communication circuit 110 transmits the processed signal to processing circuit 112. Processing circuit 112 processes the information from communication circuit 110 according to instructions stored in memory 114. When wireless control 120 transmits an open signal, processing circuit 112 opens umbrella system 10; when wireless control 120 transmits a close signal, processing circuit 112 closes umbrella system 10. In an alternative arrangement, a wired control 132 is connected via a cable or other wiring system to control circuit 106 and/or processing circuit 112. In one or more arrangements, the electronic components of the system 10 may additionally or alternatively be powered by this wired connection, which eliminates the need for batteries 44.

In one or more arrangements, a control(s) 116 (or other input of user interface 131) is communicatively connected to motor 40 and/or processing circuit 112. When activated, control(s) 116 operates to power motor 40, thereby opening and closing umbrella frame 24.

In one or more arrangements, processing circuit 112 is configured to monitor one or more sensors 118 and perform one or more operations in response to one or more sensors 118 and/or user inputs satisfying a trigger condition specified by a set of instructions stored in memory 114. Sensor 118 is formed of any sensing device such as a current sensor, a motion sensor, a vibration sensor, or any other form of a sensor. In one or more arrangements, sensor 118 is configured to detect a manual rotation of table 46 and/or rotating tube 20 and when this motion is detected the processing circuit 112 initiates motorized opening or closing of the umbrella frame 24. In one or more arrangements, a sensor 118 is configured to detect when the umbrella frame 24 is in a fully opened and/or fully closed position and to stop movement once this fully opened or fully closed position is achieved and/or when obstruction is detected.

In operation, when motor 40 is activated in response to user input and/or sensors satisfying a trigger condition, processing circuit 112 causes motor 40 to rotates driven gear 38, which meshingly drives around stationary gear 36, thereby rotating motor housing assembly 16 and rotating tube 20. As rotating tube 20 rotates, lower hub 28 is driven along the length of rotating tube 20 by engagement of its teeth 70 with helical groove 22. As lower hub 28 is driven, the umbrella frame 24 articulates upon upper hub 34 and lower hub 28, thereby opening or closing the umbrella frame 24.

When lower hub 28 engages a full open or full closed position, fingers 82 engage detents 80 and the umbrella frame 24 is held in place after the motor 40 ceases to be powered.

Manual System:

While the system shown herein includes a motor 40 and is thereby operated by motorization, a manual system is hereby contemplated wherein motor 40, and the electronic components are removed. In this example arrangement, umbrella frame 24 is raised or lowered by manually. This manual opening or closing can be accomplished by a plurality of manners, which is due in large part to the counterbalance assembly 62 that counteracts the forces of opening umbrella frame 24. The manual umbrella system 10 can be opened by simply grasping the umbrella frame 24, at or near the ends of upper supports 66 and pulling them up or pushing them down until the fingers 82 engage a detent 80 when the umbrella frame 24 is in a fully opened or fully closed position. The manual umbrella system 10 can be opened by simply grasping the rotating tube 20 and rotating it until the fingers 82 engage a detent 80 when the umbrella frame 24 is in a fully opened or fully closed position. The manual umbrella system 10 can be opened by simply grasping the rotating table 46 and rotating it until the fingers 82 engage a detent 80 when the umbrella frame 24 is in a fully opened or fully closed position. In doing so, the umbrella frame 24 is very easy to open due to the counterbalance assembly 62.

Automatic Close Function:

Problems occur when umbrellas are left open, such as when a storm kicks up. As such, in one or more arrangements, system 10 includes an auto-close function that automatically closes umbrella frame 24 upon certain functions or conditions. In one or more arrangements, sensor 118 is a time sensor and the processing circuit 112 is programmed to close the umbrella frame 24 if umbrella system 10 is left open after a predetermined time. In another arrangement, sensor 118 is a light sensor and the processing circuit 112 is programmed to close the umbrella frame 24 if left open after a predetermined darkness level. In another arrangement, sensor 118 is a wind sensor and the processing circuit 112 is programmed to close the umbrella frame 24 if left open and wind exceeds a predetermined threshold. Any other trigger condition can be used and is hereby contemplated for use to initiate an automatic close operation.

Users of umbrella systems (like umbrella system 10 shown and described herein) tend to raise the umbrella frame 24 and open the material 26 for use when the conditions are nice and the wind is low. However, after use of the umbrella system 10 has concluded, users tend to leave the umbrella frame 24 and material 26 in a fully raised and deployed and open position. That is, users tend to forget to close the umbrella frame 24 and material 26. This becomes a problem when the wind picks up, due to the approach of a storm or the like.

When the umbrella frame 24 and material 26 is opened, the elongated length of the combined support pole 12 and rotating tube 20 creates a large lever. When wind picks up, even a slight breeze (not to mention heavy gusts) can generate massive forces on the substantial surface area of the opened umbrella frame 24 and material 26. The combination of the long lever formed by the support pole 12 and rotating tube 20 coupled with the substantial surface area of the opened umbrella frame 24 and material 26, can lead to catastrophic events when the wind increases. This may include:

the wind blowing the umbrella system 10, and any table 46 it is connected to over;

the wind ripping the umbrella system 10 out of its base 14 or table 46 it is held by;

the wind blowing the umbrella system 10 into adjacent buildings, vehicles or other property, thereby causing damage;

the wind blowing the umbrella system 10 into people in the area, thereby causing injury; and/or the wind blowing the umbrella system 10 down to the ground or into another object, thereby damaging or destroying the umbrella system 10.

However, there are often some precursor signs that umbrella system 10 can sense using sensor 118 before these catastrophic events occur. That is, often, when an umbrella system 10 is unintentionally left in a fully open position, and the wind picks up, there are some warning signs that the umbrella system 10 may sense before a catastrophic event occurs, such as the umbrella system 10 tipping over, the umbrella system 10 being ripped out of its base, the umbrella system 10 being damaged or causing damage or injury or the like.

These warning signs of a potential catastrophic wind event often include the movement on the umbrella system 10, vibrations on the umbrella system 10, tilting of the umbrella system 10. To sense this movement, sensor 118 may be formed of an accelerometer sensor, a vibration sensor, a gyro sensor, a tilt sensor, a motion sensor, a wind sensor, a motor movement sensor, a sound sensor, or any other form of a sensor or any combination thereof.

Accelerometer Sensor:

In one or more arrangements, sensor 118 includes an accelerometer sensor, or simply an accelerometer. An accelerometer is any form of a device or sensor that measures acceleration forces which are often caused by movement or vibration of the accelerometer or the device that the accelerometer is attached to. In this application, when an accelerometer is used as sensor 118 attached to umbrella system 10 the accelerometer sensor would sense the acceleration of the umbrella system 10 caused by wind blowing on the umbrella system 10.

Vibration Sensor:

In one or more arrangements, sensor 118 includes a vibration sensor. A vibration sensor is any form of a device or sensor that senses vibration of the vibration sensor or the device that the vibration sensor is attached to. In this application, when a vibration sensor is used as sensor 118 attached to umbrella system 10 the vibration sensor would sense the vibrations of the umbrella system 10 caused by wind blowing on the umbrella system 10.

Gyro Sensor:

In one or more arrangements, sensor 118 includes a gyro sensor. A gyro sensor, also known as angular rate sensors or angular velocity sensors are any form of a device or sensor that sense angular velocity. Also known as a gyroscope, gyro sensors are any form of a sensor that senses or measures orientation and/or angular velocity. In this application, when a gyro sensor is used as sensor 118 attached to umbrella system 10 the gyro sensor would sense the orientation and/or angular velocity of the umbrella system 10 caused by wind blowing on the umbrella system 10.

Tilt Sensor:

In one or more arrangements, sensor 118 includes a tilt sensor, which may also be known as an inclinometer or an inclination sensor. A tilt sensor is any form of a device or sensor that senses the tilt or angular orientation one or multiple axes of a reference plane. In this application, when a tilt sensor is used as sensor 118 attached to umbrella system 10 the tilt sensor would sense the tilt of the umbrella system 10 caused by wind blowing on the umbrella system 10.

Motion Sensor:

In one or more arrangements, sensor 118 includes a motion sensor, which may also be known as a motion detector. A motion sensor is any form of a device or sensor that senses or detects moving objects. Motion sensors may include an optical, microwave, RF, IR, acoustic, visible light, radar, LIDAR, or any other form of a sensor that can sense changes surrounding the sensor. In this application, when a motion sensor is used as sensor 118 attached to umbrella system 10 the motion sensor would sense the motion of the umbrella system 10, or the area around the umbrella system 10, caused by wind blowing on the umbrella system 10.

Wind Sensor:

In one or more arrangements, sensor 118 includes a wind sensor, which may also be known as an anemometer or wind direction sensor or wind profiler. A wind sensor is any form of a device or sensor that senses the wind. In this application, when a wind sensor is used as sensor 118 attached to umbrella system 10 the wind sensor would sense the wind blowing on the umbrella system 10.

Motor Movement Sensor:

In one or more arrangements, sensor 118 includes a motor movement sensor. A motor movement sensor is any form of a device or sensor that senses when the motor 40 is moving. When energy is passed through motor 40 the motor 40 moves. However, when motor 40 is moved, the motor 40 generates energy (current and/or voltage). Or, said another way, every motor 40 becomes a generator when it is driven or forced to rotate. When motor 40 is forced to rotate, motor 40 generates energy (current and/or voltage). When sensor 118 is a motor movement sensor, sensor 118 senses the generation of this current and/or voltage. In this particular application, motor 40 is operably connected to umbrella frame 24 and rotating tube 20 having helical grooves 22 therein. When motor 40 operates, motor 40 causes rotating tube 20 to rotate which drives umbrella frame 24 open or closed through its connection to the helical grooves 22 in the exterior surface of rotating tube 20 by way of lower hub 28. In contrast, when wind blows, a force is applied onto umbrella frame 24. This force may cause umbrella frame 24 to move upward or downward. As umbrella frame 24 moves upward or downward, lower hub 28 by way of its connection to helical grooves 22 may cause rotating tube 20 to rotate which in-turn causes motor 40 to rotate, thereby generating an electrical disturbance (voltage and/or current spike) which is then sensed by motor movement sensor. In this application, when a motor movement sensor is used as sensor 118 attached to umbrella system 10 the motor movement sensor would sense the movement of the umbrella system 10 caused by wind blowing on the umbrella system 10.

Sound Sensor:

In one or more arrangements, sensor 118 includes a sound sensor which may also be known as a microphone or an acoustic sensor. A sound sensor is any form of a device or sensor that senses sound. In this application, when a sound sensor is used as sensor 118 attached to umbrella system 10 the sound sensor would sense the sound in the area of the umbrella system 10 caused by wind blowing on the umbrella system 10.

Any other form of a sensor or any combination of sensors is hereby contemplated for use as sensor 118. The use of multiple sensors 118 provides redundancy and higher accuracy and therefore is preferred. The use of multiple sensors 118 that include different types of sensors also provides redundancy and higher accuracy and therefore is preferred.

In the arrangement shown, as one example, the sensor 118 or sensors 118 sense the conditions that umbrella system 10 is exposed to. This information, or the sensed conditions, is transmitted by sensor 118 to processing circuit 112 of control circuit 106. Using software, instructions, code and/or algorithms, processing circuit 112 tracks the sensed conditions of or surrounding umbrella system 10 and determines whether a qualifying disturbance has occurred. That is, using software, instructions, code and/or algorithms, processing circuit 112 tracks the sensed conditions of or surrounding umbrella system 10 and determines whether the wind is increasing to the point that it is likely that a catastrophic event could occur. If a qualifying disturbance occurs, and the umbrella frame 24 is in a partially or wholly raised position, which in one or more arrangements is information that the control circuit 106 and/or processing circuit 112 tracks, then the control circuit 106 and/or processing circuit 112 initiates an auto-close operation. In the arrangement shown, as one example, an auto-close operation causes the motor 40 to drive the rotating tube 20 in a closing direction, thereby closing the umbrella frame 24. By closing the umbrella frame 24 this causes the umbrella frame 24 and material 26 to collapse along the rotating tube 20, thereby substantially reducing its surface area and thereby substantially reducing the potential that wind will knock the umbrella system 10 over or rip the umbrella system 10 out of its base 14 or otherwise affect umbrella system 10.

Automatic Close Only:

In one or more arrangements, umbrella system 10 includes an automatic close function only. Or, said another way, in one or more arrangements, umbrella system 10 does not include an auto-open function. That is, it is desirable for umbrella system 10 to automatically close itself when the umbrella system 10 senses that the wind is picking up so as to prevent a catastrophic event. However, it would not be desirable for the umbrella system 10 to have an auto-open function wherein the umbrella system 10 opens when wind increases or when wind decreases. That is, in one or more arrangements, it is desirable to require user interaction (press of a button of wireless control 120, wired control 132 or any other manner of operation, etc.) to open the umbrella system 10 while allowing the umbrella system 10 to either be closed by user interaction (press of a button of wireless control 120, wired control 132 or any other manner of operation, etc.) or by an automatic close movement.

Delay Timer:

In one or more arrangements, umbrella system 10 includes a delay timer associated with the automatic close function. That is, in many cases, when an umbrella system 10 is opened by user interaction, such as by press of a button of wireless control 120, wired control 132 or any other manner of operation, etc., for a period of time thereafter it is likely that the person that opened the umbrella system 10 will use the umbrella system 10. During this use it is likely that the user interaction with the umbrella system 10 could be sensed by sensors 118 as a qualifying disturbance which would then cause the initiation of an automatic close operation. However, it is highly undesirable to have the umbrella system 10 automatically close when a user is using the umbrella system 10.

As such, to avoid this possibility, in one or more arrangements, umbrella system 10 includes a delay timer function. This delay timer function delays the automatic closing function. That is, as one demonstrative example, the delay timer is 1-hour. In this example, when a user interacts with the umbrella system 10 and opens the umbrella system 10, for the period of 1-hour thereafter the umbrella system 10 is prevented from automatically closing. This prevents the umbrella system from automatically closing on the user when they are using the umbrella system 10. After the expiration of the delay timer, the umbrella system 10 may again initiate an automatic close function when a qualifying disturbance is detected using sensors 118.

In an alternative arrangement, as one example, umbrella system 10 includes a delay timer that after the expiration of the delay timer the umbrella system 10 automatically closes. This delay timer is another way to prevent catastrophic events from occurring by closing the umbrella system 10 when it was left opened for an extended period of time. That is, as one example, the delay timer is 7-hours. In this example, 7-hours after the umbrella system 10 was initially opened the control circuit 106 and/or processing circuit 112 initiates an automatic close function, thereby automatically closing the umbrella system 10 under the assumption that it was forgotten.

Detection of People:

In one or more arrangements, when sensor 118 is a motion sensor, the motion sensor is configured to detect when people are in the vicinity of the umbrella system 10. And, when people are in the vicinity of the umbrella system 10 the control circuit 106 is configured to not automatically close the umbrella system 10 as these people are likely using or enjoying the opened umbrella system 10 and if they wanted to close the umbrella system 10 then all they would have to do is manually interact with umbrella system, such as press of a button of wireless control 120, wired control 132 or any other manner of operation, etc. to close the umbrella system 10. Or, said another way, if people are in the vicinity of the umbrella system 10, it is likely that an approaching storm is not likely, and if it is these people can close the umbrella system 10. As such, when motion sensor senses people are in the vicinity of the umbrella system 10, and for a predetermined period of time thereafter, automated movements, such as an automatic close operation, is prevented by control circuit 106 and/or processing circuit 112.

Detecting whether people are in the vicinity of umbrella system 10 and temporarily or for a predetermined amount of time thereafter stopping or preventing automated movements is desirable because the presence of people can create conditions that sensors 118 could interpret as a qualifying disturbance (such as increasing wind). Or, said another way, when people are using umbrella system 10 these people can create conditions that sensors 118 could determine is an increased wind and therefore cause the umbrella system 10 to close, which is undesirable if people are using the umbrella system 10. And, if people are around umbrella system 10 and the wind is increasing, these people can simply close the umbrella system 10. As such, in this example arrangement, when people are detected by motion sensor 118 automated movements are suspended.

Audible Warning:

In one or more arrangements, when umbrella system 10 includes an automatic close (or if it exists, an automatic open) function, umbrella system 10 also includes an audible warning. That is, in this example arrangement, when control circuit 106 determines that a qualifying disturbance has occurred, or a delay timer has expired and it is time to automatically close the umbrella system 10, the umbrella system 10 initiates an audible warning or indication indicating to users in the vicinity that the umbrella system 10 is planning to automatically close.

This audible warning serves two purposes. First, if users are in the area of the umbrella system 10 and they hear the audible warning and they do not want the umbrella system 10 to automatically close they can intervene by interacting with the umbrella system 10 (e.g. press of a button of wireless control 120, wired control 132 or any other manner of operation, etc.), thereby stopping the automatic close function. Second, the issuance of this audible warning gives users in the area time to move out of the way of the umbrella system 10 before it begins to close. This gives the users in the area the ability to avoid injury.

In one or more arrangements, the audible waring is issued prior to the automatic close (or if it exists the automatic open) function. In one or more arrangements, the audible warning is issued during all or a part of the movement of the umbrella system 10 and/or for a predetermined amount of time thereafter. The issuance of this audible warning during the movement of the umbrella system 10 allows users to stay clear of the umbrella system 10 as it moves, thereby avoiding injury and interference.

In one or more arrangements, sensor 118 is contained within the components of umbrella system 10. In one or more arrangements, sensor 118 is contained within the hollow interior of container 41. In one or more arrangements, sensor 118 is contained on a printed circuit board of control circuit 106. In one or more arrangements, sensor 118 is contained within a housing of control circuit 106. In one or more arrangements, sensor 118 is contained within the hollow interior of rotating tube 20. In one or more arrangements, sensor 118 is contained within the hollow interior of stationary support pole 12. It is hereby contemplated that sensor 118 may be contained within any other portion of umbrella system 10. Containing sensor 118 within one of the components of umbrella system 10 provides the benefit of providing a self-contained unit, which is a benefit. Another benefit of containing sensor 118 within one of the components of umbrella system 10 is that this shields and protects sensor 118. Another benefit of containing sensor 118 within one of the components of umbrella system 10 is that this shielding can help eliminate some of the noise or other external variations from affecting the results provided by sensor 118 which can lead to a higher quality of data and thereby improved sensing of qualifying disturbances. In one or more arrangements, an algorithm or other software, code or programming is used to evaluate the results of sensor 118 so as to determine if a qualifying disturbance has been detected, which improves the quality of results and operation.

Alternative Arrangement:

In the arrangement shown, as one example, with reference to FIGS. 27-35 an alternative arrangement of motorized umbrella system 10 is presented. The arrangement shown in FIGS. 27-35 is similar to the motorized umbrella system 10 shown in FIGS. 21-26 and as such the disclosure related to the arrangement shown in FIGS. 21-26 applies to the arrangement shown in FIGS. 27-35 unless stated specifically herein. Similarly, the arrangement shown in FIGS. 27-35 is similar to the umbrella system 10 shown in FIGS. 1-20 and as such the disclosure related to the arrangement shown in FIGS. 1-20 applies to the arrangement shown in FIGS. 27-35 unless stated specifically herein.

System 10:

In the arrangement shown, as one example, motorized umbrella system 10 includes a support pole 12, a lower bearing assembly 33 having a lower cover 96 and an upper cover 94, a rotating tube 20 having a center tube 32 and a counterbalance assembly 62 therein, a motor housing assembly 16 having a battery holder 45, a power source 42 including a plurality of batteries 44, a motor 40 having a gear assembly 40B and a drive shaft 40A that connects to a driven gear 38, a motor support 134, a ring gear housing 136 having a ring gear 138 and a connection assembly 140, a container 41 having a plurality of flanges 142, a top cap 144 and a seal 146, among other features and elements. These elements and features are similar if not identical to those features described herein unless specifically stated otherwise.

Support Pole & Lower Bearing Assembly 33:

In the arrangement shown, as one example, motorized umbrella system 10 includes a support pole 12 as is described herein. In the arrangement shown, as one example, a lower bearing assembly 33 is connected to the upper end of the support pole 12 and is comprised of a lower cover 96 that connects to an upper cover 94, as is described herein. In the arrangement shown, as one example, lower bearing assembly 33 connects the upper end of support pole 12 to the lower end of rotating tube 20, which contains center tube 32 and counterbalance assembly 62 therein, as is described herein. In the arrangement shown, as one example, lower bearing assembly 33 connects the upper end of support pole 12 to the lower end of rotating tube 20 while allowing the rotation of rotating tube 20.

Battery Holder 45:

In the arrangement shown, as one example, motorized umbrella system 10 includes a battery holder 45. Battery holder 45 is formed of any suitable size, shape, and design and is configured to enclose the lower end container 41 while also holding various components of the motorized umbrella system 10 such as batteries 44, the lower end of motor 40, among other components. In the arrangement shown, as one example, battery holder 45 fits around rotating tube 20 and includes a lower section 148 that encloses the lower end of container 41 and serves to receive the lower end of batteries 44, motor 40 and other components positioned within container 41. When viewed from above or below, the exterior peripheral edge of lower section 148 is generally circular in shape so as to fit within the generally cylindrical hollow interior of container 41 when the lower end of container 41 is placed over battery holder 45, thereby enclosing the components held by battery holder 45.

In the arrangement shown, as one example, a collar 150 extends upward from lower section 148 of battery holder 45. Collar 150 has a smaller diameter than lower section 148 and fits around rotating tube 20 while allowing rotating tube 20 to rotate.

In the arrangement shown, as one example, the lower end of lower section 148 includes a recess 152. Recess 152 is formed of any suitable size, shape, and design and is configured to facilitate the attachment of battery holder 45 to lower bearing assembly 33. In the arrangement shown, as one example, recess 152 includes features that mesh with features in the exterior surface of upper cover 94 such that when battery holder 45 is placed on top of lower bearing assembly 33 the battery holder 45 meshes with upper cover 94. In this way, this engagement between the features of recess 152 with the features of upper cover 94 provide alignment for battery holder 45 and prevent the rotation of battery holder 45 when rotating tube 20 rotates.

In the arrangement shown, as one example, battery holder 45 holds power source 42 therein, which in the arrangement shown is a plurality of batteries 44, however, any other form of a power source is hereby contemplated for use, such as line power, solar power, wireless power, and/or any other source of power. In one or more arrangements, batteries 44 are rechargeable batteries such that the user can periodically charge the batteries 44 and then use the motorized umbrella system 10 multiple times, perhaps for an entire season, before having to re-charge the batteries. In one or more arrangements, batteries 44 are electrically connected to solar panel 274 which recharges the batteries 44 when exposed to sunlight. In one or more arrangements, solar panel 274 is connected to the upper end of upper hub 34, in another arrangement; the solar panel 274 is connected to and/or integrated into the material 26, such as using a flexible solar panel film. Any other manner of charging and/or powering motorized umbrella system 10 is hereby contemplated for use.

Motor Support 134:

In the arrangement shown, as one example, a motor support 134 is positioned above battery holder 45. Motor support 134 is formed of any suitable size, shape, and design and is configured to hold motor 40 therein as well as connect to battery holder 45. In the arrangement shown, as one example, motor support 134 is a generally disc-shaped member that extends around rotating tube 20 in a generally circular shape when viewed from above or below. In the arrangement shown, as one example, motor support 134 includes a honeycomb-shaped support structure that extends across its disc-shaped body to provide structural rigidity while also minimizing material usage and weight.

In the arrangement shown, as one example, the upper end of motor 40 is connected to and held by motor support 134 and the drive shaft 40A extends through the motor support 134. In this example arrangement, motor 40 and gear assembly 40B are positioned below motor support 134 while driven gear 38 is positioned above motor support 134.

In the arrangement shown, as one example, motor support 134 connects to battery holder 45. More specifically, in the arrangement shown, as one example, the center portion of motor support 134 includes features that engage and lock with features in the upper end of the center portion of collar 150 of battery holder 45. In this way, when motor support 134 is engaged with and locked with battery holder 45, motor support 134 remains stationary as rotating tube 20 rotates due to the mating and locking engagement between the recess 152 of battery holder 45 with the features of upper cover 94 of lower bearing assembly 33.

Ring Gear Housing 136:

In the arrangement shown, as one example, a ring gear housing 136 is positioned above motor support 134. Ring gear housing 136 is formed of any suitable, size, shape, and design and is configured to hold and house ring gear 138 as well as connect to rotating tube 20. In the arrangement shown, as one example, ring gear housing 136 is a generally circular shaped member having an open lower end that includes ring gear 138 that extends around the interior facing surface of the outward edge of ring gear housing 136. Ring gear 138 is configured to mesh with driven gear 38 and as such, as motor 40 rotates, driven gear 38 rotates. As driven gear 38 rotates, due to the meshing engagement between driven gear 38 and ring gear 138, ring gear 138 is driven. Due to the engagement between motor 40 with motor support 134, and the engagement between motor support 134 with battery holder 45, and the engagement between battery holder 45 with upper cover 94 of lower bearing assembly 33, and the engagement between lower bearing assembly 33 and the stationary support pole 12, the motor 40 remains stationary while the ring gear 138 and ring gear housing 136 rotate around motor 40.

In the arrangement shown, as one example, ring gear housing 136 engages and locks onto rotating tube 20 such that when ring gear 138 and ring gear housing 136 rotates so rotates rotating tube 20. In one or more arrangements, ring gear housing 136 may connect to and lock onto rotating tube 20 by any manner, method or means including but not limited to, for example, screwing, bolting, snap-fitting, friction fitting, pinning, pinching, welding, adhering, affixing, interlocking, magnetic connection, and/or any other way of connecting two components together. In the arrangement shown, as one example, to facilitate the locking engagement between ring gear housing 136 and rotating tube 20, ring gear housing 136 includes a connection assembly 140. In the arrangement shown, as one example, connection assembly 140 is connected to the upper interior edge of ring gear housing 136 and is configured to engage and lock onto rotating tube 20. In the arrangement shown, as one example, connection assembly 140 is formed of a plurality of fingers that extend upward from the upper center edge of ring gear housing 136 and are configured to pinch onto the exterior surface of rotating tube 20. However, any other configuration is hereby contemplated for use.

Container 41:

In the arrangement shown, as one example, a container is positioned above and around battery holder 45, motor support 134 and ring gear housing 136. Container 41 is formed of any suitable size, shape, and design and is configured to fit around and shelter the internal components of motor housing assembly 16. In the arrangement shown, as one example, container 41 is a generally cylindrical shaped member that fits around rotating tube 20 and includes a closed upper end, a generally cylindrical exterior surface having a plurality of flanges 142 that extend outward therefrom in spaced relation to one another, and a hollow lower end that is configured to receive battery holder 45, motor support 134, ring gear housing 136, and other components therein.

In the arrangement shown, as one example, a threaded collar 154 extends upward from the upper center end of the upper end of container 41. In the arrangement shown, as one example, threaded collar 154 is configured to receive top cap 144 in threaded engagement. In the arrangement shown, as one example, top cap 144 is a ring-shaped member that fits around rotating tube 20 and includes threads in its interior surface that thread with the threads of threaded collar 154 of container 41. In the arrangement shown, as one example, seal 146 is a ring shaped member that fits around rotating tube 20 and seals to the exterior surface of rotating tube and seals the upper end of container 41 and top cap 144 so as prevent water and moisture from entering the hollow interior of container 41. In one or more arrangements, seal 146 is formed of a silicone, rubber, or composite material that is flexible and compressible and forms a waterproof or water-resistant seal.

In the arrangement shown, as one example, motor housing assembly 16 is assembled on support pole 12 and rotating tube 20 by placing battery holder 45 on top of lower bearing assembly 33 such that the features of the recess 152 of battery holder 45 engage the features of upper cover 94 of lower bearing assembly 33. In one or more arrangements, motor support 134 is lowered onto battery holder 45 until the features at the upper end of collar 150 of battery holder 45 engage and lock with the motor support 134. In one or more arrangements, mechanical fasteners, such as screws or bolts are used to lock battery holder 45 and motor support 134 together by passing these mechanical fasteners through motor support 134 and into battery holder 45 and thereafter tightening the two components together. In this example arrangement, ring gear housing 136 is placed over motor support 134 causing the teeth of driven gear 38 to mesh with the teeth of ring gear 138. In this example arrangement, container 41 is lowered over battery holder 45, motor support 134 and ring gear housing 136 until the connection assembly 140 of ring gear housing 136 is received within the cylindrical opening at the upper center of container 41 adjacent threaded collar 154. In this example arrangement, top cap 144 is placed around rotating tube 20 and threaded onto threaded collar 154 and seal 146 is placed over the upper end of top cap 144. As threaded collar 154 is tightened this causes connection assembly 140 to tighten against rotating tube 20. In doing so, the engagement between connection assembly 140 of ring gear housing 136 locks top cap 144, container 41 and ring gear housing 136 to rotating tube 20 such that as rotating tube 20 rotates, so rotates top cap 144, container 41, ring gear housing 136 and seal 146. Or, said another way, as driven gear 38 is driven by motor 40, ring gear 138, ring gear housing 136, container 41, top cap 144 and rotating tube 20 rotate as battery holder 45, motor support 134, motor 40 and batteries 44 remain stationary due to their connection to lower bearing assembly 33. This arrangement provides a strong, sound, moisture resistant, convenient, and easy to use system that operates efficiently and quietly.

Flanges and Manual Movement to Initiate Motorized Movement:

In the arrangement shown, as one example, the exterior peripheral edge of container 41 includes a plurality of flanges 142. Flanges 142 are formed of any suitable size, shape, and design and are configured to facilitate engagement of the container 41 by a user so as to facilitate or initiate a motorized open movement or a motorized close movement. In the arrangement shown, as one example, flanges 142 are flat extensions that extend outward in alignment with the axis of rotation of container 41. In the arrangement shown, as one example, flanges connect at their upper end adjacent the upper end of the exterior sidewall of container 41 and extend downward as they extend outward at an angle before curving toward the lower end of the exterior sidewall of container 41. In this way, when viewed from the side, flanges 142 form approximately half of a teardrop shape that extends outward from the exterior sidewall of container 41. However, any other shape is hereby contemplated for use. In the arrangement shown, as one example, a plurality of flanges are equally spaced around the exterior peripheral edge of container 41.

In the arrangement shown, as one example, a user initiates a motorized open or motorized close operation by grasping one of the flanges 142 and rotating the container 41. As container 41 is fixed to ring gear housing 136 and rotating tube 20, the rotation of container 41 cause ring gear housing 136 and ring gear 138 to rotate. As ring gear housing 136 and ring gear 138 rotate, this drives driven gear 38 through its meshed engagement with the teeth of ring gear 138. This driving of driven gear 38 drives motor 40. When a motor is driven it becomes a generator. As such, as the container 41 is rotated by a user, this drives the motor 40, which causes the generation of voltage and/or current that is then sensed by a current or voltage sensor which is described herein as a motor movement sensor.

That is, in one or more arrangements, control circuit 106 includes a sensor 118 that is a motor movement sensor. A motor movement sensor is any form of a device or sensor that senses when the motor 40 is moving. When energy is passed through motor 40, the motor 40 moves. However, when motor 40 is moved, the motor 40 generates energy (current and/or voltage). Or, said another way, every motor 40 becomes a generator when it is driven or forced to rotate. When motor 40 is forced to rotate, by a user grasping a flange 142 and rotating container 41, motor 40 generates energy (current and/or voltage). When sensor 118 is a motor movement sensor, sensor 118 senses the generation of this current and/or voltage. In this case, when a user grasps a flange 142 and rotates container 41 this causes the internal components of motor 40 to rotate, thereby generating an electrical disturbance (voltage and/or current spike) which is then sensed by motor movement sensor 118. In this application, when a motor movement sensor 118 senses this manual movement, processing circuit 112 and/or control circuit 106 is programmed to power motor 40 and move umbrella frame 24 from an open position to a closed position, or alternatively from a closed position to an open position.

As the motor 40 rotates driven gear 38, driven gear 38 causes ring gear housing 136, container 41 and rotating tube 20 to rotate. As rotating tube 20 rotates umbrella frame 24 is opened or closed in the manners described herein through the engagement of lower hub 28 with helical groove 22.

The use of flanges 142 and the initiation of a motorized movement by a user slightly rotating container 41 provides an easy to use system that eliminates buttons or switches. Buttons or switches are undesirable because they can be hard to find, which is especially true for umbrellas where the material 26 hangs down in a closed position and covers most if not all of the support pole, which makes finding a button or switch difficult. In addition, buttons or switches may be undesirable because they are expensive, complicated, and can fail due to corrosion, which is prevalent in outdoor applications, especially in salt-water environments.

In contrast, the use of flanges 142 on container 41 is easy to use because even when the material 26 covers the container 41, the user can simply grasp any of the multiple flanges 142 and rotate container 41, thereby initiating a motorized movement. This does not require any precision by the user and is fast and easy. As such, the convenience of this arrangement is unmatched. In addition, this provides a robust solution that eliminates buttons and/or switches.

This solution allows the user to operate the umbrella system 10 from any position around container 41. This coupled with the use of a wireless control 120 and/or a wired control 132, coupled with a wind disturbance function that senses wind and closes the umbrella frame, provides an unprecedented ability to control the operation of an umbrella system 10.

Obstruction and Position Detection by Motor Movement Sensor 118: In one or more arrangements, control circuit 106 is configured to monitor motor movement sensor 118 when opening and/or closing umbrella frame 24 to detect when umbrella frame 24 has reached the fully opened or fully closed positions and/or to detect if umbrella frame 24 is obstructed (e.g., by a person). In one or more arrangements, processing circuit 112 and/or control circuit 106 monitor current using motor movement sensor 118 when moving umbrella frame 24. When umbrella frame 24 becomes obstructed or reaches the fully opened or fully closed positions, workload on motor 40 increases, which causes electric current drawn by motor 40 to increase. When measured current exceeds a predetermined threshold (e.g., stored in memory 114) processing circuit 112 of control circuit 106 halts operation of motor 40.

Brake: In some applications, when the umbrella frame 24 is fully opened or fully closed it can have a tendency to drift, or not hold its fully opened or fully closed position, which is undesirable. In one or more arrangements, to resolve this problem, when umbrella frame 24 has been fully opened or fully closed or has reached its desired position, control circuit 106 connects the positive lead of motor 40 to the negative lead of motor 40, thereby instituting an internal brake. When the internal brake is turned on, motor 40 provides resistance to further movement which helps to hold the position of the umbrella frame 24 and prevents drift of the umbrella frame 24.

This is often referred to as shorting the motor 40 by connecting the positive lead to the negative lead. In one or more arrangements, this shorting of the positive lead of motor 40 to the negative lead of motor 40 is accomplished using a switch. In one or more arrangements, this shorting of the positive lead of motor 40 to the negative lead of motor 40 is accomplished using what is known as an H-Bridge, or H-Bridge circuit which is an electronic circuit that switches the polarity of a voltage applied to a load, among other circuitry that may be used. This arrangement utilized the internal resistance of motor 40 to hold the position of umbrella frame 24 in place.

In one or more arrangements, due to the limitations of counterbalance assembly 62 and/or the spring 72 of the counterbalance assembly 62, the torque profile of the umbrella frame 25 is not perfectly matched by the torque profile of the counterbalance assembly 62. In one or more arrangements, this results in the umbrella frame 24 being under-sprung at the open position, meaning that the counterbalance assembly 62 is providing less counterbalance force than the weight of the umbrella frame 24 meaning that the umbrella frame 24 has a tendency to sag at the fully opened position; and this results in the umbrella frame 24 being over-sprung at the closed position, meaning that the counterbalance assembly 62 is providing more counterbalance force than the weight of the umbrella frame 24 meaning that the umbrella frame 24 has a tendency to pop-up or slightly open at the fully closed position. Applying the internal brake of motor 40 by shorting the positive lead to the negative lead helps to hold umbrella frame 24 in a tight and fully expanded position in the fully opened position that resists the under-sprung nature of counterbalance assembly 62 at the fully opened position. Applying the internal brake of motor 40 by shorting the positive lead to the negative lead helps to hold umbrella frame 24 in a tight and compact position in the fully closed position that resists the over-sprung nature of counterbalance assembly 62 at the fully closed position.

When the internal brake is used, the control circuit 106 is configured to turn off the brake when a motorized movement command is detected. Turning off this brake of motor 40 allows for free manual movement, and/or motorized opening and closing. That is, control circuit 106 turns off this brake when the control circuit 106 initiates motorized movement of motor 40.

In these ways, the use and application of an internal brake utilizing motor 40 is a simple, easy to use and efficient manner of improving the functionality of umbrella system 10 that utilizes the existing components of the system 10 and does not require the addition of a separate mechanical brake assembly to the system 10.

Alternative Arrangement:

In the arrangement shown, as one example, with reference to FIGS. 36-81 an alternative arrangement of motorized umbrella system 10 is presented. The arrangement shown in FIGS. 36-81 is similar to the motorized umbrella system 10 shown in FIGS. 27-35 and as such the disclosure related to the arrangement shown in FIGS. 27-35 applies to the arrangement shown in FIGS. 36-81 unless stated specifically herein. Similarly, the arrangement shown in FIGS. 36-81 is similar to the motorized umbrella system 10 shown in FIGS. 21-26 and as such the disclosure related to the arrangement shown in FIGS. 21-26 applies to the arrangement shown in FIGS. 36-81 unless stated specifically herein. Similarly, the arrangement shown in FIGS. 36-81 is similar to the motorized umbrella system 10 shown in FIGS. 1-20 and as such the disclosure related to the arrangement shown in FIGS. 1-20 applies to the arrangement shown in FIGS. 36-81 unless stated specifically herein.

System 10:

In the arrangement shown, as one example, motorized umbrella system 10 includes a support pole 12, a base 14, a motor housing assembly 16, a table 46, a rotating tube 20 having one or more helical grooves 22 therein, a center tube 32, an umbrella frame 24 that supports fabric or material 26 and is connected to a movable lower hub 28, a counterbalance assembly 160, and a rotational locking assembly 178 among other features and elements. In this example arrangement, support pole 12, base 14, motor housing assembly 16, table 46, rotating tube 20, center tube 32, umbrella frame 24 and material 26, and movable lower hub 28 are similar if not identical to those features previously described herein unless specifically stated otherwise.

Counterbalance Assembly 160:

In the arrangement shown, as one example, system 10 includes a counterbalance assembly 160. Counterbalance assembly 160 is formed of any suitable size, shape, and design and is configured to provide a counterbalance force that counteracts the forces involved in raising and lowering umbrella frame 24.

In the arrangement shown, counterbalance assembly 160 is positioned within a hollow interior 158 formed by collar 84 and cover 86 of upper hub 34. Components of counterbalance assembly 160 may be directly or indirectly connected to upper hub 34 by any manner, method or means such as threading, bolting, pinning, riveting, gluing, welding, or any other manner of connection. In this alternative arrangement, upper hub 34 is any is formed of any suitable size, shape, and design and is configured to support and enclose counterbalance assembly 160 while facilitating connection of upper hub 34 with the upper end of umbrella frame 24, the upper end of center tube 32, and the upper end of rotating tube 20.

In the arrangement shown, as one example, the counterbalance assembly 160 is included in system 10 in lieu of counterbalance assembly 62. However, it is contemplated that, in one or more arrangements, system 10 may include both counterbalance assembly 160 and counterbalance assembly 62.

Spools 162:

In the arrangement shown, as one example, counterbalance assembly 160 includes two spools 162 positioned within the hollow interior 158 of upper hub 34. Spools 162 are formed of any suitable size, shape, and design and are configured to facilitate spooling of cord 170. In the arrangement shown, as one example, each spool 162 has an elongated cylindrical shape extending between a first end 164 and a second end 166. In this example arrangement, spools 162 are operably connected to upper hub 34 and are configured to rotate about a horizontal axis to facilitate spooling of cord 170. However, it is contemplated in some embodiments, that spools 162 may be operably connected to rotate about a non-horizonal axis. While the arrangement shown includes two spools 162, the embodiments are not so limited. Rather, it is contemplated that counterbalance assembly 160 may include more or fewer spools 162 in one or more embodiments.

Spring Assemblies 168:

In one or more arrangements, counterbalance assembly 160 includes a set of spring assemblies 168 positioned within the hollow interior 158 of upper hub 34. Spring assemblies 168 are formed of any suitable size, shape, and design and are configured to facilitate spooling and tensioning of cord 170. In the arrangement shown, as one example, counterbalance assemblies 160 include spring spools upon which ribbon springs (not shown) can be attached to form a spring assembly 168. However, embodiments are not so limited. Rather, it is contemplated that spring assembly 168 may use any type of constant force or variable force spring including, for example, ribbon springs, torsion springs, compression springs, extension springs, Belleville springs, drawbar springs, volute springs, garter springs, flat springs, and/or gas springs, among others.

In the arrangement shown, as one example, a respective spring assembly 168 is operably connected to each side of the two spools 162. However, it is contemplated that counterbalance assembly 160 may include more or fewer spring assemblies 168 in one or more embodiments. In this example arrangement, spring assemblies 168 may be constant force springs, variable/gradient force springs, or a combination of constant force springs and variable/gradient force springs. Spring assemblies 168 are operably connected to spools 162. As spools 162 rotate, the operable connection with the spring assemblies 168 cause forces to be built up within and/or released from, spring assemblies 168.

Cords 170:

In the arrangement shown, as one example, counterbalance assembly 160 includes cords 170. Cords 170 are formed of any suitable size, shape, and design and are configured to facilitate transfer of counterbalance forces to lower hub 28. In this example arrangement, a first end of each cord 170 is connected to a spool 162 and spooled around an exterior surface of spool 162. In this example arrangement, the other end of each cord 170 is connected to lower hub 28. As lower hub 28 is moved downward, as umbrella system 10 is closed, cords 170 attached to the lower hub 28 are pulled. As cords 170 are pulled by lower hub 28, cords 170 unspooled from spools 162. Unspooling of cords 170 from spools 162 rotates spools 162, which causes spring assemblies 168 to be tensioned. As lower hub 28 is moved upward, as umbrella system 10 is opened, tension on spring assemblies 168 providing a counterbalance force, which can substantially reduce the amount of energy needed to open umbrella system 10.

Tapered Exterior Surface of Spools 162:

In the arrangement shown, as one example, spools 162 have a tapered exterior surface to better match a torque profile of counterbalance assembly 160 with a torque profile of the umbrella frame 24. As previously described, it can be difficult to implement a counterbalance assembly 160 with a torque profile that perfectly matches a torque profile of the umbrella frame 24. For example, umbrella frame 24 being under-sprung at the open position, meaning that the counterbalance assembly 160 is providing less counterbalance force than the weight of the umbrella frame 24 meaning that the umbrella frame 24 has a tendency to sag at the fully opened position. As another example, umbrella frame 24 may be over-sprung at the closed position, meaning that the counterbalance assembly 160 is providing more counterbalance force than the weight of the umbrella frame 24 meaning that the umbrella frame 24 has a tendency to pop-up or slightly open at the fully closed position.

In one or more arrangements, the tapered shape of the spools 162 causes cords 170 to be wrapped around an increasing or decreasing diameter of spools 162 as lower hub 28 is raised and cords 170 are spooled on spools 162. Due to this changing diameter, the torque applied on spool 162 by tension on cord 170 changes dynamically as lower hub 28 is raise and or lowered.

As an illustrative example, in one or more arrangements, spools 162 are implemented by spool cords from a larger diameter to a smaller diameter as lower hub is raised as umbrella frame 25 is opened. As lower hub 28 approaches a fully raised position, the smaller diameter of the spools 162 encountered by cords 170 provides more leverage for spring assemblies 168 to pull cord 170 tight, thereby helping to prevent sagging of umbrella frame 24. Conversely, as lower hub 28 approaches a fully lowered position, a larger diameter of the spools 162 encountered by cords 170 provides less leverage for spring assemblies 168 to pull cord 170 tight, thereby helping to prevent umbrella frame 24 from popping-up or slightly opening at the fully closed position.

Rotational Locking Assembly 178:

In one or more arrangements, system 10 includes a rotational locking assembly 178. Rotational locking assembly 178 is formed of any suitable size, shape, and design and is configured to prevent rotation of rotating tube 20 when locked. In the arrangement shown, as one example, rotational locking assembly 178 includes a gear member 180 operably attached to rotating tube 20, an inner assembly 182 and an outer collar 184, among other components.

Gear Member 180:

Gear member 180 is formed of any suitable size, shape, and design and is configured to facilitate engagement and interlocking of locking rotating tube 20 and inner assembly. In the arrangement shown, as one example, gear member 180 is operably attached to the lower end of rotating tube 20. In the arrangement shown, as one example, gear member 180 has a generally cylindrical shaped exterior surface 186 having a set of teeth 188 extending around exterior surface 186.

Inner Assembly 182:

Inner assembly 182 is formed of any suitable size, shape, and design and is configured to facilitate engagement and interlocking with gear member 180 to prevent rotation of rotating tube 20. In the arrangement shown, as one example, inner assembly 182 is configured to engage teeth 188 of gear member 180 and prevent rotation of the gear member 180 and rotating tube 20 in response to the outer collar 184 being rotated a first direction. In this example arrangement, inner assembly 182 is configured to disengage from teeth 188 of the gear member 180 and permit rotation of the gear member 180 and rotating tube 20 in response to rotation of the outer collar 184 in a second direction, opposite of the first direction.

In the arrangement shown, as one example, inner assembly 182 includes an inner collar 190 and a locking member 192. Inner collar 190 and locking member 192 are formed of any suitable size, shape, and design and are configured to facilitate engagement of and disengagement from teeth 188 of gear member 180 responsive to rotation of the outer collar 184. In the arrangement shown, as one example, inner collar 190 has an elongated tube shape extending between an upper end 196 and a lower end 194. In this example arrangement, inner collar 190 has a cylindrical shaped inner surface 198 and a cylindrical shaped outer surface 200.

In the arrangement shown, as one example, gear member 180 is positioned inside of inner collar 190. In this example arrangement, inner collar 190 includes an opening 202 through which teeth 188 of gear member 180 are accessible. In this example arrangement, inner collar 190 also includes a fulcrum feature 204 adjacent to opening 202.

In the arrangement shown, as one example, locking member 192 is a rocker arm having a pivot point 208 configured to engage the fulcrum feature 204, an arm 210 extending out from pivot point 208, and a catch feature 212. In this example arrangement, locking member 192 is configured to extend arm 210 through opening 202 to engage and interlock with teeth 188 in response to catch features 212 of locking member 192 being moved in a first direction, thereby preventing rotation of gear member 180. In this example arrangement, locking member 192 is configured to retract arm 210 and disengage from teeth 188 in response to catch features 212 being moved in the opposite direction, thereby permitting gear member 180 to rotate.

Outer Collar 184:

Outer Collar 184 is formed of any suitable size, shape, and design and is configured to cause inner assembly 182 engage and interlock with gear member 180 when outer collar 184 is rotated in the first direction and cause inner assembly 182 to disengage from gear member 180 when outer collar 184 is rotated in the opposite direction.

In the arrangement shown, as one example, outer collar 184 has an elongated tube shape extending between an upper end 216 and a lower end 218. In this example arrangement, outer collar is configured to fit over and around inner assembly 182. In this example arrangement, an inner diameter of upper end 216 is approximately equal to an outer diameter of rotating tube 20. In this example arrangement, an inner diameter of lower end 218 is approximately equal to an outer diameter of inner collar 190. In the arrangement shown, as one example, outer collar 184 has a catch feature 224 on an interior surface that is configured to engage catch feature 212 of locking member 192.

In operation: when outer collar 184 is rotated in the first direction, catch features 224 engage and cause catch feature 212 of locking member 192 to move in the first direction. As a result, arm 210 is extended through opening 202 to engage teeth 188 and thereby prevent rotation of gear member 180 and rotating tube 29. Conversely, when outer collar 184 is rotated in a second opposite direction, catch features 224 engage and cause catch feature 212 of locking member 192 to move in the second direction. As a result, arm 210 is retracted and disengaged from teeth 188, thereby permitting rotation of gear member 180 and rotating tube 29.

Lock Feature 226:

In one or more arrangements, rotational locking assembly 178 includes a lock feature 226. Lock feature 226 is formed of any suitable size, shape, and design and is configured to inhibit rotation of the outer collar 184 relative to inner collar 190 once outer collar 184 has been rotated in the second direction to cause inner assembly 182 to disengage from teeth 188 and permit gear member 180 to rotate. In the arrangement shown, as one example, lock feature 226 includes a raised protrusion on exterior surface 200 of inter collar 190. In this example arrangement the lock feature 226 is configured to mate with a recess of catch feature 224 of outer collar 184 when outer collar 184 is rotated in the second direction. Once lock feature 226 have engaged the recess of catch feature 224, a larger amount of force is initially required to move the outer collar back in the first direction.

This lock feature 226 may be useful, for example, to prevent accidental unlocking of rotational locking assembly 178 when rotating tube 20 and gear member 180 are rotating during operation. In this manner, damage to teeth 188 and/or inner assembly 182 can be avoided.

Lower Bearing Assembly:

In one or more arrangements, lower bearing assembly 33 is positioned within rotational locking assembly 178. Lower bearing assembly 33 is formed of any suitable size, shape, and design and is configured to facilitate smooth rotation of rotating tube 20. In this example arrangement, lower bearing assembly 33 is positioned within inner collar 190. In the arrangement shown, as one example, lower bearing assembly 33 supports the lower end of rotating tube 20 and/or gear member 180 to facilitate smooth rotation of rotating tube 20 and/or gear member 180.

Figure 82:
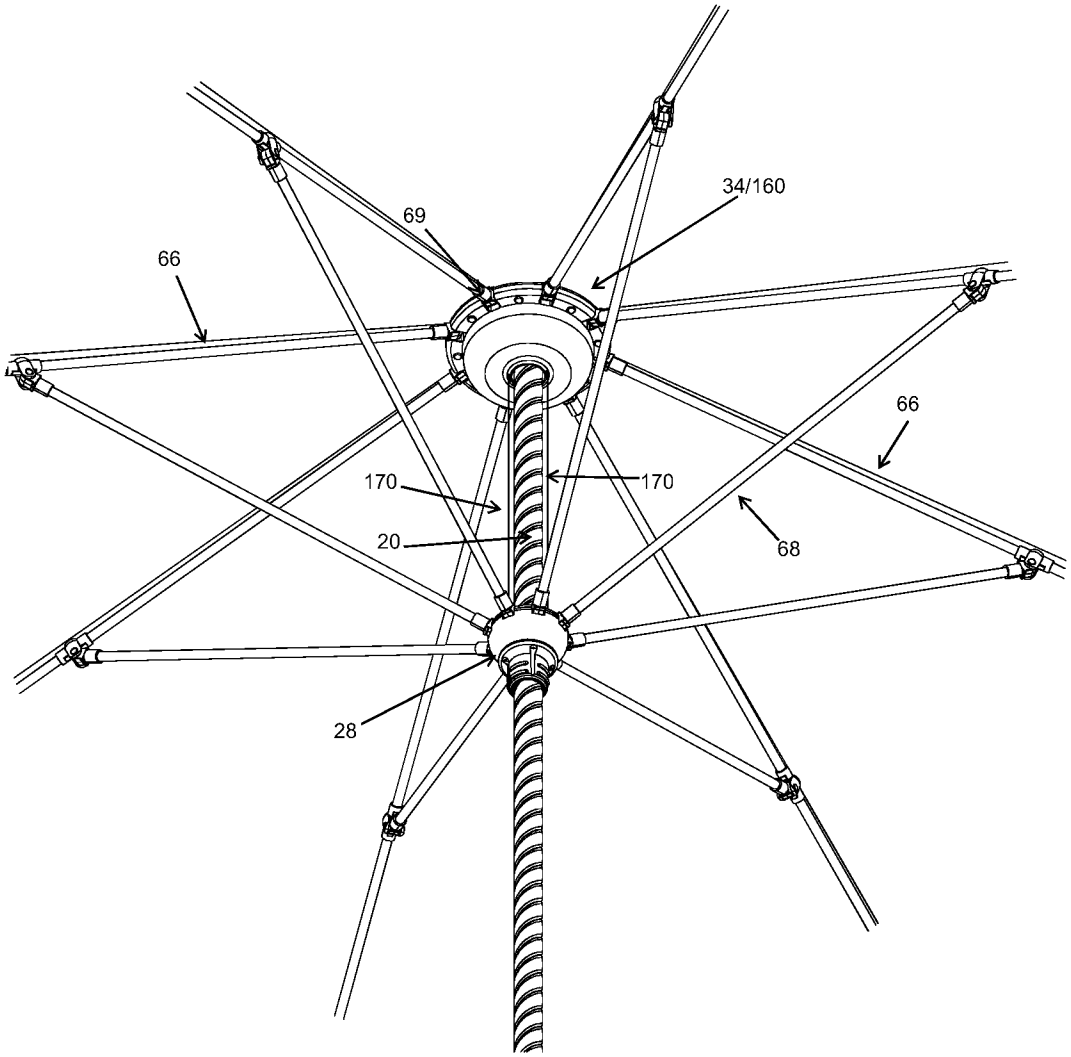
FIG. 82 is a close up lower perspective view of upper hub, lower hub, and umbrella frame of an umbrella system, in accordance with one or more embodiments.
Figure 83:
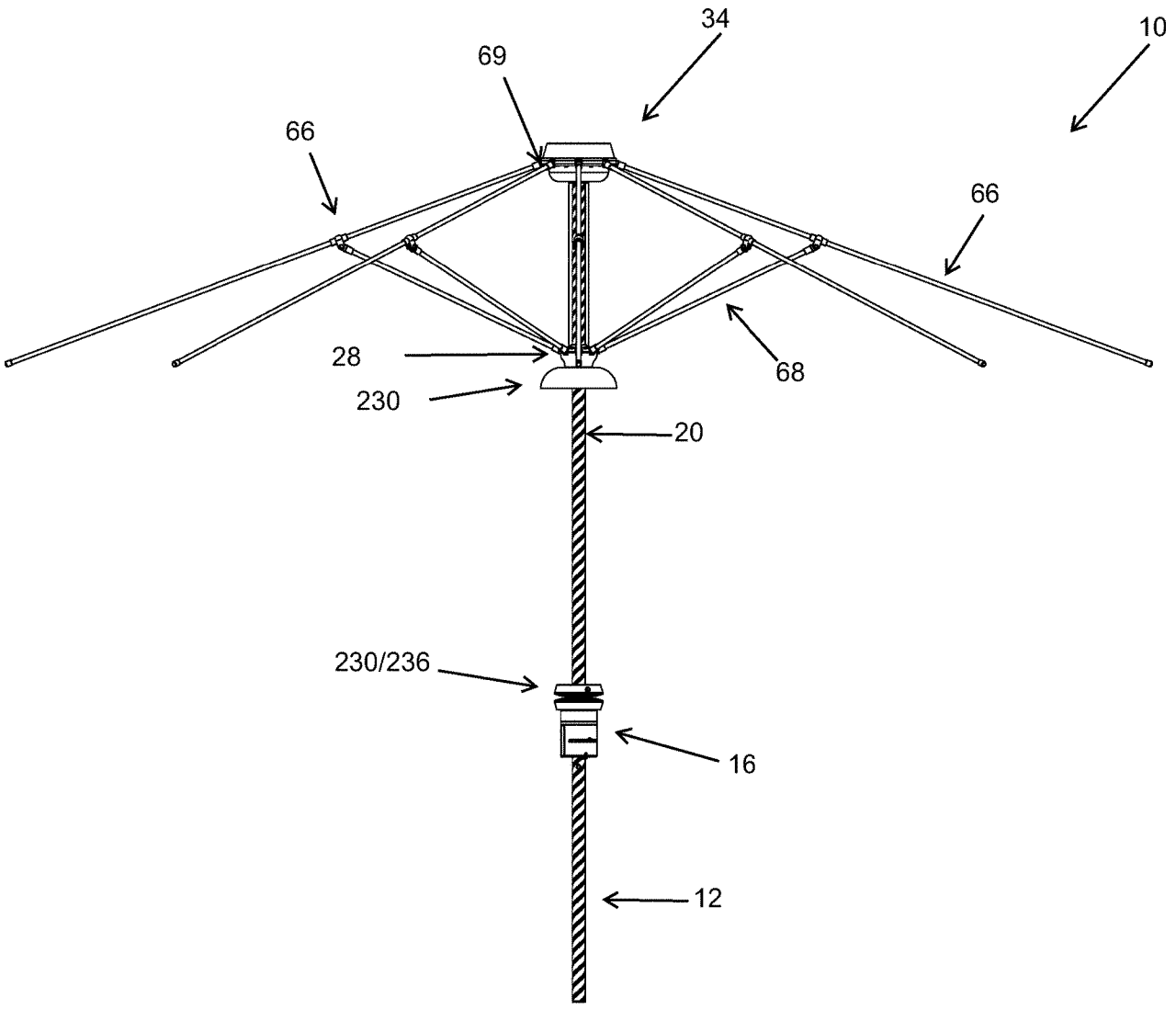
FIG. 83 is a rear view of an umbrella system, in accordance with one or more embodiments; the view showing upper and lower lighting assemblies moved to the lower position on the rotating tube in connection with motor housing assembly 16.
Figure 84:
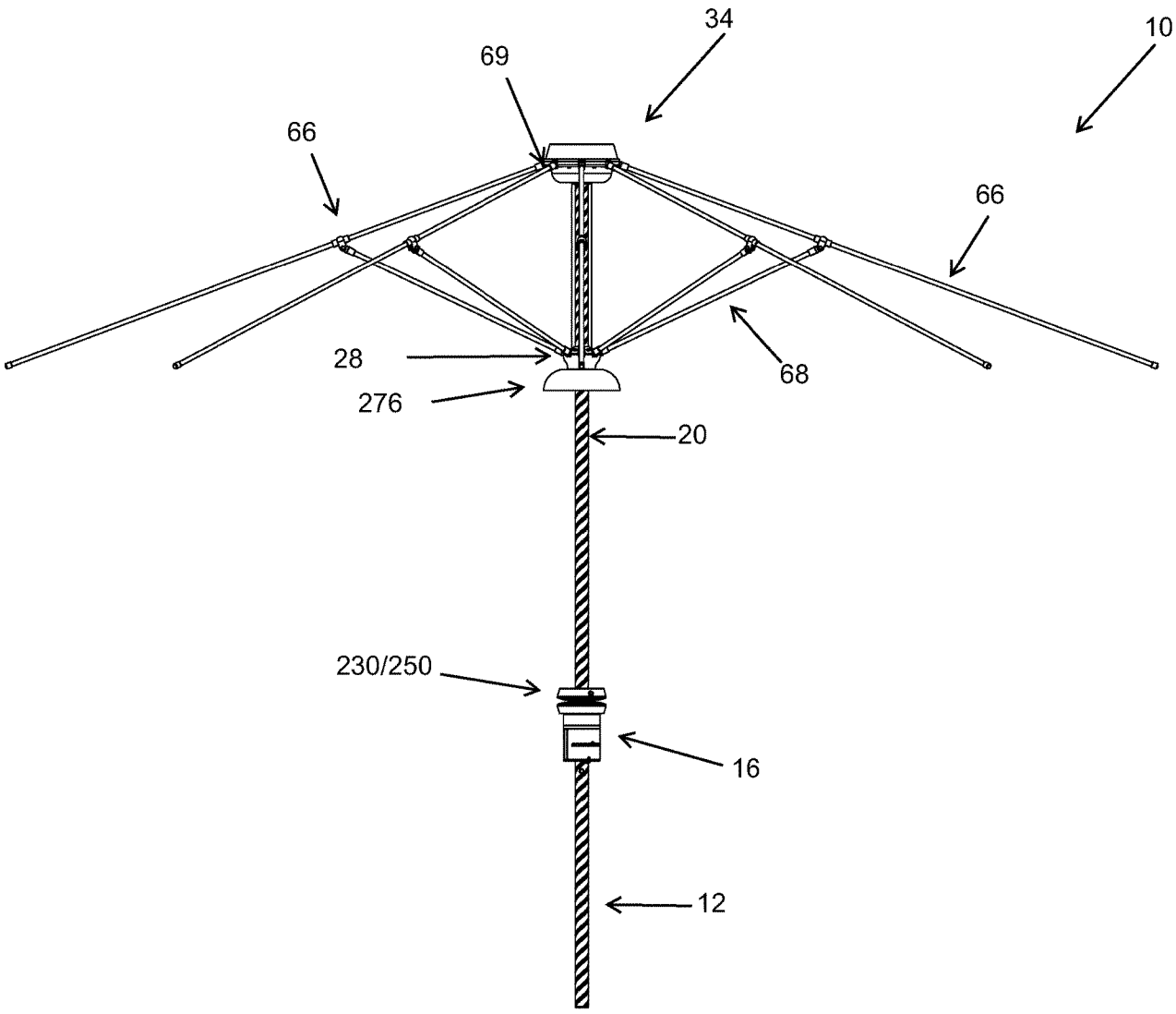
FIG. 84 is a rear view of the umbrella system shown in FIG. 83, in accordance with one or more embodiments; the view showing upper and lower lighting assemblies moved to raised positions on the rotating tube.
Figure 85:
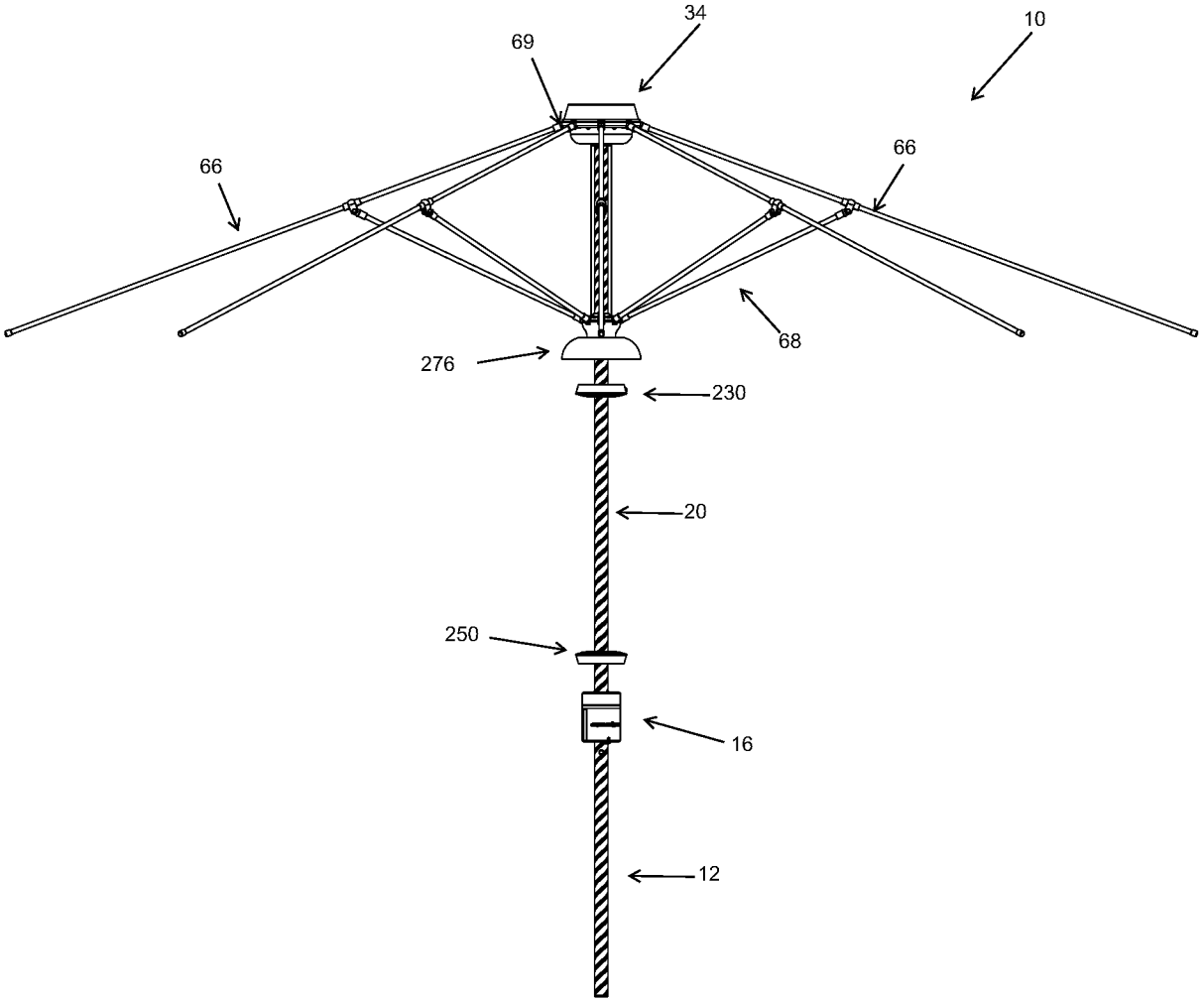
FIG. 85 is a rear view of the umbrella system shown in FIG. 83, in accordance with one or more embodiments; the view showing upper and lower lighting assemblies moved to raised positions on the rotating tube.
Figure 86:
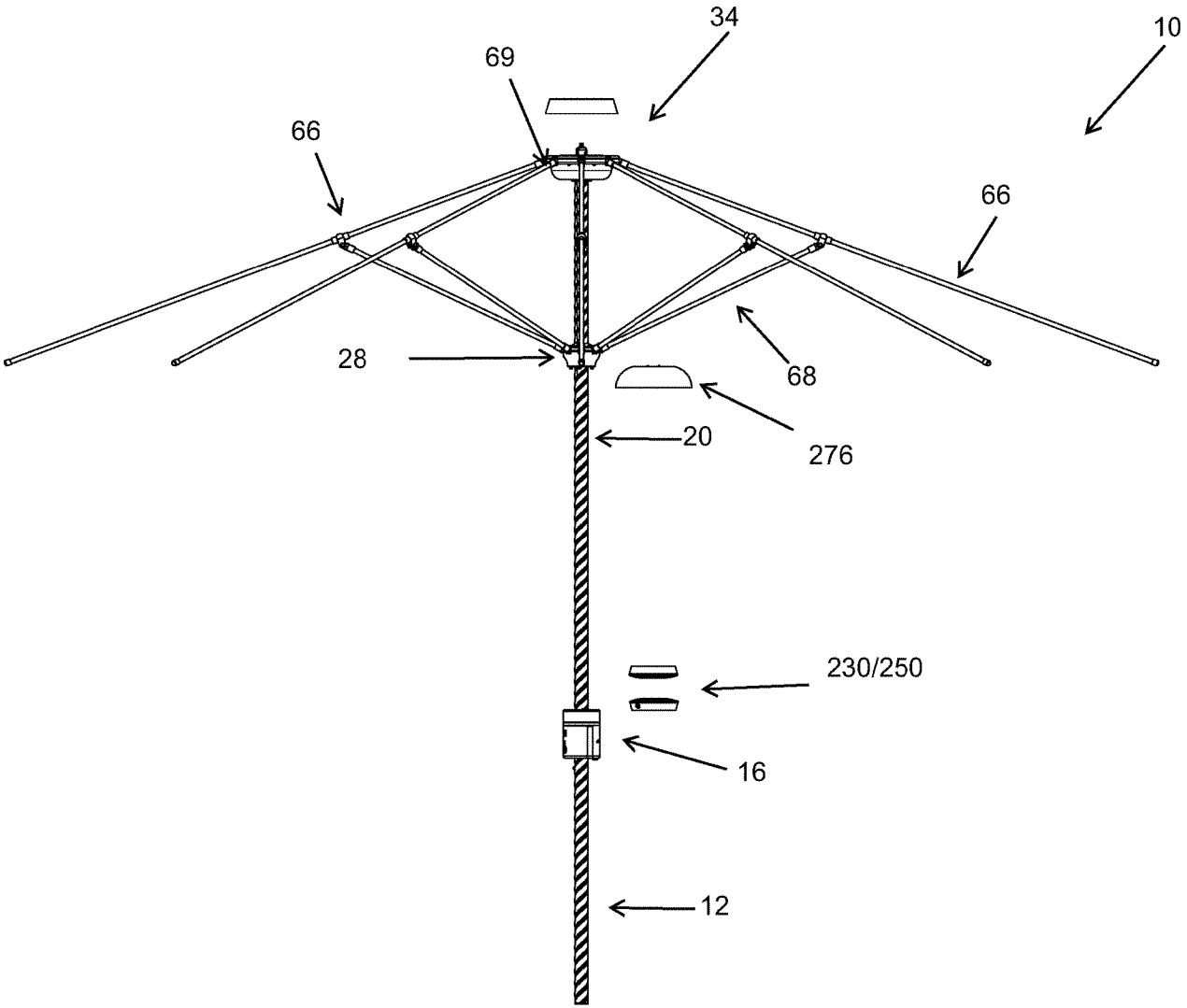
FIG. 86 is a rear view of the umbrella system shown in FIG. 83, in accordance with one or more embodiments; the view showing upper and lower lighting assemblies, reflector, and cover of upper hub detached.
Figure 87:
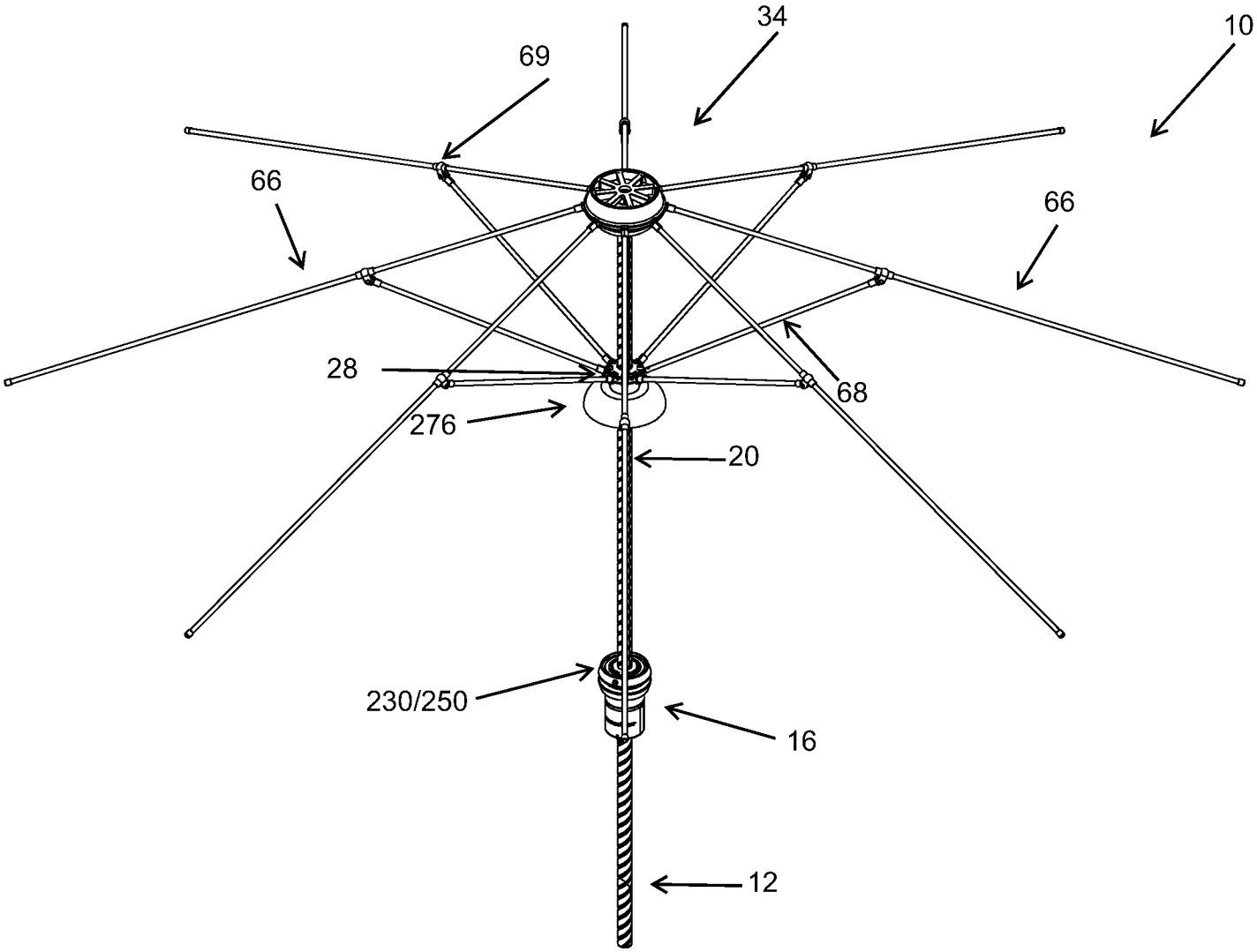
FIG. 87 shows an upper perspective view of the umbrella system shown in FIG. 83, in accordance with one or more embodiments.
Figure 88:
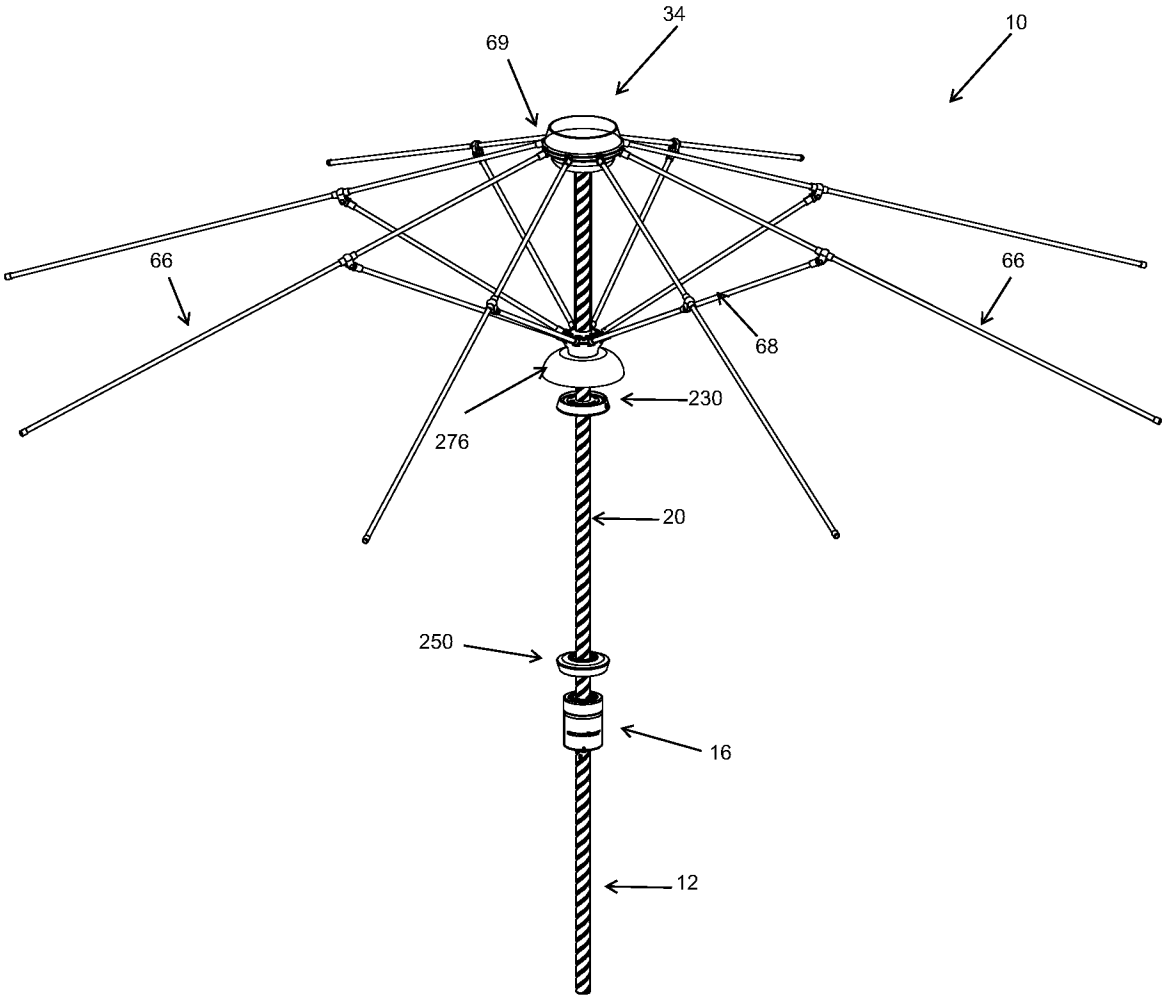
FIG. 88 shows an upper perspective view of the umbrella system shown in FIG. 83, in accordance with one or more embodiments.
Figure 89:
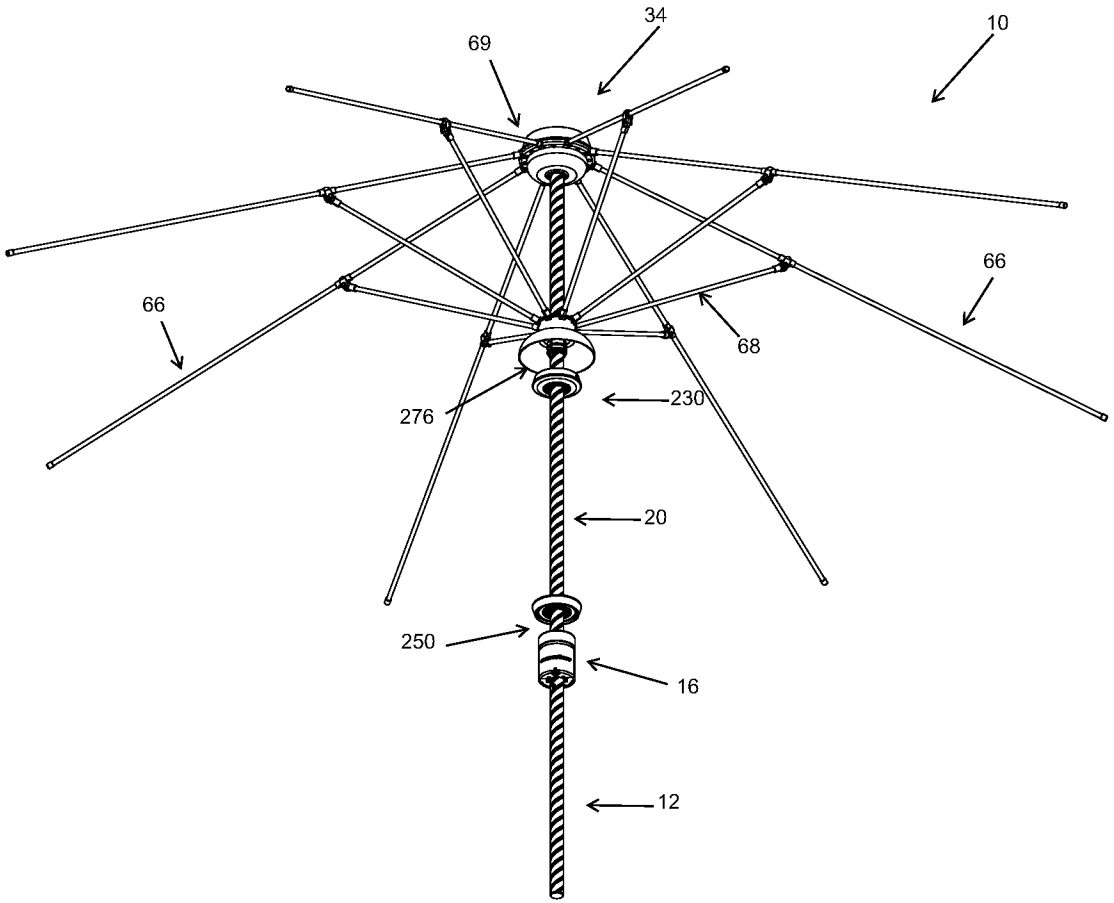
FIG. 89 shows a lower perspective view of the umbrella system shown in FIG. 83, in accordance with one or more embodiments.
Figure 90:
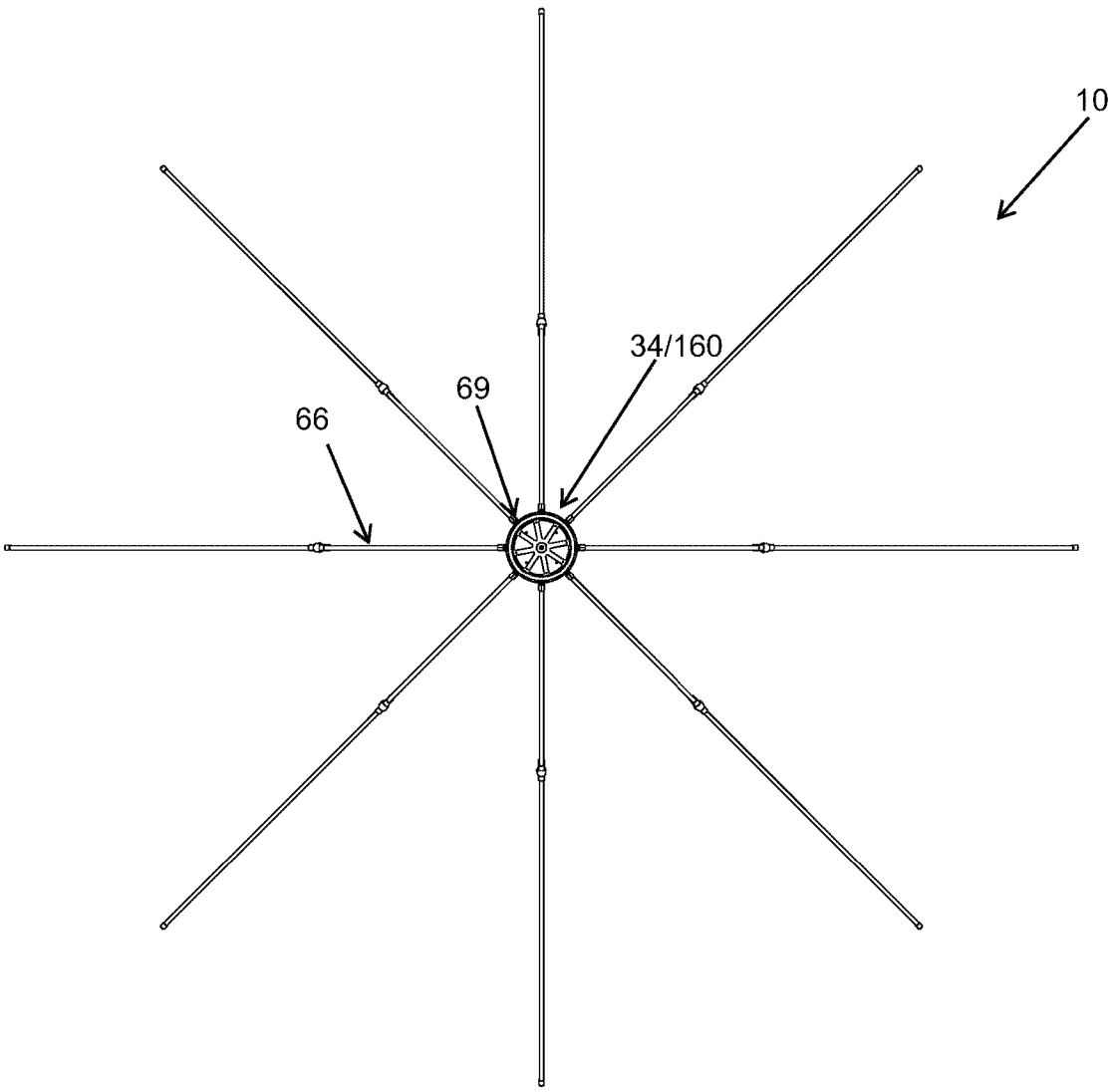
FIG. 90 shows a top view of the umbrella system shown in FIG. 83, in accordance with one or more embodiments.
Figure 91:
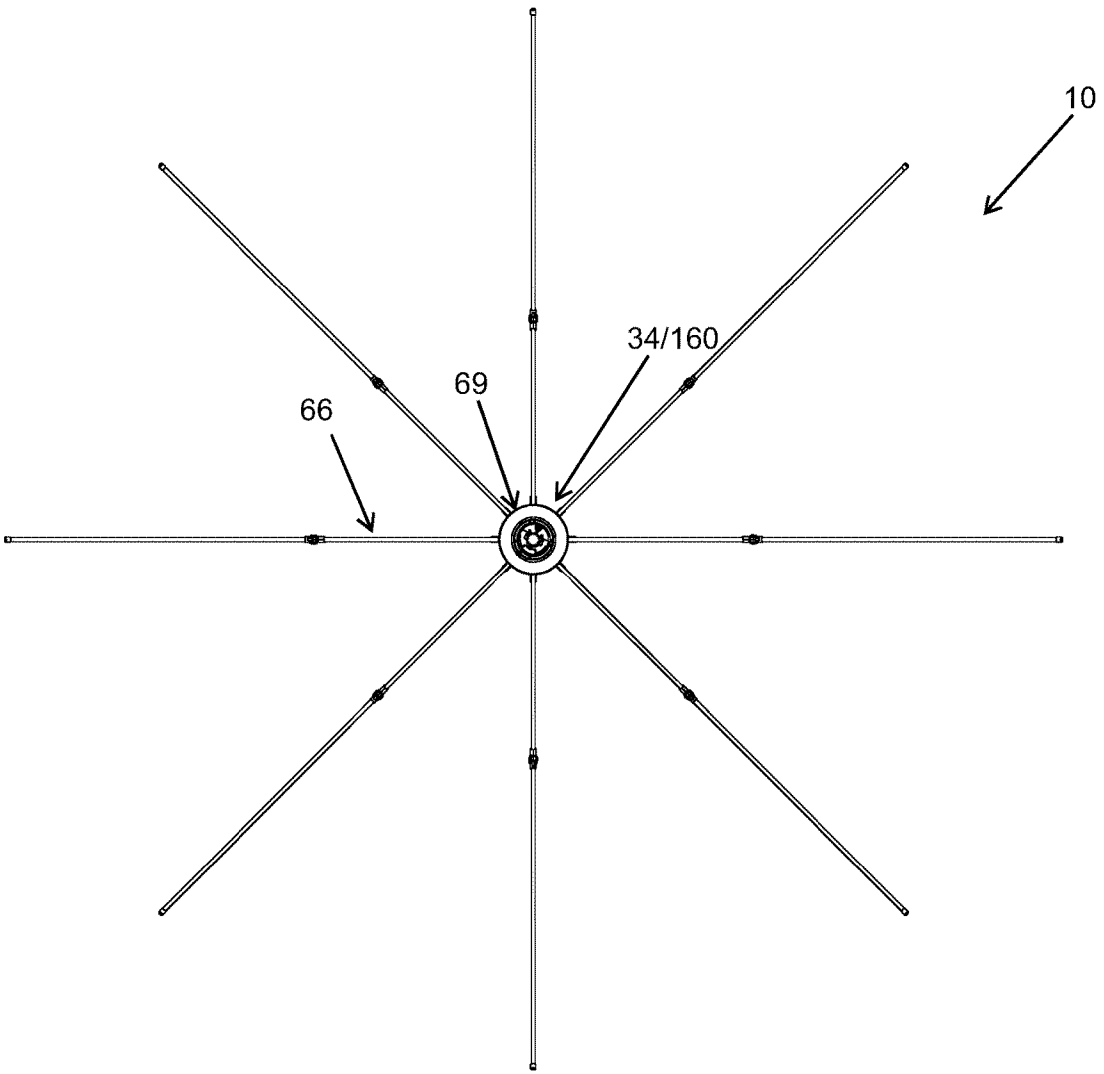
FIG. 91 shows a bottom view of the umbrella system shown in FIG. 83, in accordance with one or more embodiments.
Figure 92:
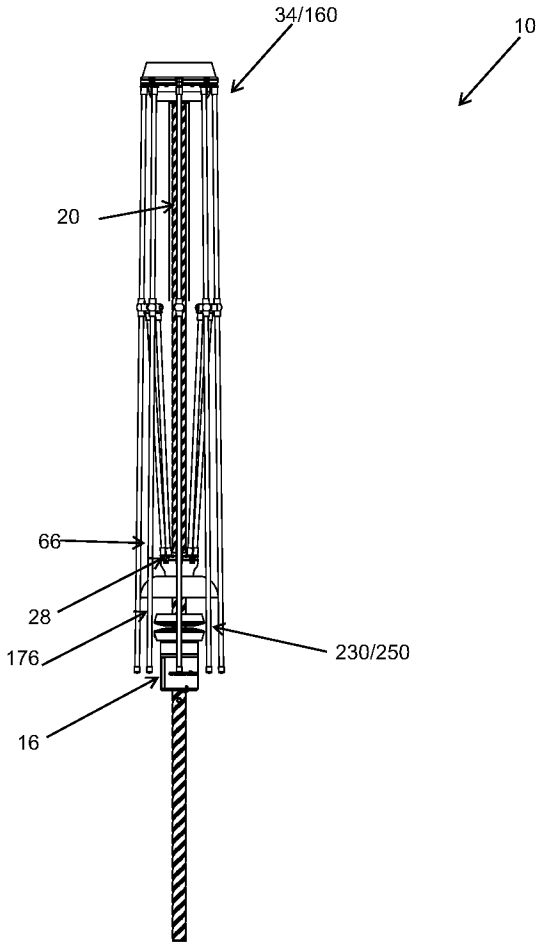
FIG. 92 shows a rear view of the umbrella system shown in FIG. 83, in accordance with one or more embodiments; the view showing the umbrella in a closed position.
Figure 93:
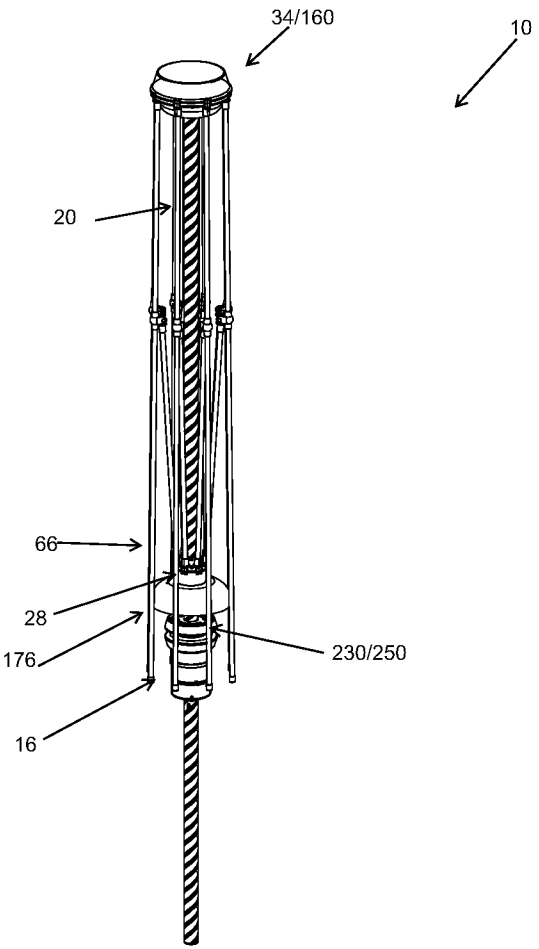
FIG. 93 shows an upper perspective view of the umbrella system shown in FIG. 83, in accordance with one or more embodiments; the view showing the umbrella in a closed position.
Figure 94:
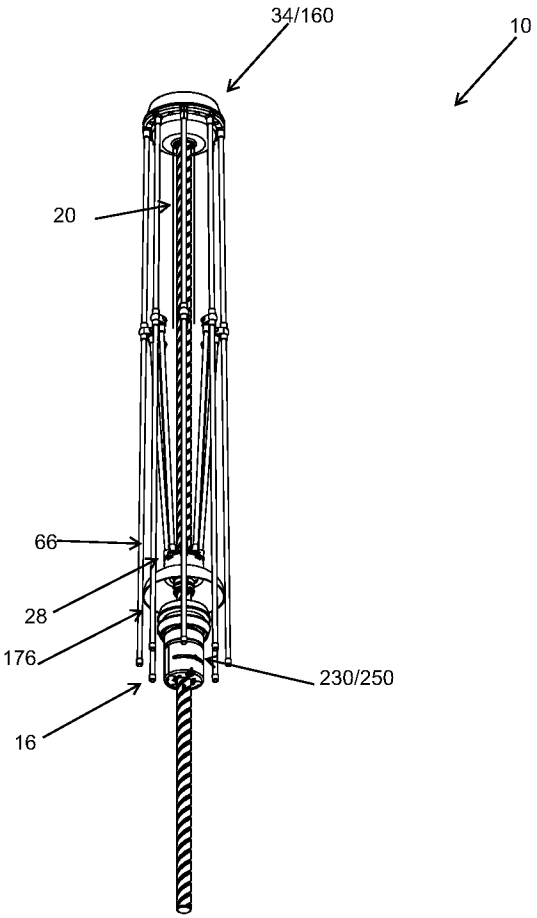
FIG. 94 shows a lower perspective view of the umbrella system shown in FIG. 83, in accordance with one or more embodiments; the view showing the umbrella in a closed position.
Figure 95:
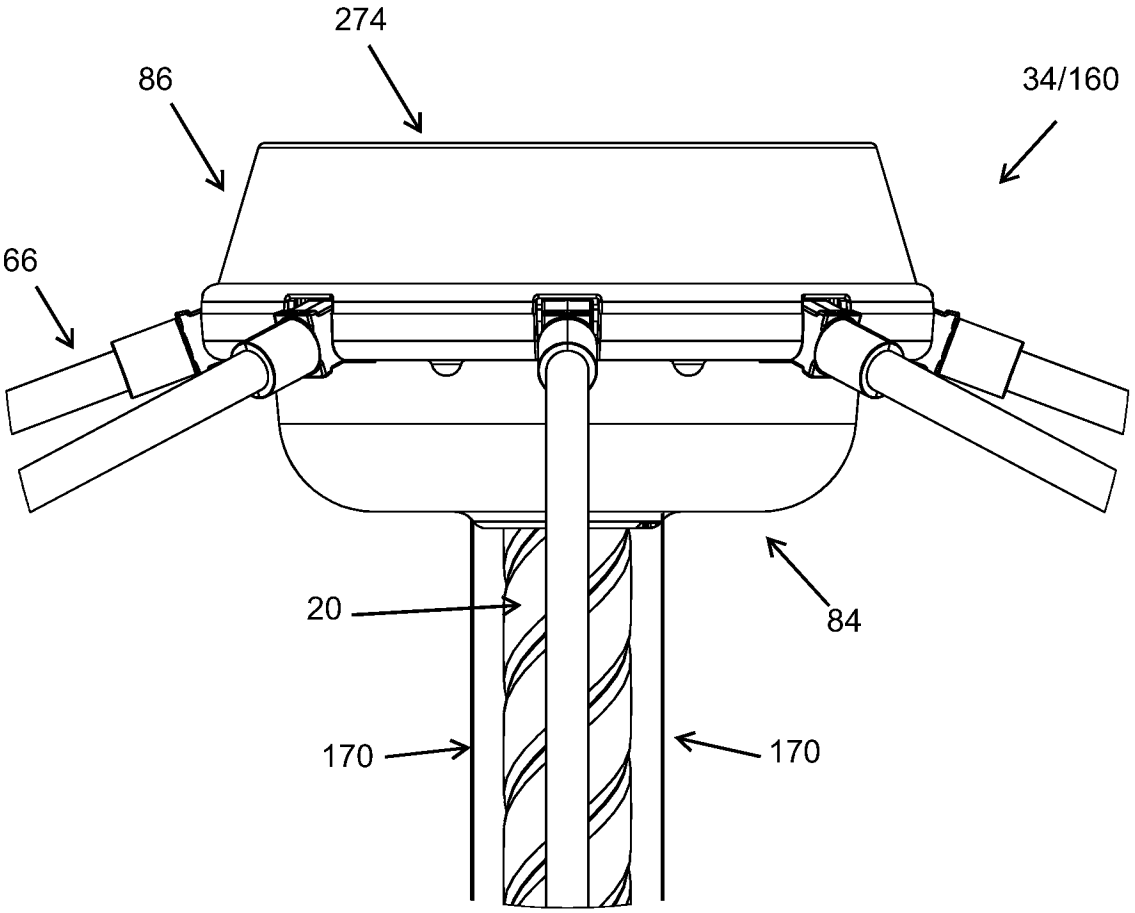
FIG. 95 is a front assembled view of the central support of the umbrella frame and the counterbalance assembly of the umbrella system shown in FIG. 83, in accordance with one or more embodiments.
Figure 96:
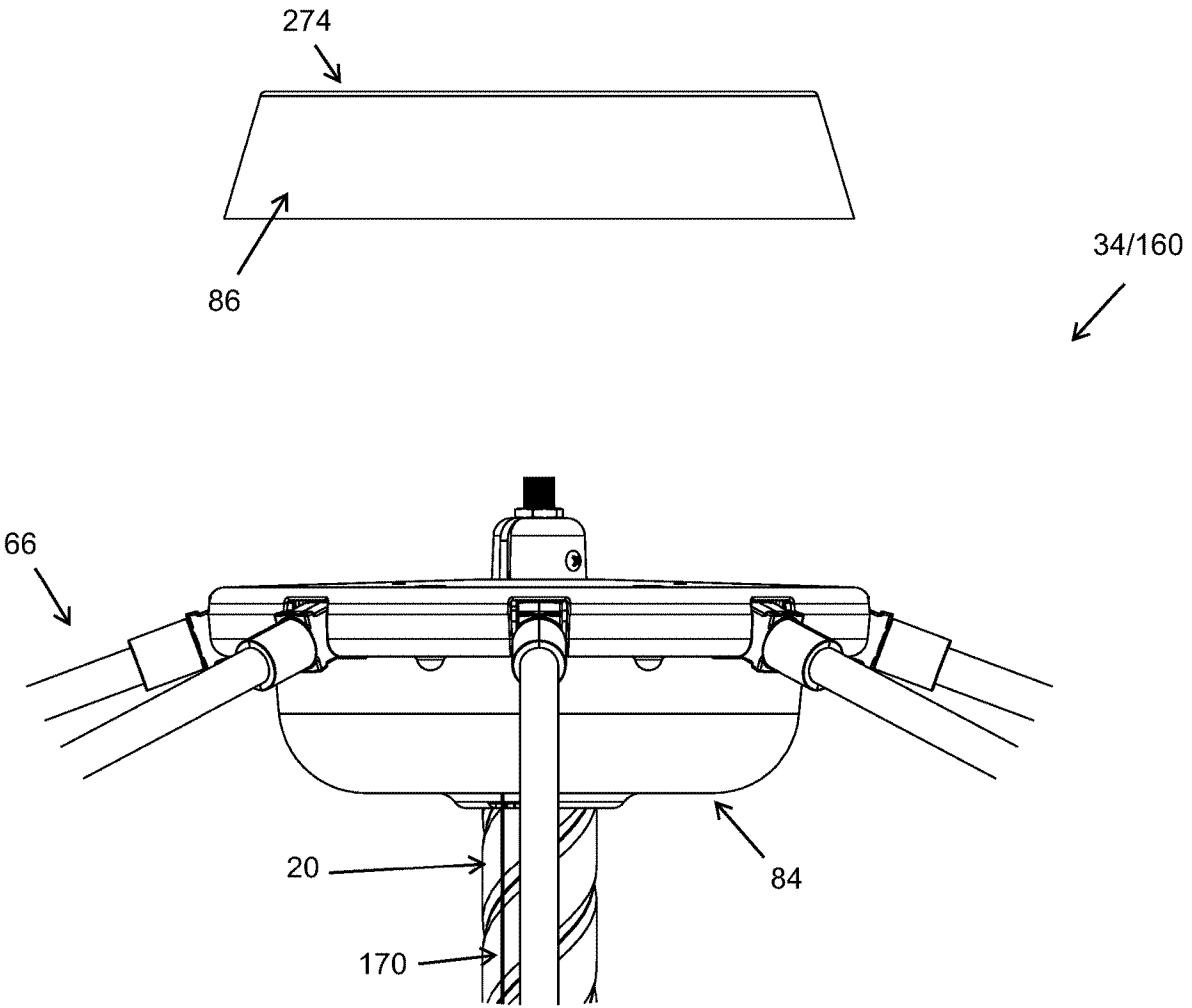
FIG. 96 is a front view of the central support of the umbrella frame and upper hub of the umbrella system shown in FIG. 83, in accordance with one or more embodiments; the view showing a cover of the upper hub removed.
Figure 97:
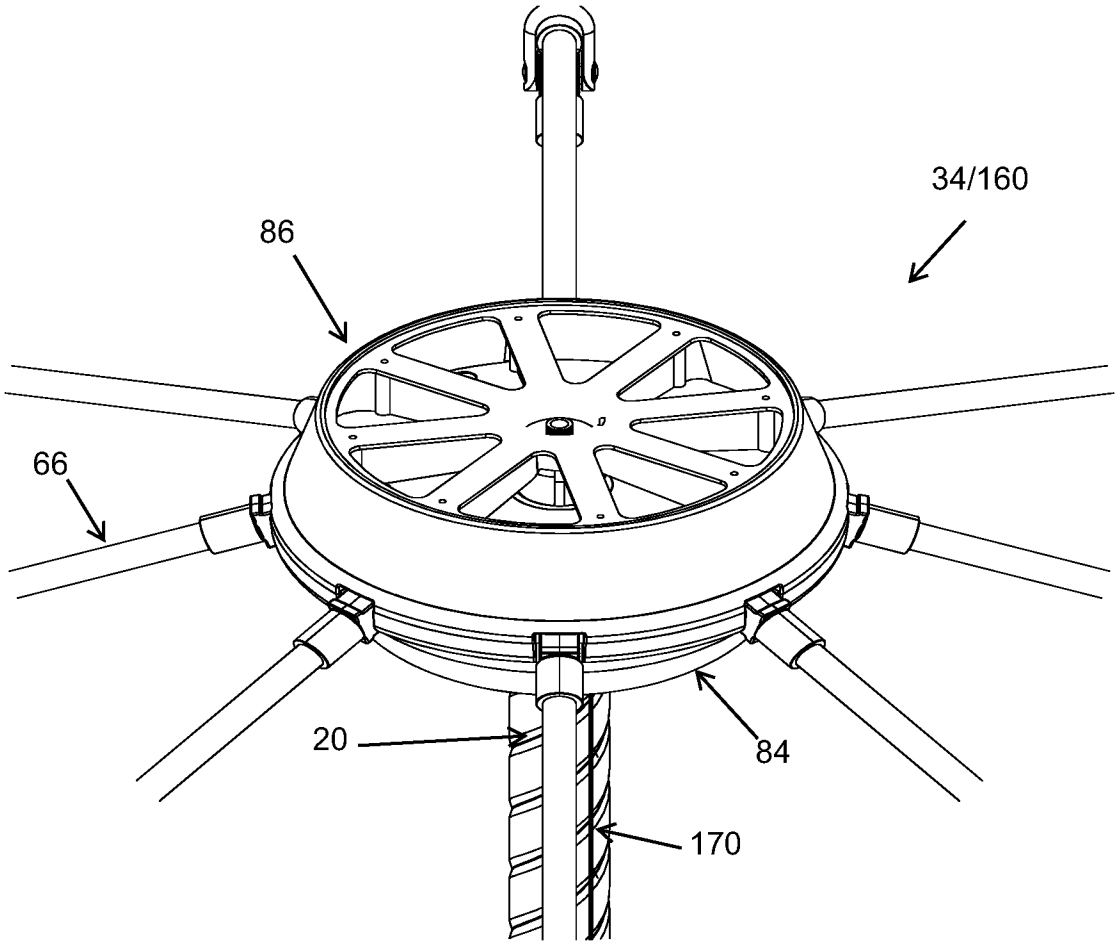
FIG. 97 is an upper perspective view of the upper hub of the umbrella system shown in FIG. 83, in accordance with one or more embodiments; the view showing a solar panel omitted from cover of upper hub.
Figure 98:
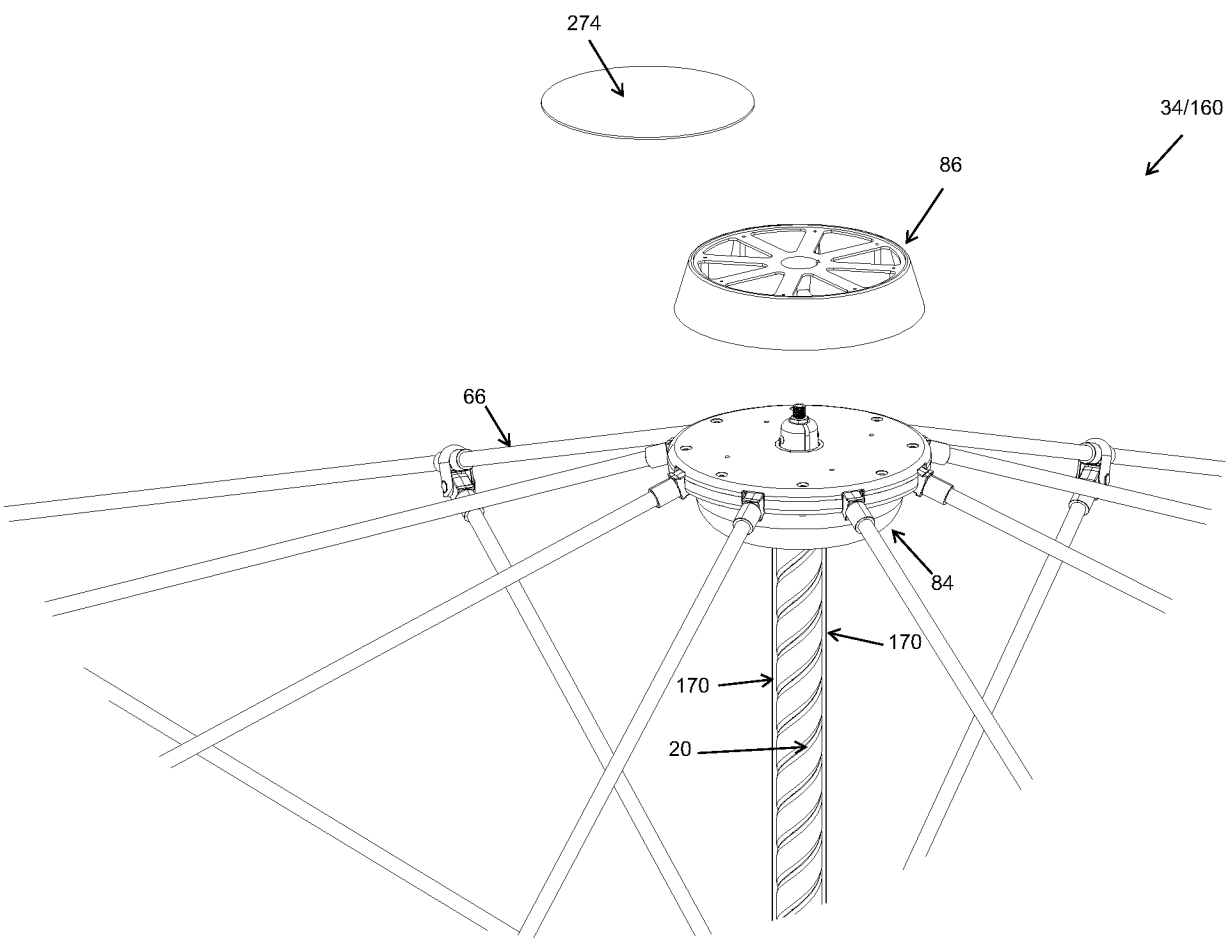
FIG. 98 is an exploded upper perspective view of the upper hub of the umbrella system shown in FIG. 83, in accordance with one or more embodiments; the view showing a solar panel omitted from cover of upper hub.
Figure 99:
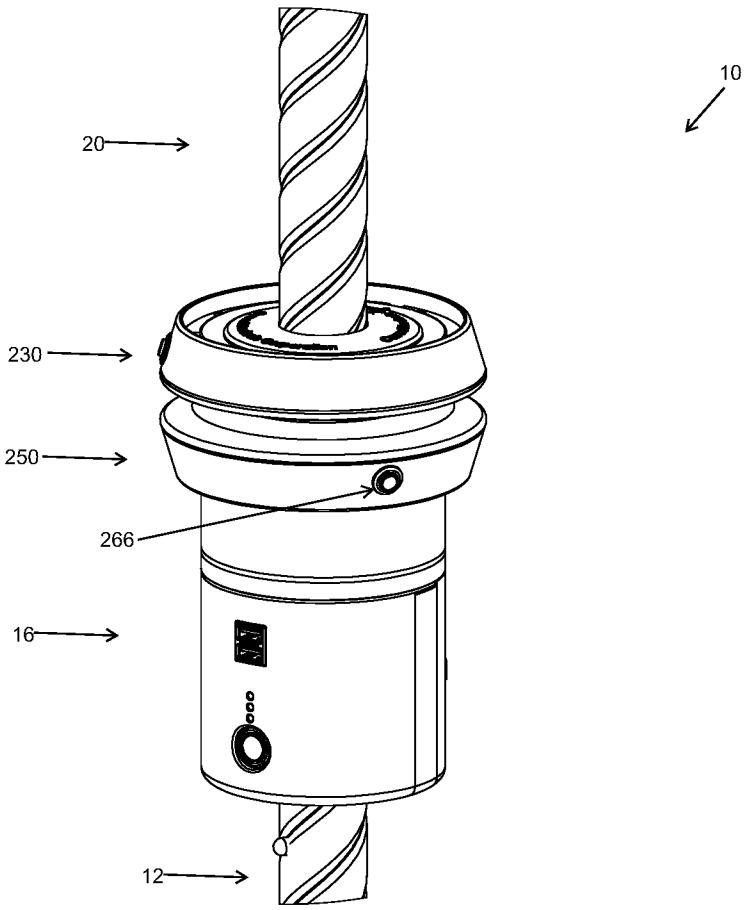
FIG. 99 is a close up upper perspective view of the motor housing assembly and lighting assemblies of the umbrella system shown in FIG. 83, in accordance with one or more embodiments.
Figure 100:
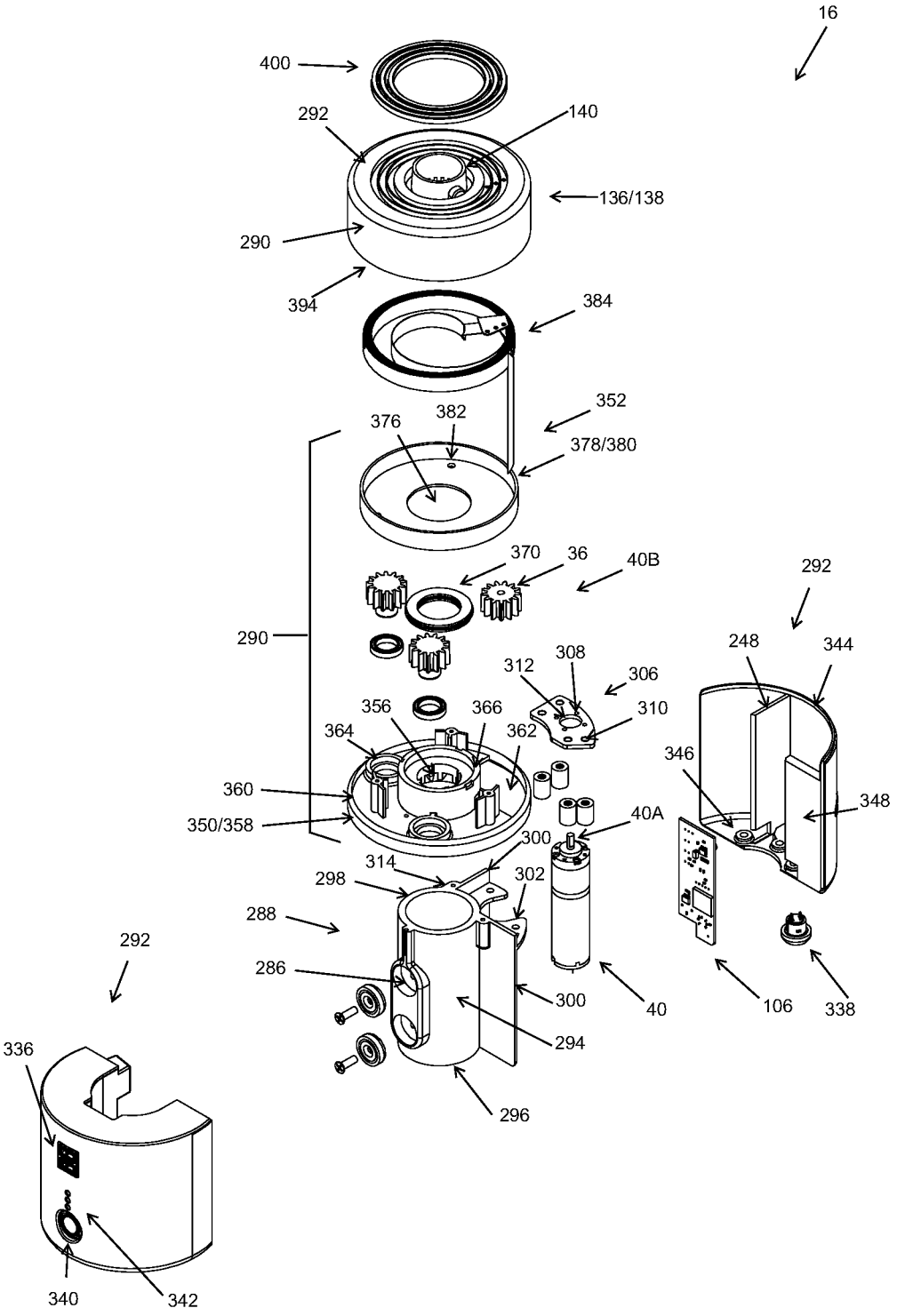
FIG. 100 is an exploded upper perspective view of a motor housing assembly of the umbrella system shown in FIG. 83, in accordance with one or more embodiments.
Figure 101:
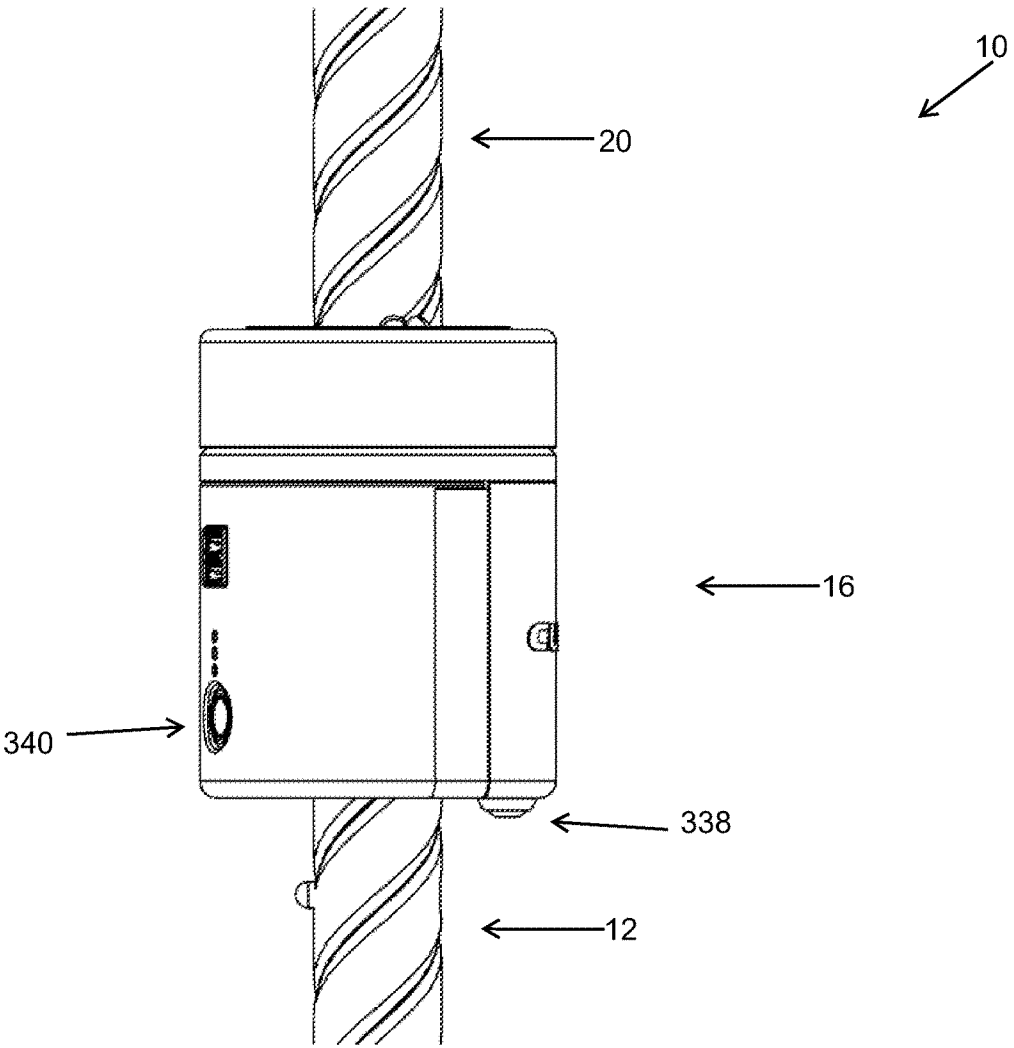
FIG. 101 is left side view of a motor housing assembly of the umbrella system shown in FIG. 83, in accordance with one or more embodiments.
Figure 102:
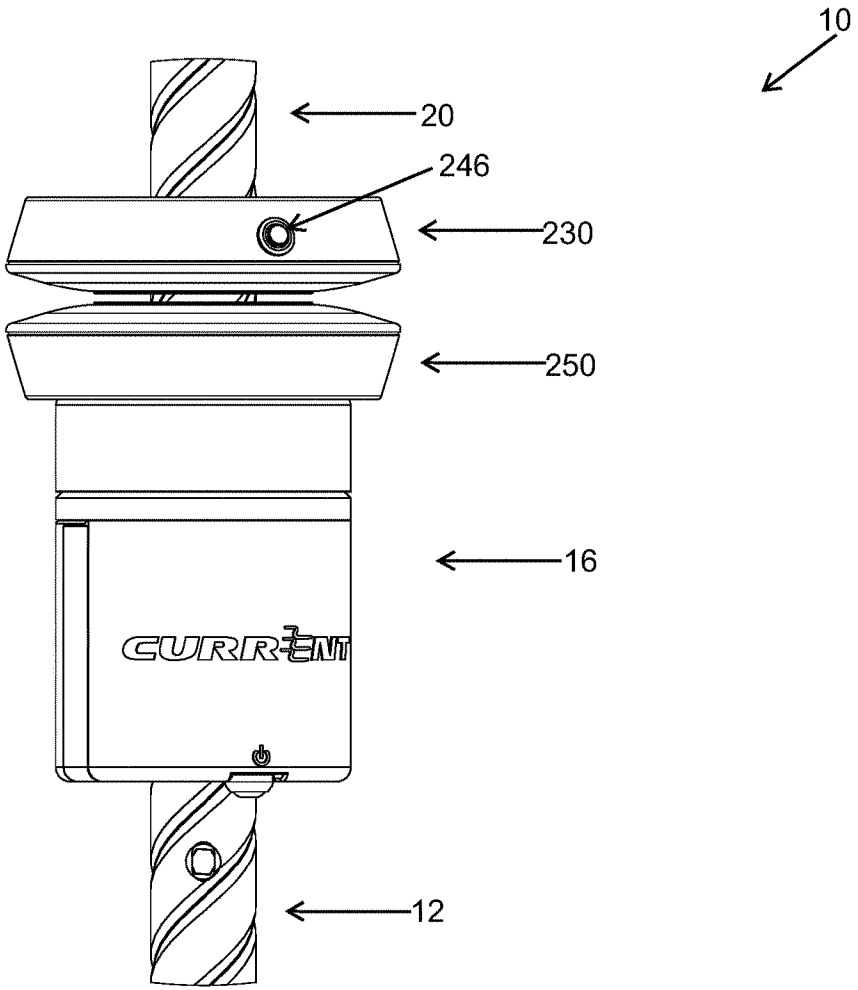
FIG. 102 is rear view of a motor housing assembly and lighting assemblies of the umbrella system shown in FIG. 83, in accordance with one or more embodiments.
Figure 103:
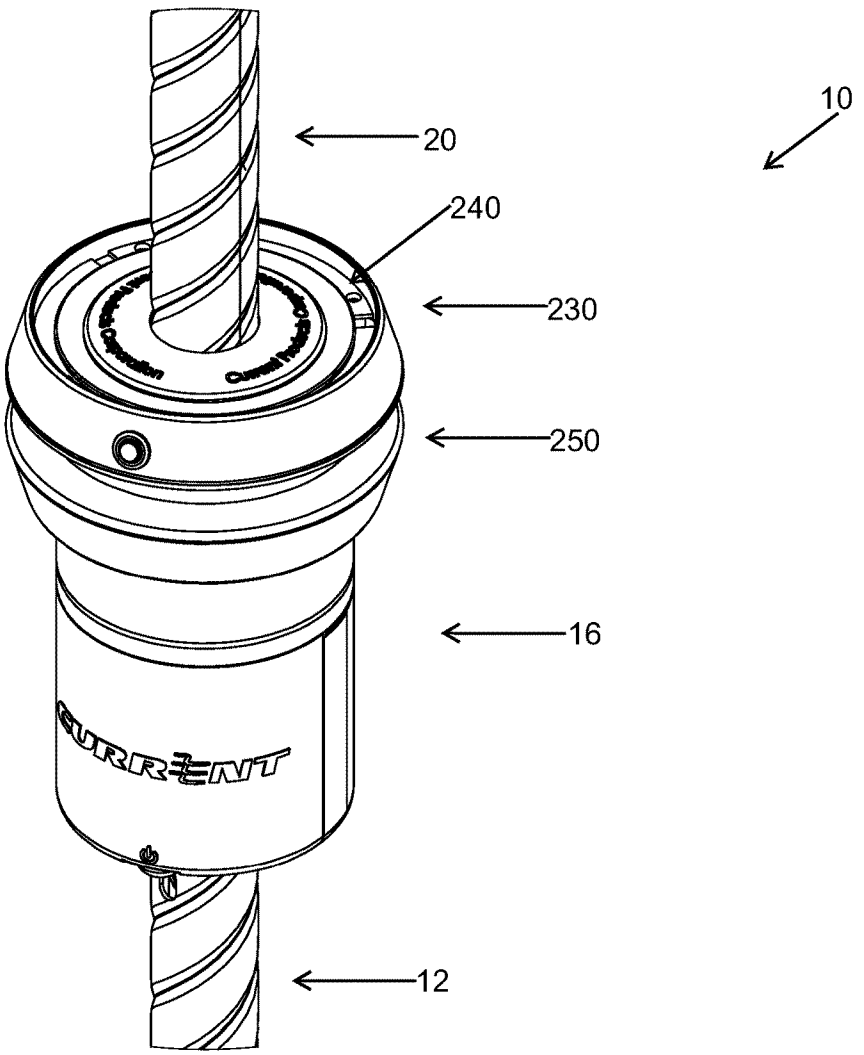
FIG. 103 is an upper perspective view of a motor housing assembly and lighting assemblies of the umbrella system shown in FIG. 83, in accordance with one or more embodiments.
Figure 104:
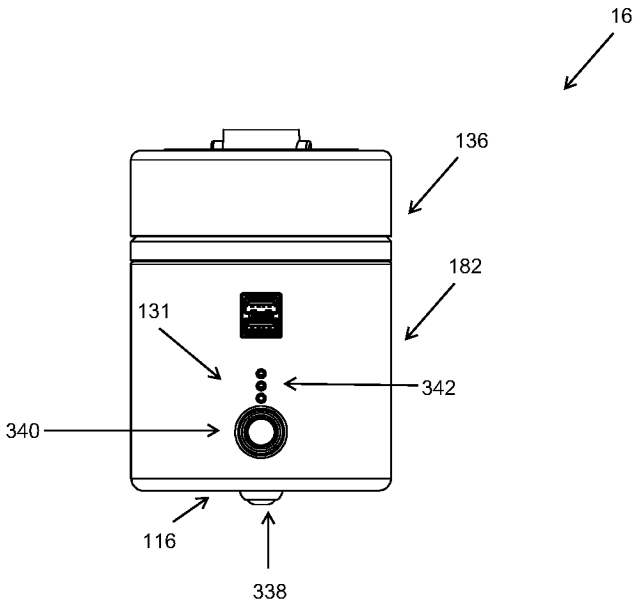
FIG. 104 is a front view of a motor housing assembly of the umbrella system shown in FIG. 83, in accordance with one or more embodiments.
Figure 105:
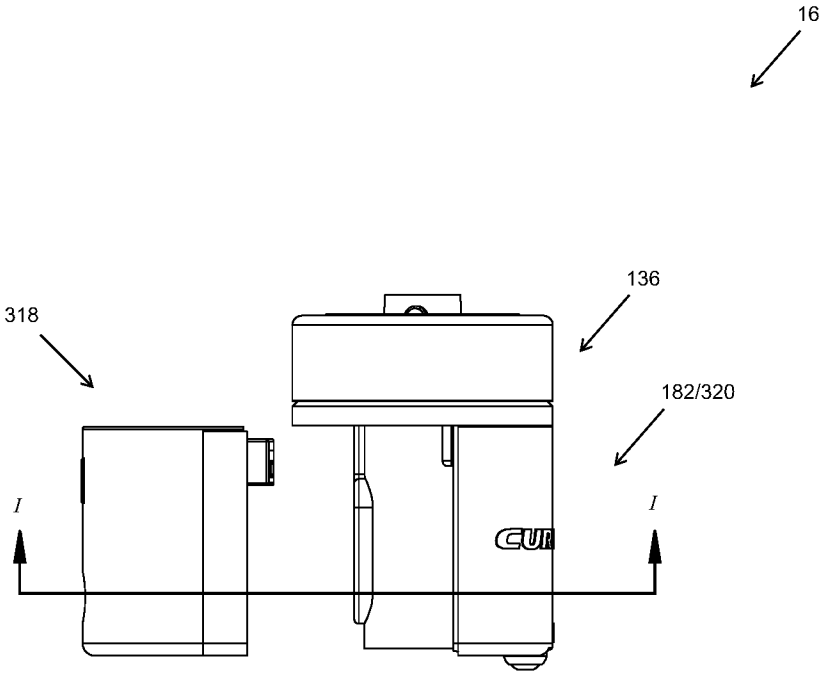
FIG. 105 is a side view of a motor housing assembly of the umbrella system shown in FIG. 83, in accordance with one or more embodiments; the view showing a front portion of the main body removed.
Figure 106:
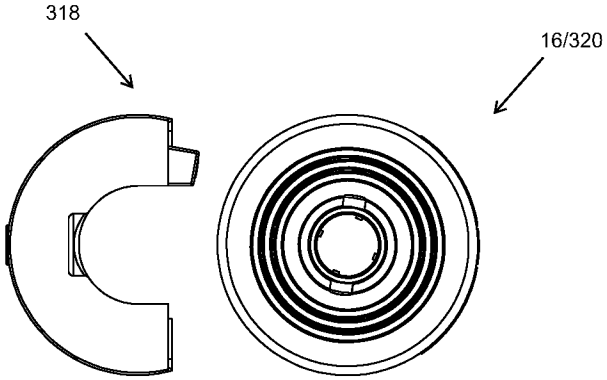
FIG. 106 is a top view of a motor housing assembly of the umbrella system shown in FIG. 83, in accordance with one or more embodiments; the view showing a front portion of the main body removed.
Figure 107:
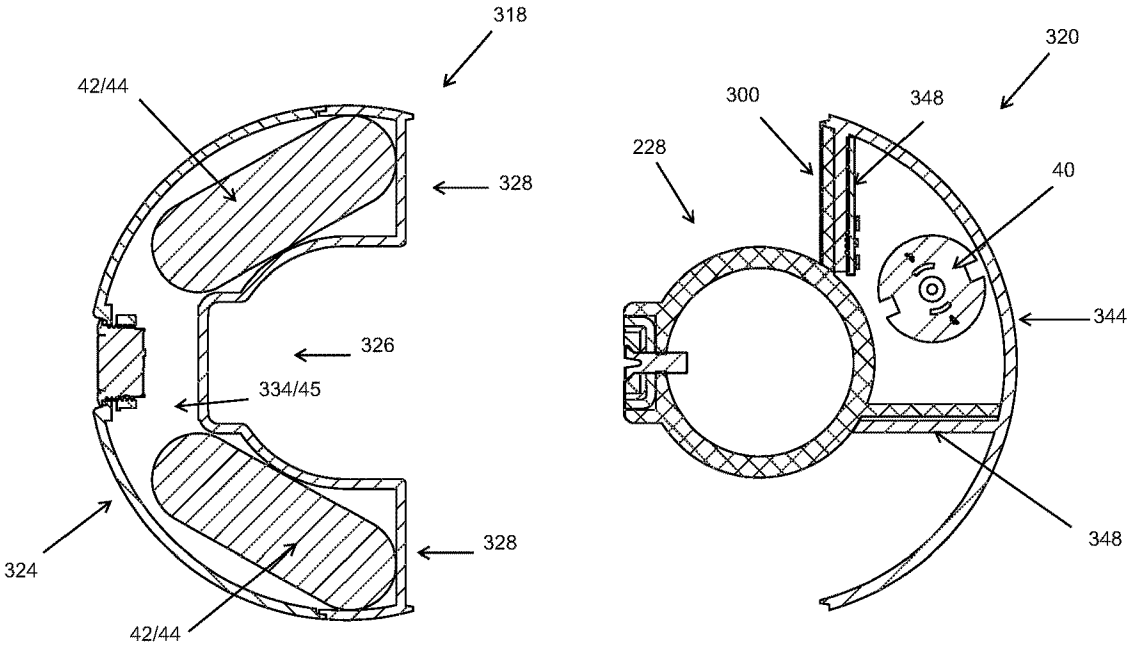
FIG. 107 is a cross section view I of the view shown in FIG. 106, in accordance with one or more arrangements.
Figure 108:
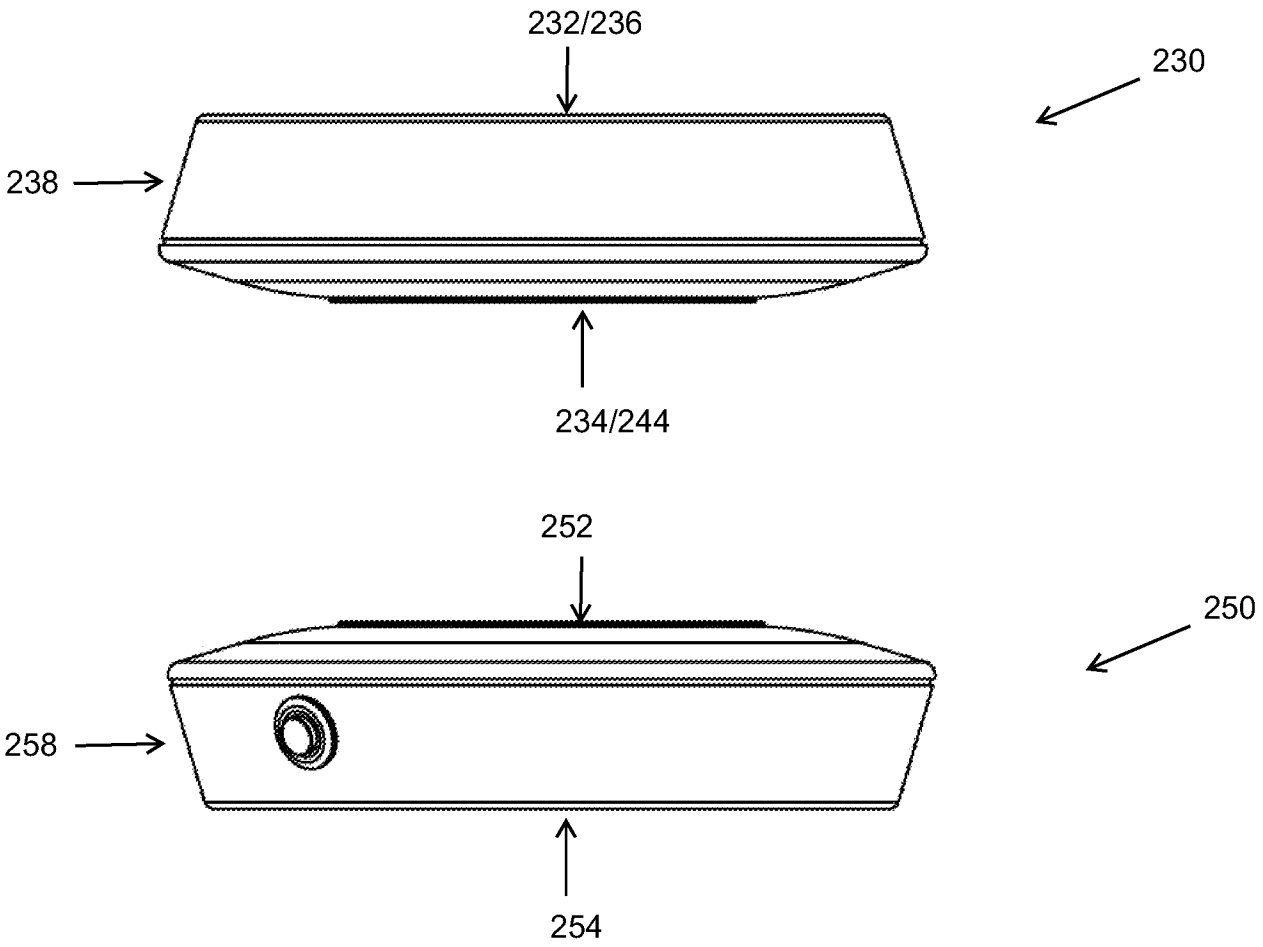
FIG. 108 shows upper and lower lighting assemblies of the umbrella system shown in FIG. 83, in accordance with one or more arrangements.
Figure 109:
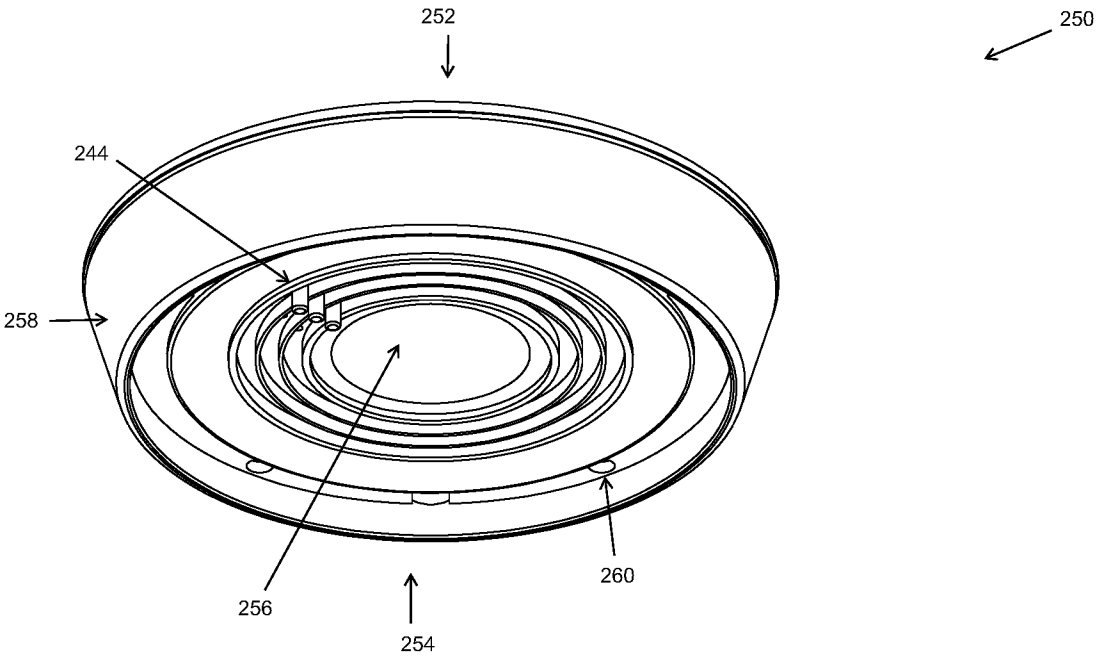
FIG. 109 shows a lower perspective view of a lower lighting assembly of the umbrella system shown in FIG. 83, in accordance with one or more arrangements.
Figure 110:
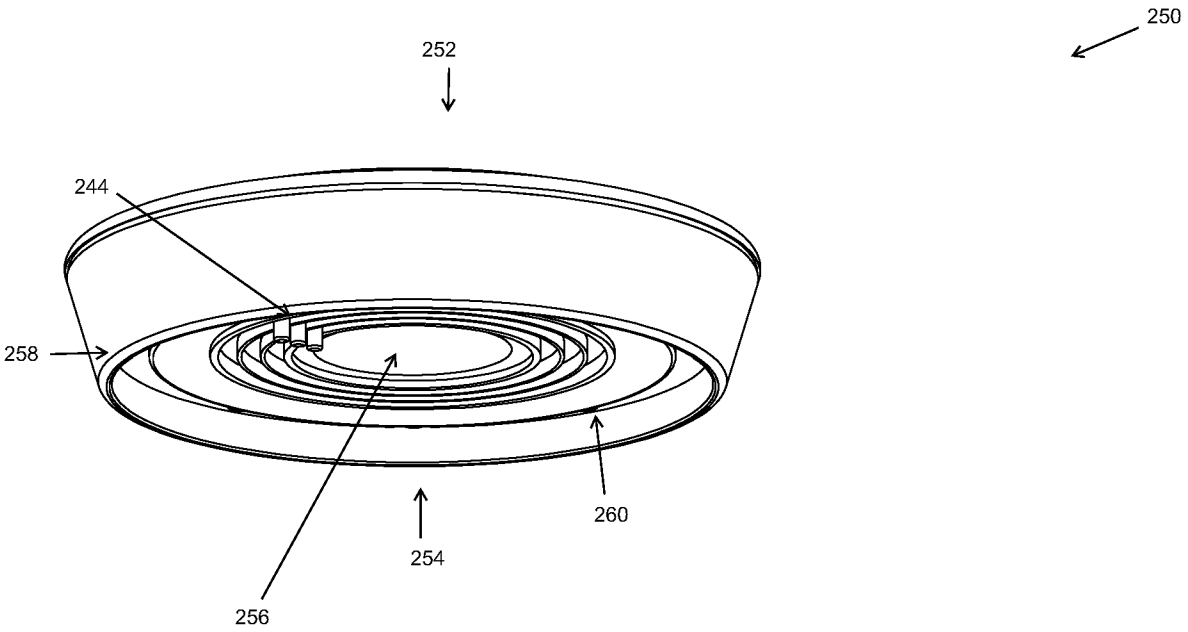
FIG. 110 shows a lower perspective view of a lower lighting assembly of the umbrella system shown in FIG. 83, in accordance with one or more arrangements.
Figure 111:
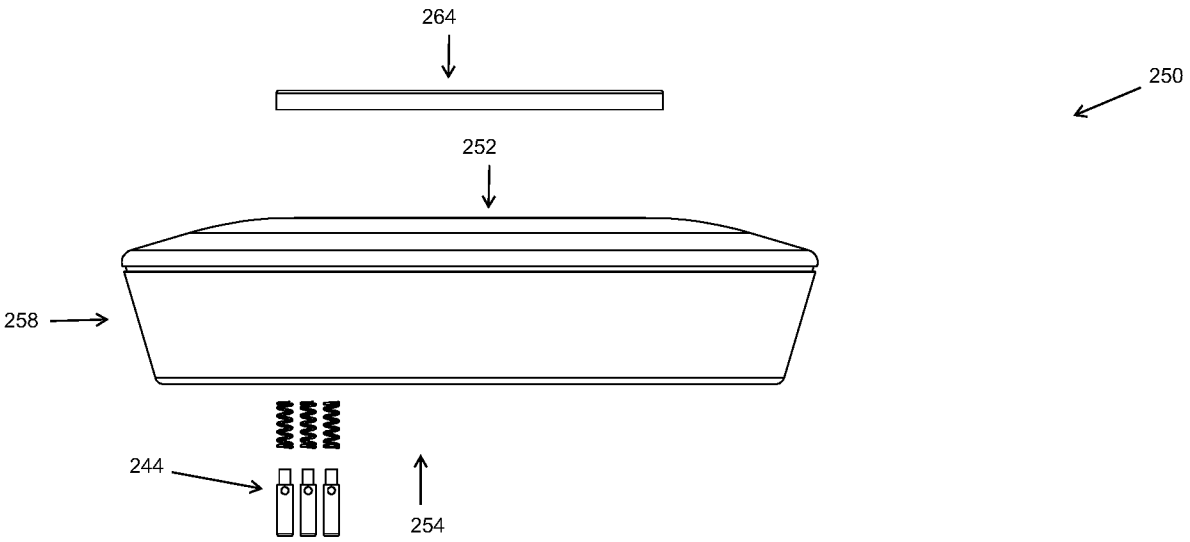
FIG. 111 shows a side exploded view of a lower lighting assembly of the umbrella system shown in FIG. 83, in accordance with one or more arrangements.
Figure 112:
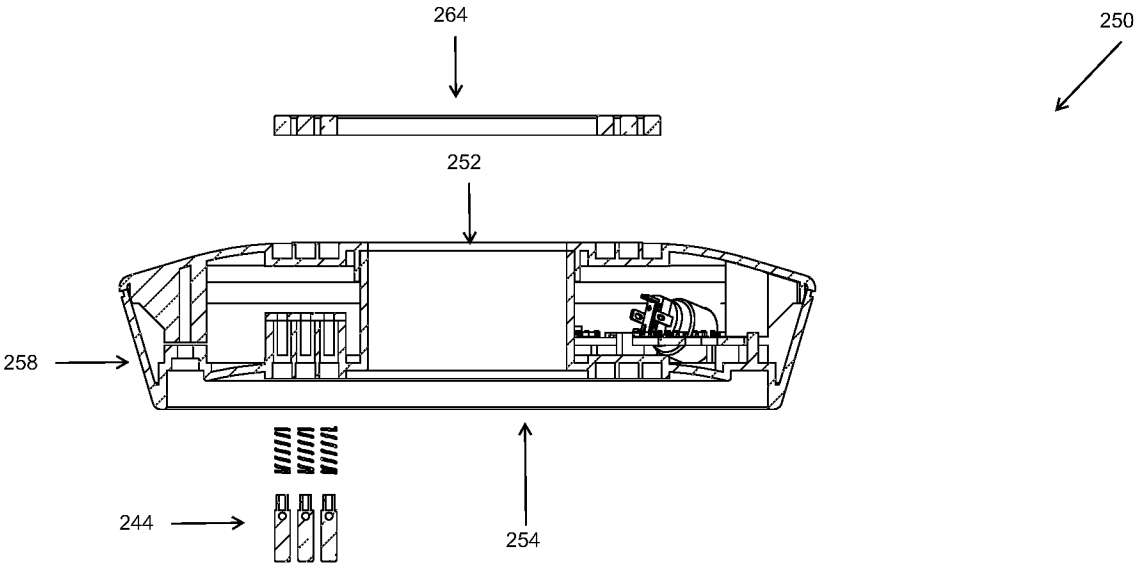
FIG. 112 shows a cross sectional side view of a lower lighting assembly of the umbrella system shown in FIG. 83, in accordance with one or more arrangements.
Figure 113:
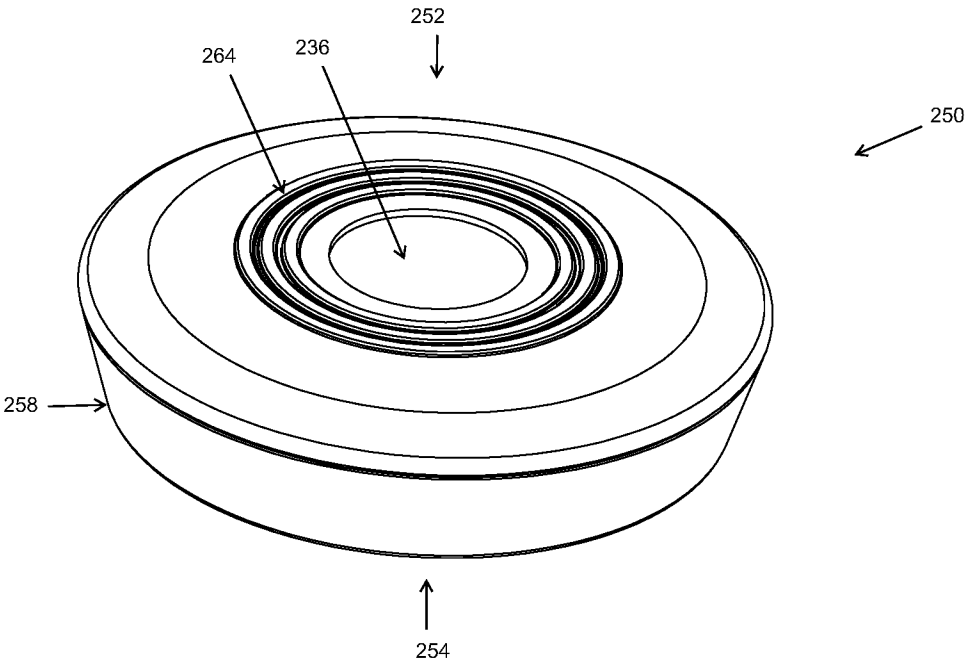
FIG. 113 shows an upper perspective view of a lower lighting assembly of the umbrella system shown in FIG. 83, in accordance with one or more arrangements.
Figure 114:
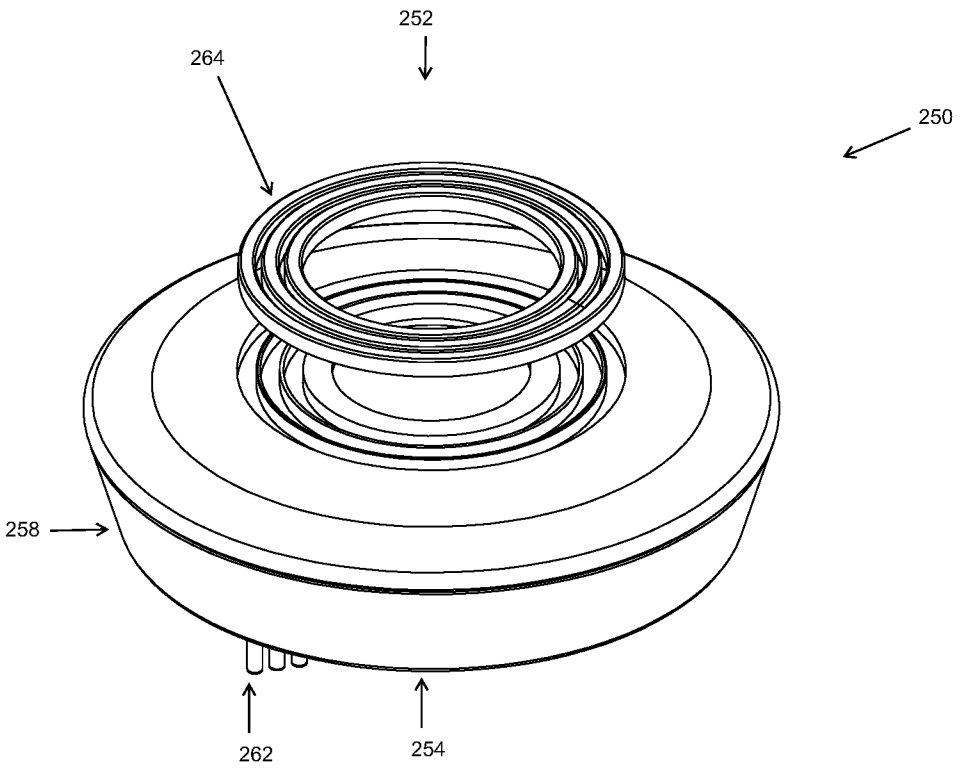
FIG. 114 shows an exploded upper perspective view of a lower lighting assembly of the umbrella system shown in FIG. 83, in accordance with one or more arrangements.
Figure 115:
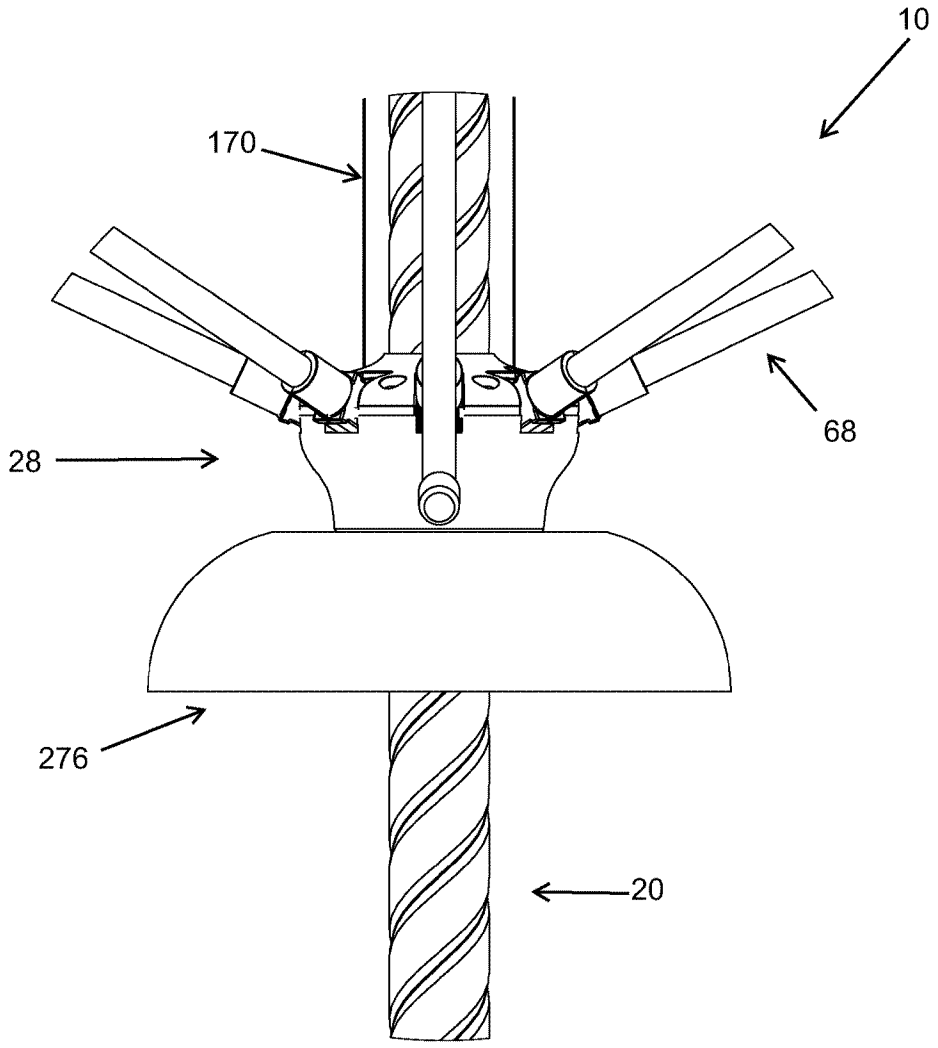
FIG. 115 is a front view of the lower hub and reflector of the umbrella system shown in FIG. 83, in accordance with one or more embodiments.
Figure 116:
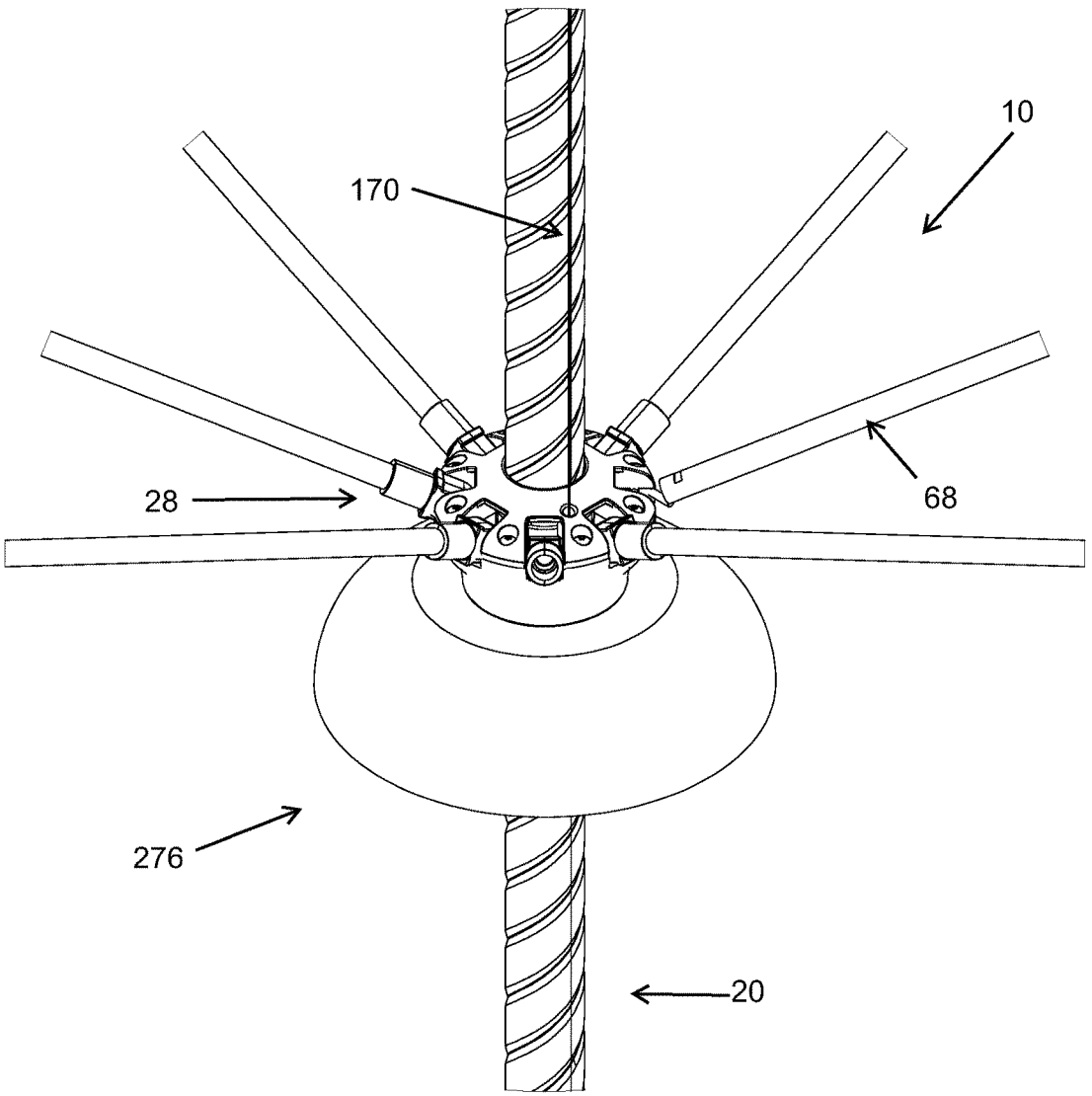
FIG. 116 is an upper perspective view of the lower hub and reflector of the umbrella system shown in FIG. 83, in accordance with one or more embodiments.
Figure 117:
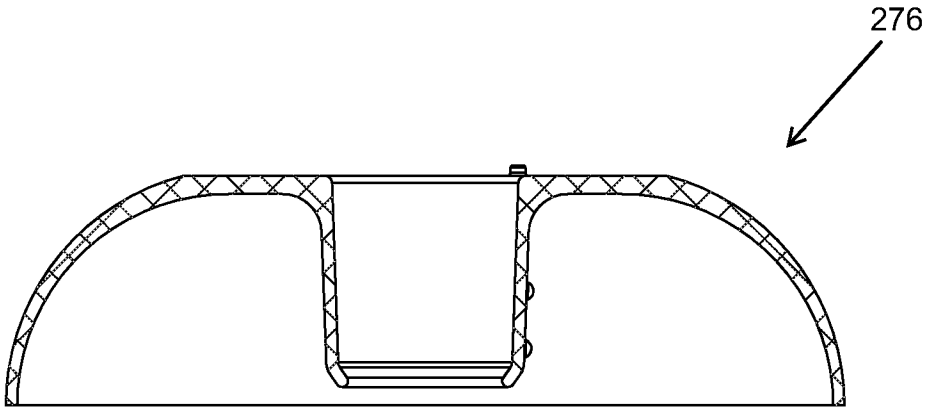
FIG. 117 is a cross sectional side view of the reflector of the umbrella system shown in FIG. 83, in accordance with one or more embodiments.

Alternative Arrangement:

In the arrangement shown, as one example, with reference to FIGS. 83-117 an alternative arrangement of motorized umbrella system 10 is presented. The arrangement shown in FIGS. 83-117 is similar to the motorized umbrella systems 10 shown in FIGS. 1-82 and as such the disclosure related to the arrangements shown in FIGS. 1-82 applies to the embodiment shown in FIGS. 83-117 unless stated specifically herein.

In this example arrangement, support pole 12, base 14, upper hub 34, counterbalance assembly 62/162, table 46, rotating tube 20, center tube 32, umbrella frame 24 and material 26, and lower hub 28 are similar if not identical to those features previously described herein unless specifically stated otherwise, with the primary differences relating to the motor housing assembly 16 and lighting assemblies 230/250.

Motor Housing Assembly 16:

In the arrangement shown, motor housing assembly 16 has a lower housing 282 and ring gear housing 136 rotationally connected to an upper end of lower housing 282.

Lower Housing 282:

Lower housing 282 is formed of any suitable size, shape, and design and is configured to holds and shelters motor 40 as well as power source 42, which in the arrangement shown is a plurality of batteries 44, and rotationally connect with ring gear housing 136 so that operation of motor 40 rotates ring gear housing 136 and rotating tube 20 relative to lower housing 282 when operated.

In the arrangement shown, as one example, lower housing 282 includes a lower connection assembly 288, gear assembly 290, and a main body 292 configured to encase the lower connection assembly 288 and gear assembly 290.

Lower Connection Assembly 288:

Lower connection assembly 288 is formed of any suitable size, shape, and design and is configured to connect with upper end of support pole 12. In the arrangement shown, as one example, lower connection assembly 288 has a generally cylindrical shaped tube 294 extending between a lower end 296 and an upper end 298. In this example arrangement, holes 286 extend through tube 294 to facilitate connection of lower connection assembly 288 to support pole 12, for example, using fasteners (e.g., screws and/or bolts). However, the embodiments are not so limited. Rather, it is contemplated that in one or more arrangements, lower connection assembly 288 may connect to and lock onto support pole 12 by any manner, method or means including but not limited to, for example, screwing, bolting, snap-fitting, friction fitting, pinning, pinching, welding, adhering, affixing, interlocking, magnetic connection, and/or any other way of connecting two components together.

In the example arrangement shown, lower connection assembly 288 has flanges 300 and 302 that extend outward from an exterior surface of tube 294 to facilitate connection with main body 292, motor 40, control circuit 106, gear assembly 290 and/or other components of motor housing assembly 16. In this example arrangement, lower connection assembly 288 has two flanges 300 extending vertically along tube 294 from upper end 298 to lower end 296. In this example arrangement, lower connection assembly 288 also has a flange 302 extending horizontally outward from tube 294 and between flanges 300 to facilitate connection with motor support 306.

Motor support 306 is formed of any suitable size, shape, and design and is configured to connect motor 40 with flange 302 of lower connection assembly 288. In the arrangement shown, as one example, motor support 306 is a curved planar-shaped member having a first set of holes 308 to facilitate connection with motor 40 and a second set of holes 310 to facilitate connection with flange 302, for example, using fasteners. In this example arrangement, drive shaft 40A of motor 40 extends through a center opening 312 motor support 306 and into gear assembly 290. In this example arrangement, lower connection assembly 288 has holes 314 extending downward from upper end 298 of tube 294 to facilitate connection with gear assembly 290, for example, using fasteners.

While some various components of lower connection assembly 288, gear assembly 290, main body 292 and/or other components of motor housing assembly 16 may be shown and/or described as being connected by holes and fasteners, the embodiments are not so limited. Rather, it is contemplated that such components may be connected by any manner, method or means including but not limited to, for example, screwing, bolting, snap-fitting, friction fitting, pinning, pinching, welding, adhering, affixing, interlocking, magnetic connection, and/or any other way of connecting two components together.

Main Body 292

Main body 292 is formed of any suitable size, shape, and design and is configured to connect with lower connection assembly 288 and/or gear assembly 290 to form an enclosure that encases lower connection assembly 288, gear assembly 290, motor 40, power source 42, control circuit 106, and/or any other components of motor housing assembly 16.

In the arrangement shown, as one example, main body 292 includes a front member 318 and a rear member 320, which form a generally cylindrical shape when motor housing assembly 16 is assembled. In this example arrangement, front member 318 includes a semi-cylindrical outer wall 324, a semi-cylindrical inner wall 326, back walls 328 extending between outer wall 324 and inner wall 326, a top 330, and a bottom 332 forming a hollow interior 334. In this example arrangement, batteries 44 of power source 42 are positioned within hollow interior 334 of front member 318. In this example arrangement, rear member 320 includes a semi-cylindrical outer wall 344, a bottom 346, and flanges 348. In this example agreement, flanges 348 facilitate connection with lower connection assembly 288.

In one or more arrangements, front member 318 is removeable from lower connection assembly 288, for example, to facilitate charging of batteries 44 or power source 42 away from umbrella system 10. For example, it may be more convenient for a user to charge batteries 44 inside of a user's residence (e.g., by connecting a power adapter to one of USB port 336 and/or to a power connector of front member). Moreover, it may be desirable for a user to be able to remove and replace a front member 318 when power of batteries 44 has been depleted with a spare front member 318 having charged batteries 44. This may be useful, for example, when users are using USB ports 336 to power and/or charge a large number of devices (e.g. smart phones, blue tooth speakers, tablets, laptops, etc). In this example arrangement, front member 318 is connected to lower connection assembly 288 by one or more magnets (not shown). This permits front member 318 to be easily be removed from and reattached to lower connection assembly 288 by a user. However, it is contemplated that additionally or alternatively front member 318 may be connect with lower connection assembly 288 by any method or means for connecting two components together.

In the example arrangement shown, user interface 131 is positioned on main body 292 to facilitate user control of system 10 (e.g., opening/closing of umbrella, turning on/off lighting assemblies 230/250, programing and/or configuring control circuit 106, and/or monitoring system 10 status, to name a few). In this example arrangement, the controls 116 of user interface 131 include a button 340 and a button 338 positioned on a bottom side of rear member 320 of main body 292. In this example arrangement, the user interface 131 includes and three display LEDs 342 positioned on a front of outer wall 324 of front member 318 as a display. However, the embodiments are not so limited. Rather, it is contemplated that user interface 131 may include any number of controls and/or display indicators, which may be located at various positions of system 10 and/or on devices communicatively connected to system.

As an illustrative example, in one or more embodiments control circuit 106 is configured to open/close umbrella frame 24 in response to user pressing button 338. In one or more arrangements, control circuit 106 is configured to light LEDs 342 to indicate a level of battery power remaining in response to a user pressing the button 340.

In the arrangement shown, USB ports 336 are also positioned on front of outer wall 324 of front member 318 of main body 292. In one or more arrangements, for example, USB ports 336 may be used by a user to charge personal devices (e.g., smartphones, laptops, mp3 players, communication circuits, speakers, or any other device). Conversely, in one or more arrangements, system 10 may be configured to charge batteries 44 by connecting USB ports 336 to a power source via a USB cable.

Gear Assembly 290

Gear assembly 290 is formed of any suitable size, shape, and design and is configured to operably connect drive shaft 40A of motor with a ring gear 138 of ring gear housing 136 to facilitate rotation of ring gear housing 136 and rotating tube 20 when motor is operated. In the arrangement shown, as one example, gear assembly 290 is positioned above lower housing 282 and includes a lower plate 350, a cover plate 352, and a set of stationary gears 36 positioned therebetween.

Lower plate 350 and cover plate 352 are formed of any suitable size, shape, and design and are configured to connect with and hold stationary gears 36 in position around ring gear 138 to facilitate rotation of ring gear 138 when one of the stationary gears 36 is rotated by motor 40. In the arrangement shown, as one example, lower plate 350 has a generally planar circular shape extending outward from a center opening 356 to an outer edge 358. In the arrangement shown, lower plate 350 has an opening 362 positioned above motor support 306. Drive shaft 40A of motor 40 extends through opening 362 into gear assembly 290 and connects with driven gear 38. In this example arrangement, gear collars 364 extend upward from lower plate 350 and hold stationary gears 36 in position within the gear collars 364.

In this example arrangement, lower plate 350 has an outer collar 360 extending upward from outer edge 358. In this example arrangement, lower plate 350 also has an inner collar 366 extending around and upward from center opening 356. In this example arrangement, center tube 32 extends through center opening 356 and connects with support pole 12. In this example arrangement, inner collar 366 is configured to receive lower end of rotating tube 20. In one or more arrangements, a bearing 370 is position within inner collar 366 to facilitate rotation of rotating tube 20. In the example arrangement shown, ring gear 138 extends around a lower end of gear housing 136, around inner collar 366, and engages stationary gears 36 and driven gear 38.

In the arrangement shown, as one example, cover plate 352 has a generally planar circular shape extending outward from a center opening 376 to an outer edge 378. In this example arrangement, cover plate 352 has a collar 380 extending upward from outer edge 378. In this example arrangement, cover plate 352 has a set of holes 382 to facilitate connection of cover plate 352 with lower plate 350, for example, using fasteners that extend through holes 382.

Ring Gear Housing 136:

In the example arrangement shown, a ring gear housing 136 is positioned above lower housing 282. Ring gear housing 136 is formed of any suitable, size, shape, and design and is configured to hold and house ring gear 138 as well as connect to rotating tube 20. In the arrangement shown, as one example, ring gear housing 136 has generally cylindrical shaped side wall 390, a top 392, and an open lower end 394 that includes ring gear 138 that extends around the interior facing surface of the side wall 390 of ring gear housing 136. Ring gear 138 is configured to mesh with stationary gears 36 and driven gear 38. As driven gear 38 rotates, due to the meshing engagement between driven gear 38 and ring gear 138 and engagement between connection assembly and rotating tube 20, ring gear 138, ring gear housing 136, and rotating tube 20 are rotated relative to lower housing 282. Due to the engagement between lower connection assembly 288 of lower housing 282 and support pole 12, lower housing 282 remains stationary while the ring gear 138, ring gear housing 136 and rotating tube 20 are rotated by motor 40.

In the arrangement shown, as one example, ring gear housing 136 engages and locks onto rotating tube 20 such that when ring gear 138 and ring gear housing 136 rotates so rotates rotating tube 20. In one or more arrangements, ring gear housing 136 may connect to and lock onto rotating tube 20 by any manner, method or means including but not limited to, for example, screwing, bolting, snap-fitting, friction fitting, pinning, pinching, welding, adhering, affixing, interlocking, magnetic connection, and/or any other way of connecting two components together. In the arrangement shown, as one example, to facilitate the locking engagement between ring gear housing 136 and rotating tube 20, ring gear housing 136 includes a connection assembly 140. In the arrangement shown, as one example, connection assembly 140 is connected to the upper interior edge of ring gear housing 136 and is configured to engage and lock onto rotating tube 20. In the arrangement shown, as one example, connection assembly 140 is formed of a plurality of fingers that extend upward from the upper center edge of ring gear housing 136 and are configured to pinch onto the exterior surface of rotating tube 20. However, any other configuration is hereby contemplated for use.

In the example arrangement shown, a set of contacts 400 are positioned on top 392 of ring gear housing 136. Contacts 400 are formed of any suitable size, shape, and design and are configured to facilitate electrical connection with lighting assemblies 230/250 and/or other device(s) positioned on top of ring gear housing 136. In the arrangement shown, as one example, contacts 400 include three contacts shaped as concentric rings. In this example arrangement, the concentric ring contacts 400 allow spring loaded pin type contacts 262 (e.g. pogo pins) on lower lighting assembly 250 and/or other device to connect with contacts 400 regardless of how lower lighting assembly 250 and/or other device is oriented/rotated. However, the embodiments are not so limited. Rather, it is envisioned that in some various arrangements, ring gear housing 136, lighting assembly 250, lighting assembly 230, and/or other device or components of system 10 may be connected using any type of contacts and/or connectors. In the arrangement shown, contacts 400 include three contacts to provide a connection for a positive lead, a negative/neutral lead, and a lead for communication of data. However, the embodiments are not so limited. Rather, it is envisioned that in some various arrangements, system 10 may include more or fewer contacts to facilitate connection between various components.

Contacts 400 are electrically connected to power source 42, control circuit 106 and/or other components of system 10 to facilitate connection of such components to lighting assemblies 230/250 and/or other device(s) positioned connection with lighting assemblies 230/250 and/or other device positioned on top of ring gear housing 136. In this example arrangement, a coiled wire 384 (e.g., a ribbon wire, flat flex cable, and/or any other type of wire or cable) is positioned within a collar 380. Coiled wire 384 electrically connects contacts of ring gear housing to power source 42, control circuit 106 and/or other components of system 10, while permitting rotating tube 20 to be rotated. By using coiled wire 384 conventional brush type contacts, which can corrode and wear quickly in outdoor environments, can be omitted. In contrast, ribbon wire 384 is covered by an insulated coating which prevents corrosion. The coiled arrangement permits the ribbon wire 384 to coil up when rotating tube 20 is rotated in a first direction and uncoiled when rotating tube 20 is rotated in the opposite direction. However, the embodiments are not so limited. Rather, it is envisioned that in some various arrangements, contacts 400 may be electrically connected with power source 42, control circuit 106 and/or other components of system 10 using any known method or means for providing an electrical connection.

Lighting Assemblies 230/250:

In one or more arrangements, system 10 includes one or more lighting elements 240 and 260 configured to facilitate illumination of an area in which system 10 is located. Such lighting elements 240 and 260 are useful to continued use of system 10 for entertainment and enjoyment after dusk. Lighting elements 240 and 260 are formed of any suitable size, shape, and design and configured to generate light. Lighting elements 240 and 260 may include but are not limited to, light bulbs, LEDs, chemical lights, lamps, and/or any other light generating device.

In the arrangement shown, as one example, system 10 includes one or more lighting assemblies 230 and/or 250. In this example arrangement, system 10 includes an upper lighting assembly 230 and lower lighting assembly 250. Upper lighting assembly 230 has a general ring shape with a top side 232 and a bottom side 234 extending outward from a center opening 236 to a cylindrical shaped sidewall 238. An inner surface of center opening 236 upper lighting assembly 230 is configured to fit around rotating tube 20 and facilitate vertical movement along rotating tube 20 so as to allow the positioning of upper lighting assembly 230 at a desired position. Similarly, lower lighting assembly 250 has a general ring shape with a top side 252 and a bottom side 254 extending outward from a center opening 256 to a cylindrical shaped sidewall 258. An inner surface of center opening 256 of lower lighting assembly 250 is configured to fit around rotating tube 20 and facilitate vertical movement along rotating tube 20 so as to allow the positioning of lower lighting assembly 250 at a desired position.

In this example arrangement, upper lighting assembly 230 includes a number of lighting elements 240 positioned on top side 232 and lower lighting assembly 250 includes a number of lighting elements 260 on bottom side 254. In this example arrangement, upper lighting assembly 230 includes a button 246 to facilitate user control of lighting elements 240. Similarly, in this example arrangement, lower lighting assembly 250 includes a button 266 to facilitate user control of lighting elements 260. While upper lighting assembly 230 and lower lighting assembly 250 are each include one button 246/266 in the arrangement shown, the embodiments are not so limited. Rather, it is contemplated that in one or more arrangements, upper lighting assembly 230 and lower lighting assembly 250 may have more or fewer buttons for control of lighting elements 240. In some different various arrangements, buttons 246/266 and/or other controls may permit a user to perform various actions including but not limited to, for example, turning on lighting elements 240/260, turning off lighting elements 240/260, adjusting brightness of lighting elements 240/260, adjusting hue/color of lighting elements 240/260, setting a timer for lighting elements 240/260, and/or any other action. For example, in one example implementation, buttons 246/266 may be used to step lighting elements 240/260 through a plurality of brightness level setting such as, high, medium, low, and off for each presses the buttons 246/266. However, the embodiments are not so limited. Rather, it is contemplated that lighting elements 240/260 may include any number of light settings and may me adjusted in any manner. Moreover, the embodiments are not limited to use of buttons for user control of lighting elements 240/260. Rather, it is contemplated that in one or more arrangements, lighting elements 240/260 may be controlled by control circuit 106 and/or by any other device communicatively connected to upper lighting assembly 230 and/or lower lighting assembly 250.

In this example arrangement, upper and lower lighting assemblies 230 and 250 may be positioned together or separately along rotating tube 20 to facilitate comfortable and aesthetically pleasing lighting. For example, lower lighting assembly 250 may be positioned at a height to provide lighting for a table without shining in the eyes of persons seated around the table. Similarly, upper lighting assembly 230 may be positioned to shine upward into umbrella to provide a diffuse ambient lighting without shining in the eyes of persons seated around the table. This configuration provides both useful light on the tabletop as well as an elegant ambiance.

In one or more arrangements, as is shown, system 10 may include a reflector 276 positioned on rotating tube 20 above upper lighting assembly 230. Reflector 276 is formed of any suitable size, shape, and design and is configured to reflect light emitted by upper lighting assembly 230 back downward. In the arrangement shown, as one example, reflector 276 has a concave circular shaped lower surface. However, the embodiments are not so limited. Rather, it is contemplated that reflector may be convex shaped, concave shaped, or any other shape. In some arrangements, reflector 276 may be configured to diffuse reflected light and/or focus light toward the table. In some arrangements, reflector 276 may be adjusted in position along rotating tube 20 to adjust focus of the light. In some arrangements, reflector 276 may optionally be configured to be removable from umbrella system 10. For example, in one or more arrangements, reflector 276 may be formed out of a flexible material having a slit formed along one side so as to permit to be attached to and/or removed from rotating tube 20.

Lighting assemblies 230 and/or 250 may be powered by various power sources in various embodiments. In one or more arrangements, lighting assemblies 230 and/or 250 are powered by power source 42 of system 10. In one or more arrangements, as one example, system 10 includes an electrical connection configured to provide power to lighting assemblies 230 and/or 250 in any position along rotating tube 20. In one example arrangement, system 10 includes a flexible cord (not shown) to connect lighting assemblies 230 and/or 250 to power source 42 while facilitating vertical movement along the length of rotating tube 20. In another example arrangement, lighting assemblies 230 and/or 250 are electrically connected to power source 42 via rotating tube 20. For instance, in one or more arrangements, a pair of electrical conductors (not shown) are positioned within a pair of helical grooves of rotating tube 20. In such arrangement, lighting assemblies 230 and/or 250 include contacts configured to connect with pair of electrical conductors to form an electrical connection with power source 42.

In the arrangement shown, as another example, lighting assemblies 230 and/or 250 each include a set of batteries (not shown) to power lighting elements 240/260. In one or more arrangements, the batteries of lighting assemblies 230 and/or 250 are configured to be recharged by power source 42. In this example arrangement, bottom side 254 of lower lighting assembly 250 includes a first set of lower contacts 262. Lower contacts 262 may be any suitable size, shape, and design, and are configured to form an electric connection between lower lighting assembly 250 and ring gear housing 136, for example, when lower lighting assembly 250 is moved to a lowered position.

In this example arrangement, lower contacts 262 of lower lighting assembly include three spring loaded contacts configured to contact the concentric ring type electric contacts 400. In this arrangement, the spring loaded pin type lower contacts 262 are capable of providing connection with the electric contacts 400 of ring gear housing 136 regardless of how lighting assemblies 230 and/or 250 are rotated relative to rotatable locking assembly 178 and/or motor housing assembly. In this example arrangement, when lower lighting assembly 250 is moved to the lower position, the lower lighting assembly 250 is connected to power source 42 and batteries of lower lighting assembly 250 are charged.

In the arrangement shown, as one example, lower lighting assembly 250 includes a set of upper contacts 264 positioned on top side 252 of lower lighting assembly 250 to facilitate electric connection with a set of lower contacts 244 positioned on bottom side 234 of upper lighting assembly 230. In the arrangement shown, as one example, upper contacts 264 on top side 252 of lower lighting assembly 250 are similar to electric contacts 400 of ring gear housing 136. In the arrangement shown, as one example, lower contacts 244 on bottom side 2354 of upper lighting assembly 230 are similar to the spring loaded pin type lower contacts 262 positioned on bottom side 254 of lower lighting assembly 250. When both lighting assemblies 230 and 250 are moved to the lower position, lower lighting assembly 250 is connected to power source 42 in motor housing assembly 16 via electrical contacts 400, and lower contacts 262 and batteries of upper lighting assembly 230 are charged. At the same time, upper lighting assembly 230 is connected to power source 42 via lower lighting assembly 250, upper contacts 264 and lower contacts 244 and batteries of upper lighting assembly 230 are charged. However, the embodiments are not so limited, rather it is contemplated that in one or more arrangements, upper lighting assembly 230 and/or lower lighting assembly 250 may be powered and/or charged by various power sources and/or methods including but not limited to, for example, batteries, dc power sources, AC power sources, solar panels, wireless power sources and/or any other known power sources and power delivery means. In one or more arrangements, lower hub 28 and/or reflector 276 may be configured to move upper lighting assembly 230 and lower lighting assembly 250 downward when umbrella frame 24 is closed so that upper lighting assembly 230 and lower lighting assembly 250 are electrically connected to power source 42 to facilitate charging of upper lighting assembly 230 and lower lighting assembly 250 when system 10 is not in use.

Power Management:

In one or more arrangements, charging of upper light right 230, lower lighting assembly 250, and/or devices connected to USB ports 336 may be selectively enabled and/or disabled by system 10. For example, in one or more arrangements, control circuit 106 may be configured to enable/disable power provided to upper lighting assembly 230, lower lighting assembly 250, and/or USB ports 336 based on sensors 118, control(s) 116, wired control 132, wireless control 120, and/or other data source. As an illustrative example, in one or more arrangements, control circuit 106 may disable power provided to upper lighting assembly 230, lower lighting assembly 250, and/or USB ports 336 based on power levels of batteries 44 of power source 42, to conserve power once battery power has reduced to a threshold level. For example, in one or more arrangements, control circuit 106 may conserve power to ensure that sufficient battery power is reserved for motor 40 to close umbrella frame 24. In this manner, system 10 is prevented from having umbrella frame 24 stuck open and susceptible to damage by draining of batteries 44 by upper lighting assembly 230, lower lighting assembly 250, and/or USB ports 336.

Additionally or alternatively, in one or more arrangements, control circuit 106 may be configured to prevent opening of umbrella frame 24 unless there is sufficient power available in batteries 44 to close the umbrella frame 24 after opening. For instance, in one or more arrangements, control circuit 106 may be configured to monitor the power levels of batteries 44 and inhibit opening of umbrella frame 24 in response to the power levels of batteries 44 being below a second threshold value (e.g., stored in memory 114) corresponding to predetermined amount of power required to open and then close umbrella frame 24. In this manner, system 10 is prevented from having umbrella frame 24 stuck open when there is insufficient power to close umbrella frame 24 after opening.

It is recognized that the power required to open/close umbrella frame 24 may vary between different umbrella models and/or even between umbrellas of the same model. Moreover, it is recognized that power required to open/close umbrella frame 24 may change over time as components wear and/or collect dust and/or debris between maintenance periods. In one or more arrangements, control circuit 106 may be configured to monitor power use during operation to determine and/or update threshold power levels use to disable powering of upper lighting assembly 230, lower lighting assembly 250, and/or USB ports 336, disable opening/closing of umbrella frame 24, and/or disable any other feature or function that uses power. For example, in one or more arrangements, control circuit 106 may monitor voltage, current, and/or other indicators of power levels, to determine the amount of power available in of batteries 44. In one or more arrangements, control circuit 106 may disable power to upper lighting assembly 230, lower lighting assembly 250, and/or USB ports 336 in response to the determined power available in batteries 44 dropping below a first threshold level (e.g., stored in memory 114). In some implementations, the first threshold level may be a predetermined conservative threshold value set during manufacture of system 10. Similarly, in some implementations, control circuit 106 may monitor voltage and/or current of motor 40 to determine the actual amount of power used when closing and/or opening umbrella frame 24 to determine the second threshold power level required to both open and close umbrella. In this manner, system 10 may compensate for changes in power requirements over time and thereby prevent system from having umbrella frame 24 stuck open due to insufficient power.

User Configurability:

In one or more arrangements, control circuit 106 is configurable by a user to customize the automated operation of system 10 by control circuit 106. For example, in one or more arrangements, operation of control circuit 106 may customized using user interface 131 (e.g., buttons 340 and/or 338 on motor housing assembly 16 and/or a user interface provided by a smartphone or other computing device that is communicatively connected to the control circuit 106 (e.g., via Bluetooth, WIFI, and/or the internet)) to define or customize the trigger conditions in memory 114. As one illustrative example, in one or more arrangements, a user may adjust a trigger condition to enable or disable automated closing of umbrella, for example, by pressing and holding button 338 for a specific duration (e.g., three seconds). However, the arrangements are not so limited. Rather, it is envisioned that a user may define and/or customize trigger conditions to perform any automated task. As some additional illustrative examples, a user may define and/or adjust trigger conditions to perform various automated operations including but not limited to, for example:

- Automated opening and/or closing of umbrella frame 24 in response to a set of trigger conditions being satisfied;
- Automated turning on and/or off lighting assembly 230 and/or lighting assembly 250 in response to a set of trigger conditions being satisfied;
- Automated adjusting color and/or brightness of lighting assembly 230 and/or lighting assembly 250 in response to a set of trigger conditions being satisfied (e.g., to automatically adjust lighting of a reception in accordance with a scheduled itinerary);
- Sending an alert message to one or more users (e.g., via email, SMS, automated phone call, push notification, messengers, social networking, and/or any other type of communication) in response to a set of trigger conditions being satisfied;
- Automatically disabling various components of system 10 to manage power usage when battery power is low according to priorities defined by a set of trigger conditions (e.g., to disable components to reserve power to close umbrella frame 24 and/or to prioritize operation of USB ports 336 over charging of lighting assemblies 230/250; and/or Disabling one or more automated features (e.g., automated closing) in response to a set of user conditions being satisfied.

As an illustrative example, in one or more arrangements, in creating a customized trigger condition a user may specify 1) one or more data sources for the trigger (e.g., selected control inputs 116, sensors 118, time, day of week, calendar, remote device or system communicatively connected to system 10); 2) values of the one or more data sources that are to trigger control circuit to perform an action when satisfied; and 3) one or more actions to be performed in response to the trigger condition being satisfied. Trigger conditions may include, for example, Boolean sensor states, various Boolean function based on of sensor values (e.g., threshold value triggers), and/or Boolean logic functions function of a combination of Boolean sensor states and/or Boolean functions. However, embodiments are not so limited. Rather, it is contemplated that in some various embodiments, trigger conditions may be specified in any configuration, arrangement, format, or structure.

In Operation:

As an illustrative example of some features, umbrella system 10 may be initially stored in a closed position. In the closed position, umbrella frame 24 is prevented from popping-up or slightly opening, thereby providing an aesthetically pleasing appearance. The umbrella frame 24 is prevented from popping-up or slightly opening due to the torque profile of counterbalance assembly 160 and/or 62 and/or due to being locked in place by rotational locking assembly 178.

A family wishing to enjoy a day outdoors may quickly, easily, and intuitively deploy umbrella system 10 for use. Rotational locking assembly 178 may easily be unlocked with one hand by rotating outer collar 184. As outer collar 184 is rotated, catch features 224 of outer collar 184 engages and causes catch feature 212 of locking member 192 to disengage arm 210 of locking member 192 from teeth 188 of gear member 180, thereby permitting gear member 180 and rotating tube 20 to rotate.

A family member may easily open the umbrella system 10 by rotating the rotating tube 20, either manually or using user interface 131 for motorized operation powered by batteries 44, as previously discussed. When rotated, helical grooves 22 rotating tube 20 engage teeth 70 of lower hub 28. At the same time lower hub 28 is prevented from rotating due to operable connection of lower hub 28 to stationary center tube 32 via upper hub 34 of umbrella frame 24. Rotation of rotating tube 20 relative to lower hub 28 causes engagement between teeth 70 and helical grooves 22 to move lower hub 28 upward along rotating tube 20. Upward movement of lower hub 28 causes lower support 68 of umbrella frame 24 to push upper supports 66 of umbrella frame 24 outward to open umbrella system 10.

In opening umbrella system 10, rotating tube 20 is rotated easily with little force due in large part to the counterbalance assembly 160 and/or counterbalance assembly 62, which counteracts the forces such as gravity that oppose opening of umbrella frame 24. As lower hub 28 approaches a fully raised position, the smaller diameter of the spools 162 encountered by cords 170 provides better leverage for spring assemblies 168 to pull cord 170 tight, thereby helping to prevent sagging of umbrella frame 24.

In some arrangements, a solar panel 274 positioned on a top surface of upper hub 34 recharges the batteries 44 of power source 42 when exposed to sunlight. At this time, lighting assemblies 230 and 250 may be moved to the lower position to also charge batteries of lighting assemblies 230 and 250 from batteries 44 of power source 42 and/or a solar panel 274.

At dusk, a family may activate lighting assemblies 230 and 250 to continue to enjoy outside activities around system 10. Additionally or alternatively, control circuit 106 may automatically activate lighting assemblies 230 and 250 or initiate other action in response to a trigger condition configured by a user in memory 114 being satisfied, as described herein. As previously mentioned, lower lighting assembly 250 may be positioned at a height to provide lighting for a table without shining in eyes of persons seated around the table. Similarly, upper lighting assembly 230 may be positioned at a height to shine upward into umbrella to provide a diffuse ambient lighting without shining in eyes of persons seated around the table. This configuration provides both useful light on the tabletop as well as an elegant ambiance. When activities have ended, lighting assemblies 230 and 250 may be turned off and moved to the lowered position to recharge batteries of lighting assemblies 230 and 250 while not in use.

A person may easily close the umbrella system 10 by rotating the rotating tube 20 in the other direction, either manually or using controls for motorized operation powered by batteries 44, as previously discussed. When rotating tube 20 is rotated in the other direction relative to lower hub 28, engagement between teeth 70 and helical grooves 22 causes lower hub 28 to move downward along rotating tube 20. Downward movement of lower hub 28, causes lower support 68 of umbrella frame 24 to pull upper supports 66 of umbrella frame 24 inward to open umbrella system 10.

In closing umbrella system 10, rotating tube 20 is rotated easily with little force due in large part to the counterbalance assembly 160 and/or counterbalance assembly 62, which counteracts the forces such as gravity that oppose opening of umbrella frame 24. As lower hub 28 approaches a fully lowered position, a larger diameter of the spools 162 encountered by cords 170 provides less leverage for spring assemblies 168 to pull cord 170 tight, thereby helping to prevent umbrella frame 24 from popping-up or slightly opening at the fully closed position.

The person may easily lock rotational locking assembly 178 to prevent rotating tube 20 from rotating and ensure that umbrella frame 24 does not pop-up or slightly opening at the fully closed position. Rotational locking assembly 178 may be locked with one hand by rotating outer collar 184. As previously discussed, due to lock feature 226, a larger amount of force is initially required to begin rotation of outer collar 184 away from the unlocked position. As outer collar 184 is rotated, catch features 224 of outer collar 184 engages and causes catch feature 212 of locking member 192 to extend arm 210 through opening 202 to engage and interlock with teeth 188 of gear member 180, thereby preventing gear member 180 and rotating tube 20 from rotating.

From the above discussion and the accompanying drawings and claims it will be appreciated that in one or more arrangements an umbrella system is presented that: improves upon the state of the art; is easier to deploy; is easier to retract; automatically opens; automatically closes; is powered by batteries; does not need to be plugged into a conventional power source to be operable; is aesthetically pleasing; improves safety; can be remotely opened; can be remotely closed; can be manually opened or closed; can be opened or closed by motorization; improves the ergonomics of opening or closing an umbrella; can be used with large umbrellas; is relatively inexpensive to manufacture; has a minimum number of parts; counterbalances the weight of the umbrella; has an intuitive design; has a long useful life; is rugged; is durable; and/or utilizes standard batteries.

It will be appreciated by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in light thereof will be suggested to persons skilled in the art and are to be included within the spirit and purview of this application.

The invention claimed is:

1. An umbrella system, comprising:

a first tube;

the first tube extending a length from a top end to a bottom end;

an umbrella frame;

the umbrella frame positioned adjacent a top end of the first tube;

wherein the umbrella frame is configured to move between an open position and a closed position;

a motor;

the motor operably connected to the umbrella system and configured to move the umbrella frame between the open position and the closed position;

a power source;

wherein the power source is configured to power the motor;

a first lighting assembly;

wherein the first lighting assembly is positioned on the first tube and is movable along the first tube between an upper position and a lower position;

wherein the first lighting assembly includes a first battery and one or more lighting elements powered by the first battery;

wherein the first lighting assembly is configured to electrically connect the first battery to the power source and thereby facilitate charging of the first battery when the first lighting assembly is moved to the lower position.

2. The system of claim 1, wherein when the first lighting assembly is moved to the lower position, the first lighting assembly is configured to form an electrical connection between the first battery and the power source at various rotational positions relative to the first tube.

3. The system of claim 1, wherein when the first lighting assembly is moved to the lower position, the first lighting assembly is configured to form an electrical connection between the first battery and the power source at any orientation around the first tube.

4. The system of claim 1, wherein when the first lighting assembly is configured to be rotated around the first tube.

5. The system of claim 1, further comprising:

a first set of electrical contacts positioned on the first lighting assembly and electrically connected to the first battery;

a second set of electrical contacts connected to the power source;

wherein the first set of electrical contacts are configured to contact the second set of electrical contacts when the first lighting assembly is moved to the lower position.

6. The system of claim 1, further comprising:

a first set of electrical contacts positioned on the first lighting assembly and electrically connected to the first battery;

a second set of electrical contacts connected to the power source;

wherein the first set of electrical contacts are configured to contact the second set of electrical contacts when the first lighting assembly is moved to the lower position;

wherein one set of the first set of electrical contacts and second set of electrical contacts are spring loaded pin type contacts and the other set of the first set of electrical contacts and second set of electrical contacts are concentric ring type contacts.

7. The system of claim 1, further comprising a second lighting assembly;

wherein the second lighting assembly is positioned on the first tube above the first lighting assembly;

wherein the second lighting assembly is movable along the tube;

wherein the second lighting assembly includes a second battery and one or more lighting elements powered by the second battery;

wherein the first lighting assembly includes a set of electrical contacts configured to electrically connect the second lighting assembly to the first lighting assembly when the second lighting assembly is moved to a position in contact with the first lighting assembly.

8. The system of claim 1, further comprising a second lighting assembly;

wherein the second lighting assembly is positioned on the first tube above the first lighting assembly and is movable along the tube;

wherein the second lighting assembly includes a second battery and one or more lighting elements powered by the second battery;

wherein the one or more lighting elements of the first lighting assembly are configured to shine light downward;

wherein the one or more lighting elements of the second lighting assembly are configured to shine light upward.

9. The system of claim 1, wherein the first lighting assembly is configured to be positioned at an infinite number of positions between the upper position and lower position.

10. The system of claim 1, further comprising a second tube;

the second tube extending a length from a top end to a bottom end;

wherein the motor is configured to move the umbrella frame between the open and closed positions by rotating the first tube relative to the second tube.

11. The system of claim 1, further comprising a second tube;

the second tube extending a length from a top end to a bottom end;

wherein the motor and power source are positioned in a motor housing assembly;

wherein the motor housing assembly includes an upper member and a lower member;

wherein the upper member is connected to the bottom end of the first tube;

wherein the lower member is connected to the top end of the second tube;

wherein the motor is configured to rotate the upper member relative to the lower member when operated.

12. The system of claim 1, further comprising a second tube;

the second tube extending a length from a top end to a bottom end;

wherein the motor and power source are positioned in a motor housing assembly;

wherein the motor housing assembly includes an upper member and a lower member;

wherein the upper member is connected to the bottom end of the first tube;

wherein the lower member is connected to the top end of the second tube;

wherein the motor is configured to rotate the upper member relative to the lower member when operated;

wherein the power source is positioned in the lower member;

wherein the upper member includes a set of electrical contacts positioned on an exterior surface of the upper member;

a brushless electrical contact configured to electrically connect the set of electrical contacts to the power source without inhibiting rotation of the upper member relative to the lower member.

13. The system of claim 1, further comprising a second tube;

the second tube extending a length from a top end to a bottom end;

wherein the motor and power source are positioned in a motor housing assembly;

wherein the motor housing assembly includes an upper member and a lower member;

wherein the upper member is connected to the bottom end of the first tube;

wherein the lower member is connected to the top end of the second tube;

wherein the motor is configured to rotate the upper member relative to the lower member when operated;

wherein the power source is positioned in the lower member;

wherein the upper member includes a set of electrical contacts positioned on an exterior surface of the upper member;

a coiled wire configured to electrically connect the set of electrical contacts to the power source without inhibiting rotation of the upper member relative to the lower member.

14. The system of claim 1, wherein the power source is a battery.

15. The system of claim 1, further comprising a solar panel positioned adjacent a top end of the first tube;

wherein the solar panel is configured to charge a battery of the power source.

16. The system of claim 1, wherein the motor is configured to move the umbrella frame between the open position and closed position by rotating the first tube.

17. An umbrella system, comprising:

a first tube;

the first tube extending a length from a top end to a bottom end;

an umbrella frame;

the umbrella frame positioned adjacent the top end of the first tube;

wherein the umbrella frame is configured to move between an open position and a closed position;

an upper hub;

the upper hub positioned adjacent the top end of the first tube;

the upper hub connected to the umbrella frame;

a lower hub;

the lower hub positioned around the first tube;

the lower hub connected to the umbrella frame;

a motor;

the motor operably connected to the umbrella system and configured to move the umbrella frame between the open and closed positions;

a power source having a first battery;

wherein the power source is configured to power the motor;

a solar panel positioned on the upper hub;

wherein the solar panel is configured to charge the first battery of the power source;

a first lighting assembly;

wherein the first lighting assembly is positioned on and is movable along the first tube;

wherein the first lighting assembly includes a second battery and one or more lighting elements powered by the second battery;

wherein the first lighting assembly is configured to electrically connect the second battery to the power source and thereby facilitate charging of the second battery when the first lighting assembly is moved to a charging position along the first tube.

18. The system of claim 17, wherein the solar panel is electrically connected to the power source by a conductor extending through a hollow interior of the first tube.

19. The system of claim 17, further comprising one or more USB ports powered by the power source.

20. The system of claim 17, further comprising one or more lighting elements powered by the power source.

21. The system of claim 17, further comprising a first lighting assembly;

wherein the first lighting assembly is movable along the length of the first tube between an upper position and a lower position;

wherein the first lighting assembly is configured to electrically connect the second battery to the power source and thereby facilitate charging of the second battery when the first lighting assembly is moved to the lower position.

22. The system of claim 17, wherein the power source includes a removable battery.

23. An umbrella system, comprising:

a first tube;

the first tube extending a length from a top end to a bottom end;

an umbrella frame;

the umbrella frame positioned adjacent a top end of the first tube;

wherein the umbrella frame is configured to move between an open position and a closed position;

a motor;

the motor operably connected to the umbrella system and configured to move the umbrella frame between the open position and the closed position;

a power source;

wherein the power source is configured to power the motor;

a first lighting assembly;

wherein the first lighting assembly is positioned on and is movable along the first tube;

wherein the first lighting assembly includes a battery and one or more lighting elements powered by the battery;

wherein the first lighting assembly is configured to electrically connect the battery to the power source and thereby facilitate charging of the battery when the first lighting assembly is moved to a charging position along the first tube.

* * * * *